US011346164B2

(12) United States Patent
Alvaer et al.

(10) Patent No.: US 11,346,164 B2
(45) **Date of Patent: *May 31, 2022**

(54) SEQUENCING FOR PIPE HANDLING

(71) Applicant: Schlumberger Technology Corporation, Sugar Land, TX (US)

(72) Inventors: Jan Alvaer, Kristiansand (NO); Christian Doennestad Nilssen, Kristiansand (NO); Joe Rodney Berry, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/826,886

(22) Filed: Mar. 23, 2020

(65) Prior Publication Data

US 2020/0284106 A1 Sep. 10, 2020

Related U.S. Application Data

(63) Continuation of application No. 16/016,709, filed on Jun. 25, 2018, now Pat. No. 10,597,954.

(60) Provisional application No. 62/570,519, filed on Oct. 10, 2017.

(51) Int. Cl.

| | |
|---|---|
| ***E21B 19/15*** | (2006.01) |
| ***E21B 19/16*** | (2006.01) |
| ***E21B 3/06*** | (2006.01) |
| ***E21B 19/20*** | (2006.01) |

(Continued)

(52) U.S. Cl.

CPC ..... *E21B 19/155* (2013.01); *E21B 3/02* (2013.01); *E21B 3/06* (2013.01); *E21B 19/16* (2013.01); *E21B 19/20* (2013.01); *E21B 3/025* (2013.01)

(58) Field of Classification Search

CPC ..... E21B 19/20; E21B 3/02; E21B 3/025; E21B 3/06

See application file for complete search history.

(56) References Cited

U.S. PATENT DOCUMENTS

| | | | |
|---|---|---|---|
| 2,412,020 | A | 12/1946 | Walters |
| 3,253,995 | A | 5/1966 | Antonsen |
| 3,874,518 | A | 4/1975 | Swoboda, Jr. et al. |

(Continued)

FOREIGN PATENT DOCUMENTS

| | | | |
|---|---|---|---|
| CN | 101798910 | A | 8/2010 |
| CN | 104563912 | A | 4/2015 |

(Continued)

OTHER PUBLICATIONS

Office Action issued in Chinese Patent Application No. 201880078473X dated Jul. 20, 2021; 13 pages (with English translation).

*Primary Examiner* — James G Sayre

(57) ABSTRACT

A method sequence for handling tubulars into or out of a wellbore, the method comprising: moving a tubular string into or out of a wellbore via a top drive; moving tubular stands to and from a setback position and a stand handoff position via a transfer bridge racker and a setback guide arm; moving tubular stands to and from the stand handoff position and a well center position via a tubular delivery arm and a lower stabilizing arm; building stands and breaking down stands offline via a mousehole and operating a roughneck on joints between the tubular stands and the tubular string.

20 Claims, 105 Drawing Sheets

(51) Int. Cl.
*E21B 3/02* (2006.01)
*E21B 3/025* (2006.01)

(56) References Cited

U.S. PATENT DOCUMENTS

| | | | |
|---|---|---|---|
| 4,042,123 | A | 8/1977 | Sheldon et al. |
| 4,274,778 | A | 6/1981 | Putnam et al. |
| 4,348,920 | A | 9/1982 | Boyadjieff |
| 4,421,179 | A | 12/1983 | Boyadjieff |
| 4,462,733 | A | 7/1984 | Langowski et al. |
| 4,501,522 | A | 2/1985 | Causer et al. |
| 4,610,315 | A | 9/1986 | Koga et al. |
| 4,621,974 | A | 11/1986 | Krueger |
| 4,715,761 | A | 12/1987 | Berry et al. |
| 4,738,321 | A | 4/1988 | Olivier |
| 4,850,439 | A | 7/1989 | Lund |
| 5,038,871 | A | 8/1991 | Dinsdale |
| 5,107,940 | A | 4/1992 | Berry |
| 5,211,251 | A | 5/1993 | Woolslayer |
| 5,423,390 | A | 6/1995 | Donnally et al. |
| 5,518,076 | A | 5/1996 | Holz et al. |
| 6,220,807 | B1 | 4/2001 | Sorokan |
| 6,513,605 | B1 | 2/2003 | Lodden |
| 6,557,651 | B1 | 5/2003 | Norby et al. |
| 6,591,471 | B1 | 7/2003 | Hollingsworth et al. |
| 6,591,904 | B2 | 7/2003 | Cicognani |
| 6,609,565 | B1 | 8/2003 | Andreychuk et al. |
| 6,748,823 | B2 | 6/2004 | Pietras |
| 6,779,614 | B2 | 8/2004 | Oser |
| 6,821,071 | B2 | 11/2004 | Woolslayer et al. |
| 6,860,337 | B1 | 3/2005 | Orr et al. |
| 6,976,540 | B2 | 12/2005 | Berry |
| 6,997,265 | B2 | 2/2006 | Berry |
| 7,043,814 | B2 | 5/2006 | Hollingsworth et al. |
| 7,114,235 | B2 | 10/2006 | Jansch et al. |
| 7,140,445 | B2 | 11/2006 | Shahin et al. |
| 7,219,744 | B2 | 5/2007 | Pietras |
| 7,246,983 | B2 | 7/2007 | Zahn et al. |
| 7,331,746 | B2 | 2/2008 | Wright et al. |
| 7,353,880 | B2 | 4/2008 | Pietras |
| 7,451,826 | B2 | 11/2008 | Pietras |
| 7,677,856 | B2 | 3/2010 | Standal |
| 7,681,632 | B2 | 3/2010 | Wood |
| 7,699,122 | B2 | 4/2010 | Eriksen |
| 7,794,192 | B2 | 9/2010 | Wright et al. |
| 7,802,636 | B2 | 9/2010 | Childers et al. |
| 7,828,085 | B2 | 11/2010 | Kuttel et al. |
| 7,931,077 | B2 | 4/2011 | Rudshaug et al. |
| 8,028,748 | B2 | 10/2011 | Laitolais, Jr. et al. |
| 8,052,370 | B2 | 11/2011 | Dekker et al. |
| 8,186,455 | B2 | 5/2012 | Childers et al. |
| 8,186,925 | B2 | 5/2012 | Littlely |
| 8,186,926 | B2 | 5/2012 | Littlely |
| 8,215,887 | B2 | 7/2012 | Fikowski et al. |
| 8,317,448 | B2 | 11/2012 | Hankins et al. |
| 8,397,837 | B2 | 3/2013 | Skogerbo |
| 8,550,761 | B2 | 10/2013 | Belik et al. |
| 8,584,773 | B2 | 11/2013 | Childers et al. |
| 8,839,881 | B1 | 9/2014 | Baumler |
| 8,839,884 | B2 | 9/2014 | Kuttel et al. |
| 8,910,719 | B2 | 12/2014 | Kockeis et al. |
| 8,949,416 | B1 | 2/2015 | Barnes et al. |
| 8,961,093 | B2 | 2/2015 | Springett et al. |
| 8,992,152 | B2 | 3/2015 | Nouwens et al. |
| 9,010,410 | B2 | 4/2015 | Story |
| 9,562,407 | B2 | 2/2017 | Magnuson |
| 9,624,739 | B2 | 4/2017 | Kannegaard et al. |
| 10,053,934 | B2 | 8/2018 | Keogh et al. |
| 10,597,945 | B2 * | 3/2020 | Nguyen ..... E21B 7/20 |
| 10,597,954 | B2 * | 3/2020 | Alvaer ..... E21B 3/06 |
| 2004/0069532 | A1 | 4/2004 | Keast |
| 2005/0173154 | A1 | 8/2005 | Lesko |
| 2006/0104747 | A1 | 5/2006 | Zahn et al. |
| 2007/0193750 | A1 | 8/2007 | Wright et al. |
| 2008/0164064 | A1 | 7/2008 | Belik et al. |
| 2008/0302525 | A1 | 12/2008 | Beierbach et al. |
| 2008/0314580 | A1 | 12/2008 | Wood |
| 2009/0053015 | A1 | 2/2009 | Zachariasen et al. |
| 2009/0274545 | A1 | 11/2009 | Liess et al. |
| 2010/0243325 | A1 | 9/2010 | Veeningen |
| 2010/0303586 | A1 | 12/2010 | Hankins et al. |
| 2010/0326672 | A1 | 12/2010 | Childers et al. |
| 2011/0079434 | A1 | 4/2011 | Belik et al. |
| 2011/0174483 | A1 | 7/2011 | Odell et al. |
| 2012/0020758 | A1 | 1/2012 | Springett et al. |
| 2012/0067642 | A1 | 3/2012 | Magnuson |
| 2012/0305261 | A1 | 12/2012 | Roodenburg et al. |
| 2013/0025937 | A1 | 1/2013 | Pilgrim et al. |
| 2013/0112395 | A1 | 5/2013 | Story |
| 2013/0220601 | A1 | 8/2013 | Ferrari |
| 2013/0284450 | A1 | 10/2013 | Roodenburg et al. |
| 2014/0028042 | A1 | 1/2014 | LaValley et al. |
| 2014/0110174 | A1 | 4/2014 | Childers et al. |
| 2014/0124218 | A1 * | 5/2014 | Pilgrim ..... E21B 19/083 166/380 |
| 2014/0202769 | A1 | 7/2014 | Magnuson |
| 2014/0328650 | A1 | 11/2014 | Hu |
| 2016/0060979 | A1 | 3/2016 | Magnuson |
| 2017/0234088 | A1 * | 8/2017 | Orr ..... E21B 19/16 166/380 |
| 2018/0216405 | A1 | 8/2018 | De Mul et al. |
| 2018/0328112 | A1 | 11/2018 | Berry et al. |
| 2019/0017334 | A1 | 1/2019 | Loeyning et al. |
| 2019/0106950 | A1 | 4/2019 | Alvaer et al. |

FOREIGN PATENT DOCUMENTS

| | | | |
|---|---|---|---|
| CN | 107227934 | A | 10/2017 |
| EP | 0979924 | A2 | 2/2000 |
| RU | 2018617 | C1 | 8/1994 |
| RU | 2100565 | C1 | 12/1997 |
| RU | 2541972 | C2 | 2/2015 |
| SU | 746081 | A1 | 7/1980 |
| SU | 1730422 | A1 | 4/1992 |
| WO | 9315303 | A1 | 8/1993 |
| WO | 0111181 | A1 | 2/2001 |
| WO | 0218742 | A1 | 3/2002 |
| WO | 2006059910 | A1 | 6/2006 |
| WO | 2010141231 | A2 | 12/2010 |
| WO | 2011016719 | A1 | 2/2011 |
| WO | 2011056711 | A2 | 5/2011 |
| WO | 2012148286 | A1 | 11/2012 |
| WO | 2014029812 | A2 | 2/2014 |
| WO | 2016204608 | A1 | 12/2016 |
| WO | 2017087200 | A1 | 5/2017 |
| WO | 2017087349 | A1 | 5/2017 |
| WO | 2017087350 | A1 | 5/2017 |
| WO | 2017190118 | A2 | 11/2017 |

* cited by examiner

FIG. 90
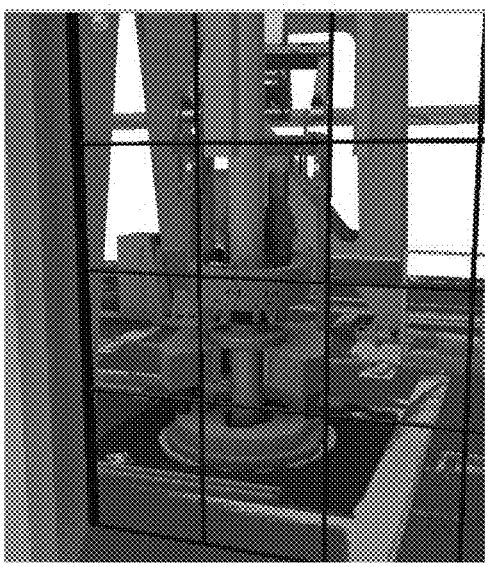
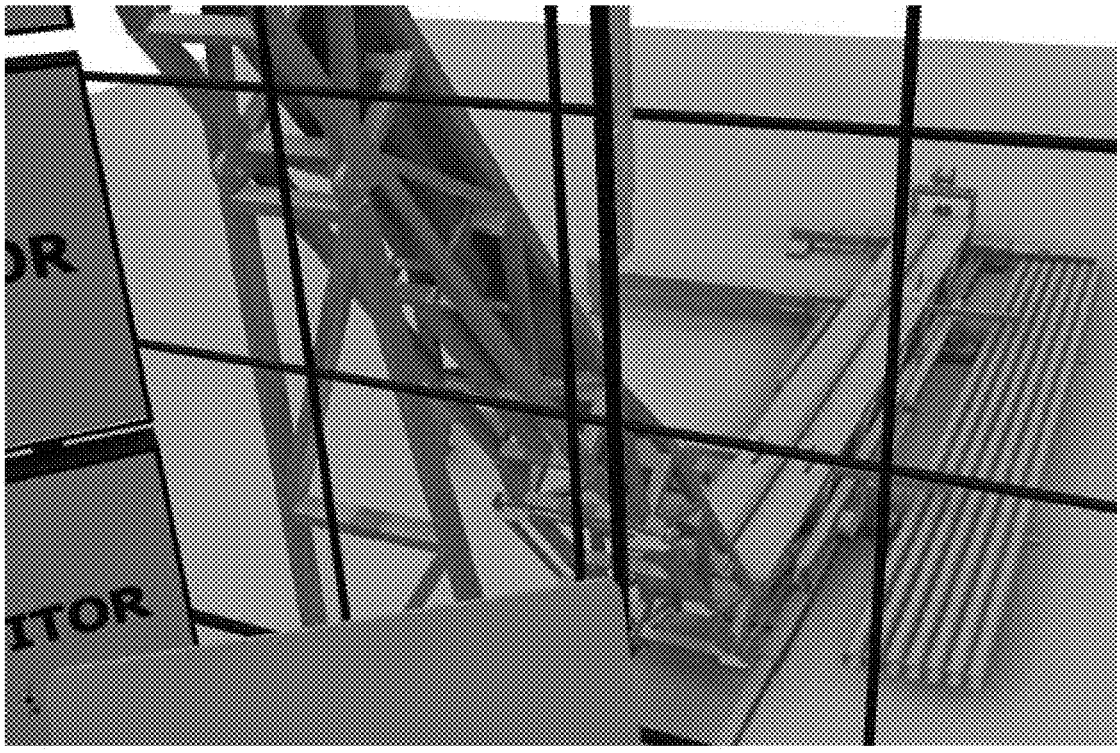
FIG. 91

SEQUENCING FOR PIPE HANDLING

RELATED APPLICATIONS

This application claims the benefit of U.S. patent application Ser. No. 16/016,709, filed Jun. 25, 2020, with the same title and U.S. Provisional Application Ser. No. 62/570,519, filed Oct. 10, 2017. Both applications are incorporated by reference herein.

TECHNICAL FIELD

The present disclosure relates to drilling and pipe handling systems and processes for drilling and handling drill pipe and casing relative to drill rig operations. In particular, the invention relates to sequences for handling pipe and casing on a drill rig.

BACKGROUND ART

In the exploration of oil, gas and geothermal energy, drilling operations are used to create boreholes, or wells, in the earth. Modern drilling rigs not only have drilling capability, but they also have pipe handling capability to allow simultaneous drilling and pipe handling operations Conventional drilling involves having a drill bit on the bottom of the well. A bottom-hole assembly is located immediately above the drill bit where directional sensors and communications equipment, batteries, mud motors, and stabilizing equipment are provided to help guide the drill bit to the desired subterranean target. A set of drill collars are located above the bottom-hole assembly to provide a non-collapsible source of weight to help the drill bit crush the formation. Heavy weight drill pipe is located above the drill collars for safety. The remainder of the drill string is mostly drill pipe, designed to be under tension. Each drill pipe is roughly 30 feet long, but lengths vary based on the style. It is common to store lengths of drill pipe in "doubles" (two connected lengths) or "triples" (three connected lengths) or even "quadruples" (four connected lengths). A "tubular stand" refers to connected sections of drill pipe, drill collars, or casing.

When the drill bit wears out, or when service, repairs or adjustments need to be made to the bottom-hole assembly, the drill string (drill pipe and other components) is removed from the wellbore and setback. When removing the entire drill string from the well, it is typically disconnected and setback in doubles or triples until the drill bit is retrieved and exchanged. This process of pulling everything out of the hole and running it all back in the hole is known as "tripping."

Tripping is non-drilling time and, therefore, an expense. Efforts have long been made to devise ways to avoid it or at least speed it up. Running triples is faster than running doubles because it reduces the number of threaded connections to be disconnected and then reconnected. Triples are longer and therefore more difficult to handle due to their length and weight and the natural waveforms that occur when moving them around. Manually handling moving pipe in the derrick and at the drill floor level can be dangerous.

It is desirable to have drilling rig processes for handling pipe in a more efficient and timely manner without sacrificing safety.

Most attempts to automate pipe handling are found offshore. However, solutions for pipe delivery on offshore drilling rigs are seldom transferable to onshore land rigs, due to the many differences in economic viability, size, weight, and transportation considerations.

SUMMARY OF INVENTION

In accordance with the teachings of the present disclosure, disadvantages and problems associated with existing drill rig control systems are alleviated.

According to one aspect of the invention, there is provided a method for performing a wellbore operation via a drill rig, the method comprising: moving a tubular string relative to the wellbore via a top drive; moving a tubular stand between a setback position and a stand handoff position via a transfer bridge racker and a setback guide arm; moving a tubular stand between the stand handoff position and a well center position via a tubular delivery arm and a lower stabilizing arm; and operating a roughneck on a joint between the tubular stand and the tubular string.

Another aspect of the invention provides a method for performing operations via a drill rig, the method comprising: conducting a drilling operation at a well center; conducting a standbuilding operation simultaneously with the drilling operation, wherein the standbuilding operation comprises: moving a first tubular single between a feeding table position and a drill floor pickup position via a catwalk; moving the first tubular single between the drill floor pickup position and a mousehole stickup position via a tubular delivery arm and a lower stabilizing arm; holding the first tubular single in the mousehole stickup position via at least one stand constraint; moving a second tubular single between the feeding table position and the drill floor pickup position via the catwalk; moving the second tubular single between the drill floor pickup position and a mousehole make/brake position via the tubular delivery arm and the lower stabilizing arm; operating a roughneck on a joint between the first and second tubular singles; moving a tubular stand comprising the first and second tubular singles between a mousehole position and a stand handoff position; and moving the tubular stand between a stand handoff position and a setback position via a transfer bridge racker and a setback guide arm.

According to still another aspect of the invention, there is provided a method for performing operations via a drill rig, the method comprising: moving a tubular string relative to the wellbore via a top drive; moving a tubular single between a feeding table position and a drill floor pickup position via a catwalk; moving the tubular single between the drill floor pickup position and a well center position via a top drive and a lower stabilizing arm; and operating a roughneck on a joint between the tubular single and the tubular string in the wellbore.

A further aspect of the invention provides a method for performing operations via a drill rig, the method comprising: moving a casing string relative to the wellbore via a top drive; moving a casing single between a feeding table position and a drill floor pickup position via a catwalk; moving the tubular single between the drill floor pickup position and a well center position; operating a casing running tool between the casing single and the top drive; and operating the top drive on a joint between the casing single and the casing string in the wellbore.

According to a further aspect of the invention, there is provided a method for performing operations via a drill rig, the method comprising: drilling a wellbore by rotating a drill string via a top drive; setting slips at the drill rig floor so that the drill string is at a stickup height relative to the drill rig floor; breaking out the connection between the top drive and the drill string; moving a drill string stand from a setback position to a stand handoff position; moving a drill string stand from a stand handoff position to a well center position; making up a joint between the drill string stand and the drill string; making up a connection between the drill string stand and the top drive; opening the slips at the drill rig floor; and continuing drilling a wellbore by rotating the drill string via the top drive.

BRIEF DESCRIPTION OF DRAWINGS

A more complete understanding of the present embodiments may be acquired by referring to the following description taken in conjunction with the accompanying drawings, in which like reference numbers indicate like features.

FIG. 90 illustrates stabbing the casing single into the casing string.

FIG. 91 illustrates loading a new casing single on the ramp of the catwalk.

FIGS. 121A-121C illustrate pulling up the first tubular from the catwalk.

FIG. 122 illustrates placing the first casing tubular in the mousehole.

FIGS. 123A and 123B illustrate pulling up a second casing tubular from the ramp of the catwalk.

FIGS. 124A and 124B illustrate stabbing the second casing tubular into the first casing tubular and making up the joint.

FIGS. 125A and 125B illustrate lowering the double of the casing stand into the mousehole.

FIGS. 126A and 126B illustrate moving the casing stand from the mousehole to the stand handoff position.

FIGS. 127A-127D illustrate setting the stand back in the fingerboard/setback from the stand handoff position.

FIG. 128 illustrates a drilling connection sequence by first positioning the top drive so that the drill string is at a stickup height, setting the slips, and breaking out the joint.

FIGS. 129A and 129B illustrate hoisting the top drive to a connection height so a new stand can be brought to well center.

FIGS. 130A and 130B illustrate moving a stand from the drill floor standby position above the mousehole to the well center.

FIGS. 131A and 131B illustrate stabbing the stand into the drill string and making up the joint.

FIGS. 132A and 132B illustrate connecting the top drive to the drill string.

Figure 133:
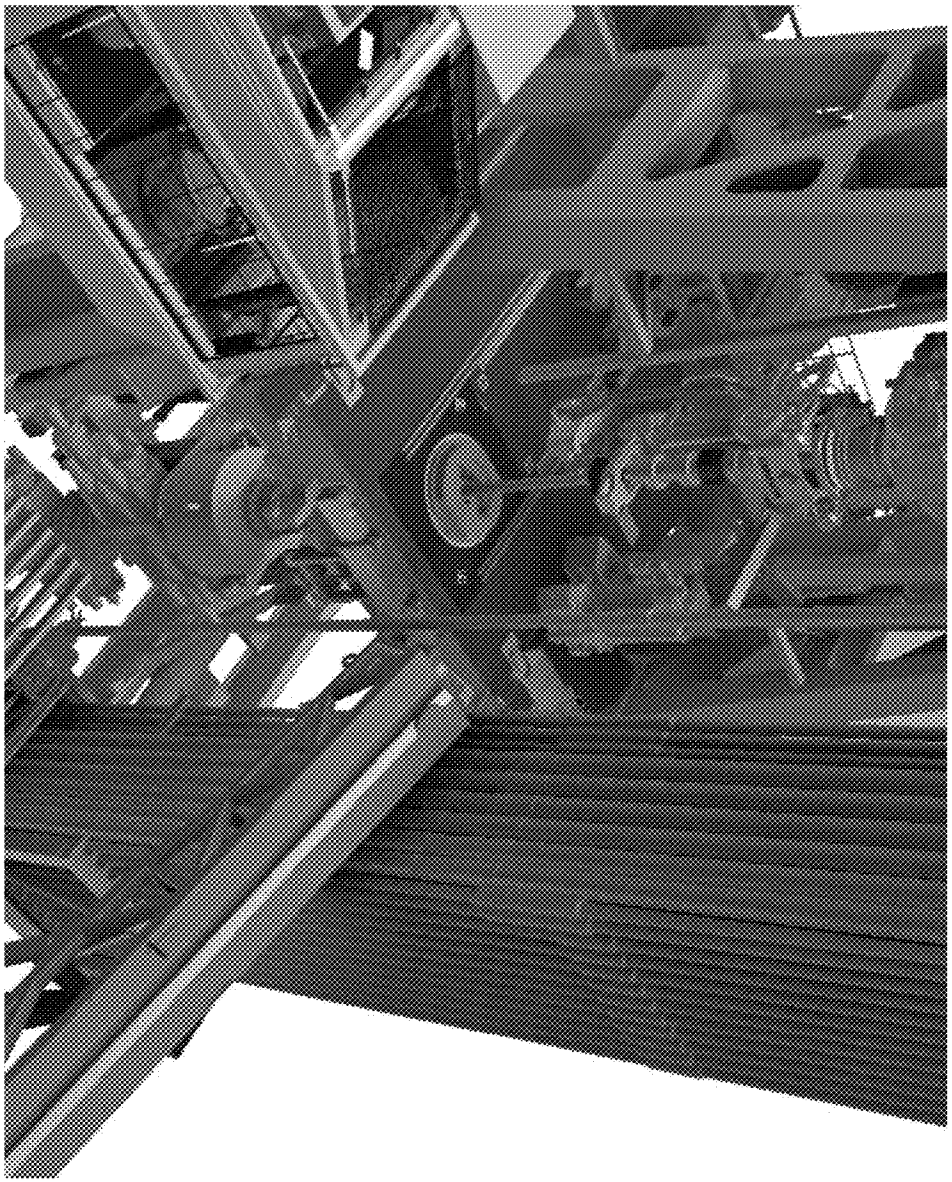

FIG. 133 illustrates opening the slips and continuing to drill with the now longer drill string.

Figure 134A:
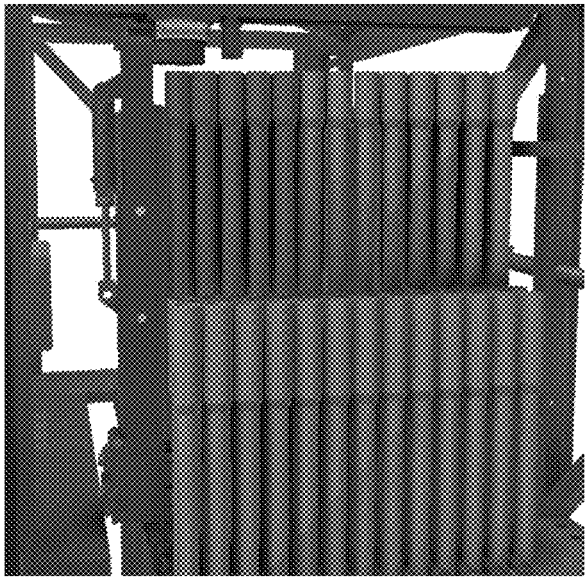
Figure 134B:
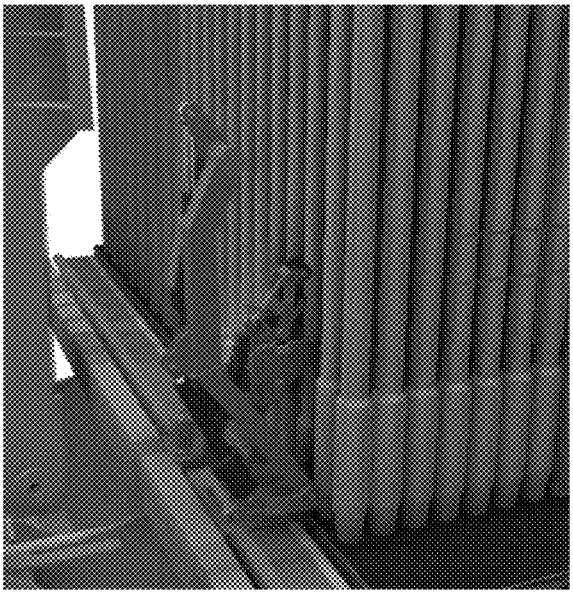

FIGS. 134A and 134B illustrate picking up another stand from the fingerboard/setback.

Figure 135A:
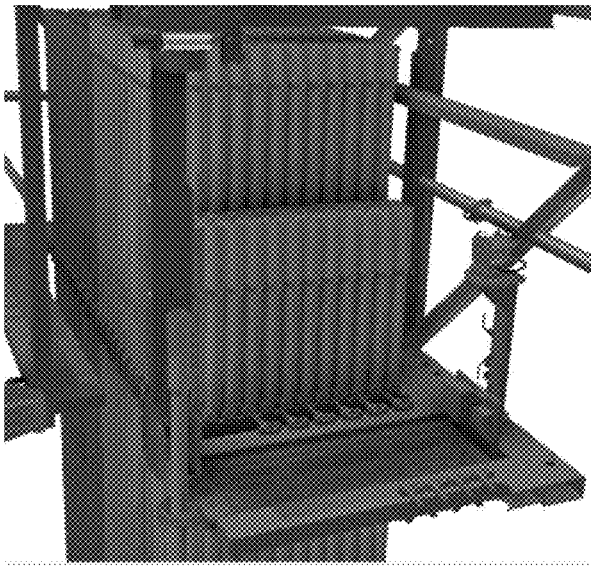
Figure 135B:
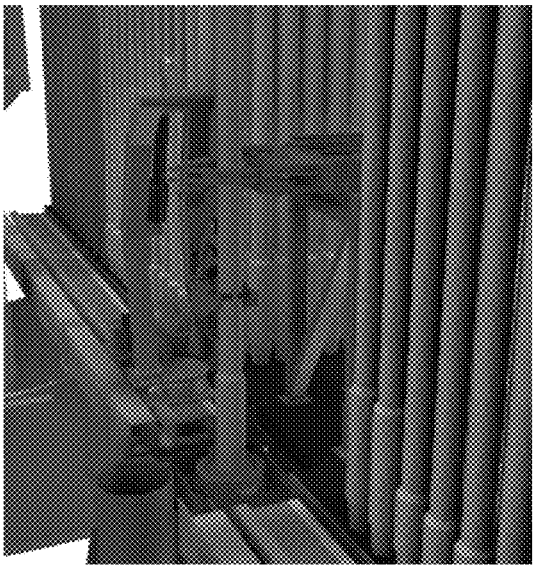

FIGS. 135A and 135B illustrate moving the stand to the stand handoff position.

Figure 136:
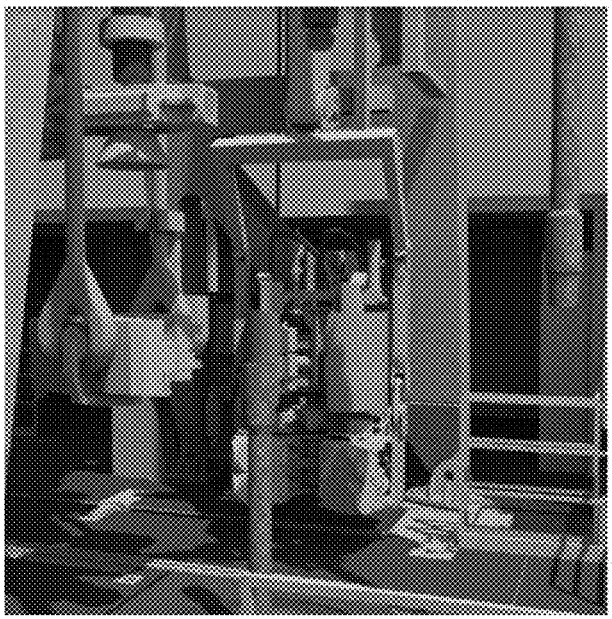

FIG. 136 illustrates a starting position for a backreaming sequence.

Figure 137A:
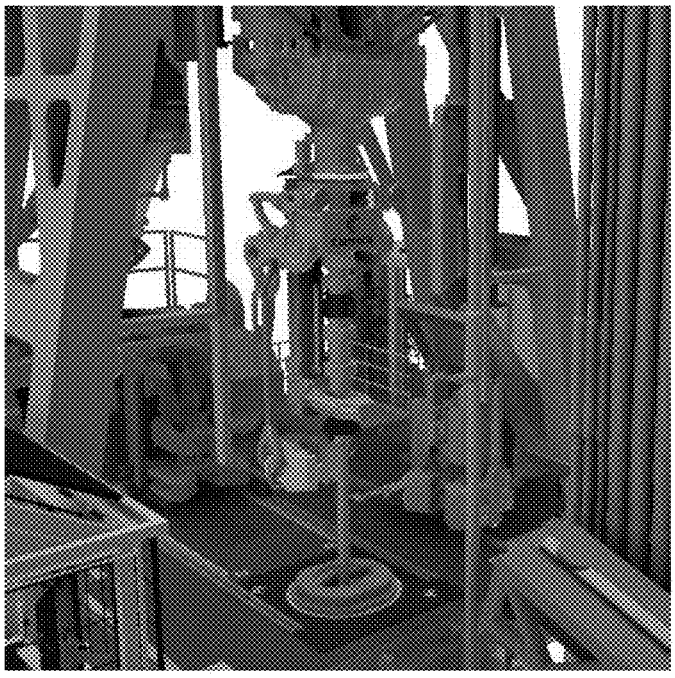
Figure 137B:
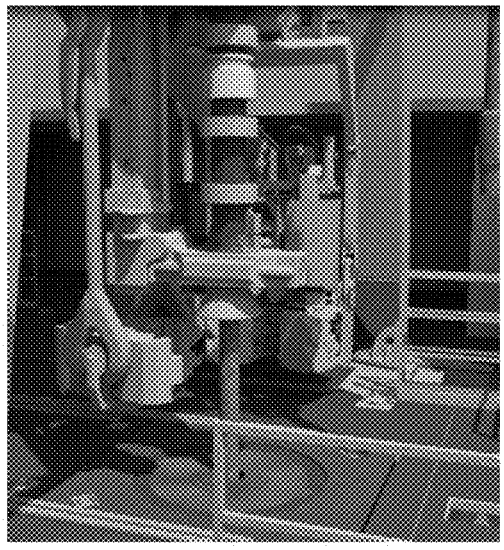

FIGS. 137A and 137B illustrate extending the top drive and tilting the link arms to a parked position so that the top drive can be made up to the drill string.

Figure 138A:
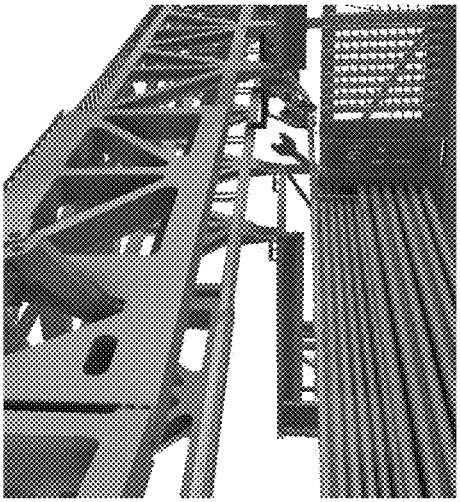
Figure 138B:
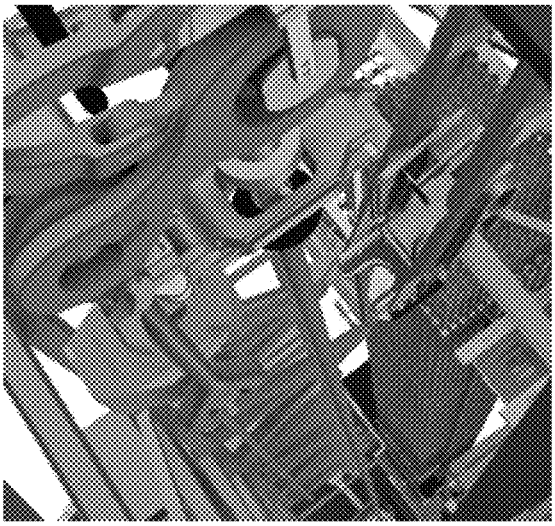

FIGS. 138A and 138B illustrate opening the slips and reaming out the stand while the tubular delivery arm and lower stabilizing arm are moved to safe standby positions.

Figure 139A:
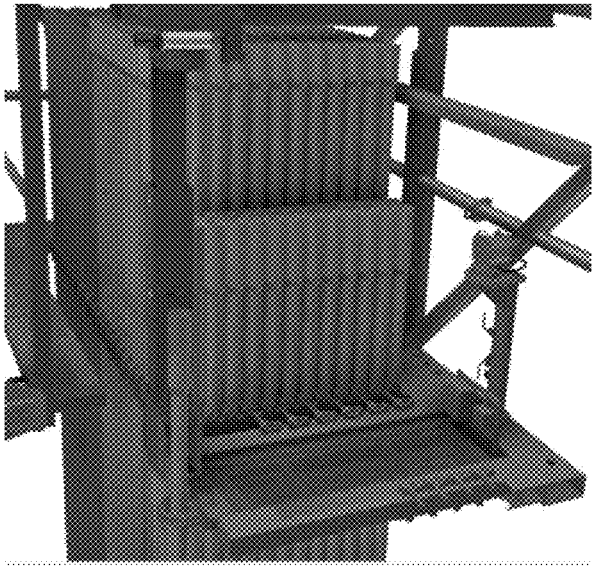
Figure 139B:
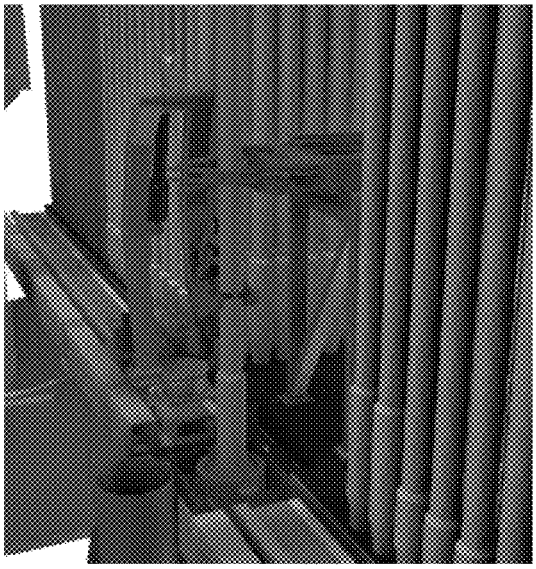

FIGS. 139A and 139B illustrate moving a stand from the stand handoff position to a position in the setback.

Figure 140A:
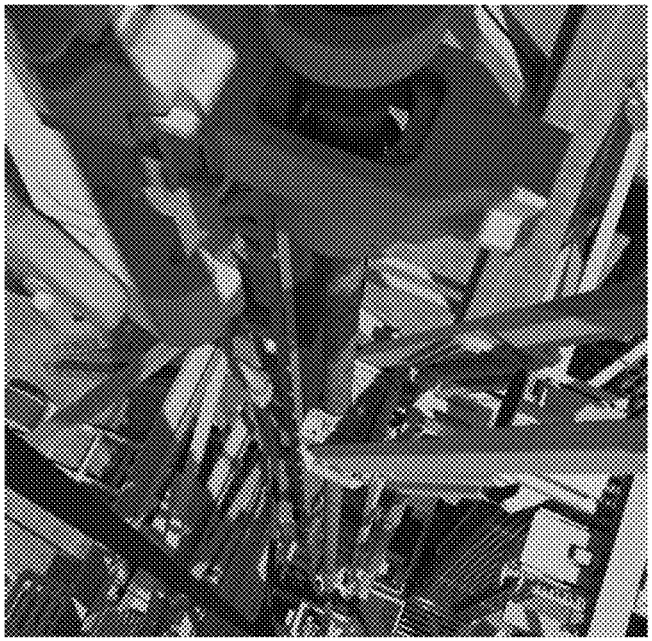
Figure 140B:
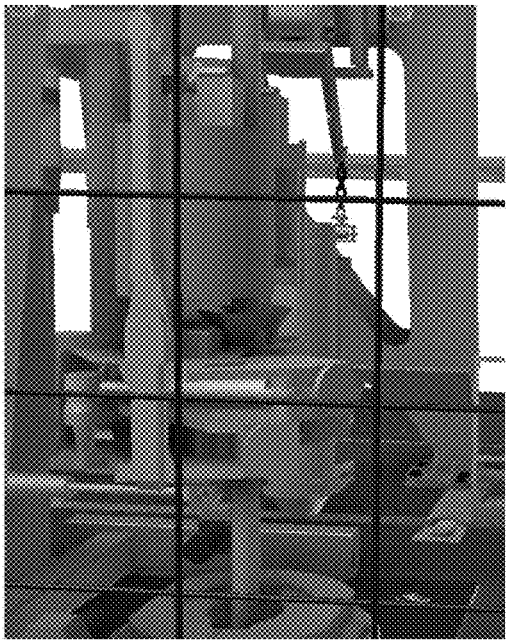

FIGS. 140A and 140B illustrate moving the tubular delivery arm, the lower stabilizing arm and the roughneck to break out the stand from the drill string in the well center.

Figure 141A:
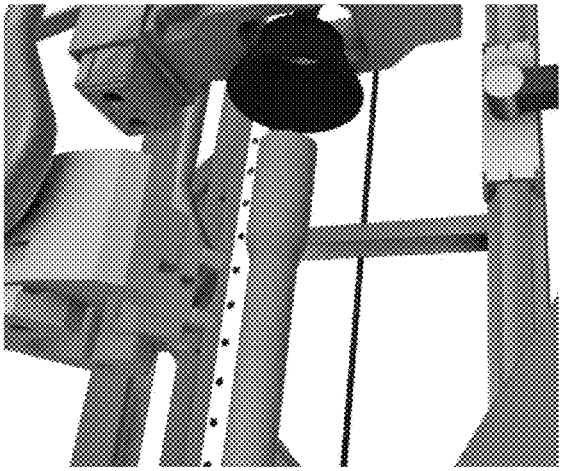
Figure 141B:
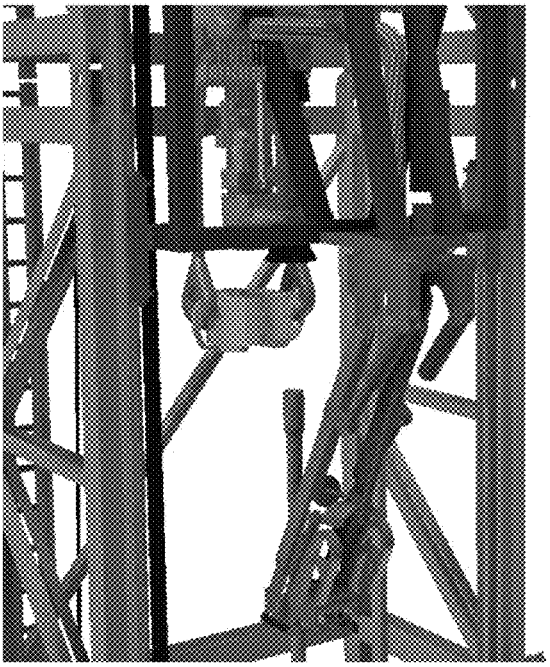

FIGS. 141A and 141B illustrate breaking out the top drive from the stand above the stickup.

Figure 142A:
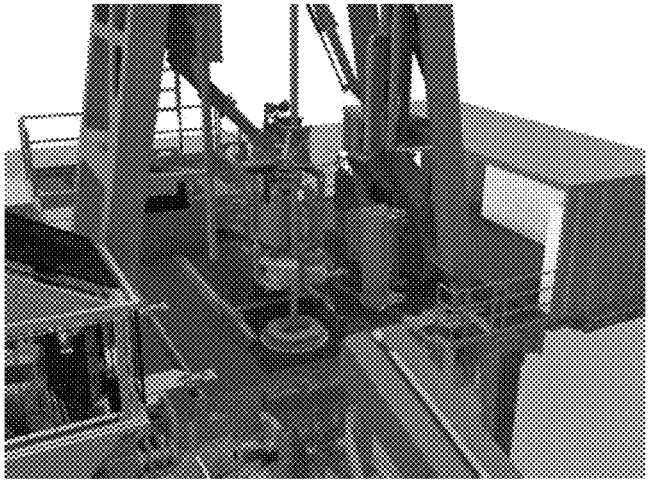
Figure 142B:
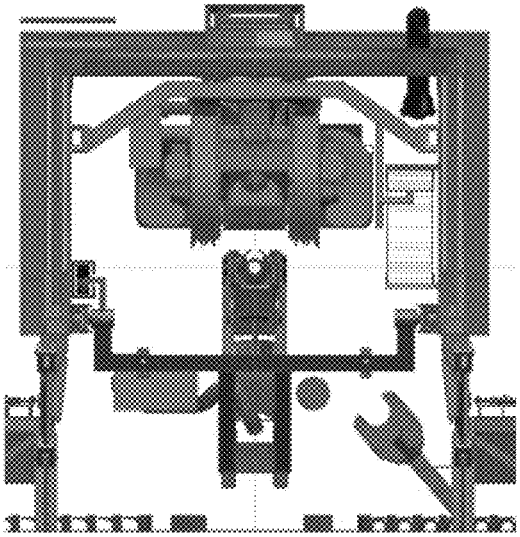

FIGS. 142A and 142B illustrate breaking out the stand from the drill string with the roughneck.

Figure 143:
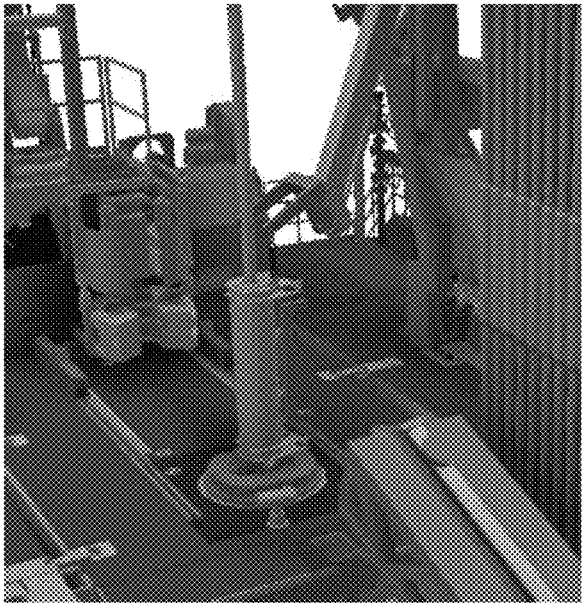

FIG. 143 illustrates draining the stand with a mud bucket while the tubular delivery arm and lower stabilizing arm lift the stand.

Figure 144A:
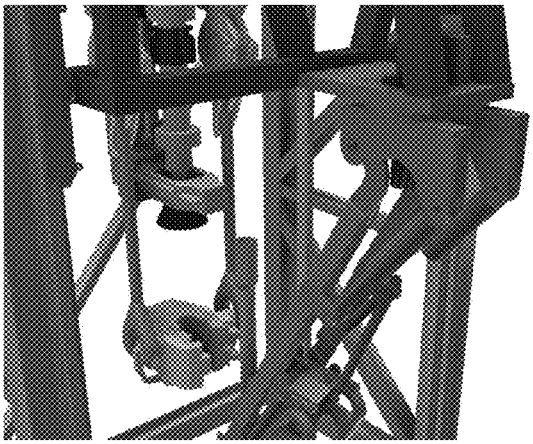
Figure 144B:
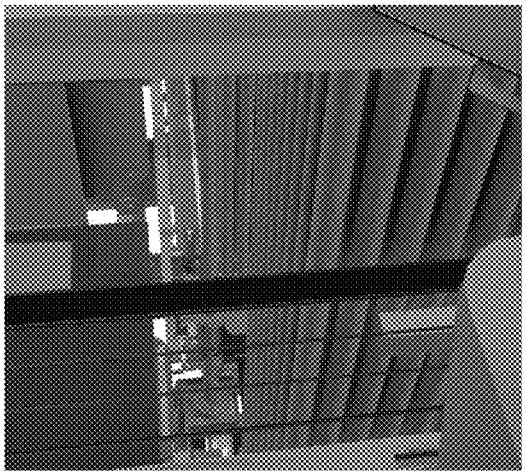

FIGS. 144A and 144B illustrate moving the stand from the well center to the stand handoff position with the top drive lowers to the stickup.

Figure 145A:
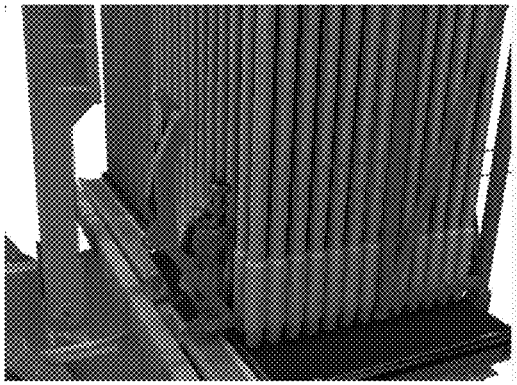
Figure 145B:
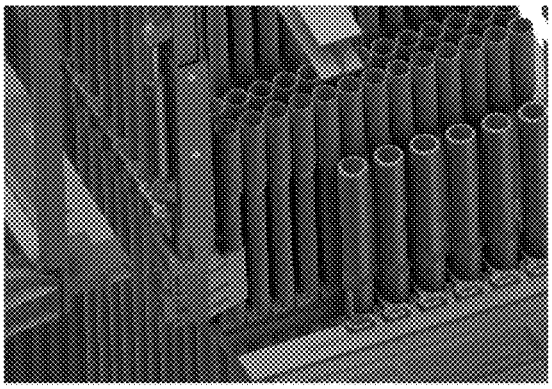

FIGS. 145A and 145B illustrate moving the stand from the stand handoff position to a position in the fingerboard/setback.

The objects and features of the invention will become more readily understood from the following detailed description and appended claims when read in conjunction with the accompanying drawings in which like numerals represent like elements.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DESCRIPTION OF EMBODIMENTS

Preferred embodiments are best understood by reference to FIGS. 1-145B below in view of the following general discussion. The present disclosure may be more easily understood in the context of a high level description of certain embodiments.

According to various aspects of the present invention sequences for pipe handling operations are provided, including: (i) tripping in drill pipe, (ii) tripping out drill pipe, (iii) tripping out drill string wet, (iv) tripping out casing stand wet, (v) tripping in casing stand with no casing running tool, (vi) tripping in drill collar stands; (vii) tripping out drill collar stands; (viii) picking up single drill pipes from catwalk to well center with top drive, (ix) laying down single drill pipes from well center to catwalk with top drive, (x) running single casing from catwalk with casing tong, (xi) laying down single casing from well center to catwalk with casing tong, (xii) running casing from catwalk with top drive and casing running tool, (xiii) running casing from catwalk with tubular delivery arm and casing running tool, (xiv) offline stand building of drill pipe, (xv) offline laying down of drill pipe stands, (xvi) offline stand building of casing, (xvii) offline laying down of casing stands, (xviii) drilling connection, and (xix) back reaming. Sequences may be performed in fully automatic mode or manual mode, wherein the sequence steps may be the same in either mode. Some sequences may be performed simultaneously, such as for example, pipe building sequences may be conducted at the same time as drilling or tripping sequences.

The various embodiments of the drilling rig system may include one or more of the following components:

1) Retractable Top Drive
2) Tubular Delivery Arm
3) Fingerboard/Setback Platform
4) Transfer Bridge Racker
5) Setback Guide Arm
6) Lower Stabilizing Arm
7) Upper Stand Constraint
8) Intermediate Stand Constraint
9) Lower Stand Constraint
10) Roughneck on Tong Handling Trolley
11) Roughneck on Tong Handling Arm
12) Catwalk
13) Rotary Table with Slips The various components may be operated in concert to perform methods for stand building, tripping in, tripping out, etc. Rig operations may be managed by two operators: a driller and a pipe handler. The driller is primarily responsible for the drilling operations which moves drill string in and out of the wellbore. The pipe handler is primarily responsible for moving pipe to/from the well center and making and breaking joint connections. Drilling operations and pipe handling operations may take place simultaneously. A zone management system or anti-collision system may be employed to ensure the components do not run into each other.

Control interface devices, such as joysticks may enable operators to perform all rig operations and functions. For example, during a single operation sequence, any number of component machines may be operated simultaneously by a single operator via two joysticks. Human machine interfaces may provide touchscreen pictures for control.

Figure 1:
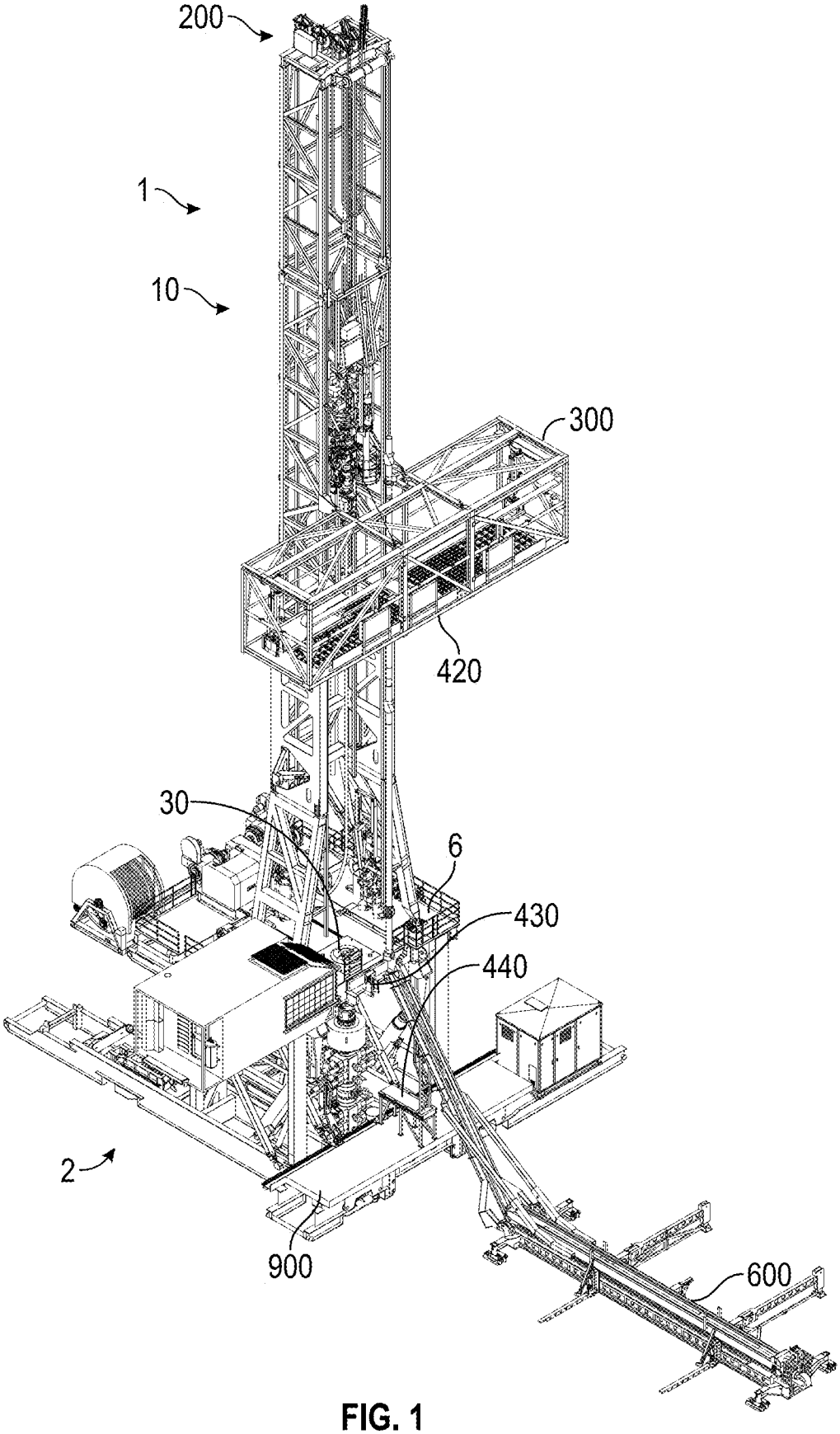
FIG. 1 is a perspective view of a drill rig with a fingerboard/setback and catwalk for performing sequence methods of the present invention.

FIG. 1 is an isometric view of an embodiment of a drilling rig system. FIG. 1 illustrates drilling rig 1 having the front portion (V-door portion) removed. In its place, a setback platform 900 is located near ground level, extending over the base box sections of a substructure 2 on the ground. In this position, setback platform 900 is directly beneath racking module 300 such that any pipe stands 80 (not shown) located in racking module 300 will be resting on setback platform 900. In this configuration, racking module 300 is located lower on mast 10 of drilling rig 1 than on conventional land rigs, since the tubular stands 80 are not resting at drill floor level. Additionally, tubular stands 80 will need to be significantly elevated to reach the level of drill floor 6.

As will be seen in the following discussion, this arrangement provides numerous advantages in complementary relationship with the several other unique components of high trip rate drilling rig 1. To be most advantageous, it requires a spacious drill floor 6 to accommodate coupling equipment such as an iron roughneck, and a lower stabilizing arm to control the free movement of tubular stands hoisted by the retractable top drive and the secondary hoisting machine.

Figure 2:
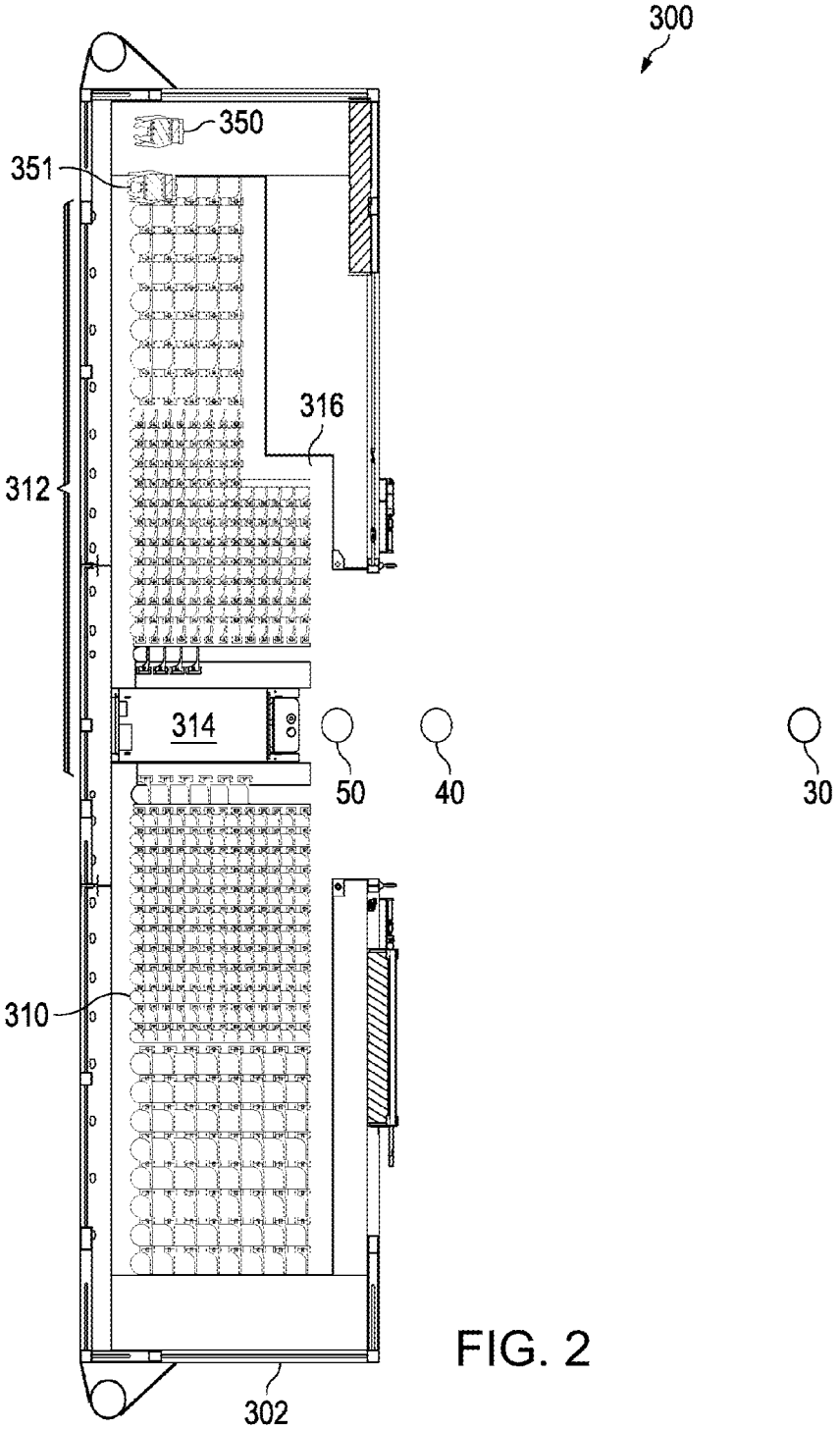
FIG. 2 is a top view of the fingerboard/setback of FIG. 1, wherein wellcenter, mousehole and stand handoff positions are indicated.

FIG. 2 shows a top view of the racking module 300. A mousehole center 40 is located on the forward edge of drill floor 6 and extends downward beneath. An intermediate stand constraint 430 is located adjacent to drill floor 6 and centered over mousehole center 40. A stand hand-off position 50 is located on setback platform 900, and extends vertically upwards, and is not impeded by any other structure beneath racking module 300. A lower stand constraint 440 is located on setback platform 900 and centerable over stand hand-off position 50. In this embodiment, stand hand-off position 50 is forward of, and in alignment with, well center 30 and mousehole center 40. FIG. 2 shows that racking module 300 has a fingerboard assembly 310 with columns of racking positions 312.

Figure 3:
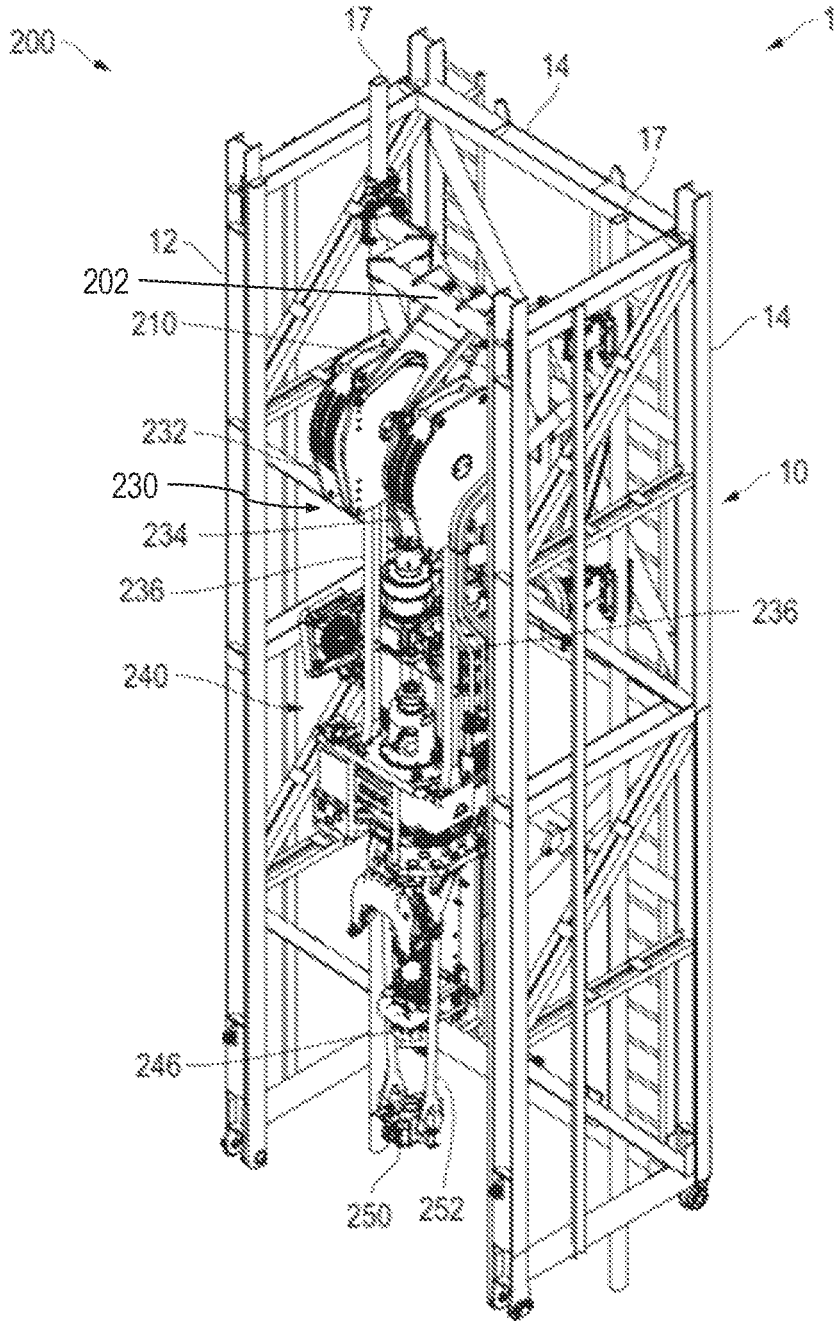
FIG. 3 is a perspective view of a top drive in a portion of the drill rig mast.

FIG. 3 is an isometric cut-away view of top drive 200 in drilling mast 10 as used in an embodiment of the high trip rate drilling rig 1. Top drive 200 has a dolly 202 that is mounted on guides 17 in mast 10. Guides 17 are proximate to the rear side 14 (draw works side) of mast 10. Dolly 202 is vertically translatable on the length of guides 17 via fittings 208. In the embodiment illustrated, top drive 200 has a split travelling block assembly 230 including a driller's side block 232 and an off-driller's side block 234. This feature provides mast-center path clearance additional to that obtained by the ability to retract dolly 202.

Figure 4:
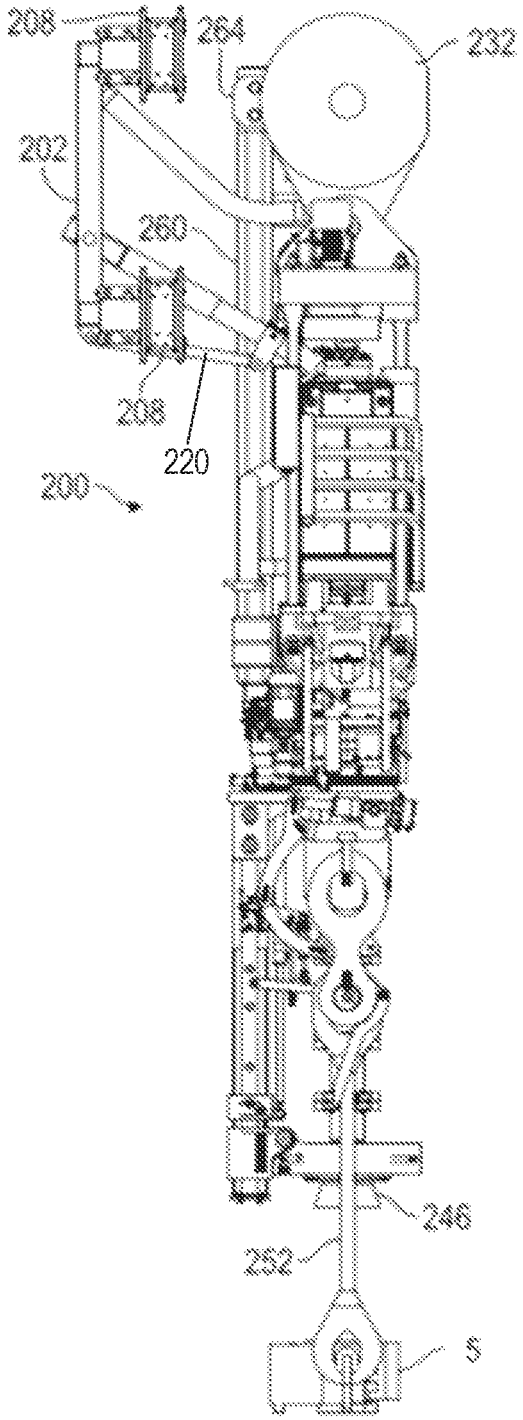
FIGS. 4 and 5 are side views of the top drive with the carriage trolley extended and retracted, respectively.

FIG. 4 shows that first yoke 210 pivotally connects block halves 232 and 234 to dolly 202, and provides their separation and alignment on a common axis of rotation. Second yoke 212 pivotally connects block halves 232 and 234 to dolly 202, and stabilizes their separation and alignment. Torque tube 260 is connected to the intersection of second yoke 212 and block halves 232 and 234 to secure it to the travelling block assembly 230. Actuator 220 extends between yoke 210 and dolly 202 to facilitate controlled movement of the top drive between a well center position and a retracted position. Connection 264 represents a point on block halves 232 and 234 of travelling block assembly 230 where torque tube 260 is connected.

Figure 5:
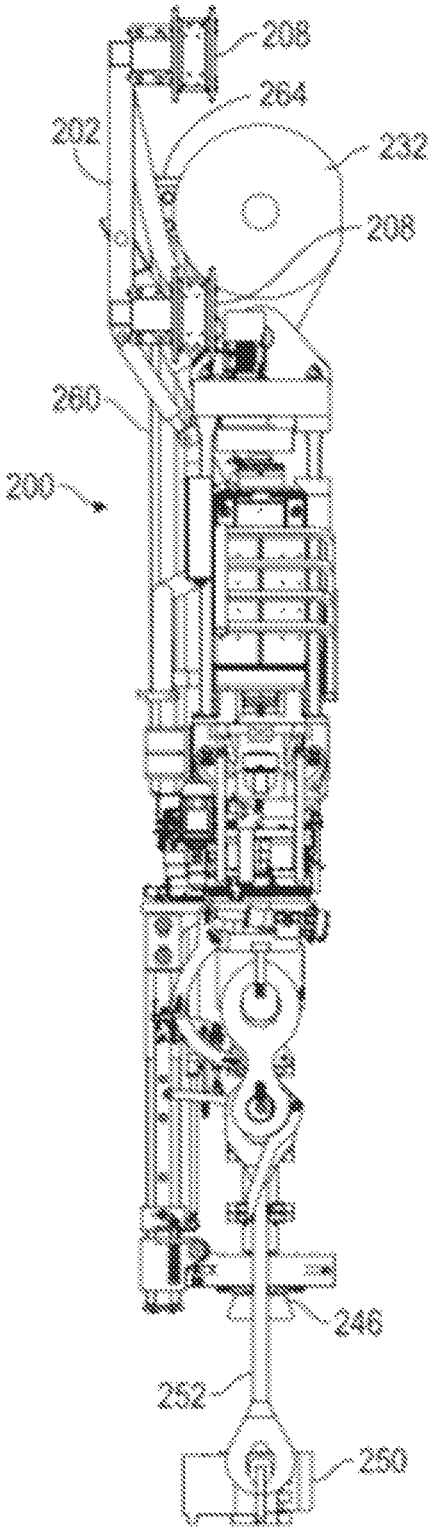

FIG. 5 is a side view of the embodiment of the retractable top drive 200 of FIG. 4, showing it retracted from the position shown in FIG. 4.

Figure 6:
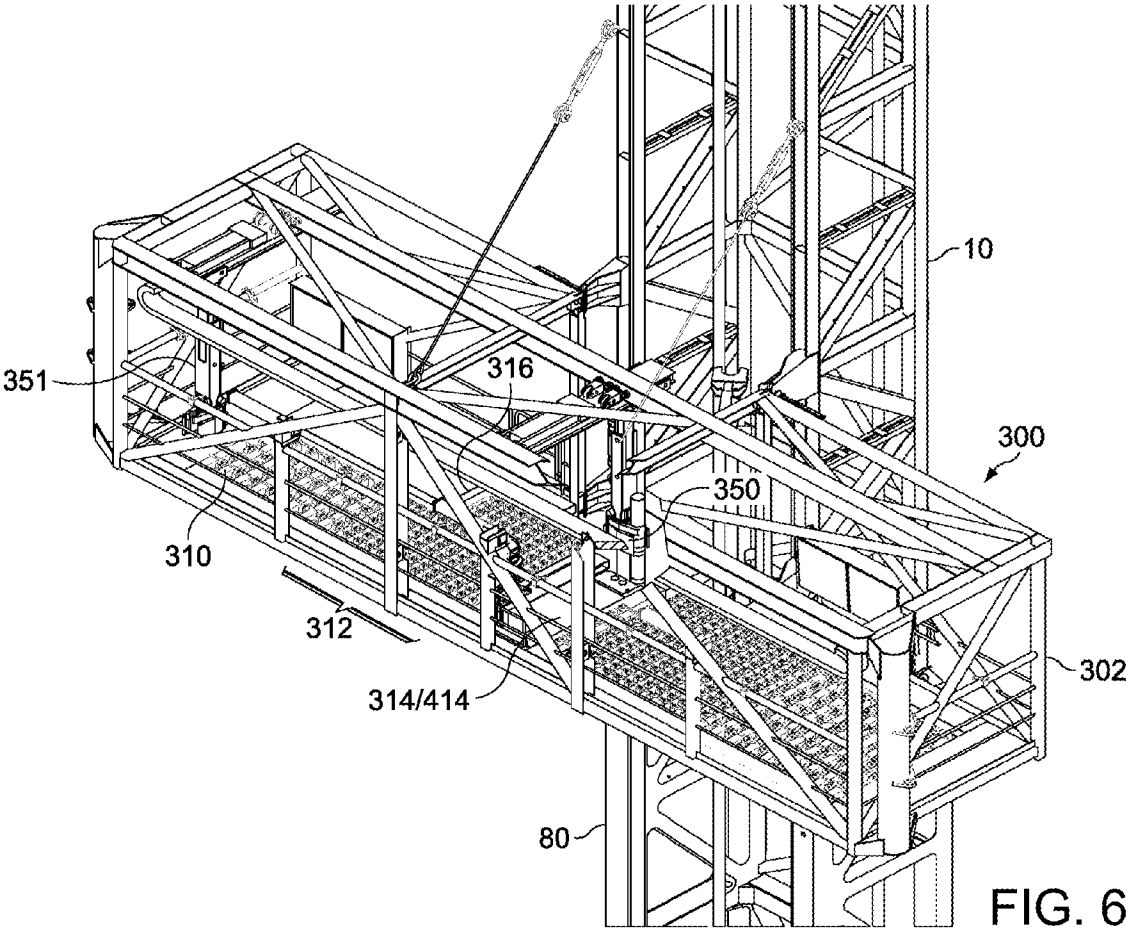
FIG. 6 is a perspective view of the fingerboard shown in FIG. 1.

FIG. 6 is a perspective view of the fingerboard shown in FIG. 1.

Figure 7:
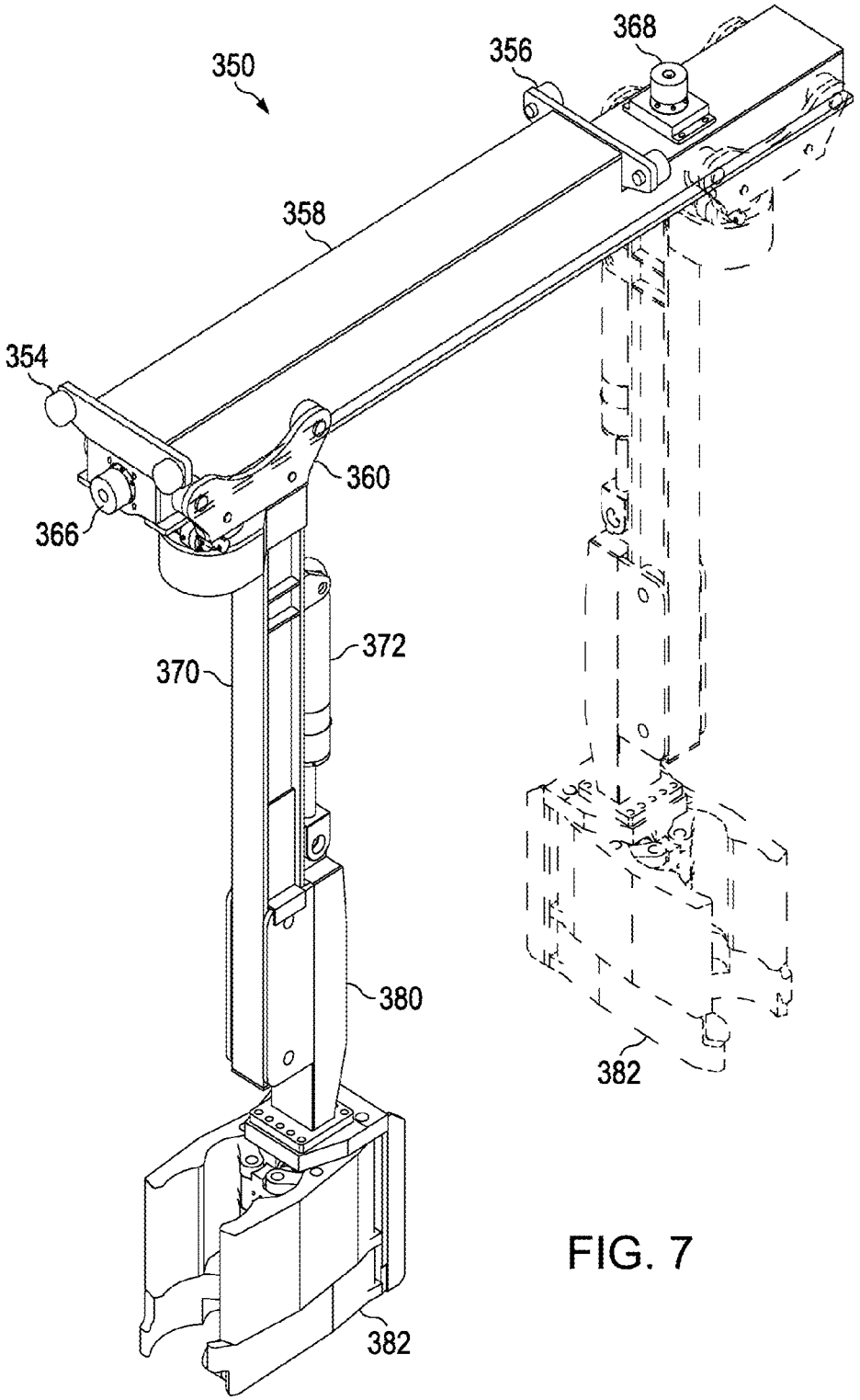
FIG. 7 is a perspective view of a transfer bridge racker.

FIG. 7 is an isometric view of an embodiment of transfer bridge racker 350, illustrating the travel range and rotation of gripper 382 connected to sleeve 380 and arm 370, as suspended from bridge 358. Transfer bridge racker 350 has the ability to position its gripper 382 over the tubular racking position 312 in the grid. In the embodiment illustrated, second upper racking mechanism 351 also has the capability of positioning its gripper 382 over the tubular racking position 312 on fingerboard assembly 310.

Figure 8:
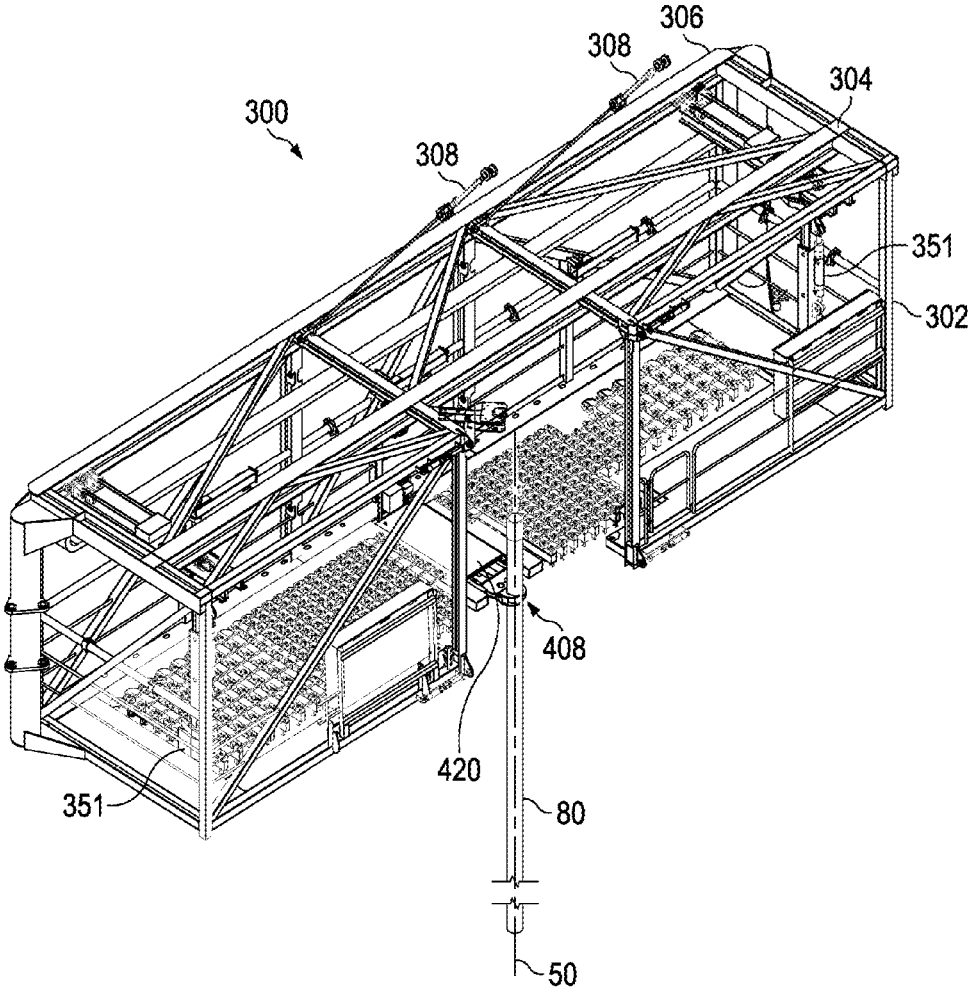
FIG. 8 is a perspective view of the fingerboard shown in FIG. 1, wherein an upper stand constraint is securing a stand.

FIG. 8 is an isometric view of racking module 300 of FIG. 6 and the transfer bridge racker 350 of FIG. 7, shown from the opposite side to illustrate clasp 408 of upper stand constraint 420 holding tubular stand 80 at stand hand-off position 50. Mast 10 is removed from this view for clarity.

Figure 9:
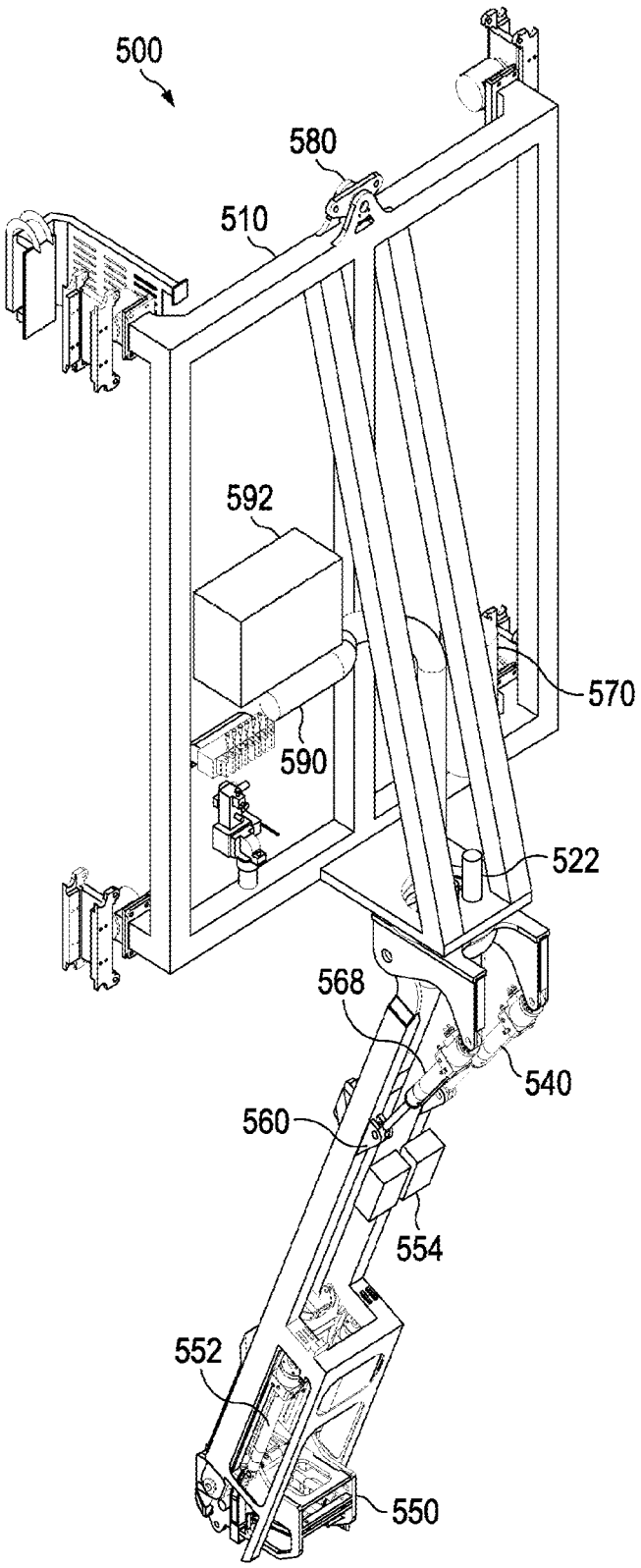
FIG. 9 is a perspective view of a tubular delivery arm.

FIG. 9 is an isometric view of a tubular delivery arm 500. Retractable top drive assembly 200 provides a first tubular handling device that vertically translates in mast 10. Tubular delivery arm 500 provides a second tubular handling device that is vertically translatable along the same mast 10 of drilling rig 1, without physically interfering with retractable top drive assembly 200. An incline actuator 552 is operative to control the angle of tubular clasp 550 relative to arm 532.

Figure 10:
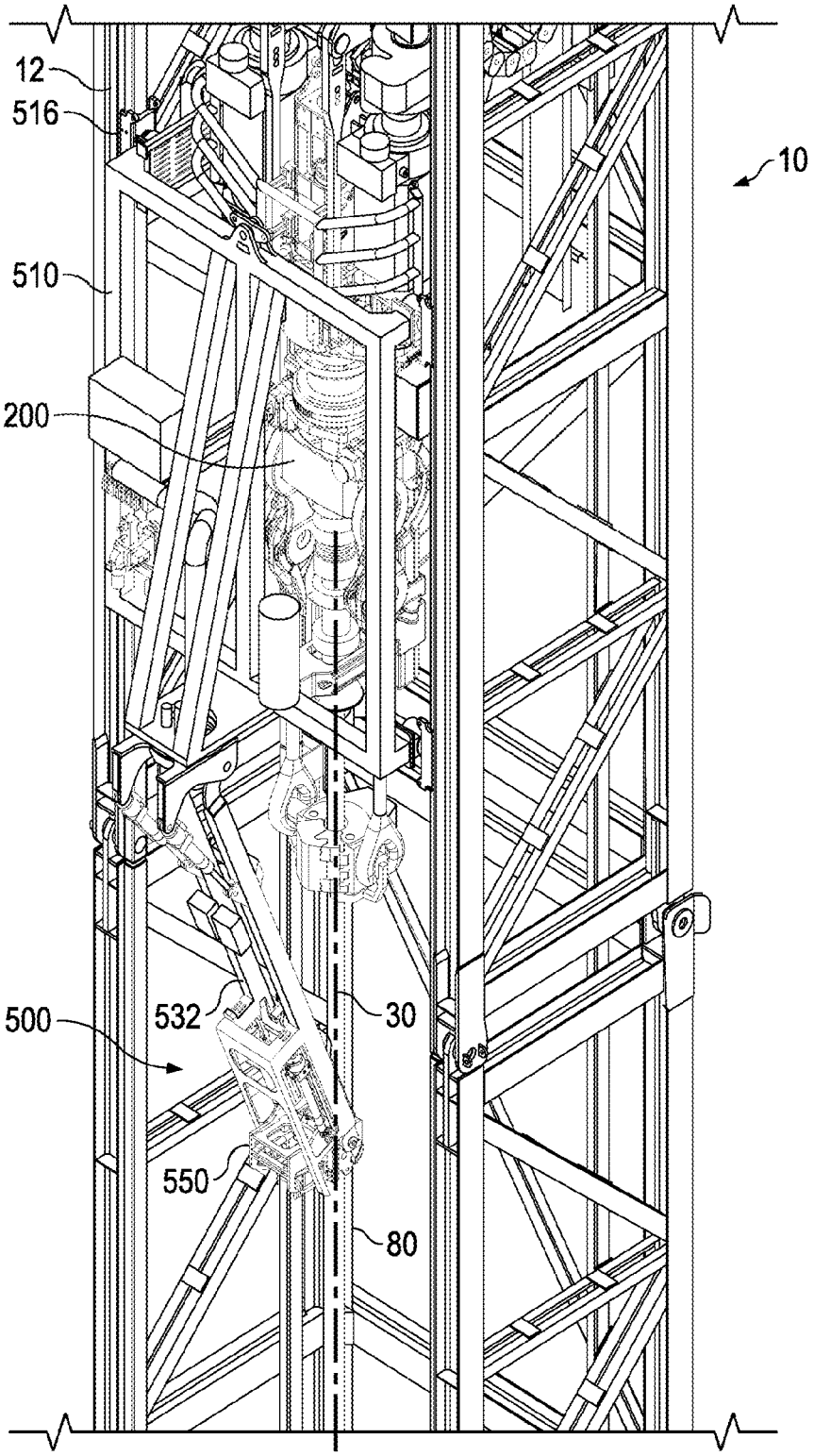
FIG. 10 is a perspective view of the tubular delivery arm of FIG. 9 mounted on a mast.

FIG. 10 illustrates how arms 532 rotated and tilted to position clasp 550 over well center 30 as seen in FIG. 10. Extension of the incline actuator 552 inclines tubular clasp 550 to permit tilting of heavy tubular stands, such as large collars, and to position tubular clasp 550 properly for receiving a tubular section 81 or tubular stand 80 from catwalk 600 (also referred to herein as catwalk machine). Tubular delivery arm 500 can be raised and lowered along mast 10 with only an electronic crown winch.

Figure 11:
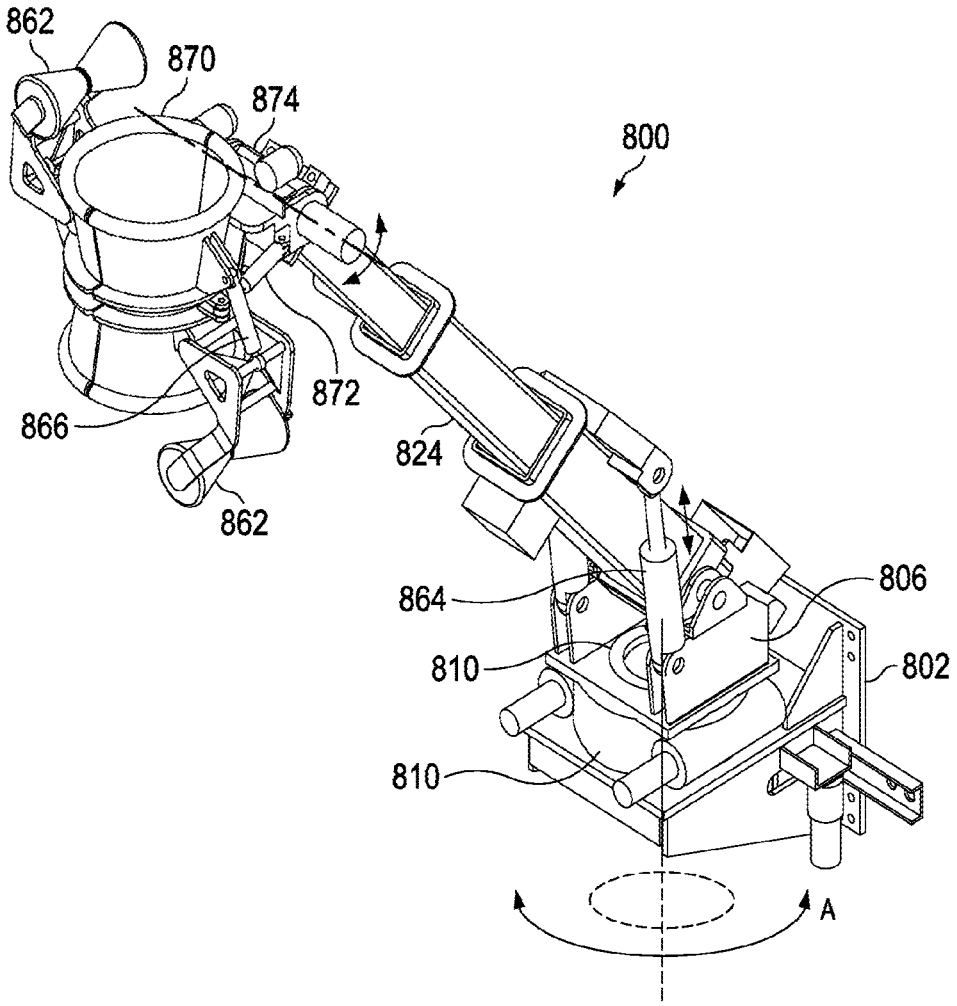
FIG. 11 is a perspective view of a lower stabilizing arm.

FIG. 11 is an isometric view of an embodiment of a lower stabilizing arm 800, illustrating the rotation, pivot, and extension of an arm 824. In this embodiment, arm 824 is pivotally and rotationally connected to a mast bracket 802. An arm bracket 806 is rotationally connected to mast bracket 802. Arm 824 is pivotally connected to arm bracket 806. A pivot actuator 864 controls the pivotal movement of arm 824 relative to arm bracket 806 and thus mast bracket 802. A rotary table 810 controls the rotation of arm 824 relative to arm bracket 806 and thus mast bracket 802. Arm 824 is extendable as shown. The operation of the various rotational and pivot controls permits placement of tubular guide 870 over center of each of a wellbore 30, a mousehole 40, and a stand hand-off position 50 of drilling rig 1.

Figure 12:
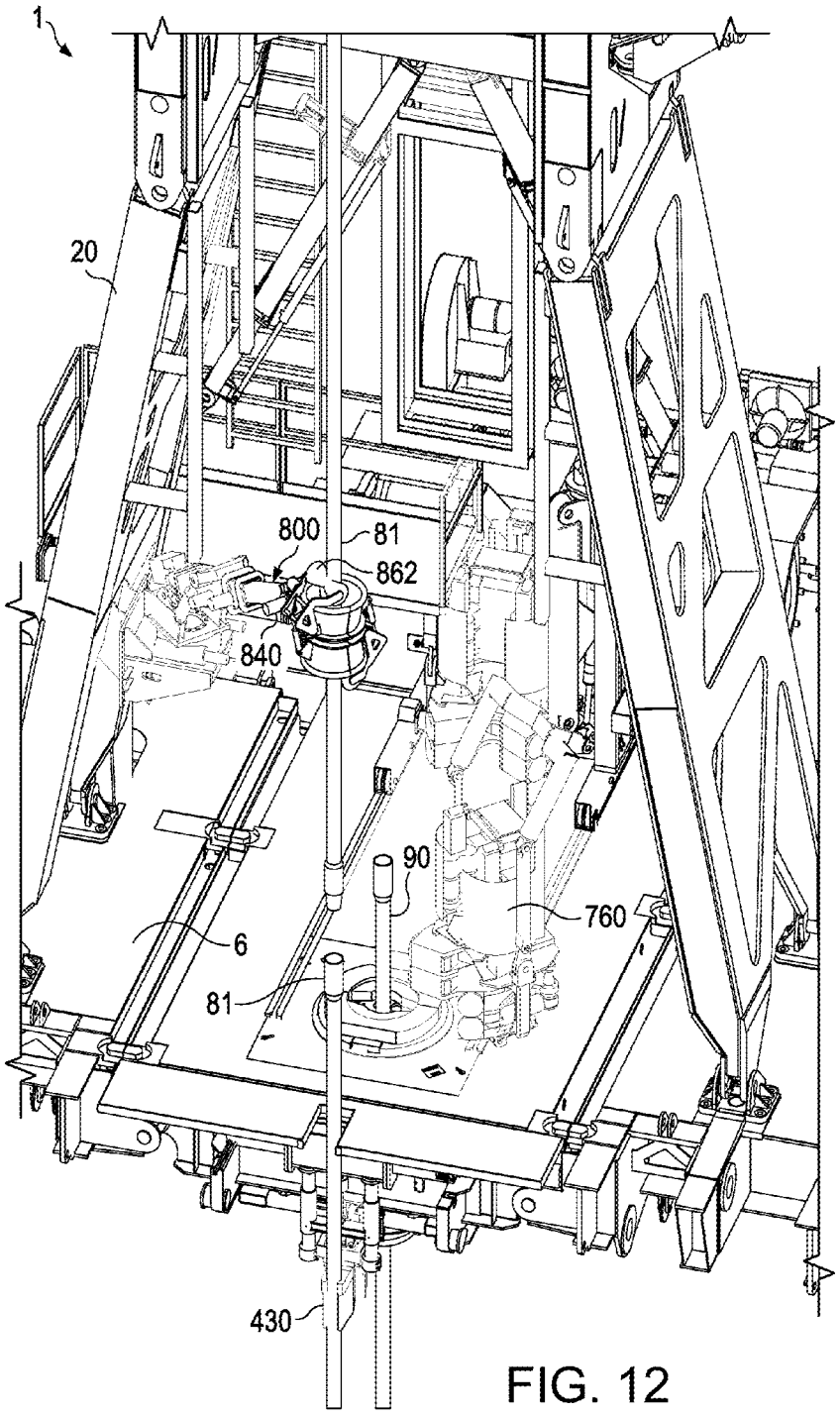
FIG. 12 is a perspective view of the drill rig floor of the drill rig shown in FIG. 1, wherein the lower stabilizing arm of FIG. 11 is positioned to stabilize tubular stands.

FIG. 12 illustrates lower stabilizing arm 800 secured to the lower end of tubular section 81 and preparing to stab it into the box connection of tubular section 81 located in mousehole 40 in a stand building procedure. In FIG. 12, tubular section 81 in mousehole 40 is secured to drill floor 6 by a tubular gripping 409 of intermediate stand constraint 430. Lower stabilizing arm 800 provides a means for locating the pin end of a hoisted tubular stand 80 into alignment with the box end of another for stabbing, or for other positional requirements such as catwalk retrieval, racking, mousehole insertion, and stand building. Lower stabilizing arm 800 can accurately position a tubular stand 80 at wellbore center 30, mousehole 40, and stand hand-off position 50 of drilling rig 1.

Figure 13:
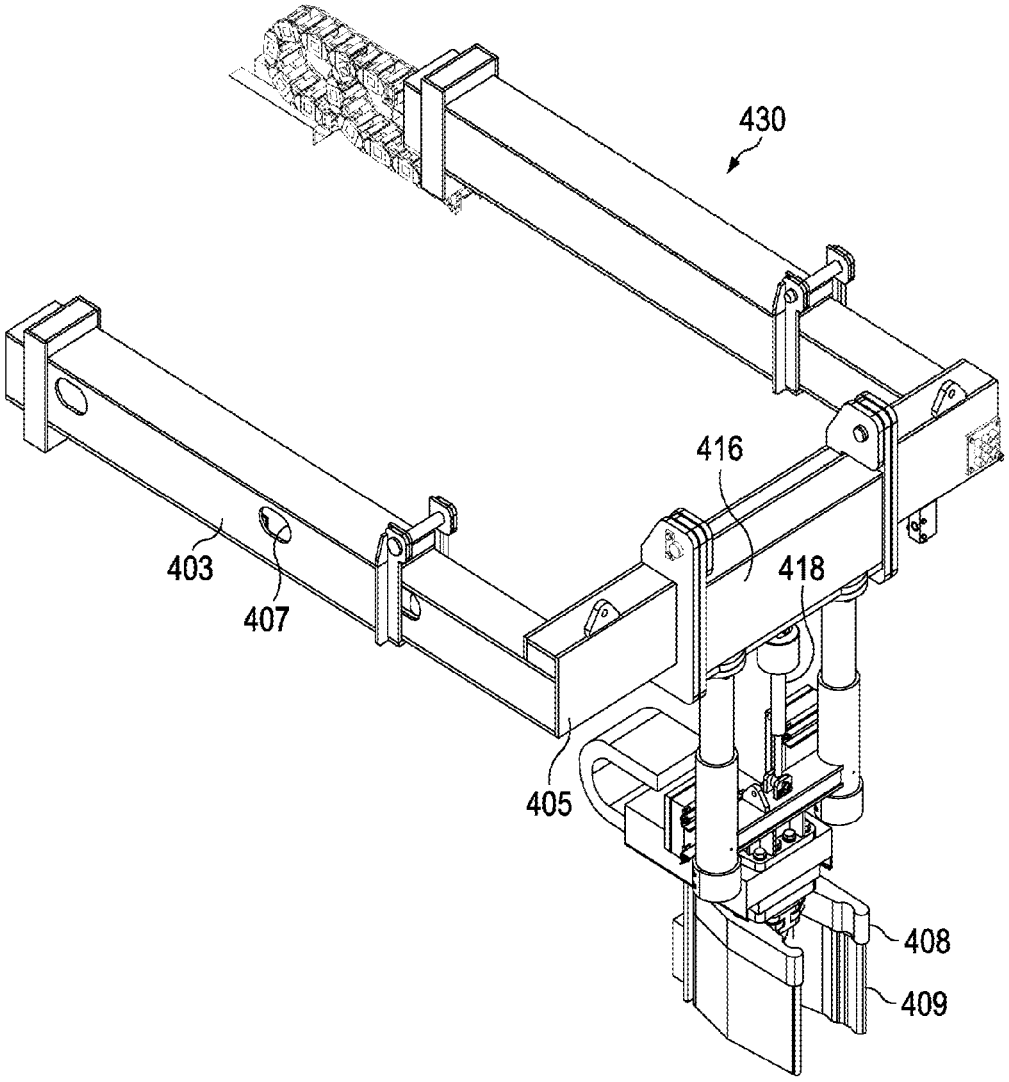
FIG. 13 is a perspective view of an intermediate stand constraint.

FIG. 13 is an isometric view of an embodiment of an intermediate stand constraint 430. Intermediate stand constraint 430 as shown can be connected at or immediately beneath drill floor 6, as illustrated in FIG. 1. Intermediate stand constraint 430 has a frame 403 that may be configured as a single unit or as a pair, as illustrated. A carriage 405 is extendably connected to frame 403. In the view illustrated, carriage 405 is extended from frame 403. A carriage actuator 407 is connected between frame 403 and carriage 405 and is operable to extend and retract carriage 405 from frame 403. A clasp 408 is pivotally connected to the end of carriage 405. A tubular gripping assembly 409 is provided and is capable of supporting the vertical load of tubular stand 80 to prevent downward vertical movement of tubular stand 80.

In operation, intermediate stand constraint 430 can facilitate stand building at mousehole 40. For example, intermediate stand constraint 430 may be used to vertically secure a first tubular section 81. A second tubular section 81 may then be positioned in series alignment by a hoisting mechanism such as the tubular delivery arm 500. With the use of an iron roughneck 760 (see FIG. 12) movably mounted at drill floor 6, the series connection between the first and second tubular sections 81 can be made to create a double tubular stand 80. Gripping assembly 409 can then be released to permit the double tubular stand 80 to be lowered into mousehole 40. Gripping assembly 409 can then be actuated to hold double tubular stand 80 in centered position, as a third tubular section 81 is hoisted above and stabbed into double tubular section 81. Once again, iron roughneck 760 on drill floor 6 can be used to connect the third tubular section 81 and form a triple tubular stand 80.

Figure 14:
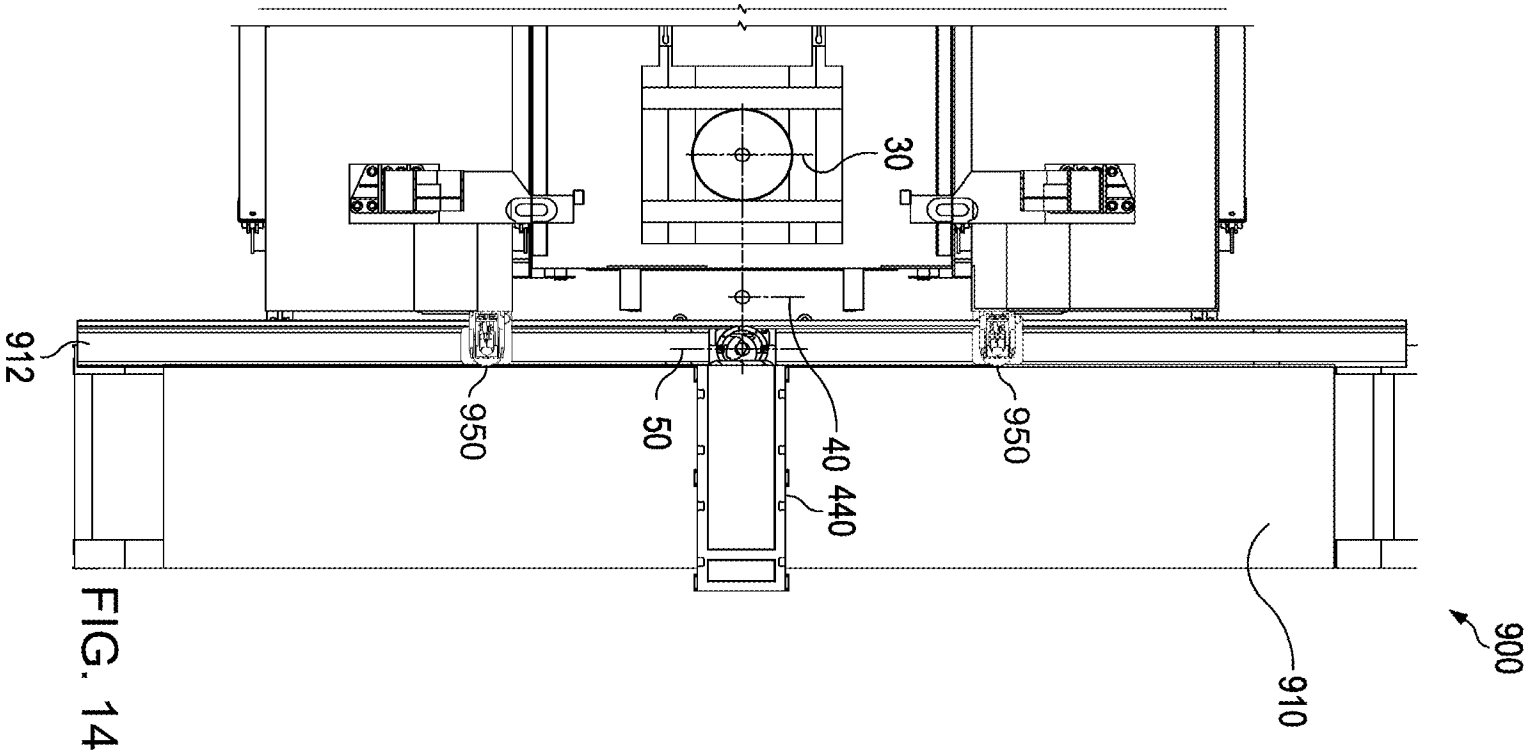
FIG. 14 is a top view of a drill floor and setback, wherein a lower stand constraint and setback guide arms are shown, and wherein the positions of the well center, stand handoff position and mousehole are identified.

FIG. 14 is a top view of setback platform 900 on which the tubular stands 80 are stacked in accordance with their respective positions in the fingerboard assembly 310. Drilling rig 1, catwalk 600 and tubular stands 80 are removed for clarity. This embodiment illustrates the relationship between well center 30, mousehole 40, and stand hand-off position 50. As seen in this view, an alleyway 912 is provided on the front edge of setback platform 900. Stand hand-off position 50 is located in alleyway 912, in alignment with mousehole 40 and well center 30. A lower stand constraint 440 is positioned in the center of the setback platform 900.

Figure 15:
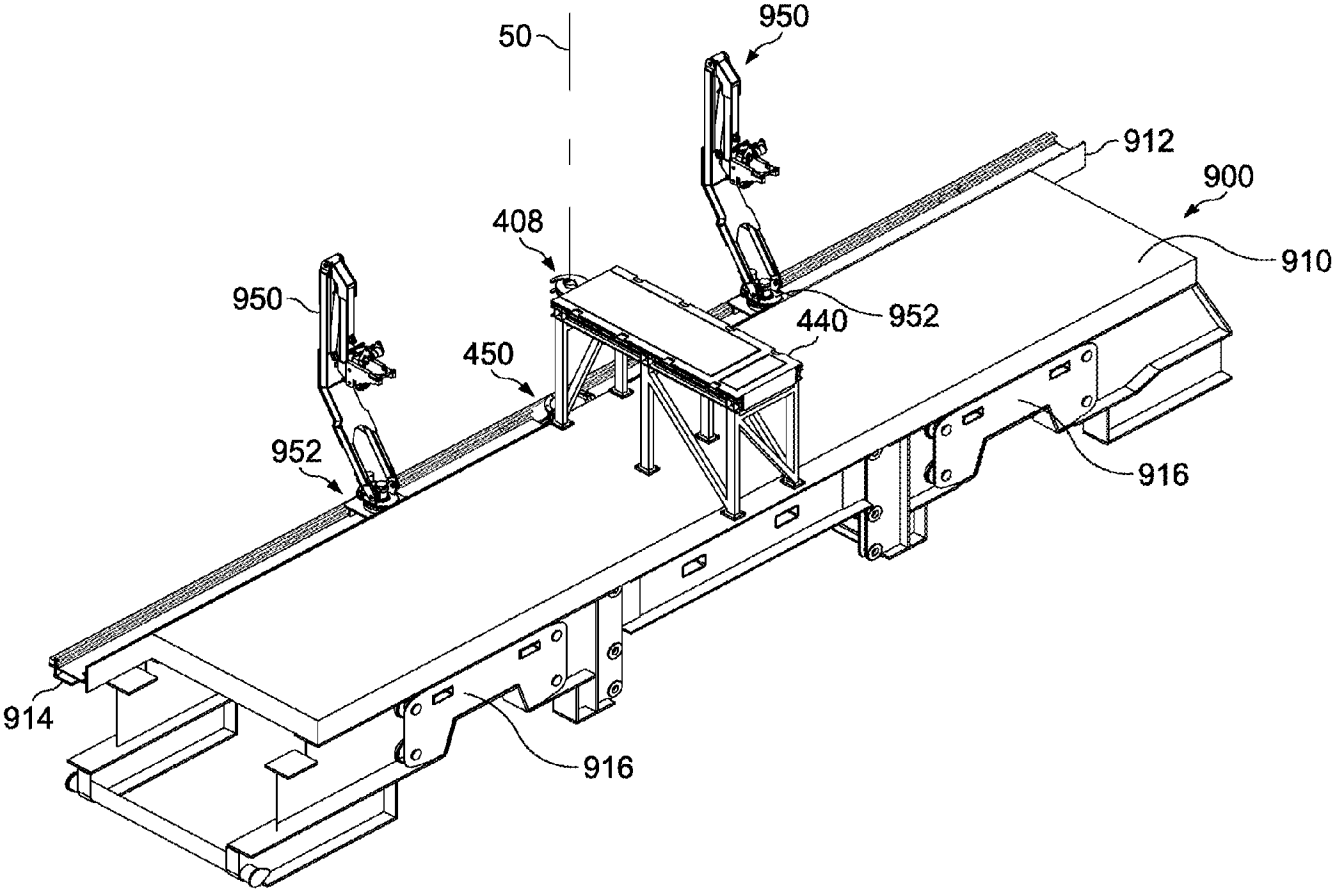
FIG. 15 is a perspective view of a setback with a lower stand constraint, and two setback guide arms.

FIG. 15 is an isometric view of the setback platform 900, wherein two lower setback guide arms 950 are shown located in alleyway 912. Alleyway 912 is offset below platform 910. Stand hand-off position 50 is located on alleyway 912. A geared rail 914 is affixed to alleyway 912. Each lower setback guide arm 950 has a base 952 translatably connected to the rail 914. The lower stand constraint 440 has a clasp 408 for engaging pipe stands 81 in the stand hand-off position 50.

Figure 16:
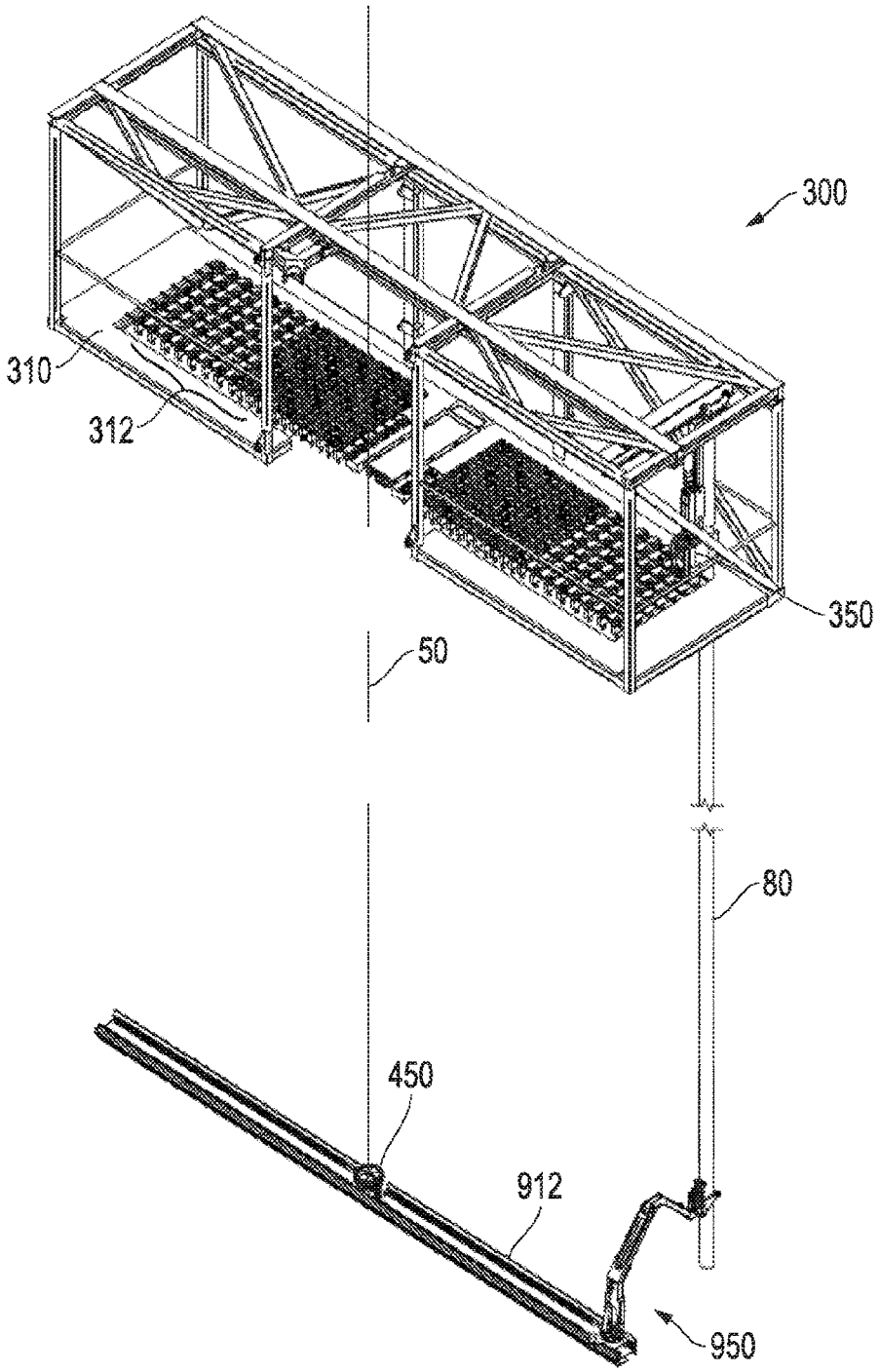
FIG. 16 is a perspective view of a fingerboard and a lower setback guide arm, wherein the stand handoff position is identified.

FIG. 16 is an isometric view illustrating tubular stand 80 supported vertically by transfer bridge racker 350 and held at its lower end by setback guide arm 950, and extended to its designated racking position.

(I) Sequence for Tripping in Drill Pipe

The initial equipment configuration for the tripping in drill pipe sequence is as follows:

- The top drive 200 is in a lower position on the well center axis 30, and the elevator is closed around a stand of drill pipe 80.
- The stand of drill pipe 80 is suspended in a spider in the rig floor 6 so that approximately 1.2 m/4 ft of drill string sticks up from the rig floor 6.
- One stand of drill pipe 80 is being lifted by the tubular delivery arm 500 and the lower stabilizing arm 800 from the stand hand-off position 50 to a stickup level about the mouse hole 40, the elevator is facing the top drive, and the drill floor is on stand by.
- The stand hand-off position is empty, and both the upper stand constraint and the lower stand constraint are open and retracted.
- The transfer bridge racker 350 and setback guide arms 950 are empty and on their way to pick up a new stand of drill pipe from the fingerboard.

The sequence for tripping in drill pipe comprises the following steps.

Figure 17A:
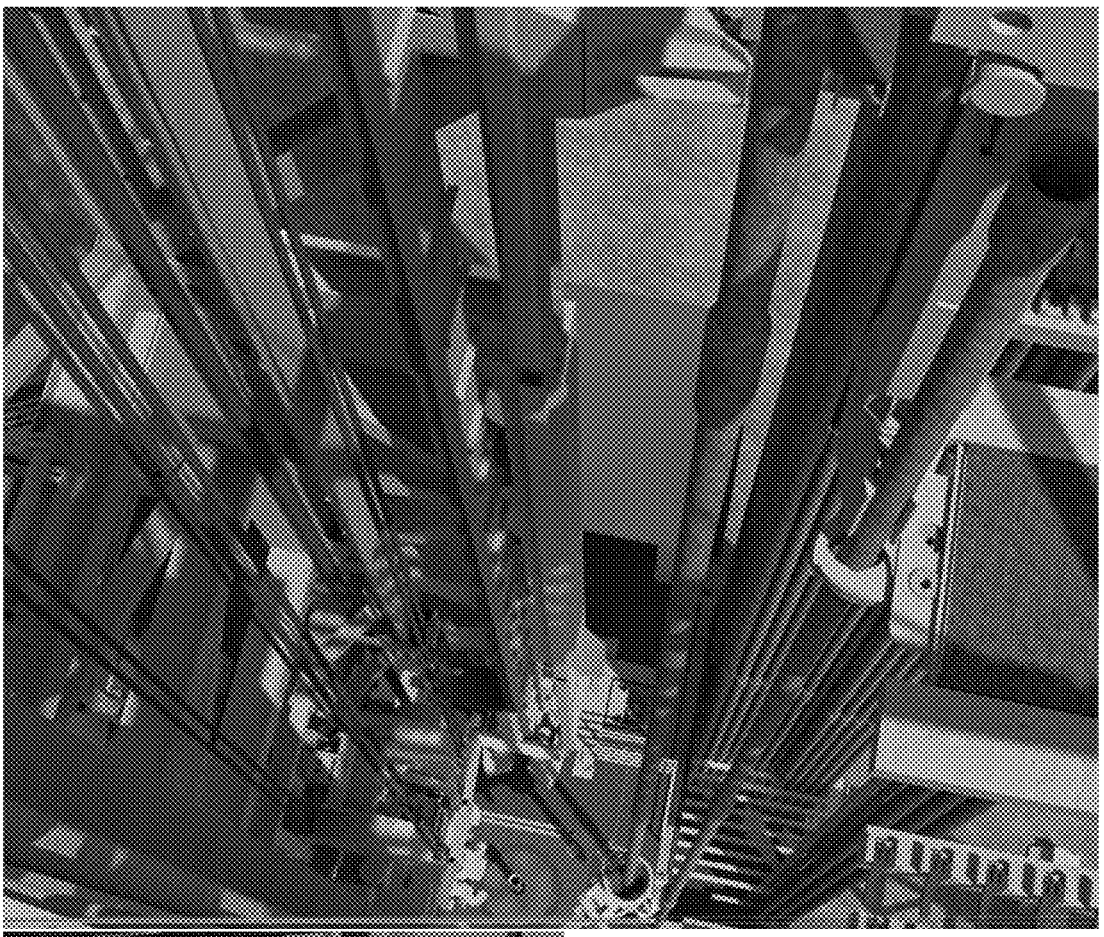
FIGS. 17A and 17B illustrate the top drive elevator being opened, the trolley being retracted and the top drive moved to its upper stop.
Figure 17B:
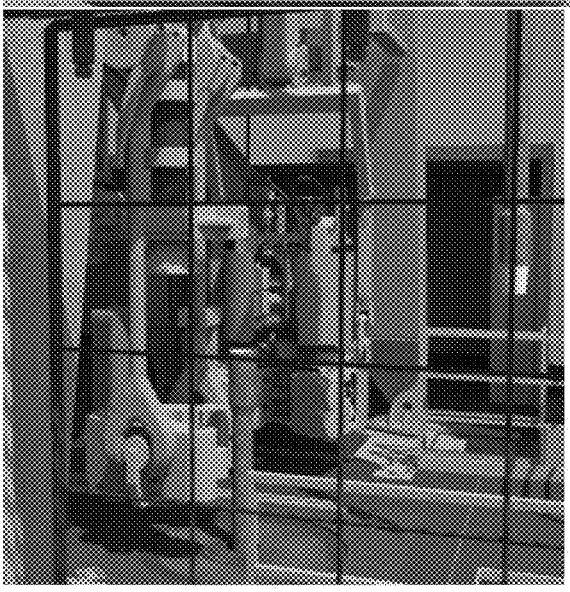

Step 1: Release the drill string and move the top drive. The top drive elevator is opened to release the drill string stickup, and the top drive is hoisted to an upper stop in the mast 10. As shown in FIG. 17B, the top drive elevator is released from the drill string stickup. As shown in FIG. 17A, the top drive 200 is being hoisted toward the top of the mast 10.

Figure 18A:
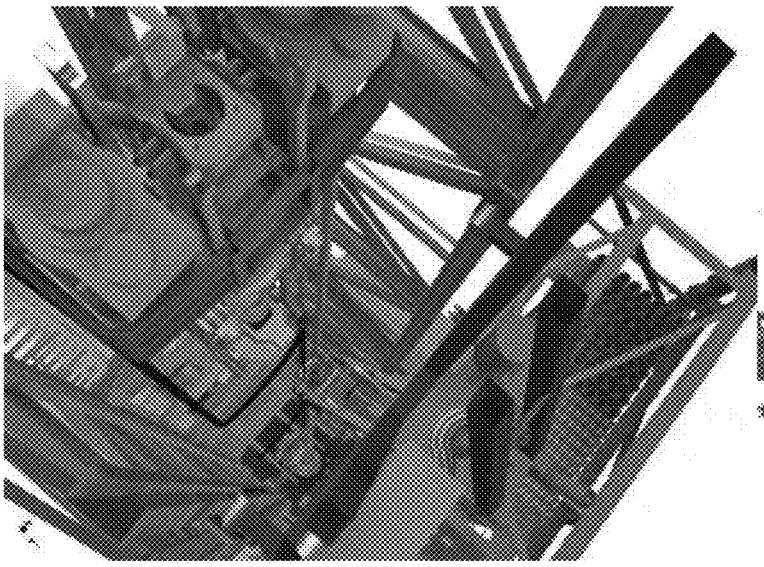
FIGS. 18A and 18B illustrate the tubular delivery arm moving a stand to the well center.
Figure 18B:
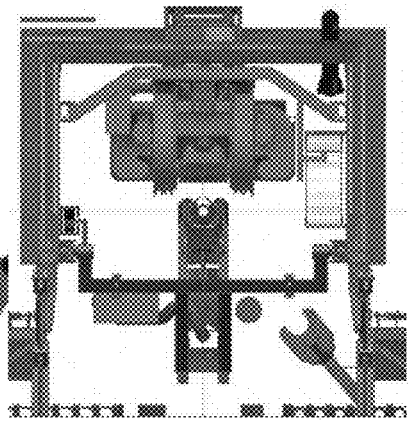

Step 2: Move a stand to the well center. The tubular deliver arm 500 and the lower stabilizing arm 800 move a pipe stand 80 from a stand by position at the drill floor 6 to the well center 30, as shown in FIGS. 18A and 18B. The selected iron roughneck 760 moves to the well center to make-up the connection.

Figure 19A:
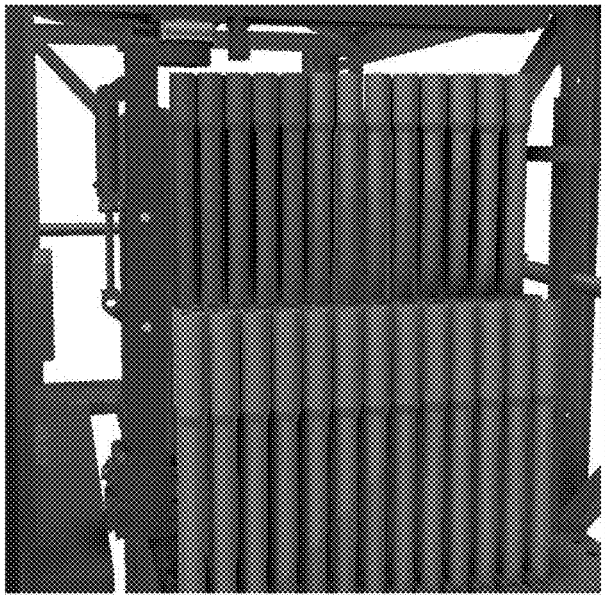
FIGS. 19A and 19B illustrate picking up a tubular stand from the setback.
Figure 19B:
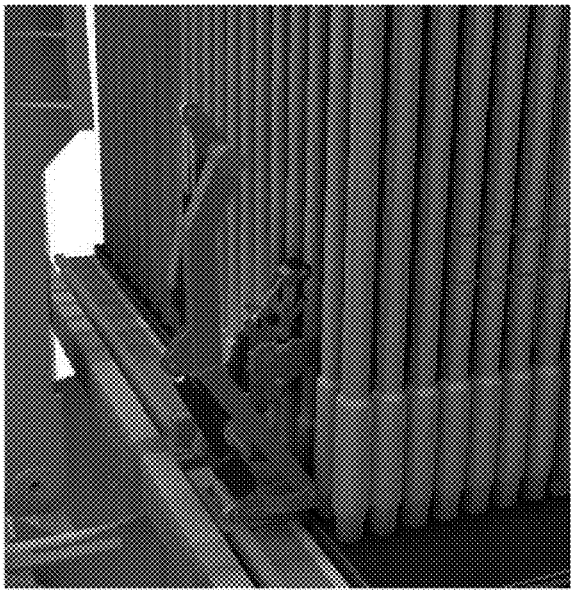

Step 3: Pick up a new stand. The transfer bridge racker 350 and a setback guide arm 950 pick up a tubular stand 80 from setback platform 900, as shown in FIGS. 19A and 19B.

Figure 20A:
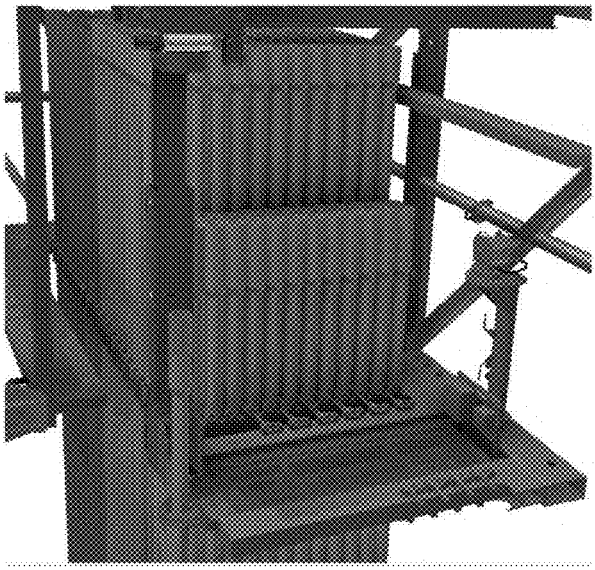
FIGS. 20A-20C illustrate moving the tubular stand to the stand handoff position.
Figure 20B:
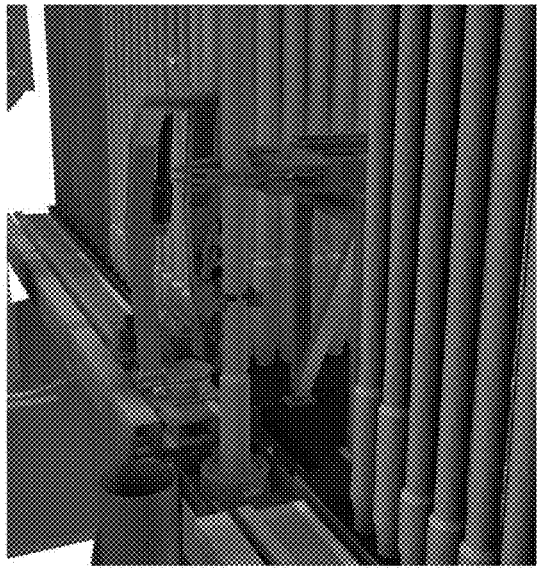
Figure 20C:
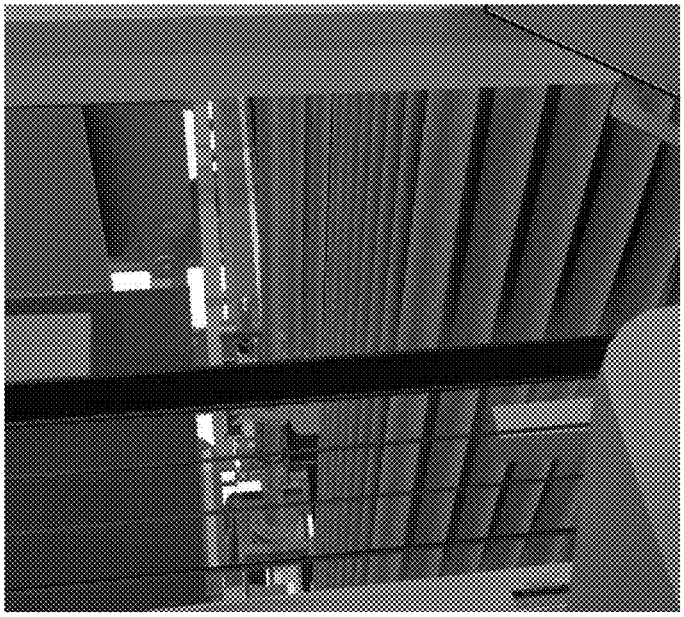

Step 4: Move the new stand to the stand hand-off position. The transfer bridge racker 350 and the setback guide arm 950 move the new stand and position it at the stand hand-off position 50, as shown in FIGS. 20A and 20B. The upper stand constraint 420 and the lower stand constraint 440 close their clasps 408 to hold the new stand 81 at the stand hand-off position 50. See FIGS. 20A and 20B. The doper integrated in the stand hand-off position 50 washes and dopes the pin end of the pipe stand 81. See FIG. 20C. The transfer bridge racker 350 and the setback guide arm 950 return to the fingerboard 310 to pick of the next stand.

Figure 21A:
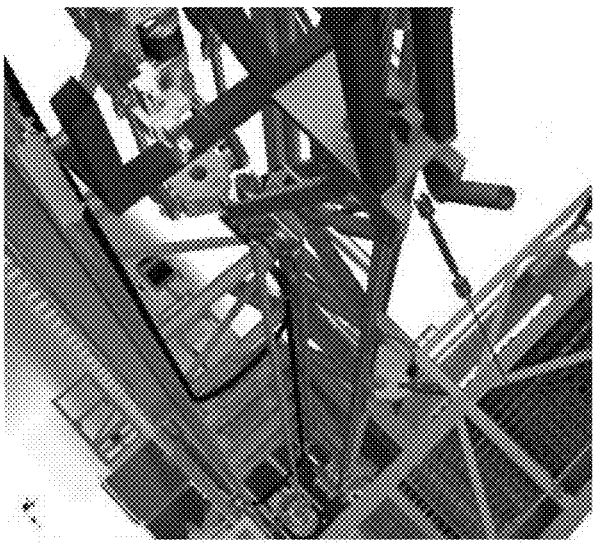
FIGS. 21A and 21B illustrate stabbing a stand at the well center and making up the connection.
Figure 21B:
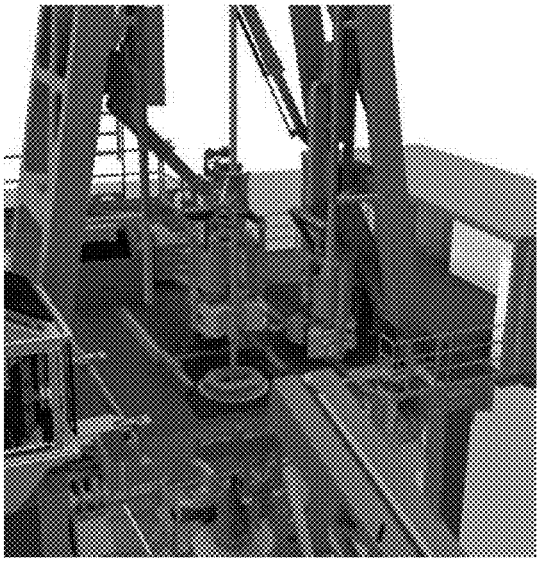

Step 5: Move the new stand to the well center and make-up connection to drill string. The top drive is retracted away from the well center 30 on its way up the mast 10. A roughneck and stabbing guide engage with the drill string stick-up at the well center 30 to assist with the stabbing of the next stand. The tubular deliver arm 500 and the lower stabilizing arm 800 pick up the next stand from the stand hand-off position 50 and move it to the well center 30. See FIGS. 21A and 21B. The tubular deliver arm 500 and the lower stabilizing arm 800 then lower the new stand and continue approximately 2 m/6 ft after stabbing the tubular, to allow room for the top drive elevator. The lower stabilizing arm 800 opens and retreats from the well center 30. The iron roughneck 760 spins and torques to make-up the connection between the new stand and the drill string.

Figure 22A:
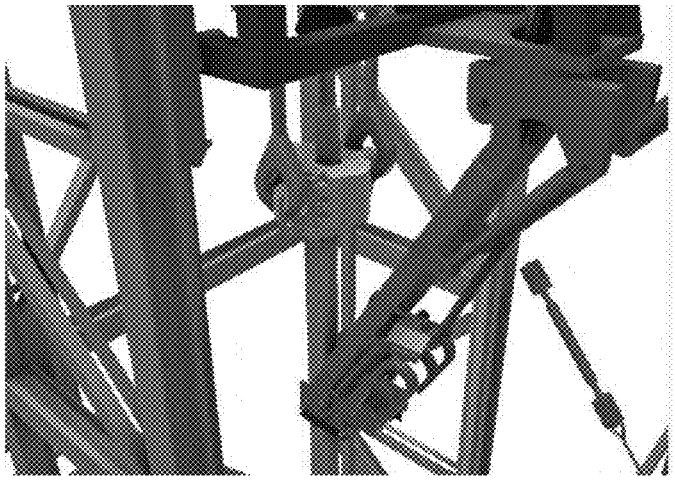
FIGS. 22A and 22B illustrate latching the top drive elevator to the tubular string.
Figure 22B:
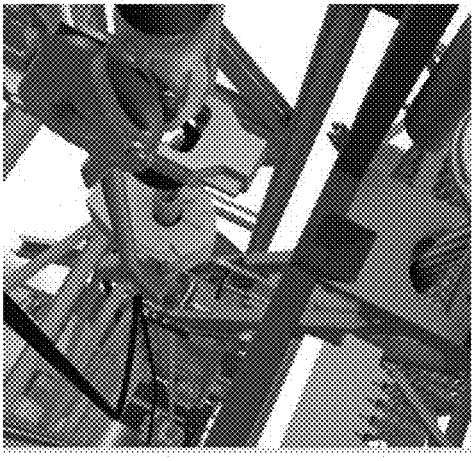

Step 6: Latch top drive elevator to drill string. With the top drive at the correct elevation, the top drive moves to the well center 30 and the elevator closes around the drill string. See FIGS. 22A and 22B. The tubular delivery arm 500 opens and retracts from the well center. Both the tubular delivery arm 500 and the lower stabilizing arm 800 move to pick up the next stand at the stand hand-off position 50. The iron roughneck 760 opens and returns to a standby position relative to the rig floor 6.

Figure 23:
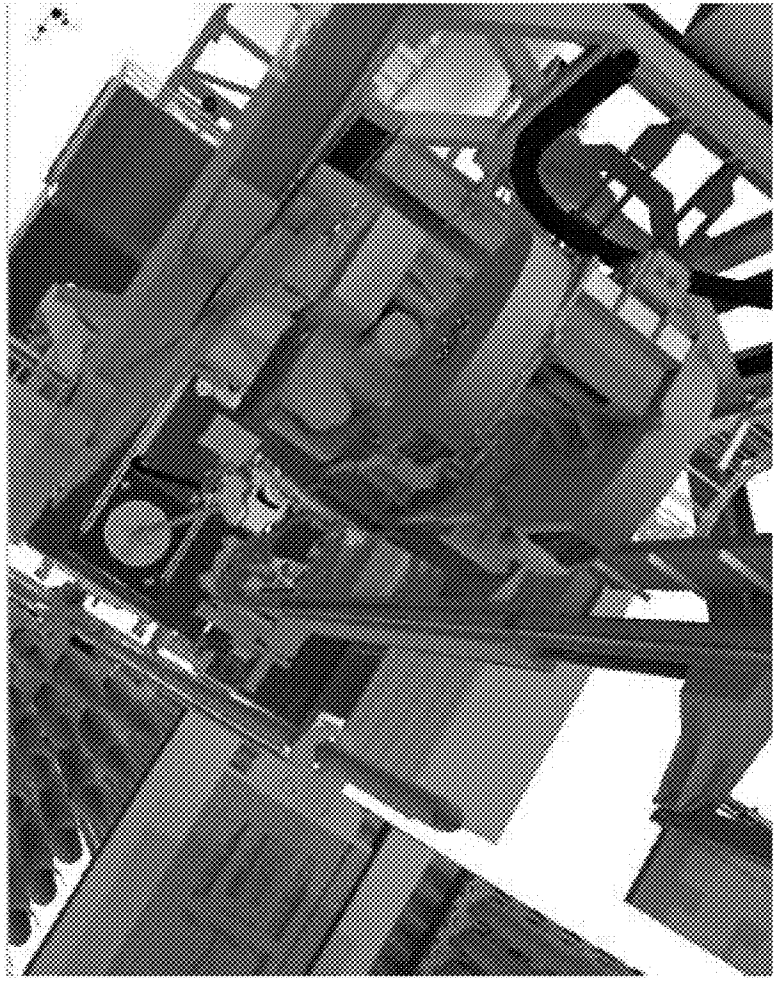
FIG. 23 illustrates opening the slips and lowering the tubular string.

Step 7: Open slips and lower drill string. The top drive and drawworks hoist to pick up the drill string weight and the slips at the spider are opened. The drill string is then lowered into the wellbore via the top drive. See FIG. 23. Both the tubular delivery arm 500 and the lower stabilizing arm 800 engage the new stand at the stand hand-off position 50. The upper and lower stand constraints 420 and 440 open and retract from the new stand. The new stand is lifted (approximately 9 m/30 ft) by the tubular delivery arm 500 and guided by the lower stabilizing arm to the drill floor 6. The top box of the stand can be doped by the tubular delivery arm 500, if desired. When the top drive has run the drill string into the borehole, the spider slips are set with the drill string at about 1.2 m stickup.

(II) Sequence for Tripping Out Drill Pipe

The initial equipment configuration for the tripping out drill pipe sequence is as follows:

- The top drive 200 is in a lower position on the well center axis 30, and the elevator is closed around a stand of drill pipe 80.

The stand of drill pipe 80 is suspended in a spider in the rig floor 6 so that approximately 1.2 m/4 ft of drill string sticks up from the rig floor 6.

The tubular delivery arm 500 and the lower stabilizing arm 800 are open at the stand hand-off position 50 and have started moving toward the drill floor 6.

A stand of drill pipe is in the stand hand-off position 50, and both the upper stand constraint 420 and the lower stand constraint 440 are clasping the stand.

The transfer bridge racker 350 and setback guide arms 950 are empty and on their way from the fingerboard to get the stand of drill pipe in the stand hand-off position 50.

The sequence for tripping out drill pipe comprises the following steps.

Figure 24A:
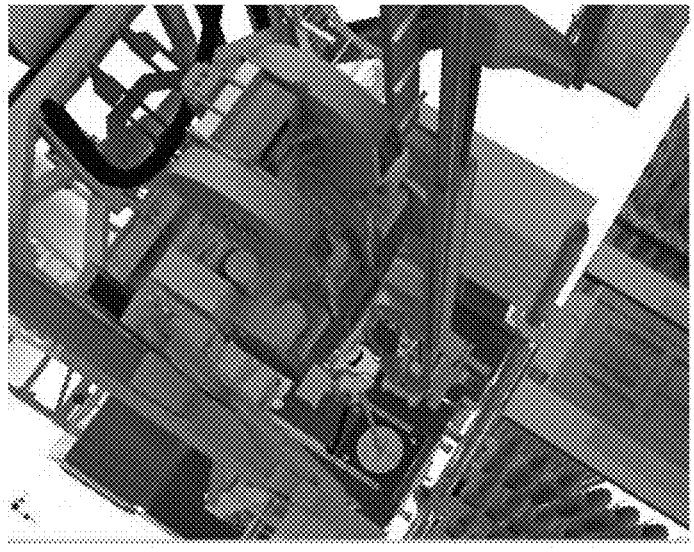
FIGS. 24A and 24B illustrate opening the slips and hoisting the tubular string, moving the tubular delivery arm to the drill floor.
Figure 24B:
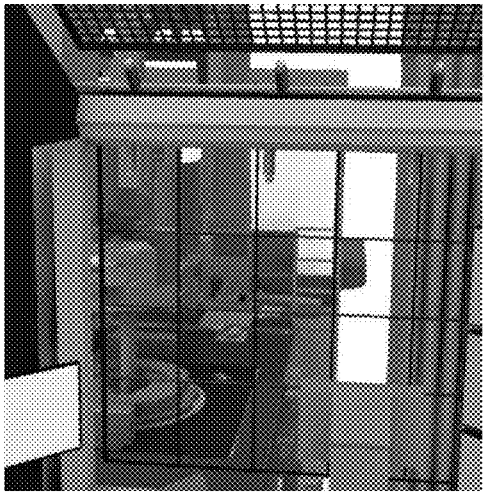

Step 1: Open slips and hoist drill string with top drive. The spider slips are opened and the drill string is hoisted via the top drive and drawworks to an upper stop in the mast 10, as shown in FIG. 24A, so that approximately 1.2 m drill string stickup will remains after break-out. The spider slips are set and the weight of the drill string is set on the slips. The tubular delivery arm 500 starts moving from the stand hand-off position 50 to a position above the drill floor. A roughneck 760 moves to the well center 30 to engage the drill string.

Figure 25A:
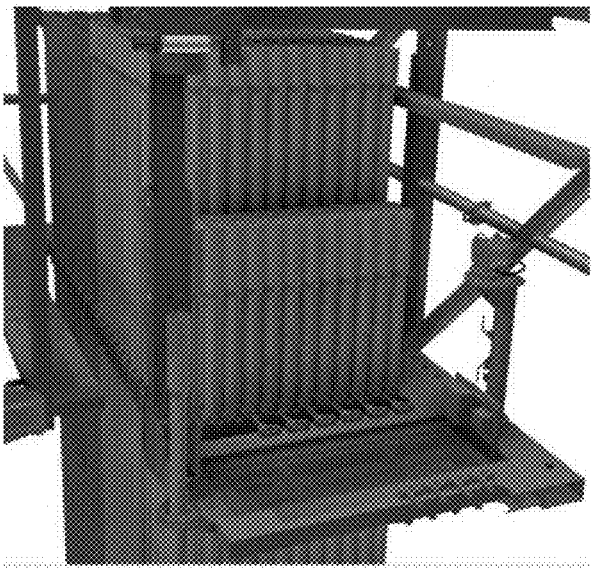
FIGS. 25A and 25B illustrate moving the stand from the stand handoff position to the fingerboard.
Figure 25B:
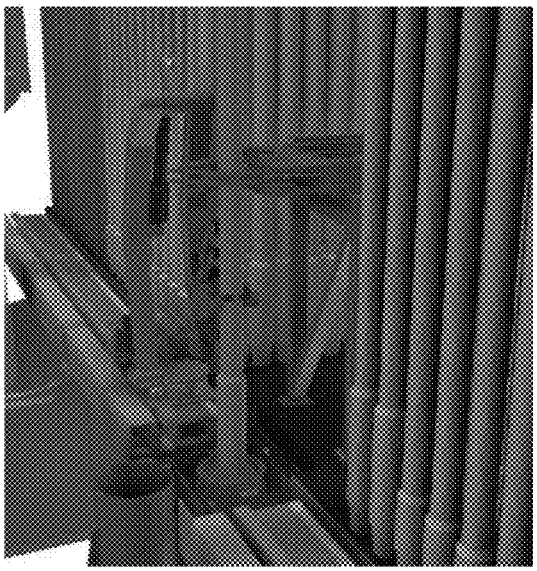

Step 2: Move a stand from the stand hand-off position to the fingerboard. The transfer bridge racker 350 and setback guide arm 950 move to the stand in the stand hand-off position 50 and close their clamps and guides. The upper stand constraint 420 and the lower stand constraint 440 open their clasps 408 to release the stand 81 at the stand hand-off position 50, and the clasps retract from the stand. The transfer bridge racker 350 and setback guide arm 950 lift the stand and move it to a selected position in the fingerboard 310. See FIGS. 25A and 25B.

Figure 26A:
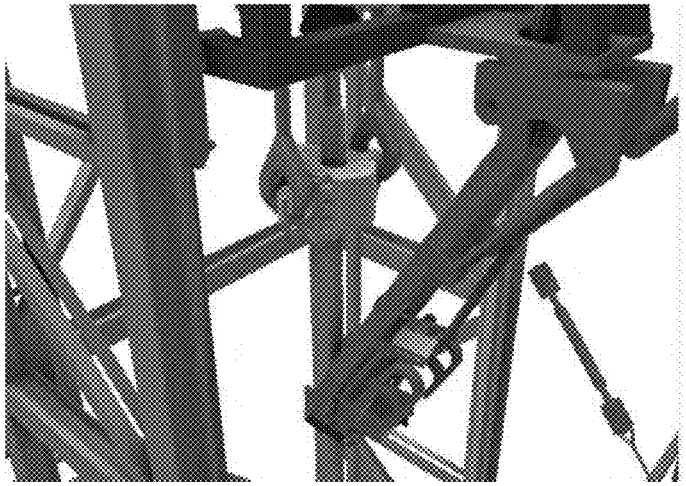
FIGS. 26A and 26B illustrate moving the tubular delivery arm, the lower stabilizing arm and the roughneck to the stand in the well center.
Figure 26B:
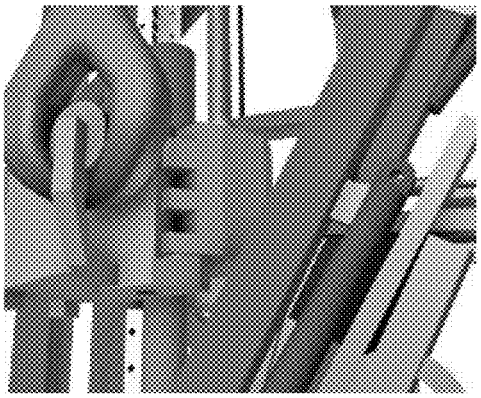

Step 3: The tubular delivery arm, lower stabilizing arm, and rough neck move to the well center. The roughneck 760 moves to the well center 30 and elevates to a proper elevation to engage the drill string for break-out of the connection. The tubular delivery arm 500 and the lower stabilizing arm 800 move to the well center 30 from the stand hand-off position 50. The tubular delivery arm 500 extends and closes its clamp on the drill string below the top drive elevator, as shown in FIGS. 26A and 26B.

Figure 27:
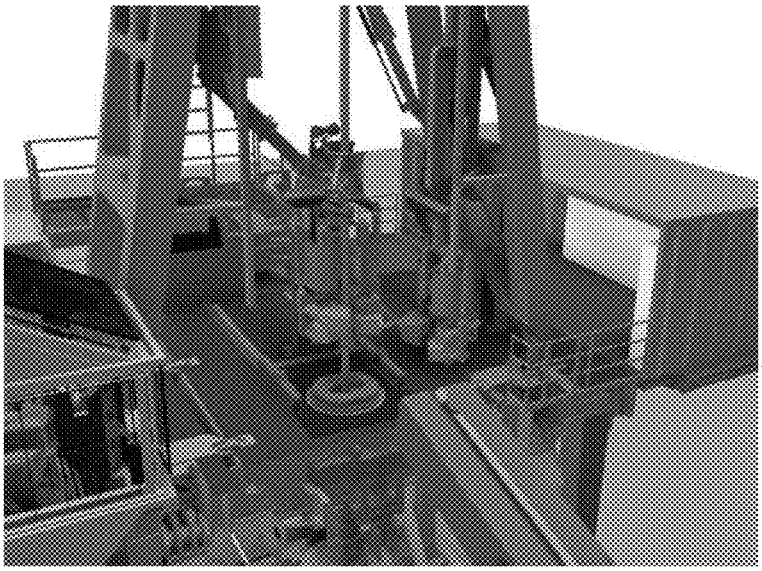
FIG. 27 illustrates opening the top drive elevator and breaking out the stand with the roughneck.

Step 4: The elevator opens and the roughneck breaks the connection. The top drive elevator opens to release the drill string, and the top drive 200 retracts from the well center position to a retracted position. The top drive begins to travel back down the mast. The roughneck 760 breaks-out the joint and spin out the threads between the stand and the drill string, so as to leave a stickup of drill string at the drill floor. See FIG. 27.

Figure 28A:
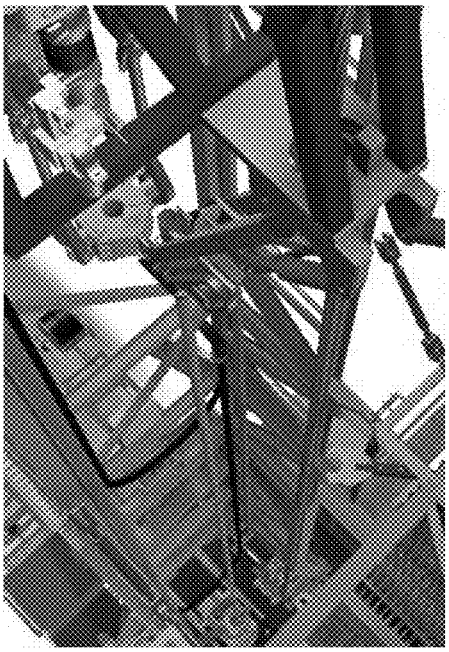
FIGS. 28A and 28B illustrate moving the stand from the well center to the stand handoff position with the tubular delivery arm and the lower stabilizing arm while the top drive lowers to the stickup.
Figure 28B:
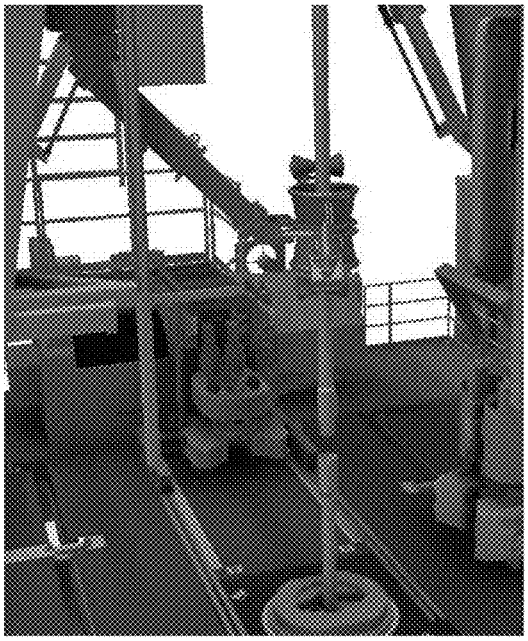

Step 5: Move the stand from the well center to the stand hand-off position while top drive lowers to stickup. The top drive is retracted away from the well center 30 on its way down the mast 10. A roughneck opens and retracts from the drill string stick-up at the well center 30 to a standby position on the drill floor. The tubular deliver arm 500 and the lower stabilizing arm 800 pick up the broken-out stand at the well center 30, lift it off the stickup, and move it to the stand hand-off position 50. See FIGS. 28A and 28B.

Figure 29:
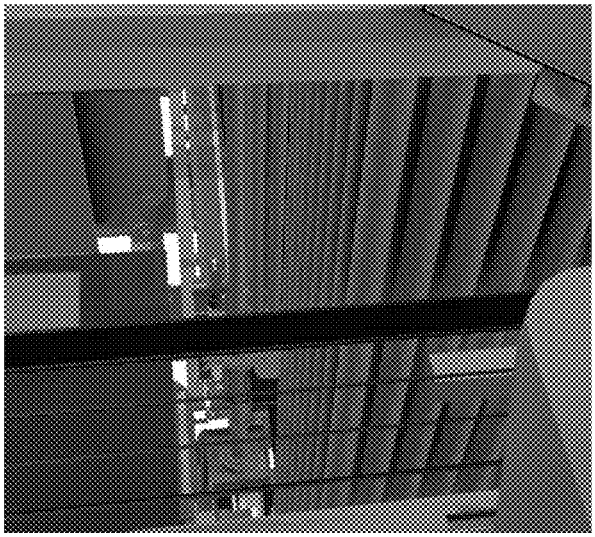
FIG. 29 illustrates extending the top drive and latching the elevator on the stickup, while the upper and lower stand constraints grip the stand at the stand handoff position.

Step 6: Latch top drive elevator to drill string and hand-off the broken-out stand. With the top drive at the correct elevation relative to the drill string stickup, the top drive moves to the well center 30 and the elevator closes around the drill string. The tubular delivery arm 500 and the lower stabilizing arm 800 position the stand on the stand hand-off position 50. The upper and lower stand constraints 420 and 430 close to hold the stand. The doper integrated in the stand hand-off position washes and dopes the pin of the stand. See FIG. 29.

Figure 30A:
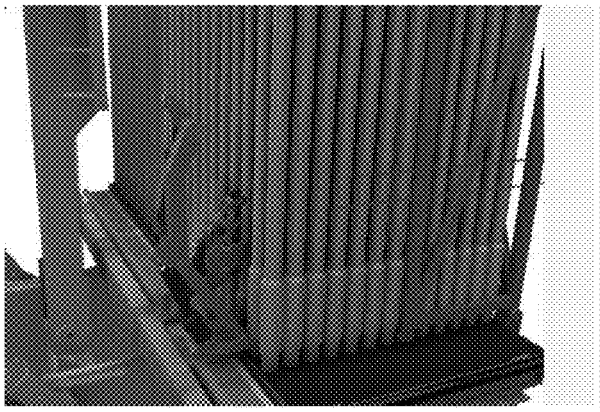
FIGS. 30A and 30B illustrate moving the stand to the setback via the transfer bridge racker and the setback guide arm.
Figure 30B:
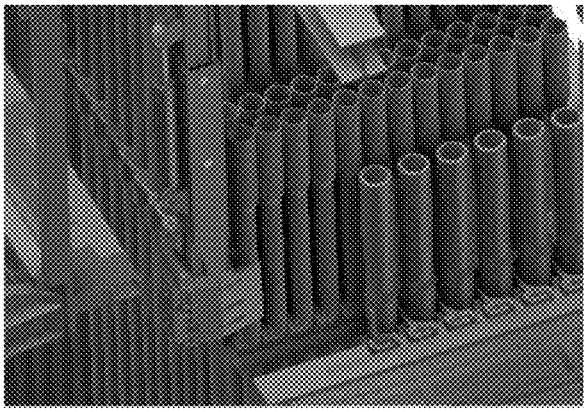

Step 7: The transfer bridge racker and the setback guide arm setback stand. The transfer bridge racker 350 and the setback guide arm 950 set back the stand in the fingerboard 310. The fingerboard 310 latches close around the stand. The transfer bridge racker 350 and the setback guide arm 950 and return to the stand hand-off position 50. See FIGS. 30A and 30B.

(III) Sequence for Tripping Out Drill String Wet

The initial equipment configuration for the tripping out wet is the same as described above for tripping out drill pipe.

The sequence for tripping out wet is very similar to the sequence for tripping out drill pipe described above. In fact, steps 1-4 and 6-7 are identical.

Figure 31A:
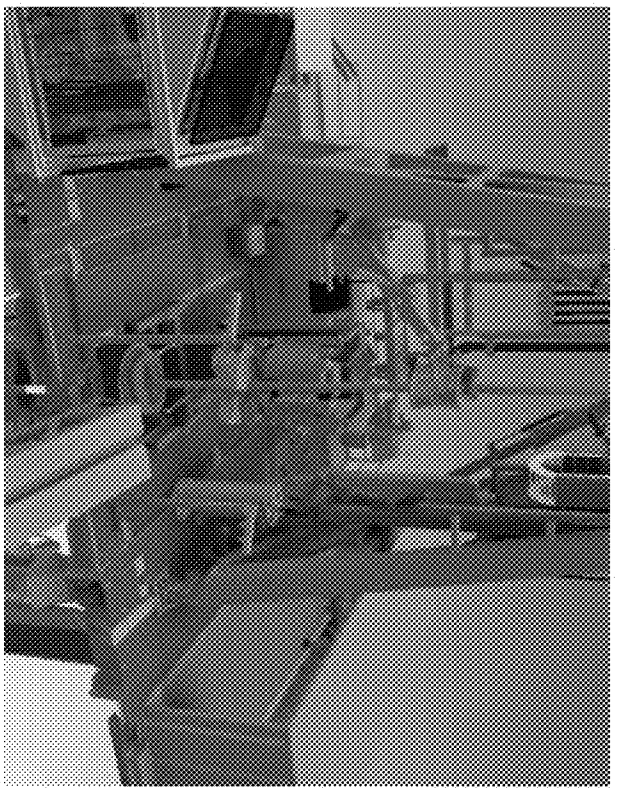
FIGS. 31A and 31B illustrate breaking out a joint for a tripping out wet operation and using a mud bucket to drain the stand.
Figure 31B:
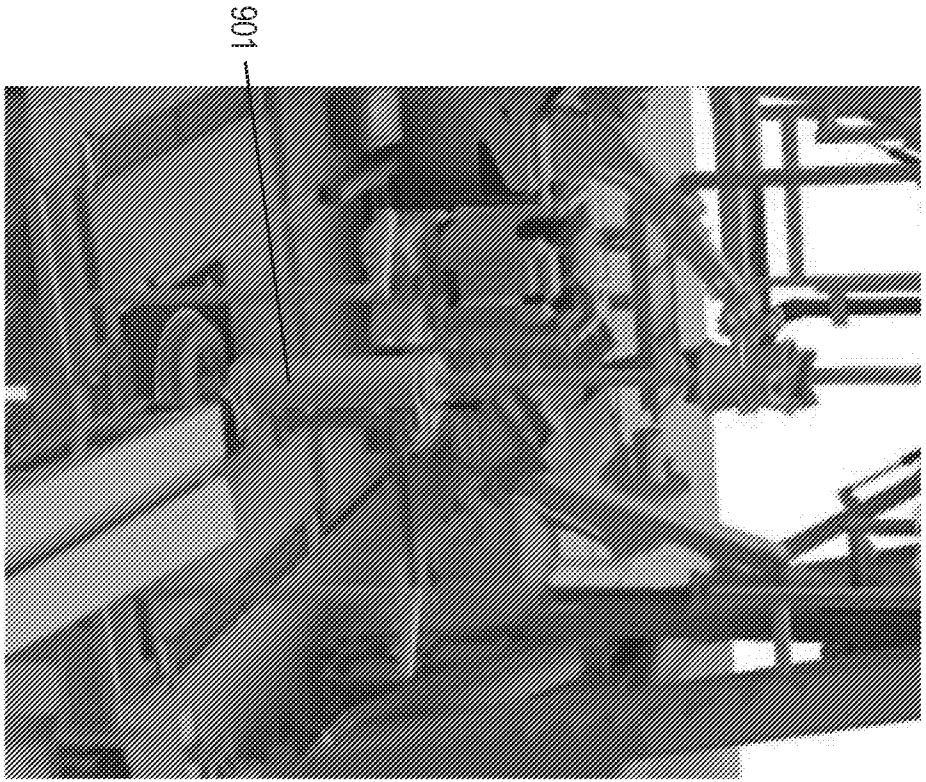

Step 5: Mud bucket 901 extends to well center and the broken-out stand is lifted off the drill string stick-up. A roughneck opens and retracts from the drill string stick-up at the well center 30 to a standby position on the drill floor. See FIG. 31A. The mud bucket 901 extends to the well center and closes on the broken-out connection. The tubular deliver arm 500 and the lower stabilizing arm 800 pick up the broken-out stand at the well center 30 and lift it off the stickup. See FIG. 31B. The fluid in the stand is captured by the mud bucket 901. The mud bucket 901 opens and retracts from the well center to its standby position. The tubular deliver arm 500 and the lower stabilizing arm 800 move the broken-out stand to the stand hand-off position 50.

(IV) Sequence for Tripping in Casing Stands Wet

A sequence for tripping out casing wet is the same as the sequence for tripping out drill stands wet.

(V) Sequence for Tripping in Casing Stand S with No Casing Running Tool

The initial equipment configuration for the casing stand tripping in sequence is the same as described above for tripping in drill pipe.

The sequence for tripping in casing is very similar to the sequence for tripping in drill pipe described above. In fact, steps 1-4 and 6-7 are identical.

Figure 32A:
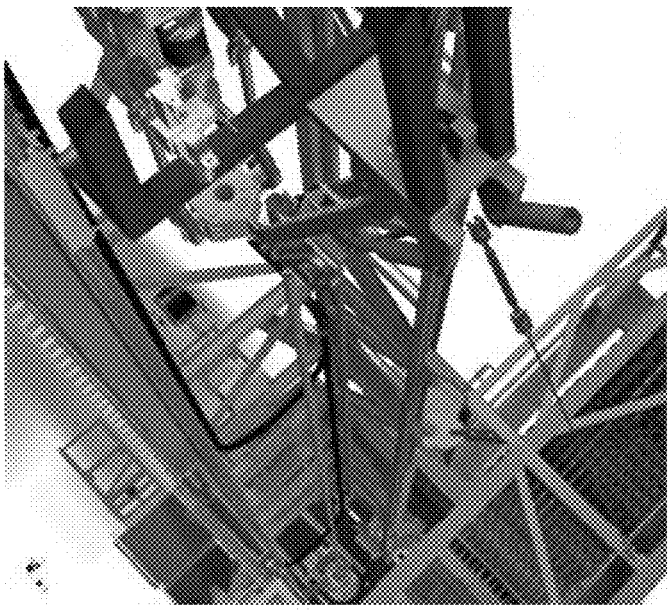
FIGS. 32A and 32B illustrate making up a casing joint connection via a casing tong.
Figure 32B:
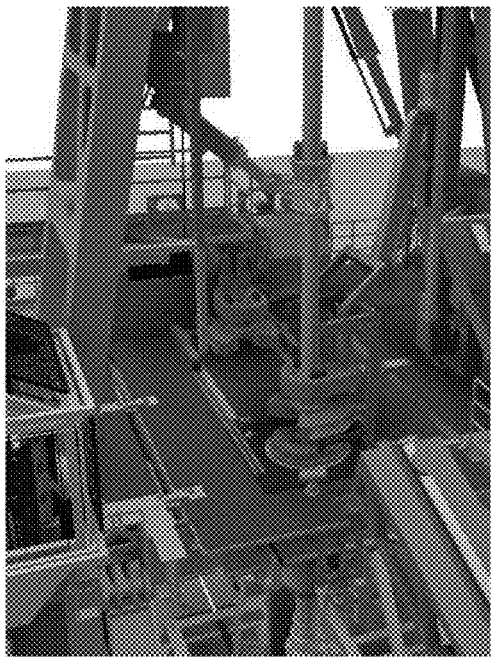

Step 5: The connection is made up by the casing tong on the tong handling arm. See FIGS. 32A and 32B.

(VI) Sequence for Tripping in Drill Collar Stands

The initial equipment configuration for the tripping in drill collar stands sequence is as follows:

The top drive 200 is in a lower position on the well center axis 30, and the elevator is closed around collar stick-up.

The stand of drill pipe 80 is suspended in a spider in the rig floor 6 so that approximately 1.2 m/4 ft of drill string sticks up from the rig floor 6.

One drill collar stand is in the stand hand-off position 50, held in position by the closed clasps of the upper and lower stand constraints 420 and 440.

The lower stabilizing arm 800 is empty and ready to pick up the drill collar stand from the stand hand-off position.

The tubular delivery arm 500 is parked at a high elevation, out of the way, because it is not to be used in the sequence for drill collar stands.

The transfer bridge racker 350 and setback guide arms 950 are empty and on their way to pick up a new drill collar stand from the fingerboard.

The sequence for tripping in drill collar comprises the following steps.

Figure 33A:
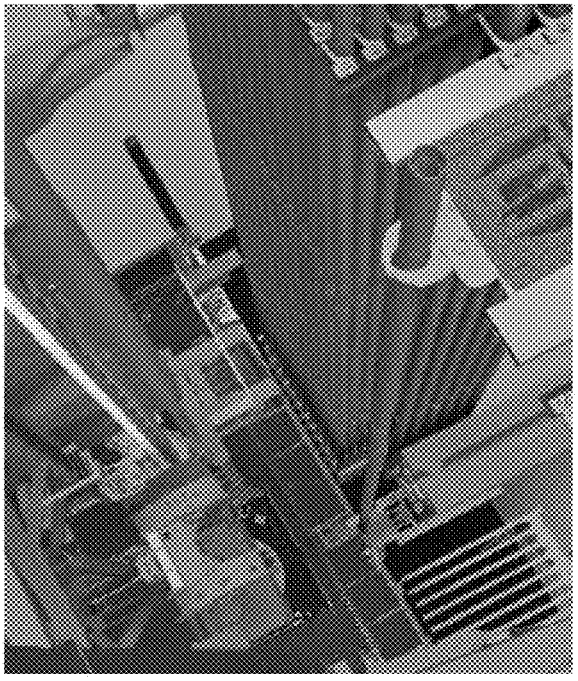
FIGS. 33A and 33B illustrate drill collar tripping where the top drive elevator is opened to release the stickup.
Figure 33B:
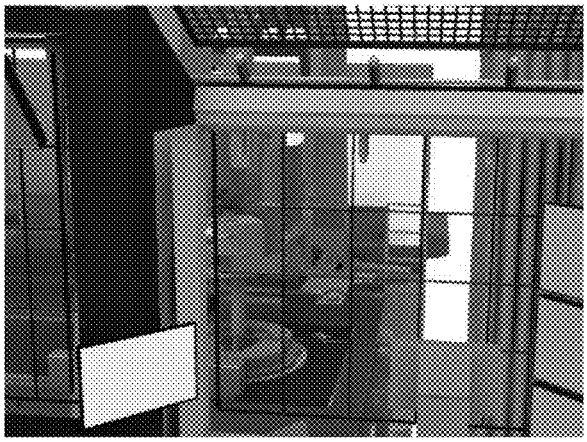

Step 1: Open top drive elevator and move top drive to upper stop. The top drive elevator is opened to release the drill collar stickup, and the top drive is hoisted to an upper stop in the mast 10. Meanwhile, a drill collar stand is in the stand hand-off position 50, held in position by the closed clasps of the upper and lower stand constraints 420 and 440. See FIGS. 33A and 33B.

Figure 34:
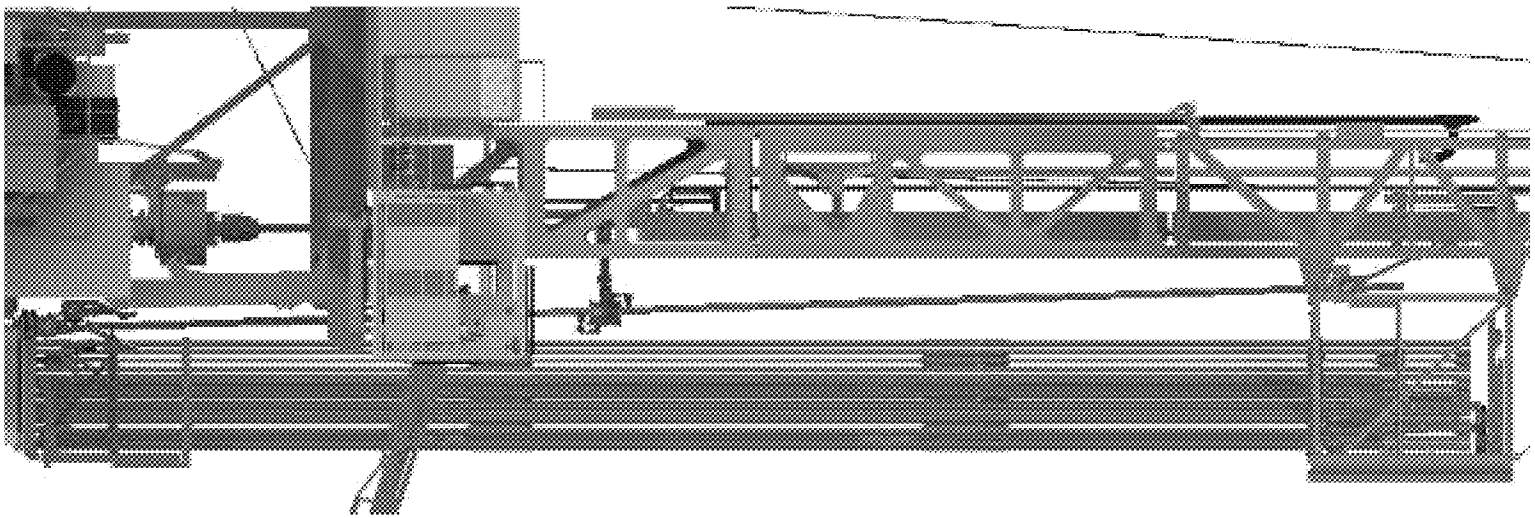
FIG. 34 illustrates tilting the drill collar stand toward the mast for pickup by the top drive.
Figure 35A:
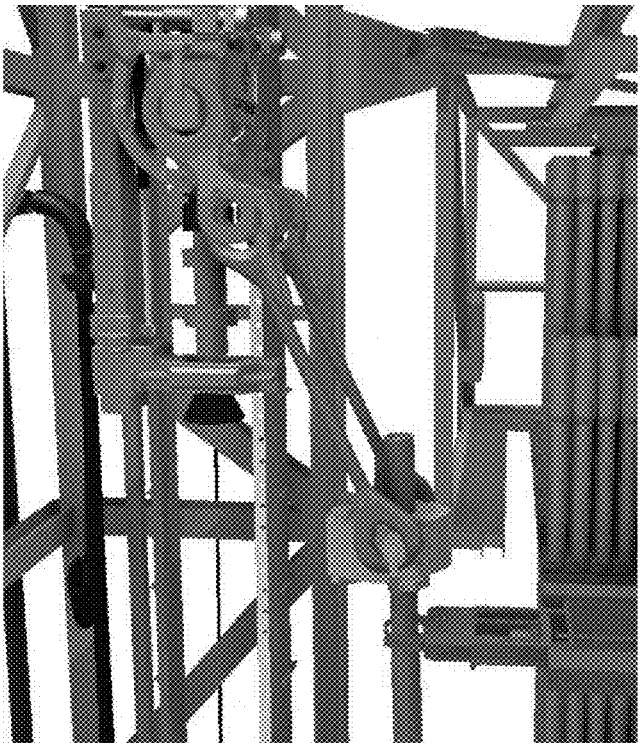
FIGS. 35A-35D illustrate latching the elevator on the tilted drill collar.
Figure 35B:
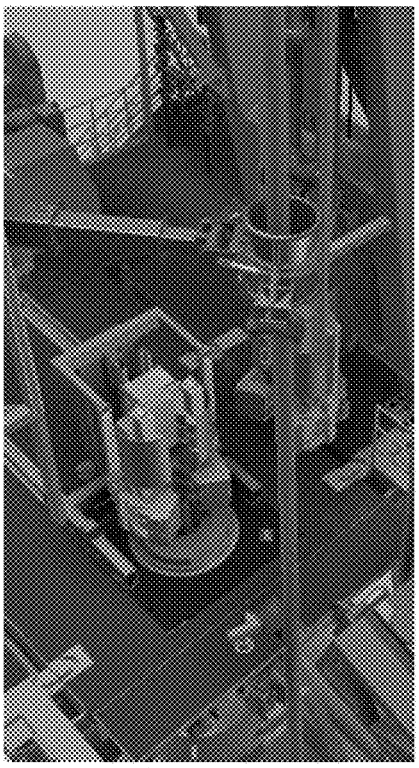
Figure 35C:
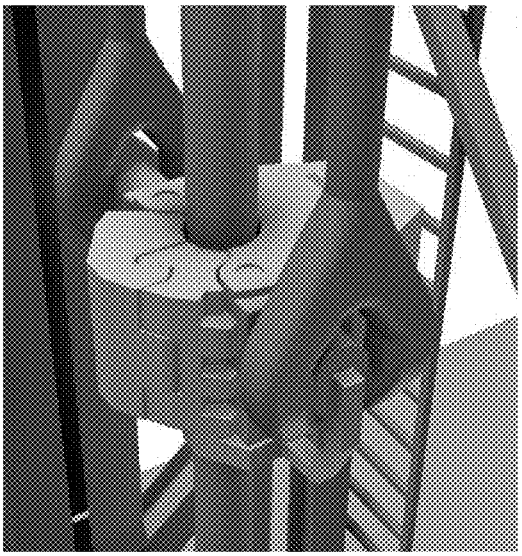
Figure 35D:
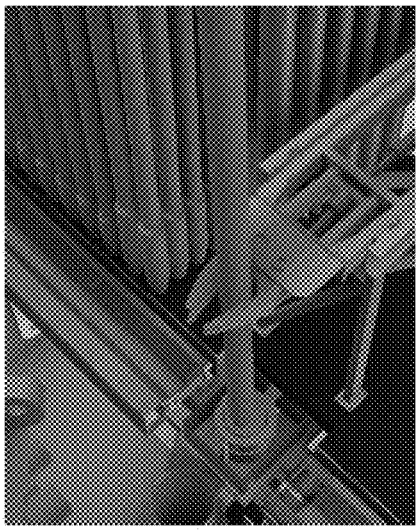

Step 2: Tilt the drill collar stand to the drill collar handover position. The upper stand constraint 420 is extending significantly and the lower stand constraint 440 is extended moderately to tilt the drill collar as shown in FIG. 34. The lower pin end of the drill collar stand remains in the alleyway 912 of the setback platform 900 (see FIG. 35D), and the drill collar stand is tilted to a drill collar handover position where the box end leans toward the mast 10. The lower stabilizing arm 800 extends toward the drill collar stand.

Step 3: Latch the top drive elevator on the tilted stand. The top drive is in the correct elevation and extended (well center) position so that the link arms of the elevator may swing toward the drill collar stand. The top drive elevator is closed on the stand. See FIG. 35A. The lower stabilizing arm 800 closes its guide funnel on the tilted drill collar stand. See FIG. 35B. The roughneck 760 on the tong handling trolley moves to the well center 30 and closes its stabbing guide. See FIG. 35B.

Figure 36:
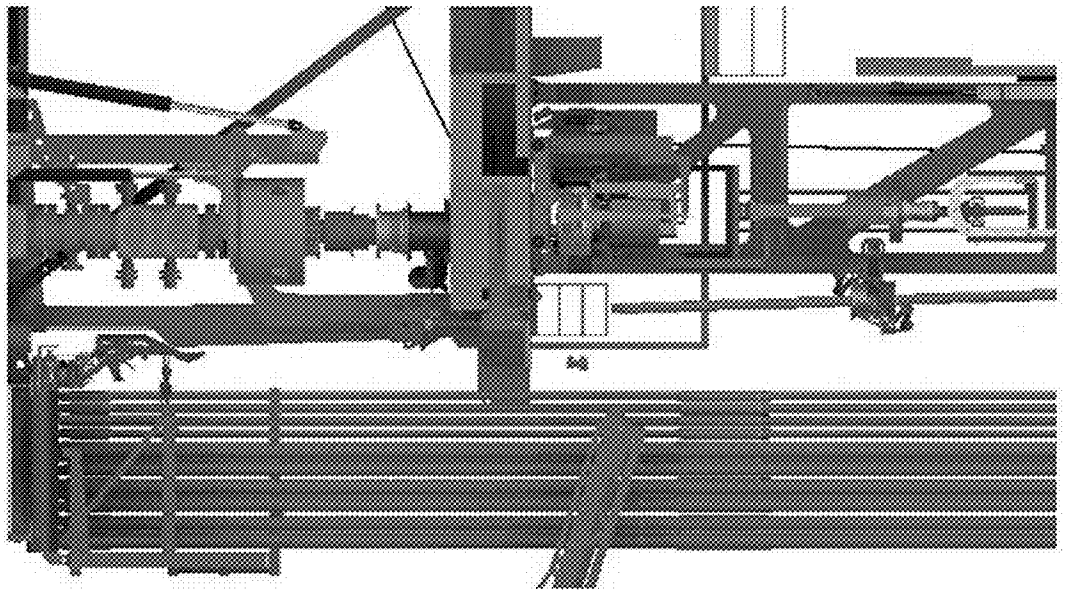
FIG. 36 illustrates lifting the drill collar stand from the stand handoff position at setback level.

Step 4: Lift the stand from the setback level to the drill floor. The upper and lower stand constraints 420 and 440 are opened to release the tilted drill collar stand. The drill collar stand is lifted (approximately 9 m/30 ft) by the top drive 200 and draw works while being guided by the lower stabilizing arm 800. The elevator link arms are allowed to float towards the well center. When the drill collar stand is suspended above the stickup, the lower stabilizing arm 800 guides the lower end of the stand to the well center 30. See FIG. 36. The lower stabilizing arm 800 closes its centralizer when the drill collar stand is close to vertical above the stickup height.

Figure 37A:
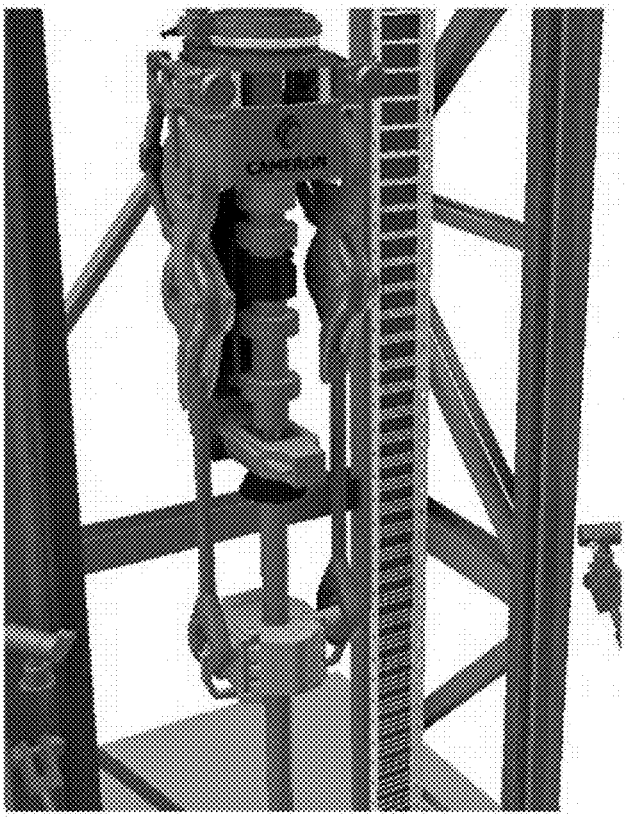
FIGS. 37A and 37B illustrate stabbing in the drill collar stand at the well center and making up the connection.
Figure 37B:
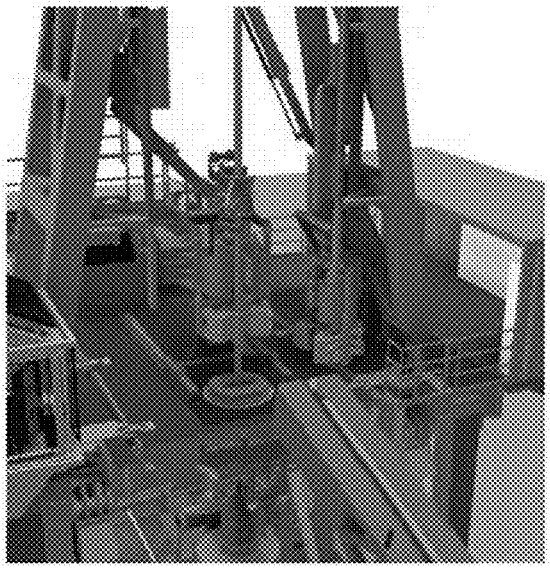

Step 5: Stab drill collar stand and make-up connection. The top drive is at the well center 30 with the drill collar stand. A roughneck stabbing guide is closed to assist stabbing. The top drive 200 then lowers the new drill collar stand to stab the stand into the string. See FIG. 37A. The lower stabilizing arm 800 opens and retreats from the well center 30. The iron roughneck 760 spins and torques to make-up the connection between the new drill collar stand and the drill collar string. See FIG. 37B. The roughneck retreats to a standby position.

Figure 38:
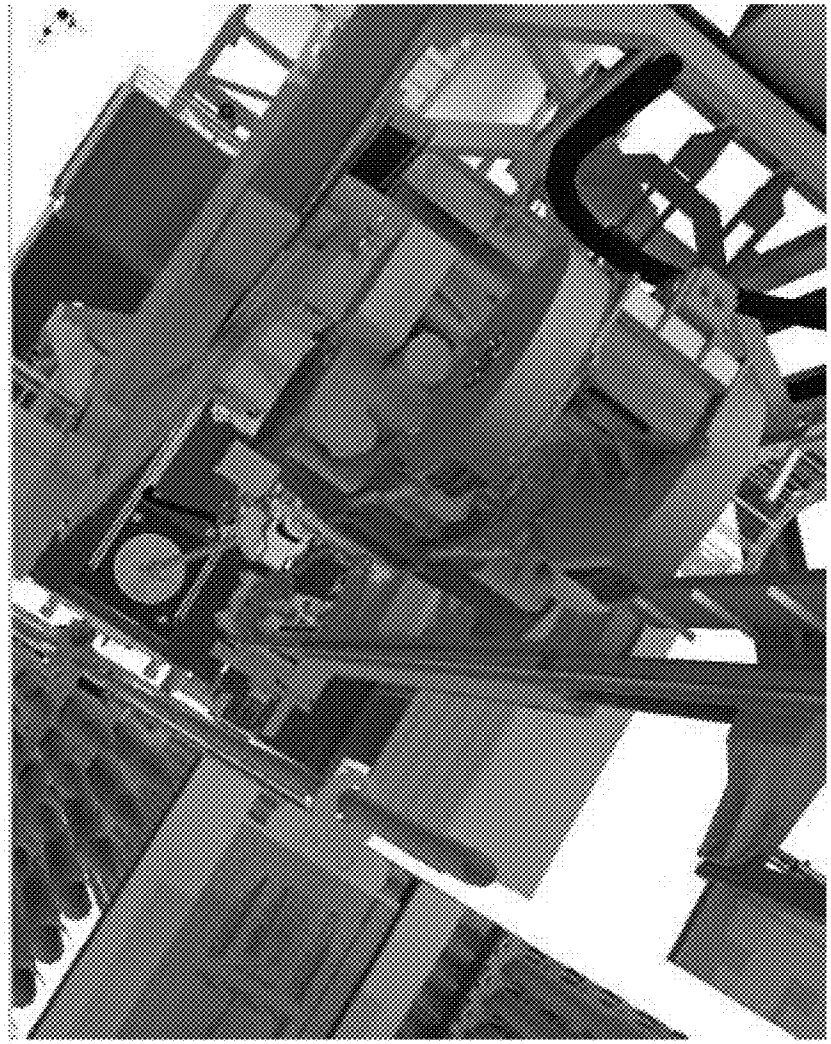
FIG. 38 illustrates opening the slips and lowering the drill collar string.

Step 6: Open slips and lower drill string. The top drive and drawworks hoist to pick up the drill collar string weight and the slips at the spider are opened. The drill collar string is then lowered into the wellbore via the top drive. See FIG. 38.

Figure 39A:
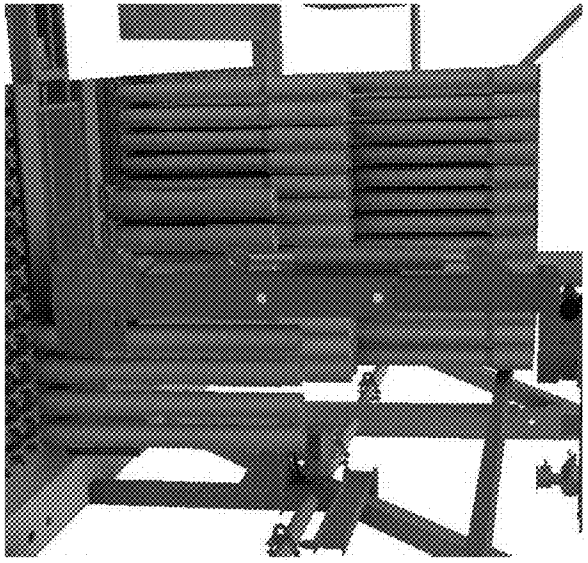
FIGS. 39A and 39B illustrate picking up a new stand from the setback.
Figure 39B:
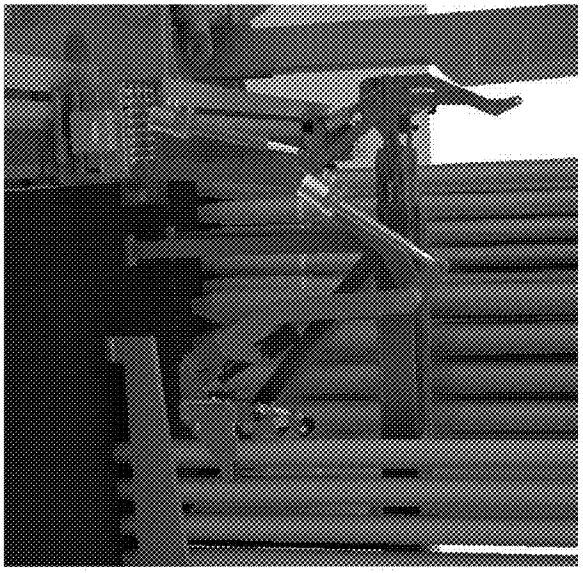

Step 7: Pick up new drill collar stand from setback. The transfer bridge racker 350 and the setback guide arm 950 pick up a drill collar stand from a selected position in the setback 900. See FIGS. 39A and 39B.

Figure 40A:
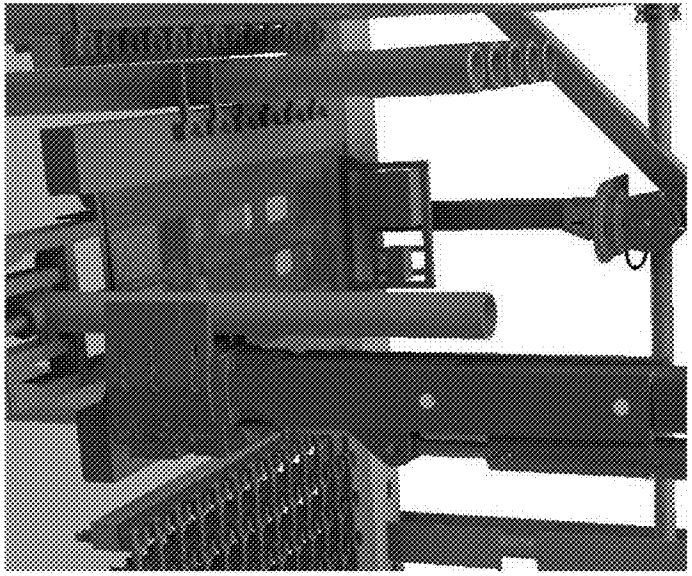
FIGS. 40A and 40B illustrate moving the stand to the stand handoff position.
Figure 40B:
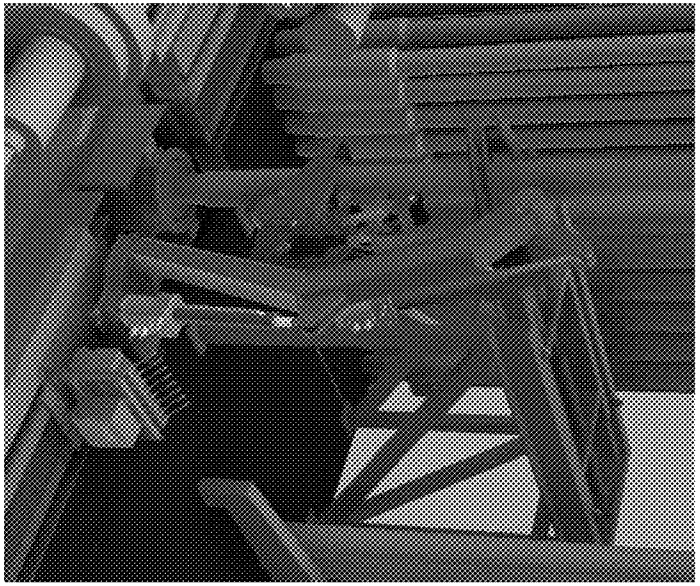

Step 8: Move stand to stand handoff position. The transfer bridge racker 350 and the setback guide arm 950 move the drill collar stand to the stand hand-off position 50. The upper and lower stand constraints 420 and 440 close their clasps to hold the stand. See FIGS. 40A and 40B. The doper integrated in the stand hand-off position washes and dopes the pin. The transfer bridge racker 350 and the setback guide arm 950 move to pick up another drill collar stand from another selected position in the setback 900 and fingerboard 310.

(VII) Sequence for Tripping Out Drill Collar Stands

The initial equipment configuration for the tripping out drill collar stands sequence is as follows:

- The top drive 200 is in a lower position on the well center axis 30, and the elevator is closed around the drill collar stick-up.
- The stand of drill pipe 80 is suspended in a spider in the rig floor 6 so that approximately 1.2 m/4 ft of drill string sticks up from the rig floor 6.
- One drill collar stand is in the stand hand-off position 50, held in position by the closed clasps of the upper and lower stand constraints 420 and 440.
- The tubular delivery arm 500 is parked at a high elevation, out of the way, because it is not to be used in the sequence for drill collar stands.
- The transfer bridge racker 350 and setback guide arms 950 are empty and on their way from the fingerboard 310 to pick up a broken-out drill collar stand in the stand hand-off position 50.

The sequence for tripping out drill collar comprises the following steps.

Figure 41A:
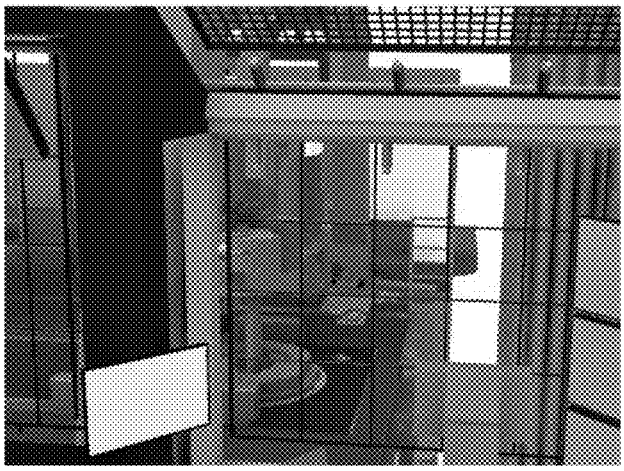
FIGS. 41A and 41B illustrate tripping out drill collars by opening the slips and hoisting the drill string.
Figure 41B:
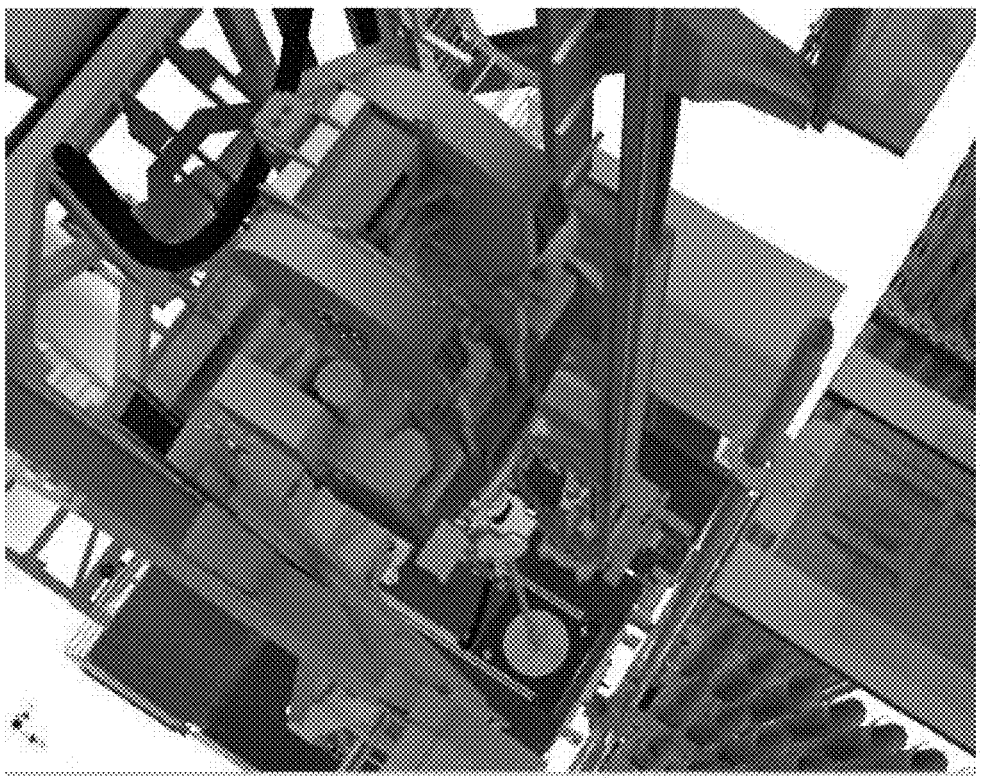

Step 1: Open slips and hoist the drill collar string. With the top drive and the drawworks, take the weight of the drill collar string and open the slips at the spider in the drill floor. Stop hoisting when the sting is raise to an elevation for a stick-up height. See FIGS. 41A and 41B.

Figure 42A:
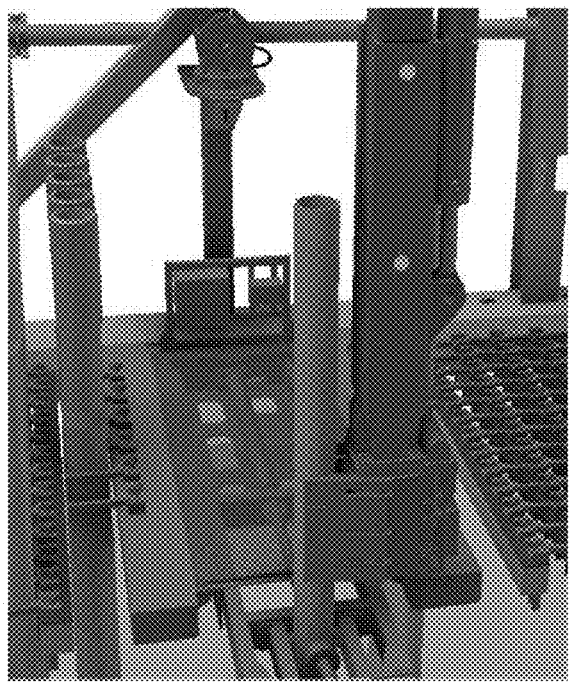
FIGS. 42A and 42B illustrate moving the stand from the stand handoff position to the fingerboard/setback.
Figure 42B:
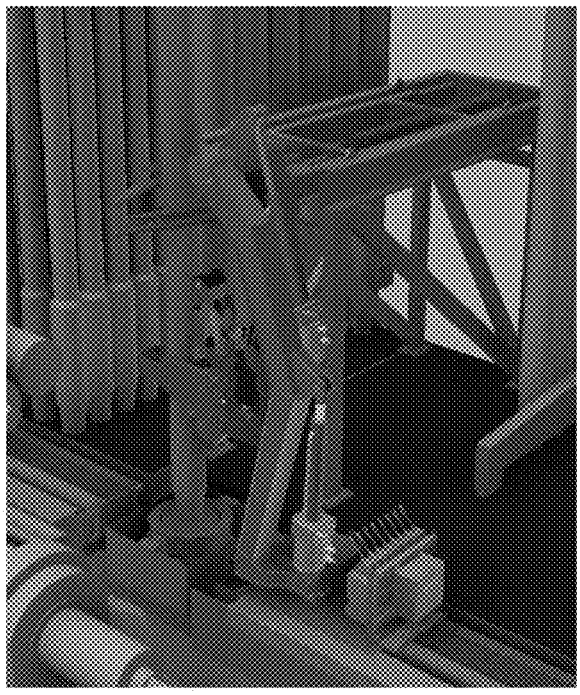

Step 2: Move stand from stand handoff position to setback/fingerboard. The transfer bridge racker 350 and the setback guide arm 950 engage the drill collar stand in the stand hand-off position 50. The upper and lower stand contraints 420 and 440 release the stand. See FIGS. 42A and 42B. The transfer bridge racker 350 and the setback guide arm 950 lift and move the drill collar stand to the setback/fingerboard. The fingerboard latches are opened when the stand is being moved into the row and closed there behind.

Figure 43:
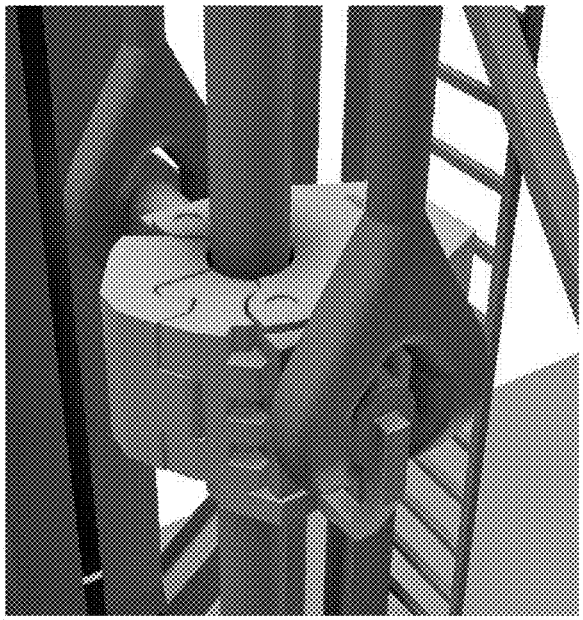
FIG. 43 illustrates moving the lower stabilizing arm and the roughneck to the stand at well center.

Step 3: The lower stabilizing arm and the roughneck move to the drill collar string. The slips are set and the weight of the string is taken off the top drive elevator. See FIG. 43. The selected roughneck 760 moves to the string at well center and elevates to the stickup height. The lower stabilizing arm 800 moves from the stand hand-off position to a safe standby position proximate the stand. The lower stabilizing arm 800 moves to the well center and closes its guide on the stand.

Figure 44:
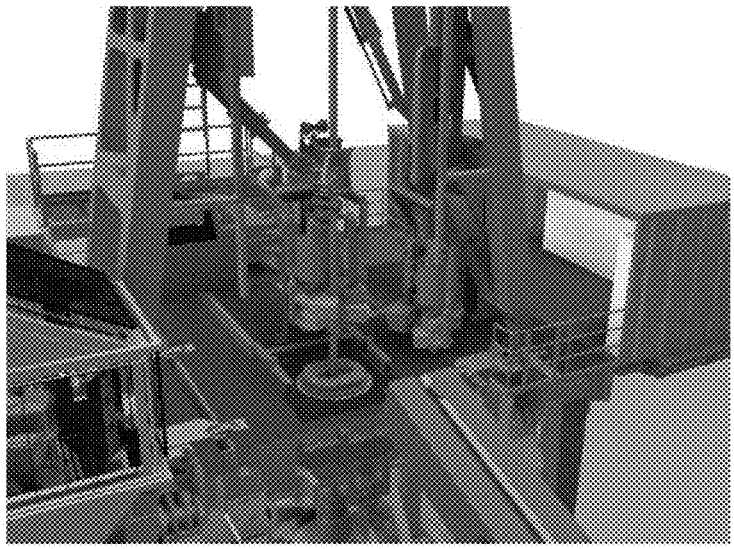
FIG. 44 illustrates breaking out the stand with the roughneck.

Step 4: Roughneck break-out. The iron roughneck 760 spins and torques to break-out the connection between the new drill collar stand and the drill collar string. See FIG. 44. The roughneck retreats to a standby position.

Figure 45A:
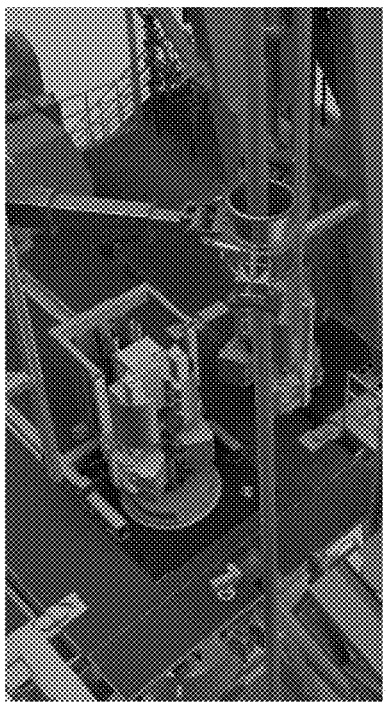
FIGS. 45A and 45B illustrate lifting the stand from the stickup with the top drive and tilting with the lower stabilizing arm.
Figure 45B:
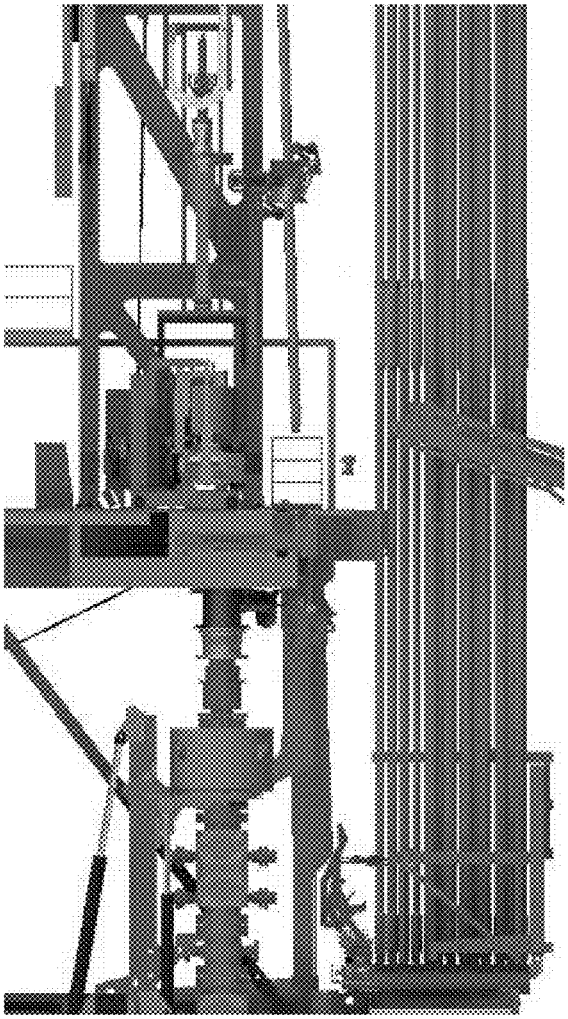

Step 5: The stand is lifted and tilted. The top 200 drive lifts the broken-out drill collar stand and the guidance is provided by the lower stabilizing arm 800. See FIGS. 45A and 45B.

Figure 46A:
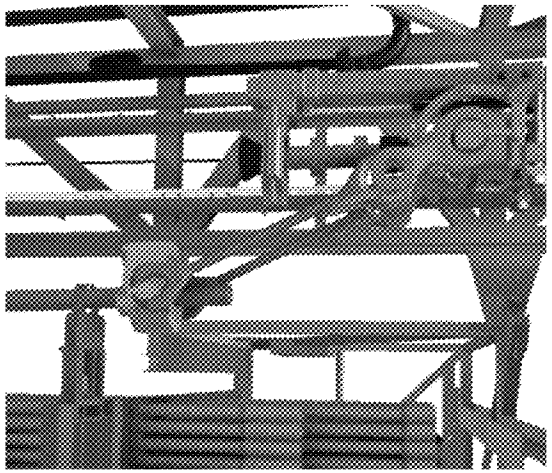
FIGS. 46A-46C illustrate tilting and lowering the stand to the stand handoff position.
Figure 46B:
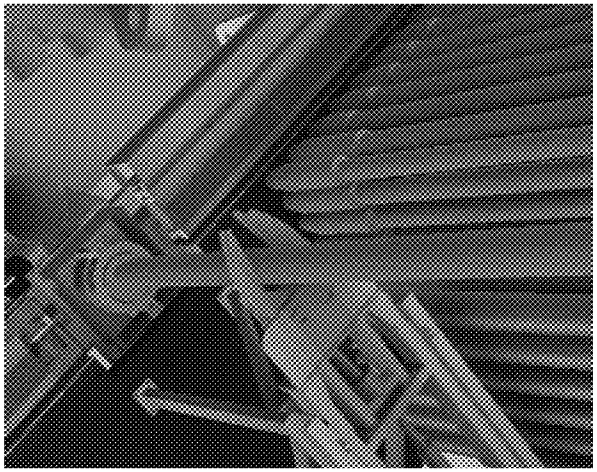
Figure 46C:
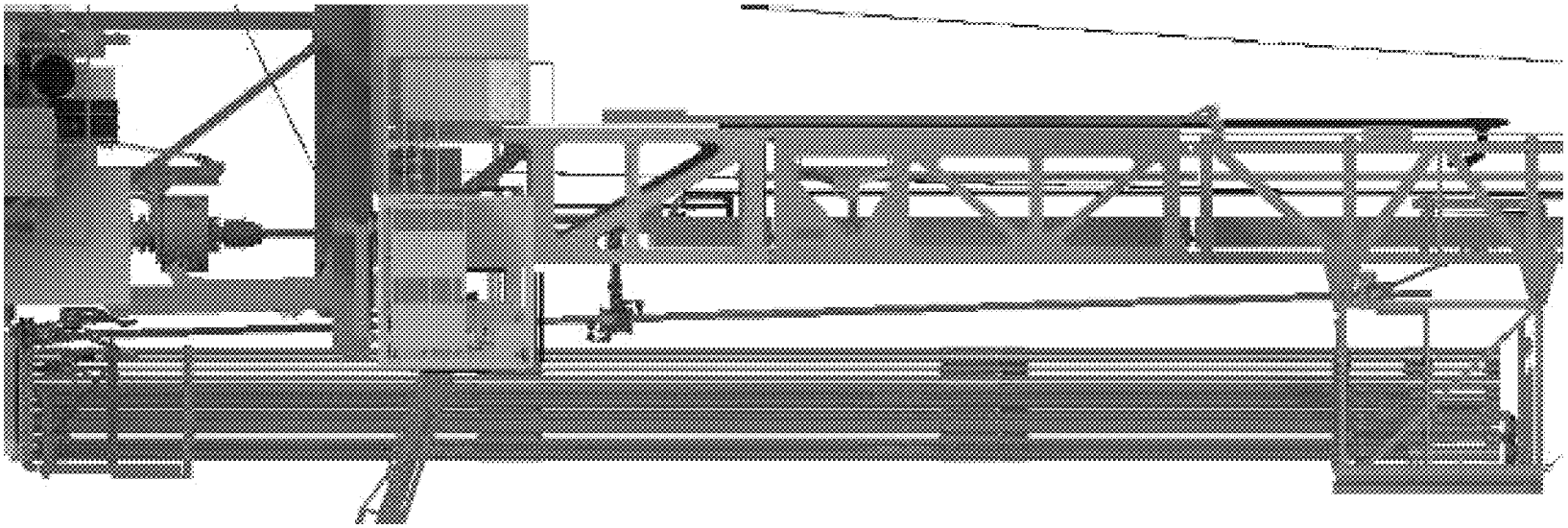

Step 6: Tilt stand to stand hand-off position. When the stand clears the stick-up, the lower stabilizing arm 800 guides the lower end of the drill collar stand as the top drive lowers the stand to the stand hand-off position on the alleyway 912 of the setback platform 900. The top drive link arms tilt toward the stand-off position. The upper and lower stand constraints 420 and 440 extend and clasp the drill collar stand. See FIGS. 46A-46C. The pin is washed and doped.

Figure 47:
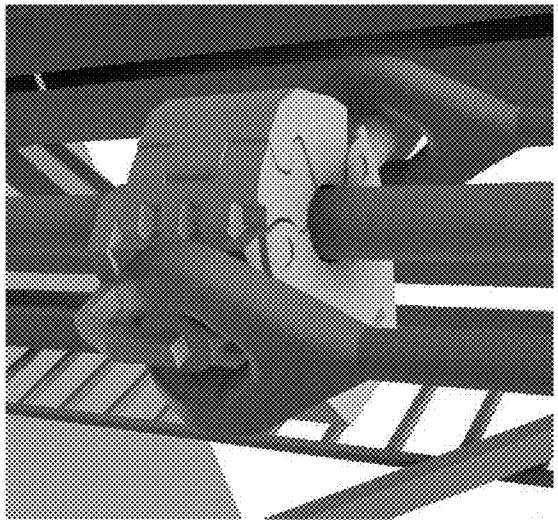
FIG. 47 illustrates opening the elevator to release the stand.

Step 7: Open the elevator. The top drive elevator is opened (see FIG. 47) and the link arms allow the elevator to float back to a vertical position under the top drive. The guide funnel of the lower stabilizer arm 800 opens and the arm moves to a standby position. The top drive lowers toward the stick-up.

Figure 48:
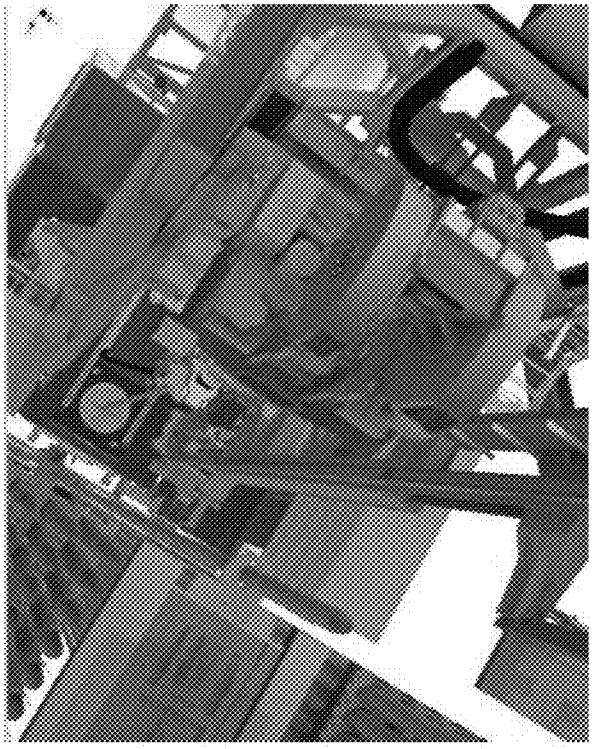
FIG. 48 illustrates tilting the drill collar stand to vertical at the stand handoff position.

Step 8: Tilt the drill collar stand to vertical at the stand hand-off position. The upper stand constraint 420 retracts significantly and the lower stand constraint 440 retracts moderately to tilt the drill collar to vertical at the stand hand-off position. See FIG. 48.

Figure 49A:
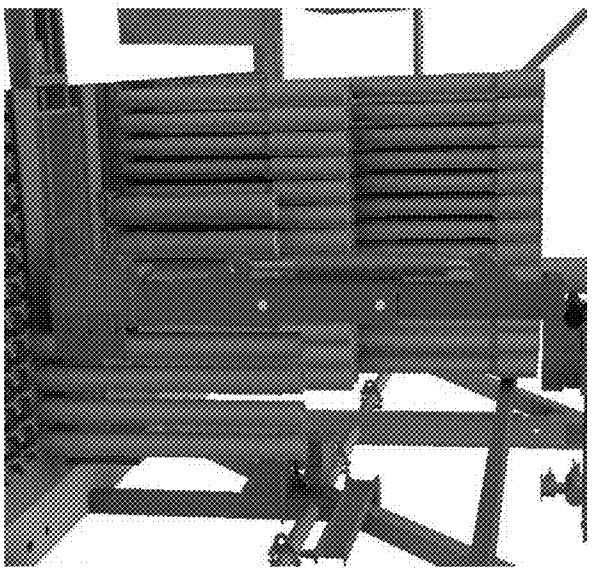
FIGS. 49A and 49B illustrate moving the stand to a position in the setback.
Figure 49B:
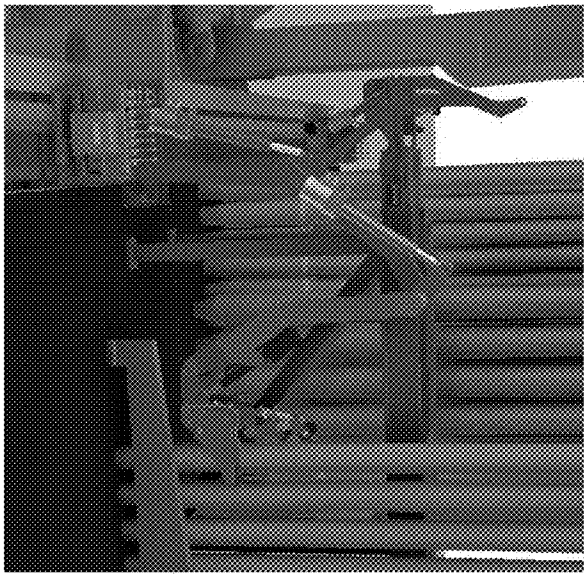

Step 9: Move the drill collar stand to the setback platform/fingerboard. The transfer bridge racker 350 and the setback guide arm 950 move to engage the drill collar stand at the stand hand-off position. The upper and lower stand constraints 420 and 440 are opened to release the drill collar stand. The transfer bridge racker 350 and the setback guide arm 950 move the drill collar stand to a selected position in the setback. See FIGS. 49A and 49B. Fingerboard latches are closed on the stand. The transfer bridge racker 350 and the setback guide arm 950 release the stand and return to the stand hand-off position.

Figure 50:
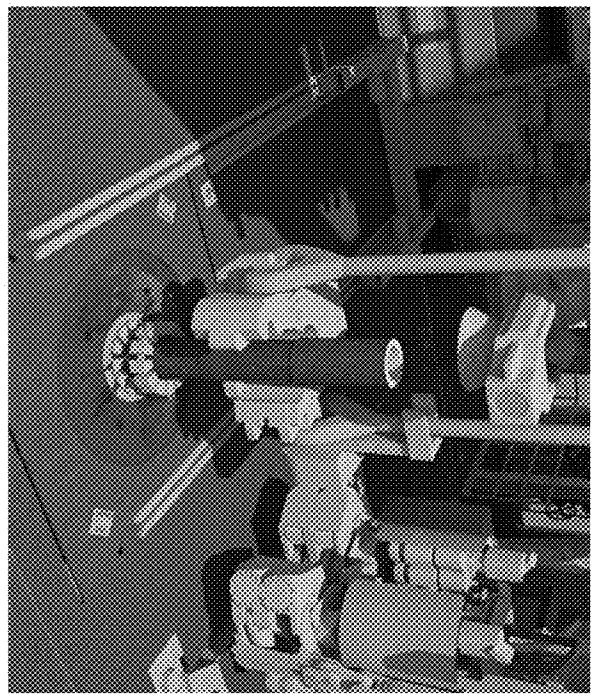
FIG. 50 illustrate extending the top drive and latching the elevator onto the drill collar stickup.

Step 10: The top drive elevator engages the stickup of the drill collar string. See FIG. 50.

(VIII) Sequence for Picking Up Singles from Catwalk with Top Drive

The initial equipment configuration for the sequence for picking up singles from the catwalk is as follows:

- The top drive 200 is in a lower position on the well center axis 30, and the elevator is closed around the pipe stick-up.
- The drill pipe is suspended in a spider in the rig floor 6 so that approximately 1.2 m/4 ft of drill string sticks up from the rig floor 6.
- The catwalk machine feeding table is loaded with tubulars (cleaned and doped).
- The catwalk machine ramp is empty and in a loading position.

The sequence for picking up singles from the catwalk comprises the following steps.

Figure 51:
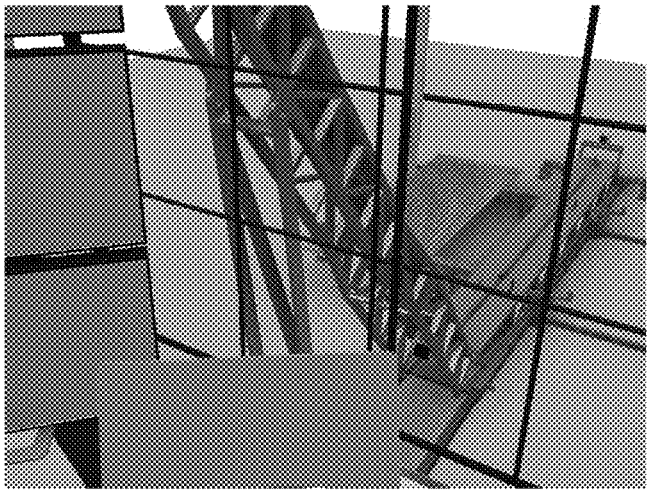
FIG. 51 illustrates picking up singles from the catwalk, first by loading a single on the ramp of the catwalk.

Step 1: Load tubular on the catwalk machine ramp. Use the feeding table to load one tubular on the ramp of the catwalk machine 600. See FIG. 51.

Figure 52A:
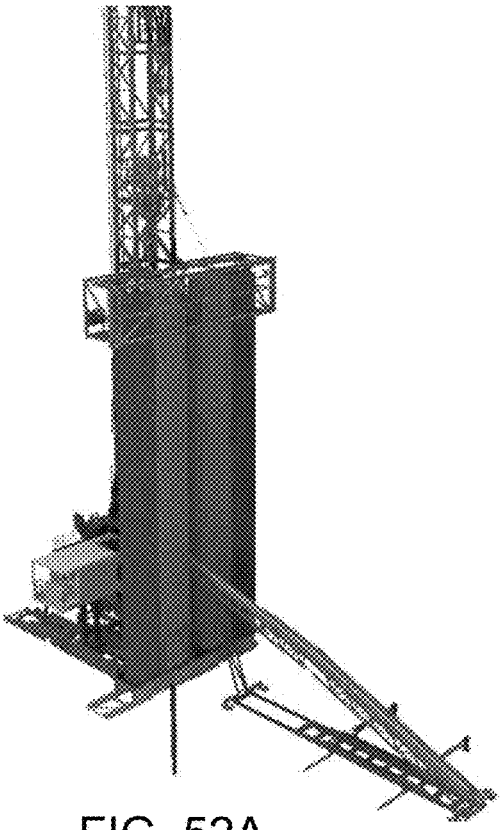
FIGS. 52A-52C illustrate running the catwalk ramp to the drill floor.
Figure 52B:
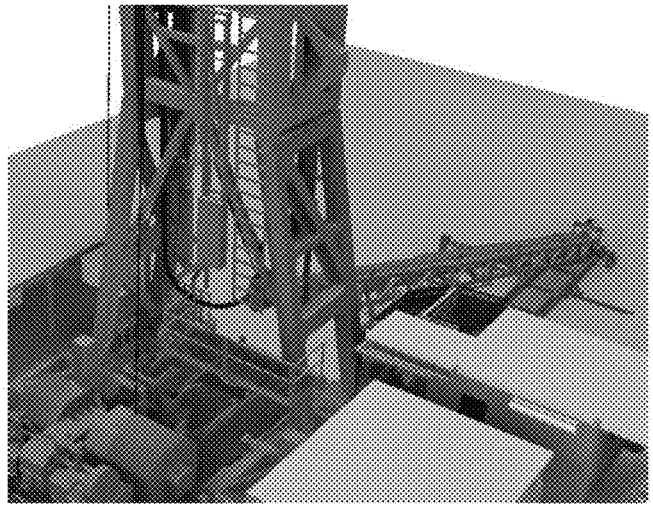
Figure 52C:
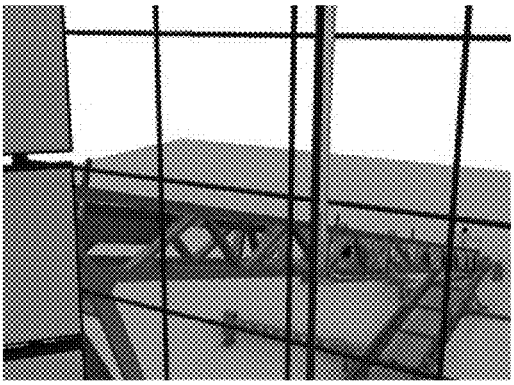

Step 2: Run the catwalk to the drill floor. The ramp of the catwalk machine 600. See FIGS. 52A-52C.

Figure 53:
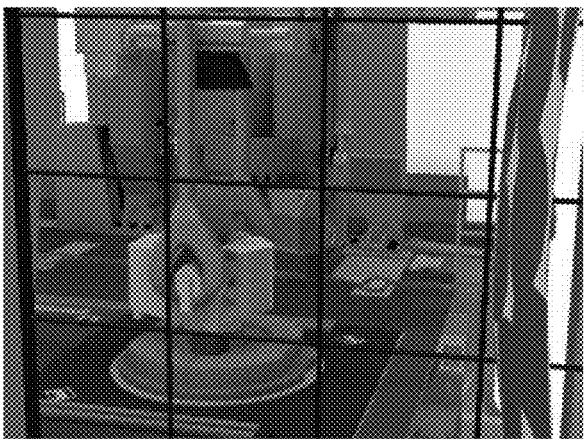
FIG. 53 illustrates opening the elevator from the stickup and hoisting the top drive to pickup the next single from the catwalk ramp.

Step 3: Open the elevator and hoist to catwalk pick-up position. The top drive 200 elevator is opened (see FIG. 53), and the link arms are tilted back so the elevator can clear the tubular joint. The top drive is hoisted to the catwalk pick-up position.

Figure 54A:
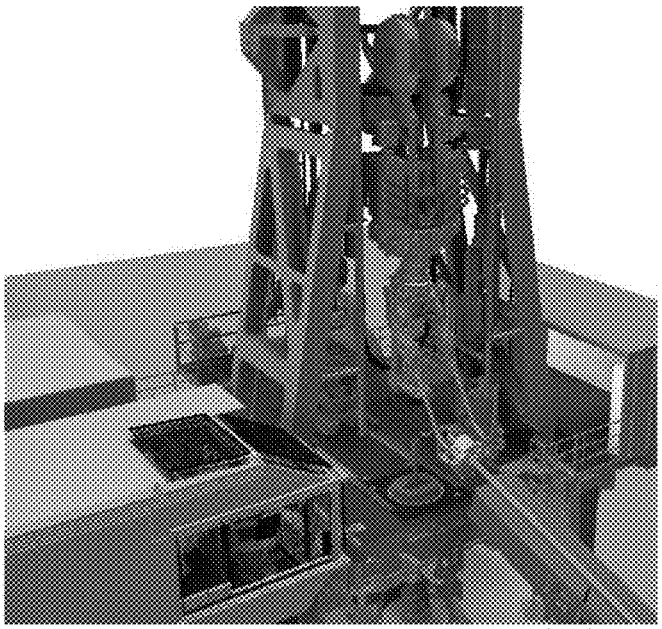
FIGS. 54A and 54B illustrate pushing the single up the ramp and latching the top drive elevator.
Figure 54B:
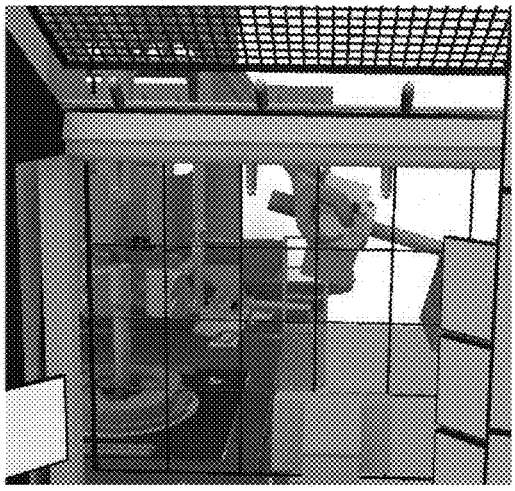

Step 4: Push the tubular. The pipe pusher of the catwalk machine 600 pushes the tubular up the ramp to the tubular latching position. The top drive link arms are tilted forward to swing the elevator toward the tubular, and the elevator latches onto the tubular. See FIGS. 54A and 54B.

Figure 55:
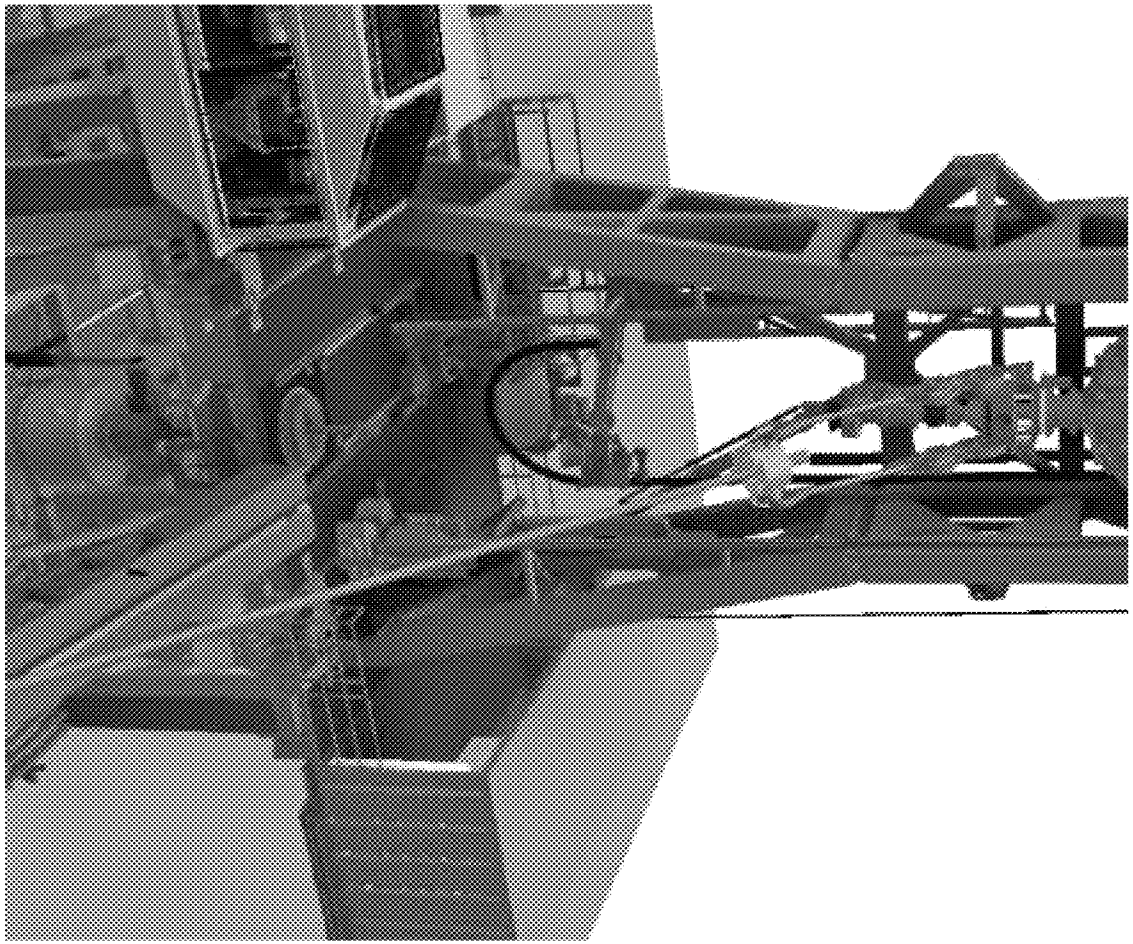
FIG. 55 illustrates hoisting the tubular single from the ramp.

Step 5: Pull up the tubular. The tubular is pulled up by hoisting the top drive 200 so that the box end of the tubular is lifted by the elevator. As the top drive is hoisted, the lower box end of the tubular slides up the ramp of the catwalk machine 600. Before the lower box end of the tubular exits the end of the ramp of the catwalk machine 600, the lower stabilizing arm 800 extends and closes its funnel to guide the tubular. As the tubular approaches vertical, the centralizers of the lower stabilizing arm 800 close on the tubular. See FIG. 55.

Figure 56:
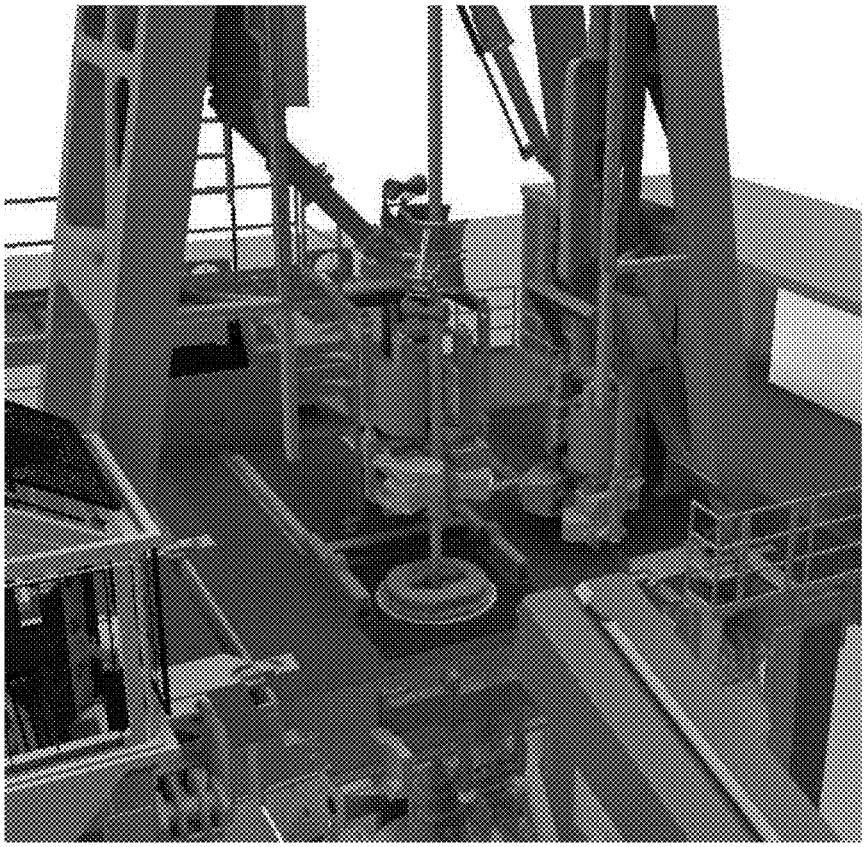
FIGS. 56 and 57 illustrate guiding the tubular single to the well center.
Figure 57:
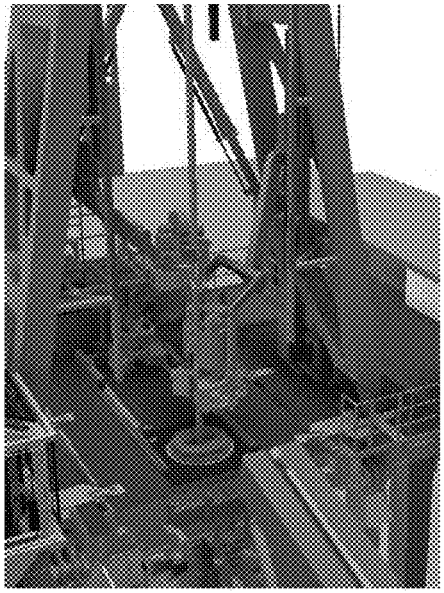

Step 6: Guide the tubular to well center. The roughneck 760 is moved to the stick-up as the top drive 200 continues to hoist the tubular. When the pin end is hoisted above the stick-up, the lower stabilizing arm 800 guides the tubular to the well center 30. The catwalk ramp moves out and down to a position for loading the next tubular. See FIG. 57. In an alternative embodiment where a tong handling arm is used, the roughneck on the tong handling trolley may be used for the connection. See FIG. 56.

Step 7: Stab the tubular. The stabbing guide of the roughneck is closed above the stick-up. The top drive is lowered to stab the tubular into the stabbing guide. When the tubular is in the stabbing guide, the lower stabilizing arm 800 is opened and retracted. The top drive is further lowered to stab the tubular into the stickup.

Figure 58:
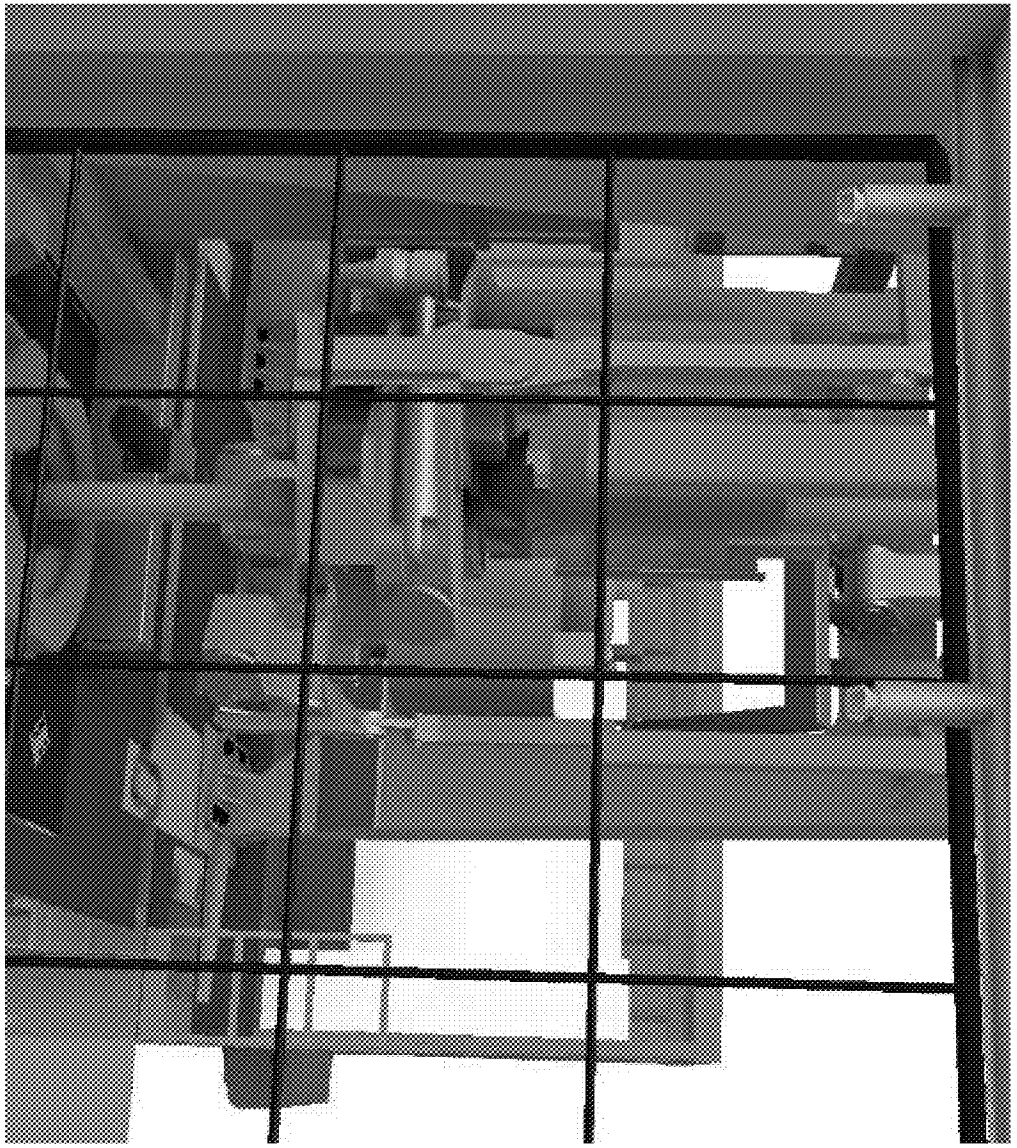
FIG. 58 illustrates stabbing the tubular single at the well center for make-up.

Step 8: Make-up the connection. The roughneck 760 spins the tubular to thread the tubular's pin end into the stick-up's box end. The roughneck 760 then applies torque to make-up the joint. See FIG. 58.

Figure 59:
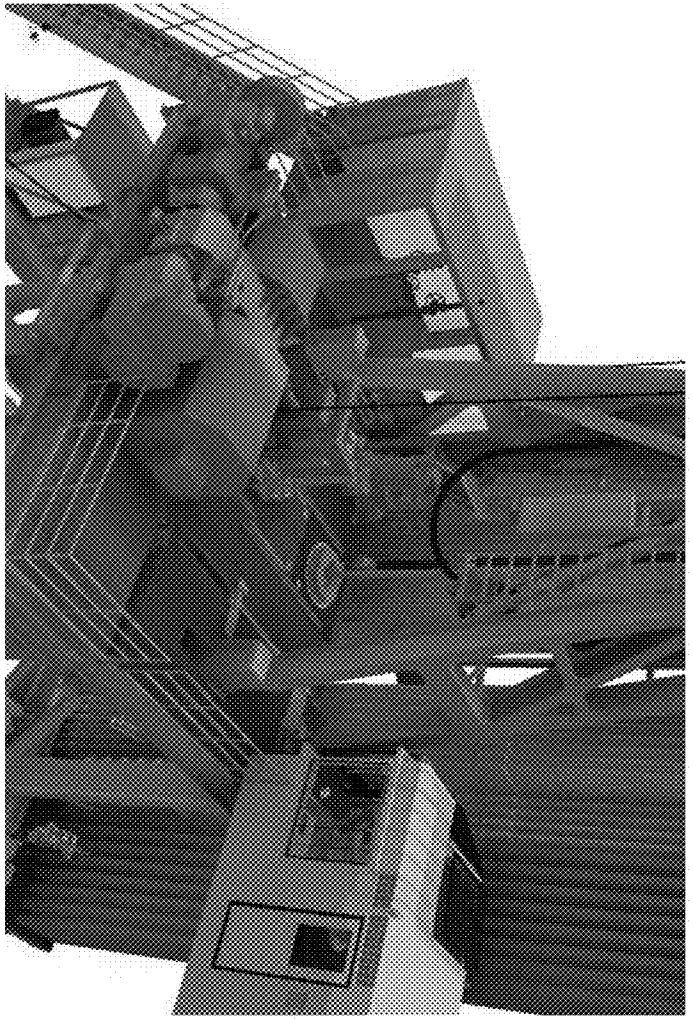
FIG. 59 illustrates lowering the drill string.

Step 9: Lower the drillstring. The roughneck is moved to its standby position. Pick up the weight of the drill string with the top drive/drawworks. Open the slips in the spider. Lower the drill string into the wellbore to the stick-up height. Set the slips in the spider. See FIG. 59.

(IX) Sequence for Laying Down Singles to Catwalk with Top Drive

The initial equipment configuration for the sequence for laying down singles from the well center to the catwalk is as follows:

- The top drive 200 is in a lower position on the well center axis 30, and the elevator is closed around the pipe stick-up.
- The drill pipe is suspended in a spider in the rig floor 6 so that approximately 1.2 m/4 ft of drill string sticks up from the rig floor 6.
- The catwalk machine feeding table is unloaded and ready to receive tubulars.
- The catwalk machine ramp is empty and in a drill floor loading position (ready to move to drill floor).
- The tubular deliver arm is parked outside a collision area.

The sequence for laying down singles from the well center to the catwalk comprises the following steps.

Figure 60A:
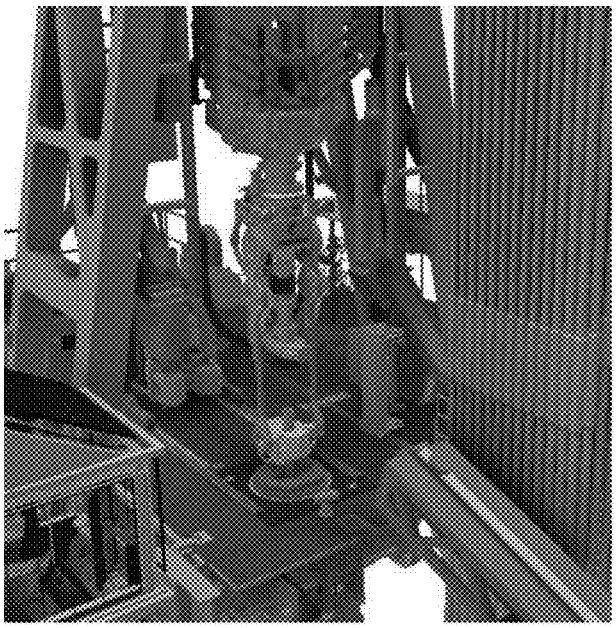
FIGS. 60A and 60B illustrate laying down singles to the catwalk with the top drive, by first opening the slips and hoisting the top drive.
Figure 60B:
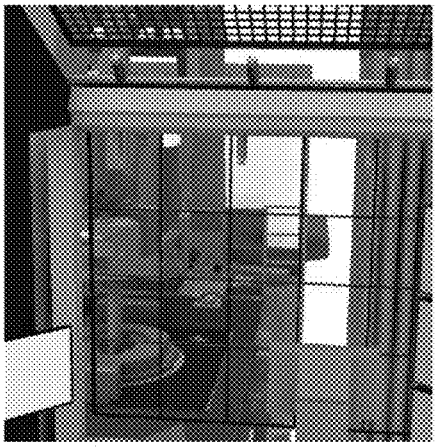

Step 1: Open slips and hoist the drillstring. The slips on the spider are opened. The top drive/drawworks take the weight of the drill string and hoist the drill string out of the well bore. They stop hoisting when a single tubular is above the stick-up height. The slips on the spider are closed. The top drive/drawworks set the weight back on the slips. See FIGS. 60A and 60B.

Figure 61A:
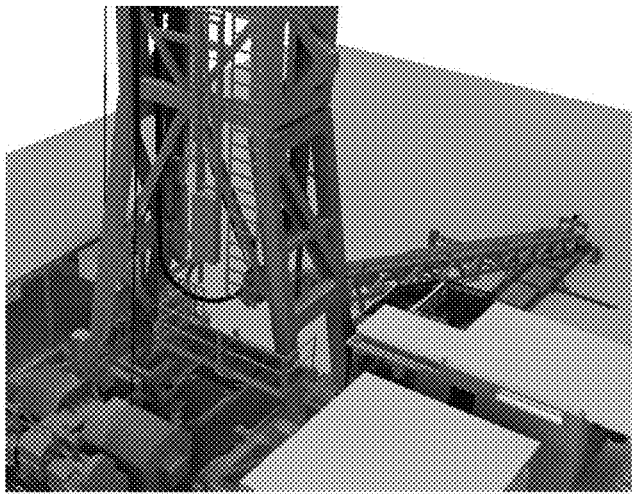
FIGS. 61A and 61B illustrate moving the ramp of the catwalk to the drill floor.
Figure 61B:
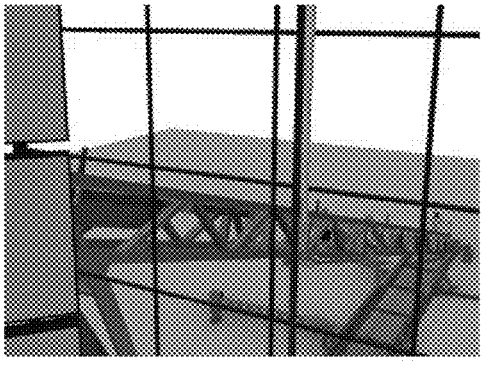

Step 2: Move the catwalk machine ramp and the pipe pusher to the lay down position. The ramp of the catwalk machine 600 is elevated so that it is straight and positioned at the drill floor. The pipe pusher is moved to the drill floor lay down position relative to the ramp. See FIGS. 61A and 61B.

Figure 62:
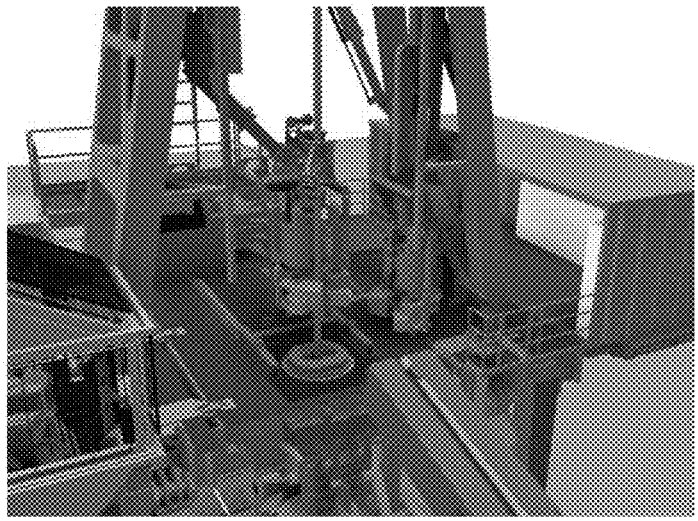
FIG. 62 illustrates moving the roughneck and the lower stabilizing arm to the well center.

Step 3: The roughneck and the lower stabilizing arm move to the well center. The selected roughneck moved to the well center 30 and elevates to the stick-up height. The lower stabilizing arm 800 moves to the well center 30 above the roughneck working height. The lower stabilizing arm 800 closes its guide funnel around the tubular. See FIG. 62.

Figure 63:
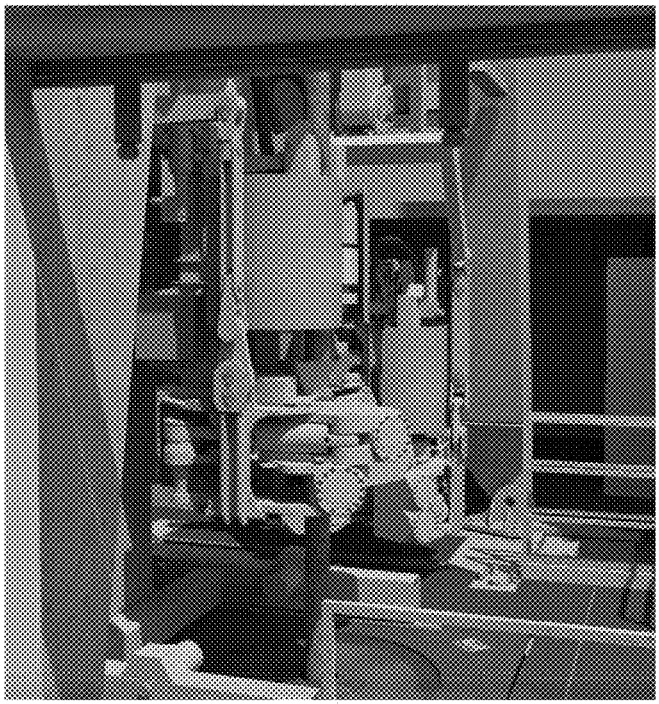
FIG. 63 illustrates breaking out the single from the string.

Step 4: Roughneck breaks out the stand. The roughneck breaks the connection and spins out the threads of the connection. The roughneck opens and retracts to a standby position. (Alternatively, the roughneck may wait at the well center until the stand is lifted by the top drive). See FIG. 63.

Figure 64A:
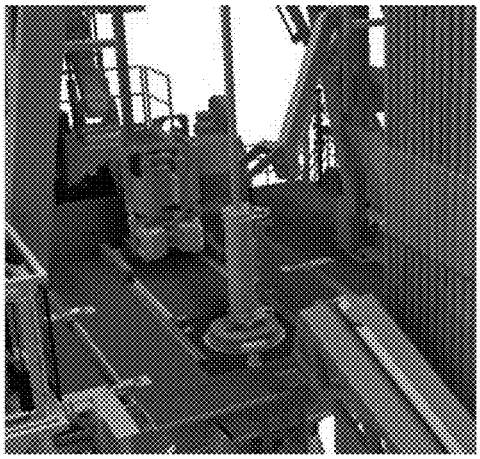
FIGS. 64A and 64B illustrate draining the single with a mud bucket, if tripping out wet.
Figure 64B:
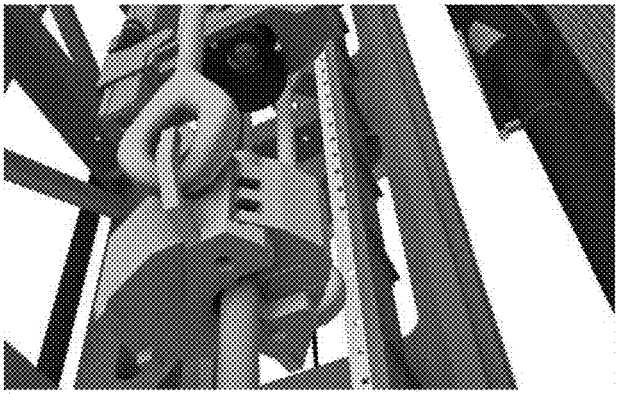

Step 5 (optional, if wet): Wet pipe. If tripping out wet, the mud bucket is moved to the well center and closed on the drill string. The top drive hoists the broken-out tubular to allow it to drain into the mud bucket. See FIG. 55. The mud bucket is then opened and retracted, while the lower stabilizing arm 800 guides the tubular above the mud bucket. See FIGS. 64A and 64B.

Figure 65A:
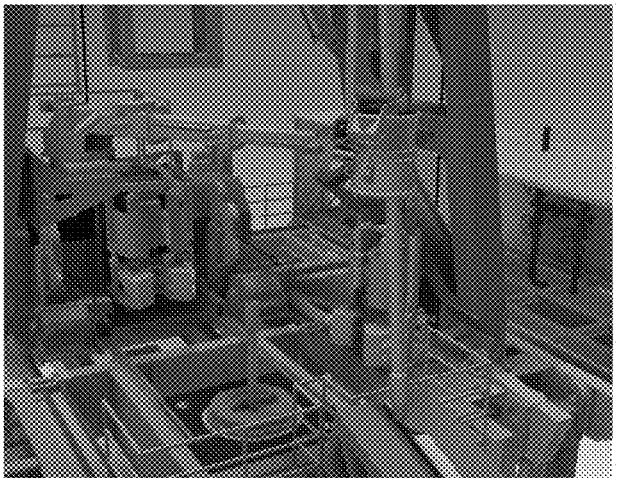
FIGS. 65A and 65B illustrate moving the single from the well center to the ramp with the top drive and lower stabilizing arm.
Figure 65B:
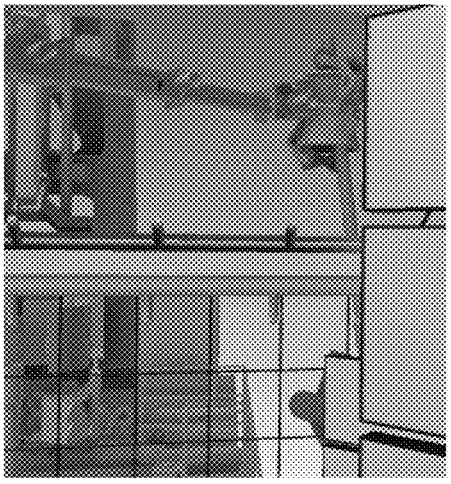

Step 6: The top drive and lower stabilizing arm move the tubular from the well center to the catwalk machine. The top drive lifts the tubular out of the stickup and above the catwalk machine. The lower stabilizing arm guides the pin end above the catwalk machine and positions the pin on the pipe pusher of the catwalk machine, which is in the drill floor lay down position. See FIGS. 65A and 65B.

Figure 66A:
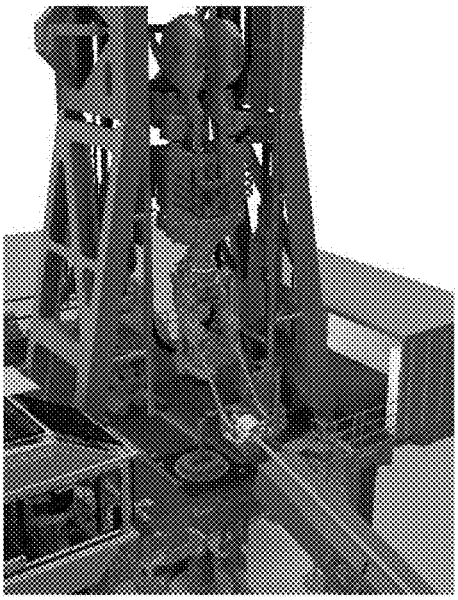
FIGS. 66A and 66B illustrate laying down the single on the ramp of the catwalk.
Figure 66B:
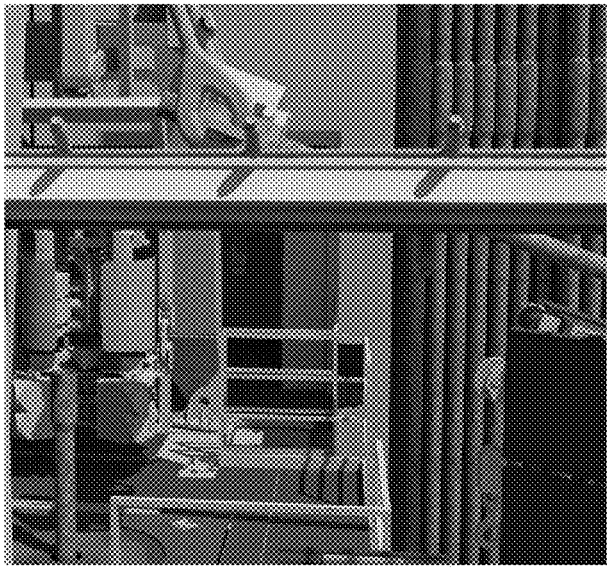
Figure 67A:
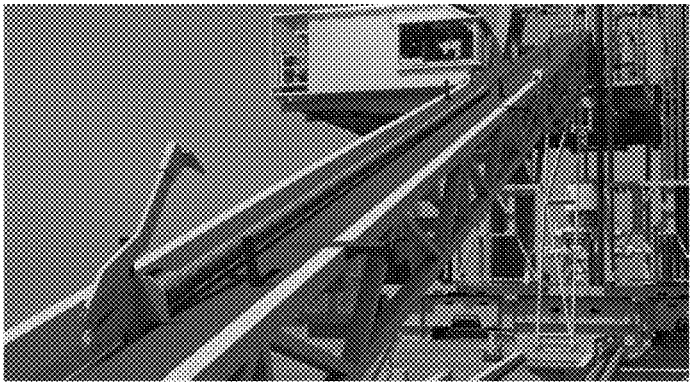
FIGS. 67A and 67B illustrate moving the pipe to the feeding table from the ramp of the catwalk.
Figure 67B:
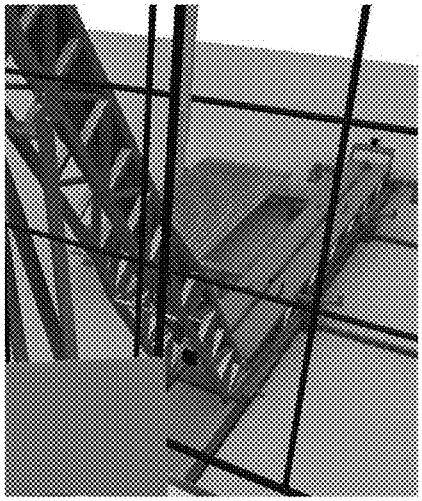
Figure 68:
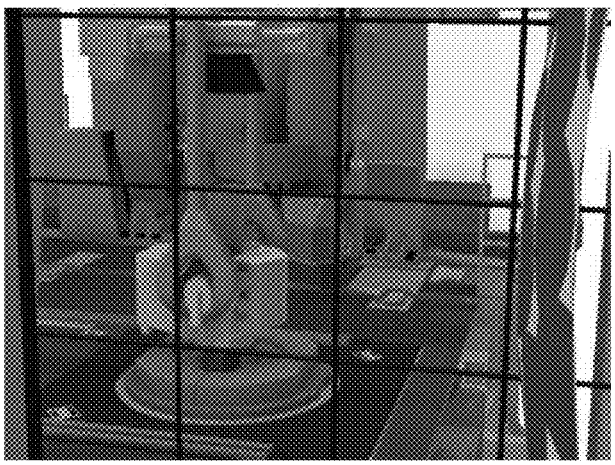
FIG. 68 illustrates lowering the top drive to the stickup and latching the elevator.

Step 7: Lay down tubular on the catwalk machine. The top drive link arms swing out to position the elevator toward the catwalk machine. As the top drive lowers toward the drill floor, the pipe musher of the catwalk machine simultaneously runs down the ramp to lay the tubular on the ramp. The elevator opens to release the tubular and the link arms rotate back (link tilt float). See FIGS. 66A and 66B.

(X) Sequence for Running Casing from Catwalk with Casing Tong

The initial equipment configuration for the sequence for running casing from the catwalk with a casing tong is as follows:

- The top drive 200 is in a lower position on the well center axis 30, and the elevator is closed around the pipe stick-up.
- The casing string is suspended in a spider in the rig floor 6 so that approximately 1.2 m/4 ft of drill string sticks up from the rig floor 6.
- The casing is laid out on the catwalk machine casing side (driller's side). The casing tubulars are cleaned and doped, with no protectors. Casing tally is updated.
- The ramp of the catwalk machine is empty, and in a loading position.

The sequence for running casing from the catwalk with a casing tong comprises the following steps.

Figure 69:
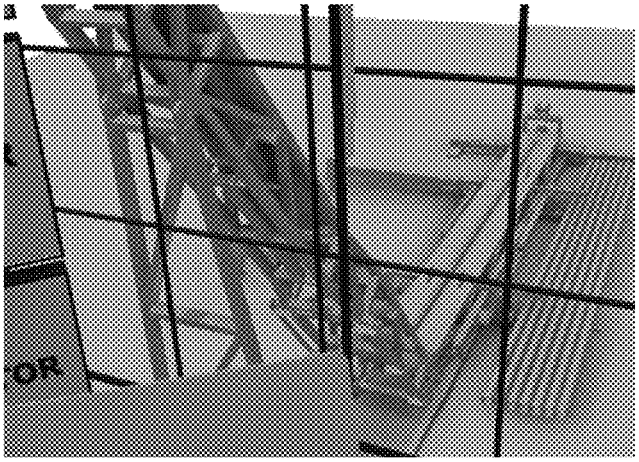
FIG. 69 illustrates running casing from the catwalk, by first loading casing with loading fingers.

Step 1: Load casing on the catwalk machine ramp. Use the casing loading fingers to load one tubular of casing on the ramp of the catwalk machine 600. See FIG. 69.

Figure 70A:
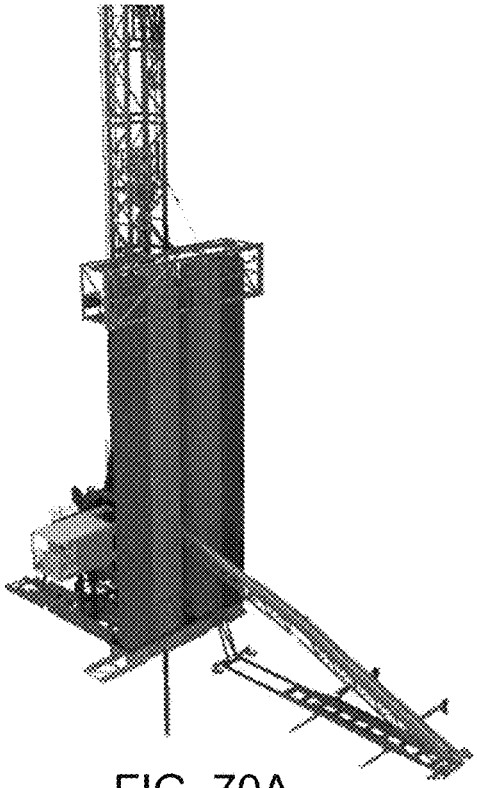
FIGS. 70A-70C illustrate running the ramp of the catwalk to the drill floor.
Figure 70B:
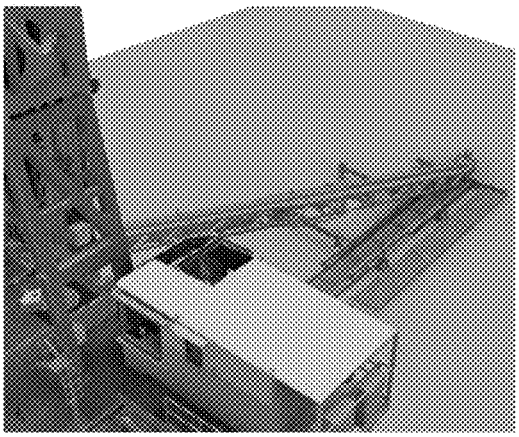
Figure 70C:
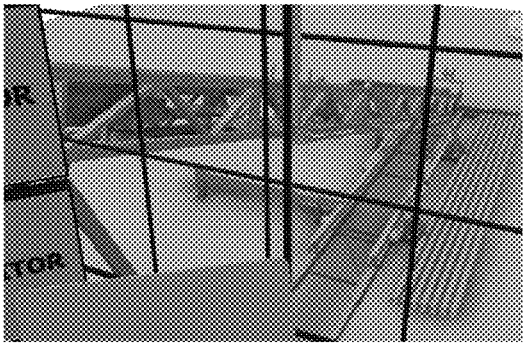

Step 2: Run the catwalk to the drill floor. The ramp of the catwalk machine 600. See FIGS. 70A-70C.

Figure 71A:
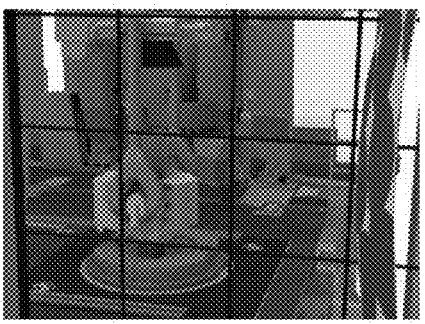
FIGS. 71A and 71B illustrate opening the elevator and hoisting the top drive to the height of the catwalk ramp.
Figure 71B:
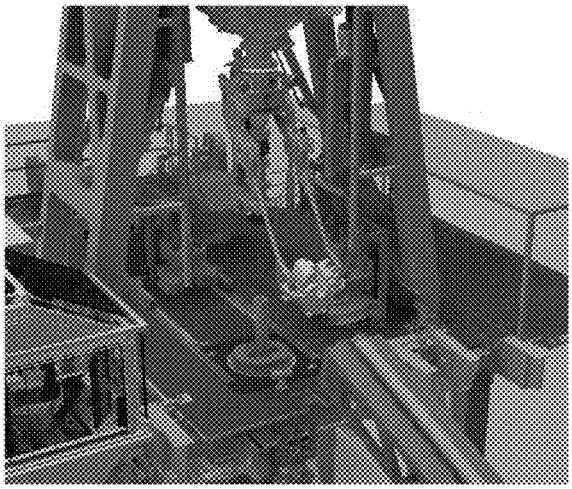

Step 3: Open the elevator and hoist to catwalk pick-up position. The top drive 200 elevator is opened, and the link arms are tilted back so the elevator can clear the casing tubular joint. See FIG. 71A. The top drive is hoisted to the catwalk pick-up position. See FIG. 71B.

Figure 72A:
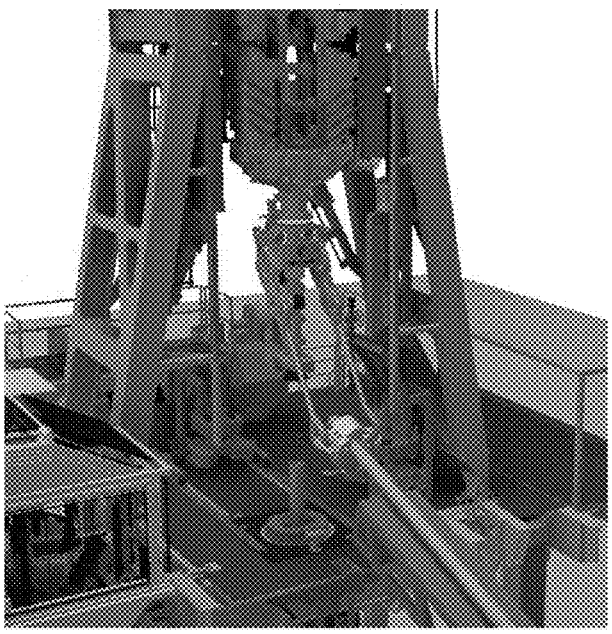
FIGS. 72A and 72B illustrate pushing the casing up the ramp.
Figure 72B:
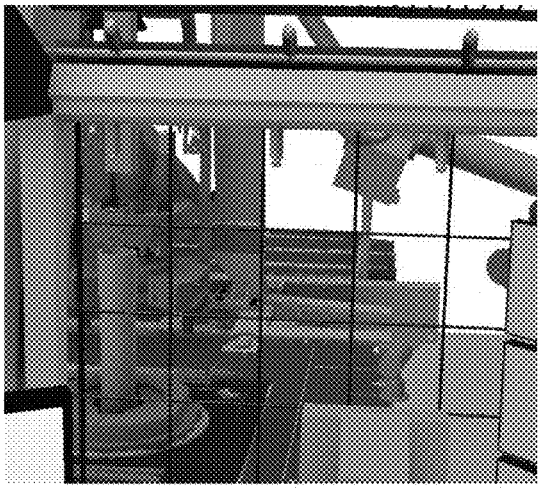

Step 4: Push the casing. The pipe pusher of the catwalk machine 600 pushes the casing up the ramp to the latching position. The top drive link arms are tilted forward to swing the elevator toward the casing, and the elevator latches onto the casing. See FIGS. 72A and 72B.

Figure 73:
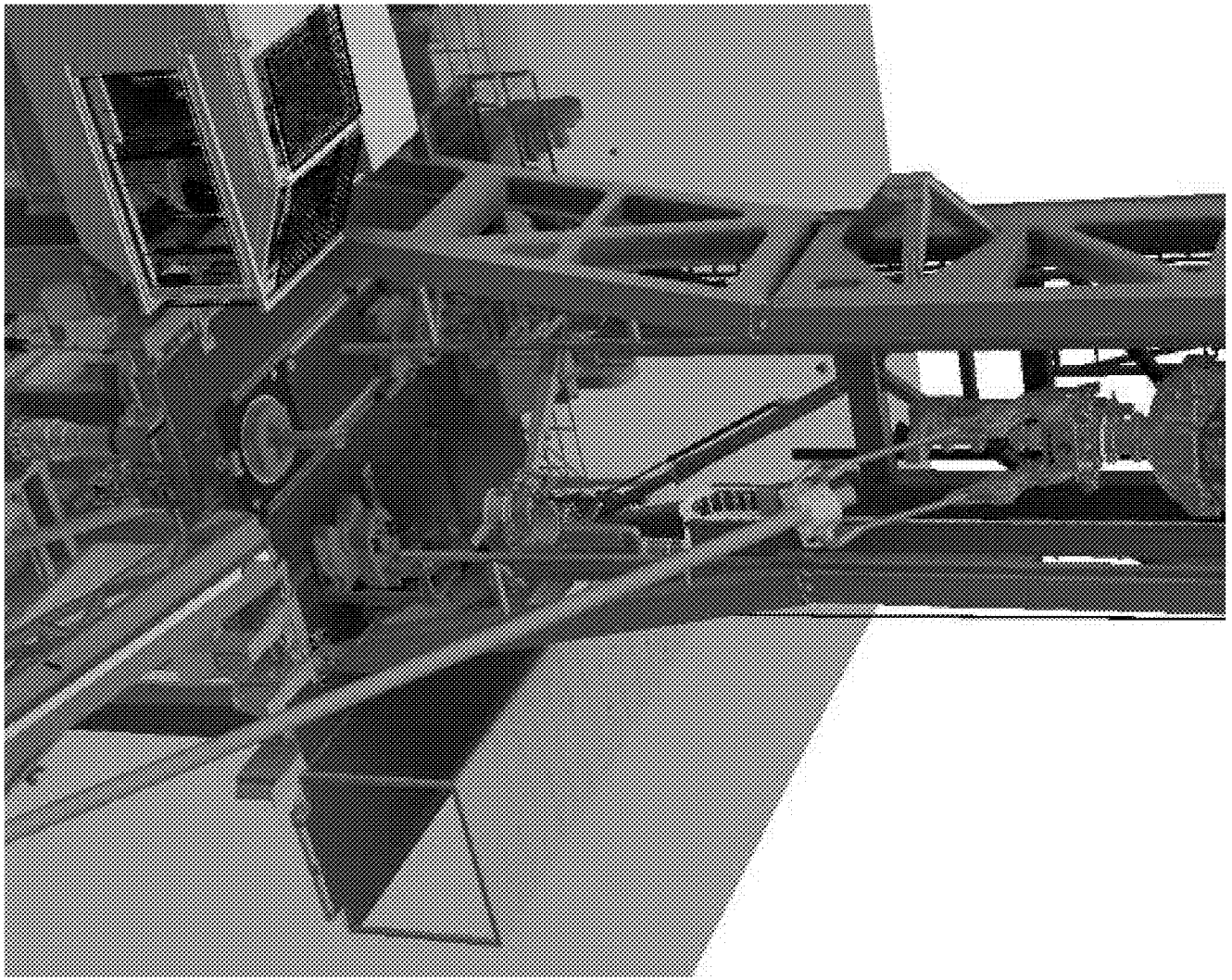
FIG. 73 illustrates pulling up the casing.

Step 5: Pull up the casing. The casing is pulled up by hoisting the top drive 200 so that the box end of the casing is lifted by the elevator. As the top drive is hoisted, the lower box end of the casing slides up the ramp of the catwalk machine 600. Before the lower box end of the casing exits the end of the ramp of the catwalk machine 600, the lower stabilizing arm 800 extends and closes its funnel to guide the casing. As the casing approaches vertical, the centralizers of the lower stabilizing arm 800 close on the casing. See FIG. 73.

Figure 74A:
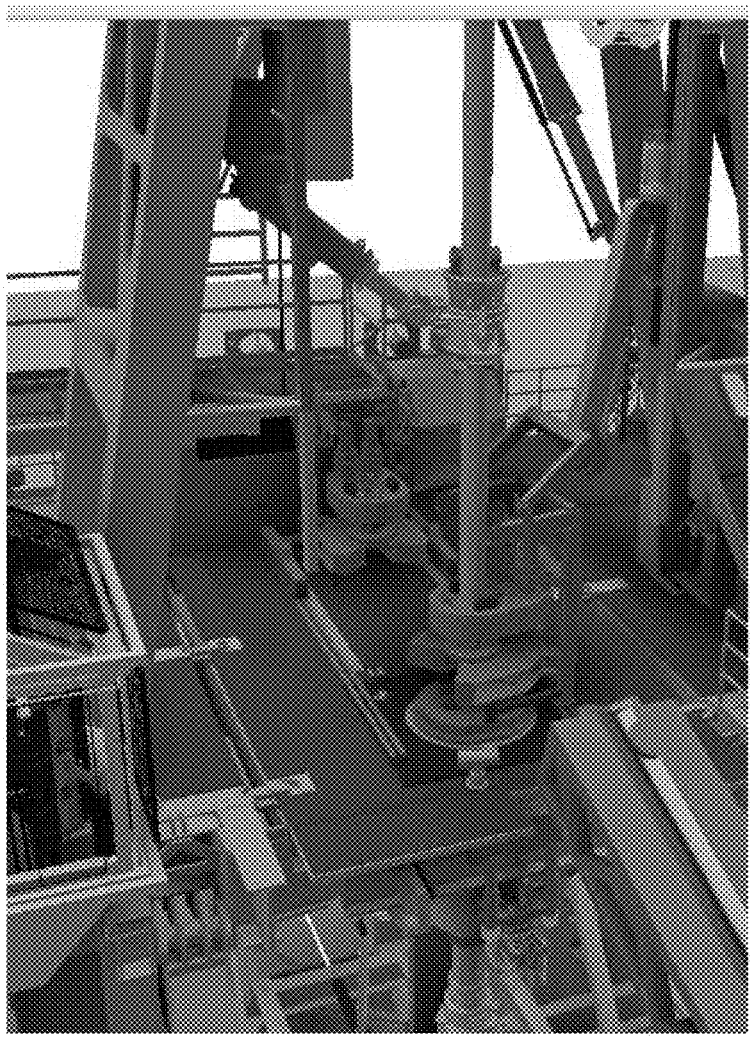
FIGS. 74A and 74B illustrate guiding the casing to the well center.
Figure 74B:
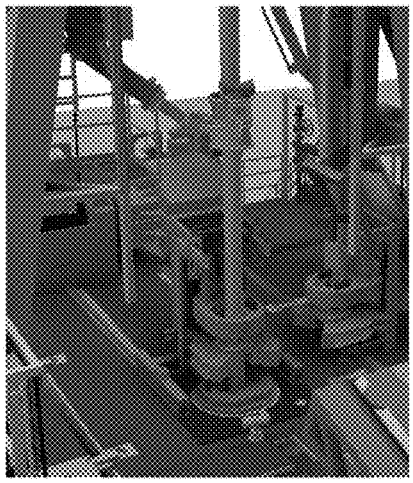

Step 6: Guide the casing to well center. The tong handling arm and casing tong are moved to the stick-up as the top drive 200 continues to hoist the casing. When the pin end is hoisted above the stick-up, the lower stabilizing arm 800 guides the casing to the well center 30. The catwalk ramp moves out and down to a position for loading the next casing. See FIG. 74A. In an alternative embodiment where a tong handling trolley is used, the roughneck on the tong handling trolley may be used for the connection. See FIG. 74B.

Figure 75:
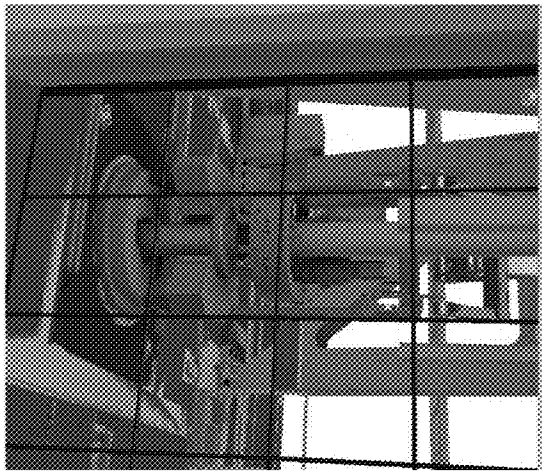
FIG. 75 illustrates stabbing the casing and making up the joint.

Step 7: Stab the casing and make-up. The stabbing guide of the casing tong is closed above the stick-up. The top drive is lowered to stab the casing into the stabbing guide. When the casing is in the stabbing guide, the lower stabilizing arm 800 is opened and retracted. The top drive is further lowered to stab the casing into the stick-up. The casing tong spins the casing to thread the casing's pin end into the stick-up's box end. The casing tong then applies torque to make-up the joint. See FIG. 75.

Figure 76:
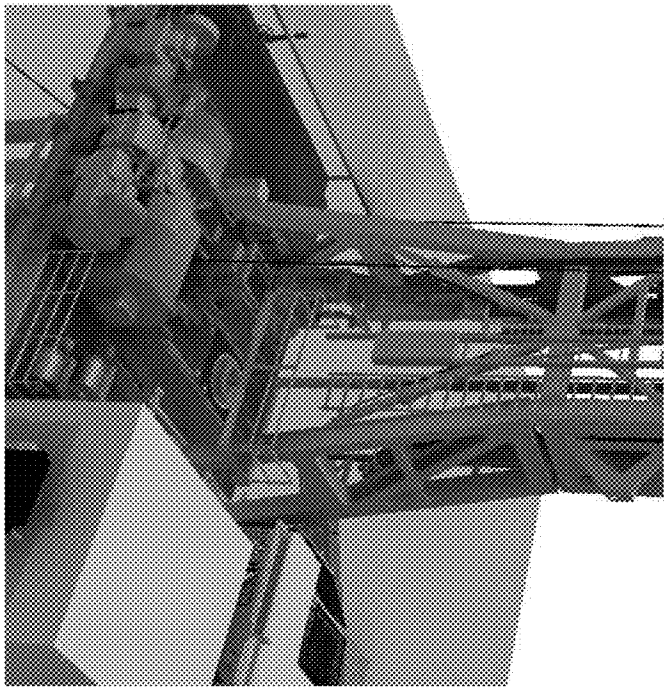
FIG. 76 illustrates lowering the casing string.

Step 9: Lower the casing string. The casing tong is moved to its standby position. Pick up the weight of the casing string with the top drive/drawworks. Open the slips in the spider. Lower the casing string into the wellbore to the stick-up height. Set the slips in the spider. See FIG. 76.

(XI) Sequence for Breaking Out Single Casing with Casing Tong and Laying Down to Catwalk The sequence for breaking out single casing with a casing tong and laying down the casing single to the catwalk is very similar to the sequence for running casing from the catwalk with the casing tong. The difference is that the steps are performed in reverse order.

(XII) Sequence for Running Casing from Catwalk with Top Drive and Casing Running Tool The initial equipment configuration for the sequence for running casing from the catwalk with a top drive and casing running tool is as follows:

- The top drive 200 is in a lower position on the well center axis 30, and the casing running tool is closed around the pipe stick-up.
- The casing string is suspended in a spider in the rig floor 6 so that approximately 1.2 m/4 ft of drill string sticks up from the rig floor 6.
- The casing is laid out on the catwalk machine casing side (driller's side). The casing tubulars are cleaned and doped, with no protectors. Casing tally is updated.
- The ramp of the catwalk machine is loaded with a casing single on the way up.
- The tubular delivery arm is parked in the top of the mast, and the lower stabilizing arm is ready.

The sequence for running casing from the catwalk with a top drive and casing running tool comprises the following steps.

Figure 77A:
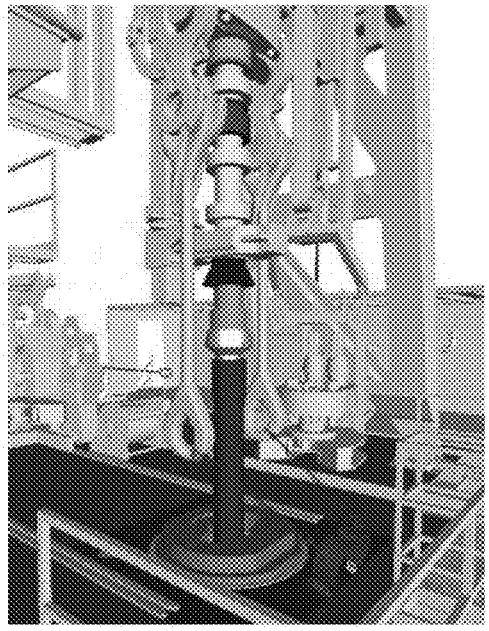
FIGS. 77A-77C illustrate running casing from the catwalk with a casing running tool, by first releasing the casing running tool from the stickup and hoisting the top drive to a ramp pickup position.
Figure 77B:
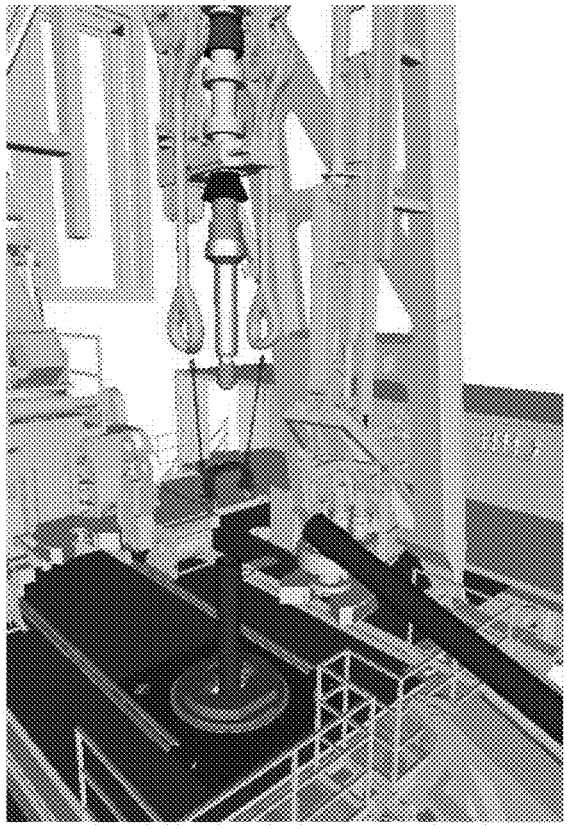
Figure 77C:
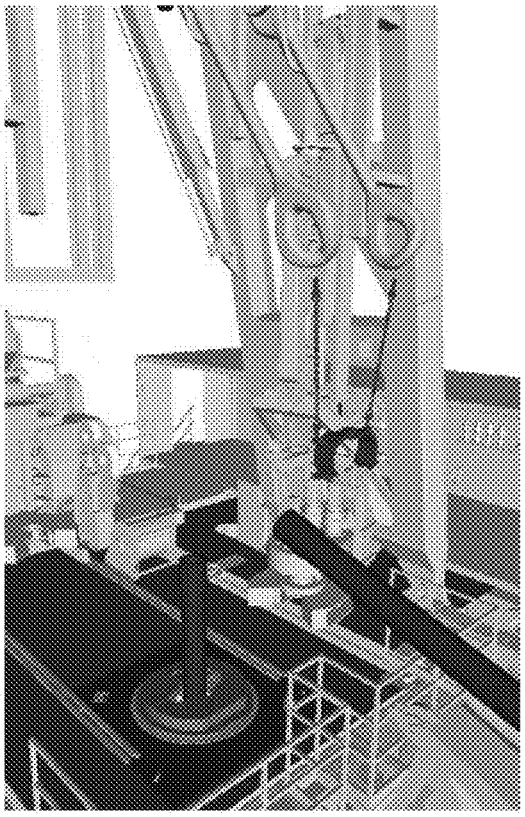

Step 1: Release casing running tool from the stickup and hoist top drive to pick up position. Release the casing running tool from the stickup. See FIG. 77A. Hoist the top drive to the catwalk pick-up position (above the casing). Activate the pipe pusher of the catwalk machine to push the casing forward to the pick-up position. See FIGS. 77B-77C.

Figure 78A:
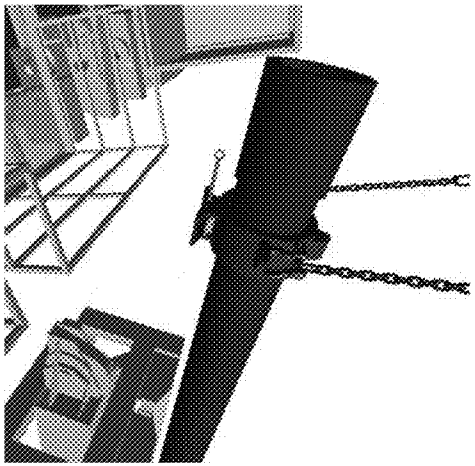
FIGS. 78A-78C illustrate latching the pickup elevator to the casing on the ramp of the catwalk.
Figure 78B:
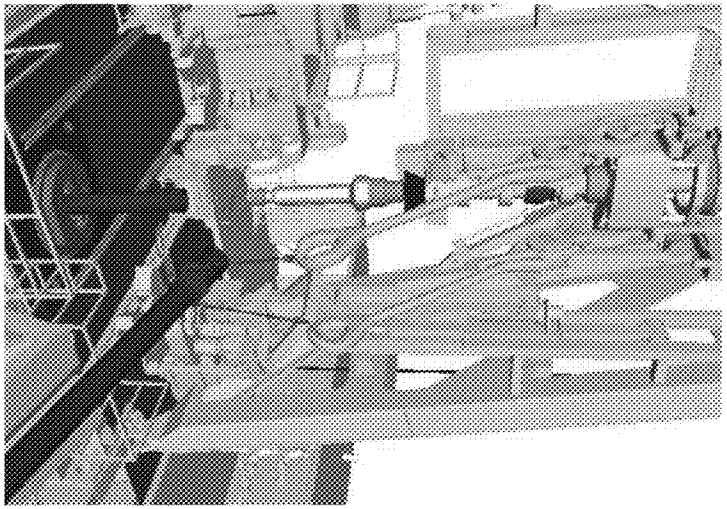
Figure 78C:
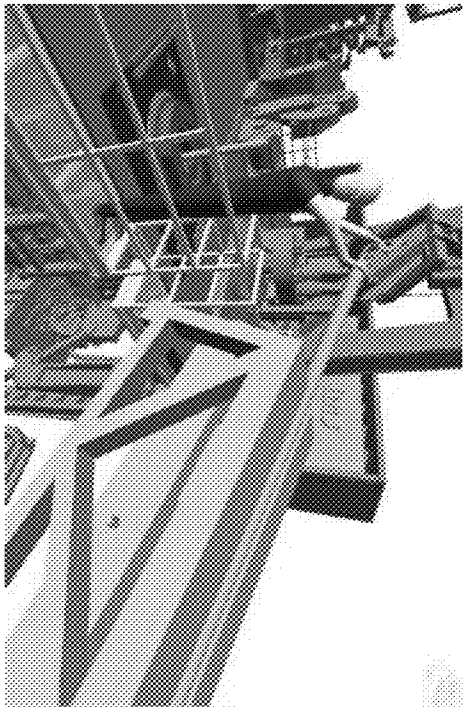

Step 2: Latch elevator. Place the pick-up elevator over the casing. Install safety pin (if manual pick-up elevator). See FIGS. 78A-78C.

Figure 79A:
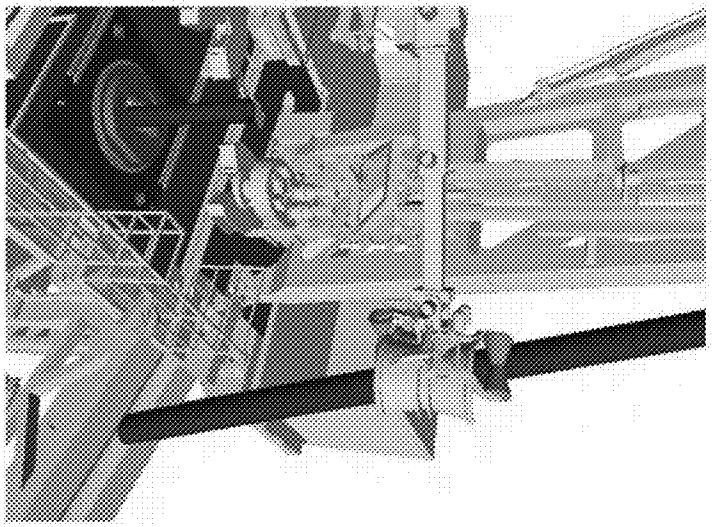
FIGS. 79A and 79B illustrate hoisting the casing from the ramp to the well center.
Figure 79B:
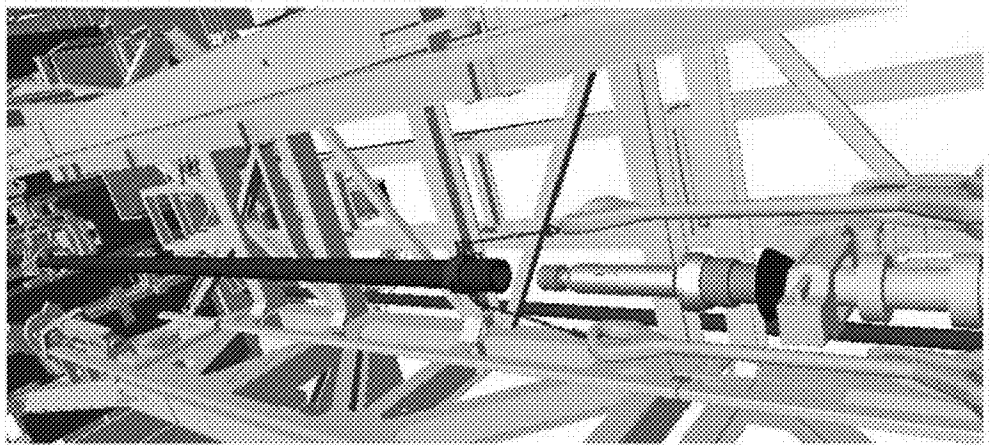

Step 3: The top drive and lower stabilizing arm hoist casing to well center. The tong handling trolley and back up tong move to the well center and elevate to the stick-up height. The top drive links retract (float) to the well center 30 so that the casing is suspended with the pin end above the stick-up and guided by the lower stabilizing arm 800. The catwalk machine is moved to the casing loading position. See FIGS. 79A and 79B.

Figure 80A:
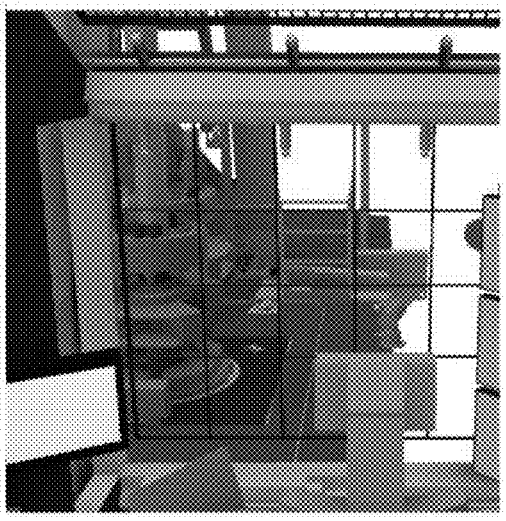
FIGS. 80A and 80B illustrate stabbing the casing.
Figure 80B:
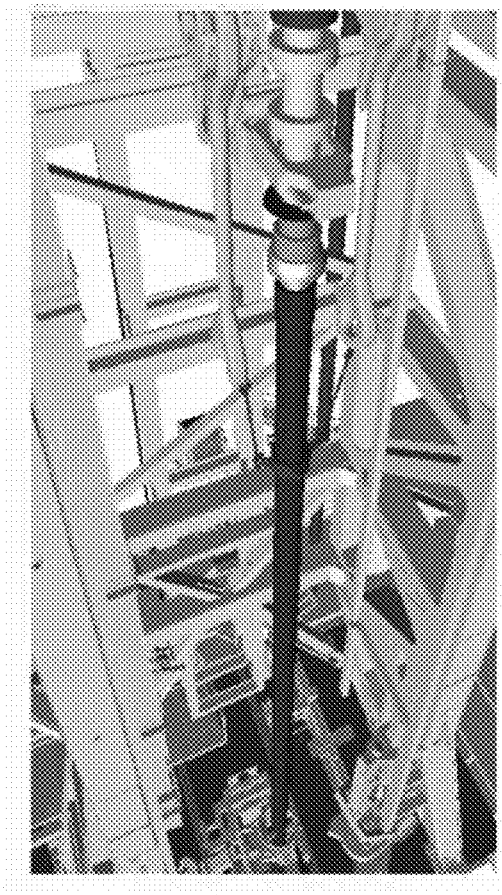

Step 4: Stab the casing and make-up. The stabbing guide of the back-up tong is closed above the stick-up. The top drive is lowered to stab the casing into the stabbing guide (the pickup elevator will slide on the casing). When the casing is in the stabbing guide, the lower stabilizing arm 800 is opened and retracted. The top drive is further lowered to stab the casing running tool. See FIGS. 80A-80B.

Figure 81:
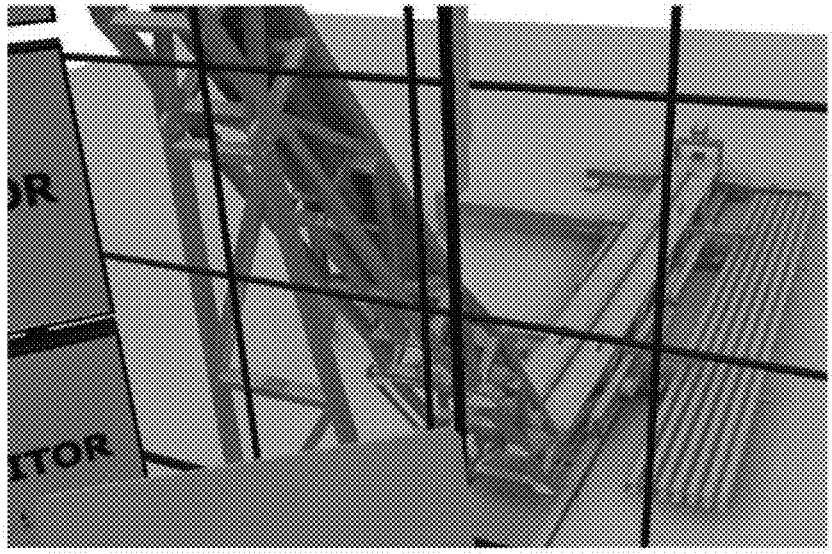
FIG. 81 illustrates loading the next casing on the ramp of the catwalk.

Step 5: Load the next casing on the ramp of the catwalk machine. Casings are placed on the casing side (driller's side) of the catwalk machine. The loading fingers of the catwalk machine load one casing onto the ramp. See FIG. 81.

Figure 82A:
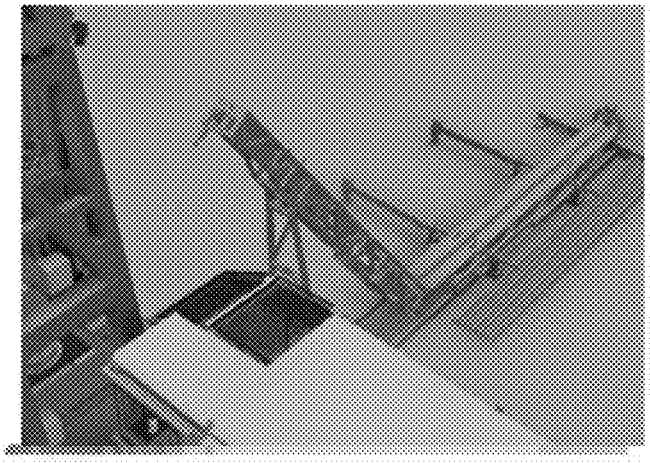
FIGS. 82A and 82B illustrate running the catwalk ramp to the drill floor.
Figure 82B:
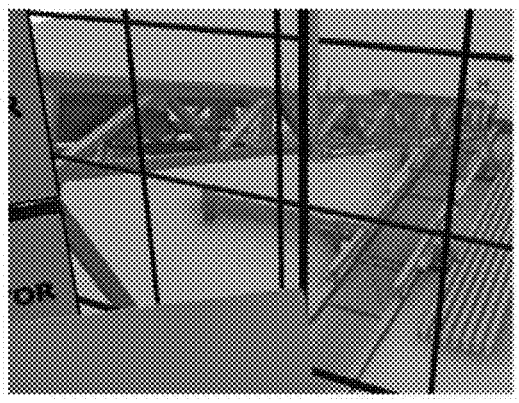

Step 6: Run the ramp of the catwalk machine to the drill floor. The catwalk machine is move to the drill floor position. See FIGS. 82A and 82B.

Figure 83A:
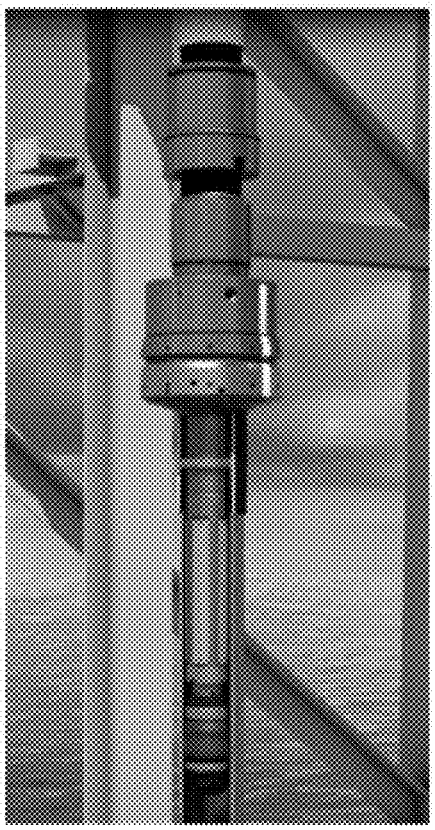
FIGS. 83A and 83B illustrate engaging the casing running tool and making up the casing.
Figure 83B:
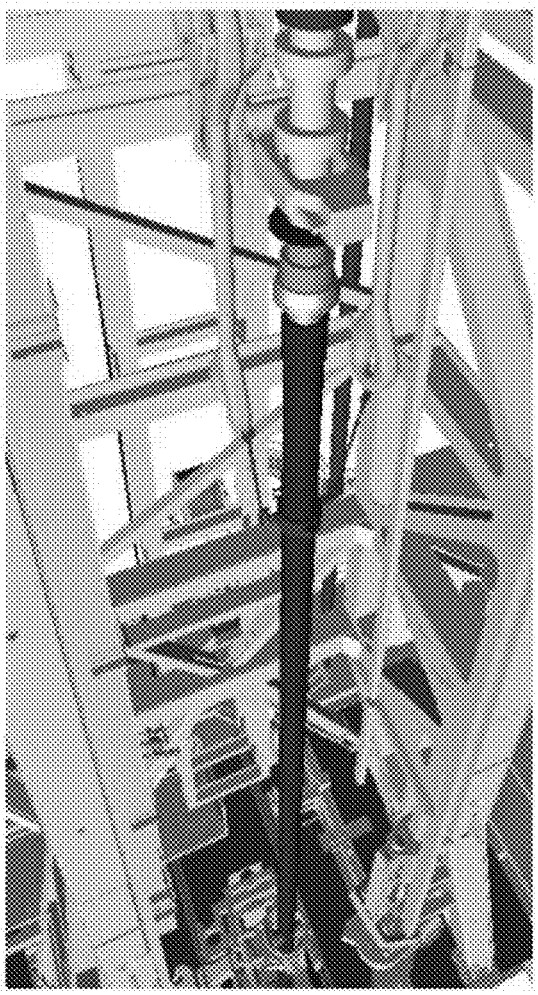

Step 7: Engage the casing running tool and make-up the casing connection. When the casing running tool is stabbed, spin in and make up the connection according to casing running tool operating procedure. See FIGS. 83A and 83B.

Figure 84:
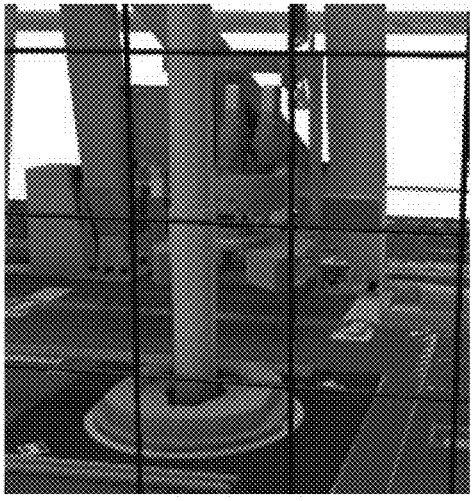
FIG. 84 illustrates opening the casing tong.

Step 8: Open the Backup tong and retract the tong handling trolley. Open the backup tong. Move the tong handling trolley to its park or standby position. See FIG. 84.

Figure 85:
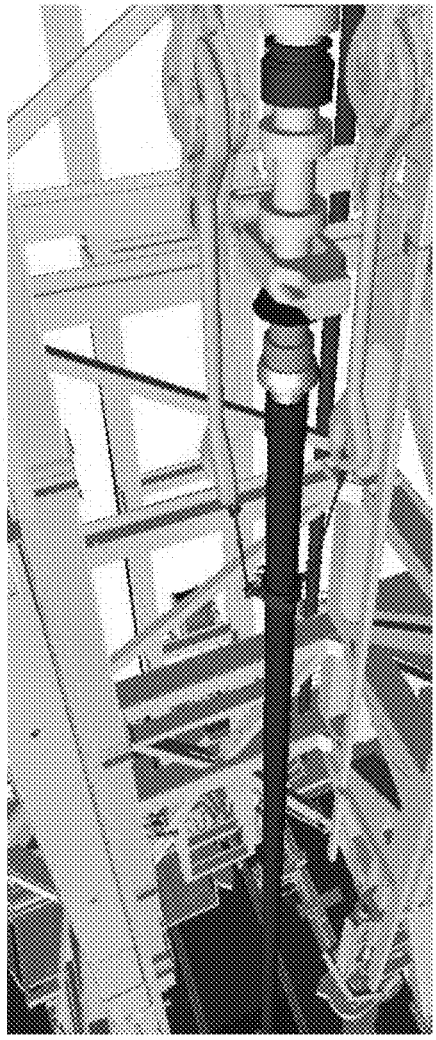
FIG. 85 illustrates lowering the casing string.

Step 9: Lower the casing string and open elevator. Pick up the weight of the casing string with the tope drive/drawworks. Open the slips in the spider. Lower the casing string to stick-up height while filling the casing with drilling mud. Stop lowering the casing string when the elevator is close to the drill floor. Open the manual elevator. See FIG. 85.

Figure 86:
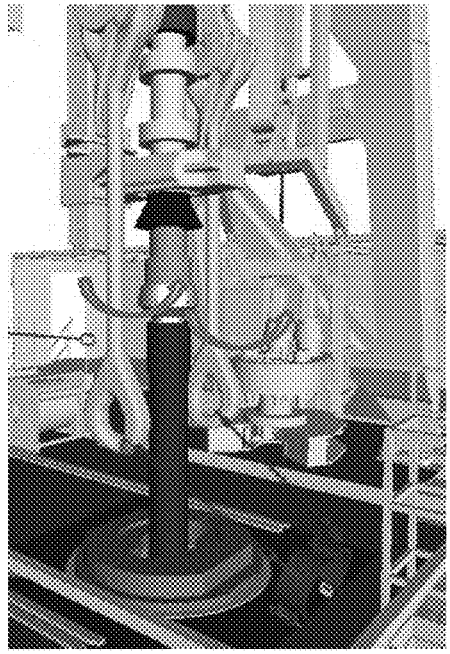
FIG. 86 illustrates tilting the link arms and setting the slips.

Step 10: Tilt the link arms out and set the slips. The link arms are tilted out toward the catwalk machine and the slips are set in the spider. See FIG. 86.

Figure 87:
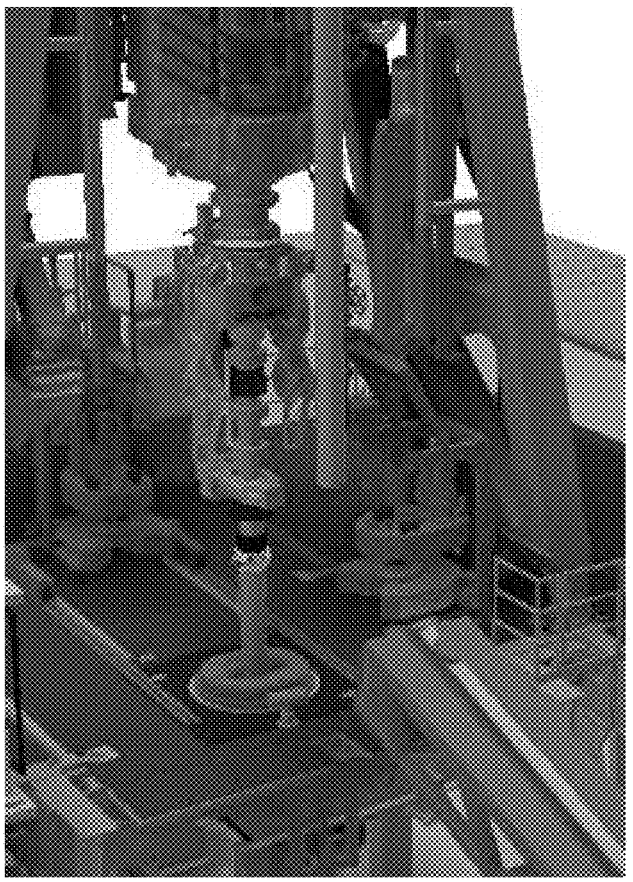
FIG. 87 illustrates running casing from a catwalk with a casing running tool, by first having the casing running tool connected to the casing string.

(XIII) Sequence for Running Casing from Catwalk with Tubular Delivery Arm and Casing Running Tool The initial equipment configuration for the sequence for running casing from the catwalk with a tubular delivery arm and casing running tool is as follows:

- The top drive 200 is in a lower position on the well center axis 30, and the casing running tool is closed around the pipe stick-up.
- The casing string is suspended in a spider in the rig floor 6 so that approximately 1.2 m/4 ft of drill string sticks up from the rig floor 6.
- The casing is laid out on the catwalk machine casing side (driller's side). The casing tubulars are cleaned and doped, with no protectors. Casing tally is updated.
- The ramp of the catwalk machine is empty in a loading position.
- The tubular delivery arm and lower stabilizing arm are holding a casing in the drilling floor standby position. See FIG. 87.

The sequence for running casing from the catwalk with a tubular delivery arm and casing running tool comprises the following steps.

Figure 88:
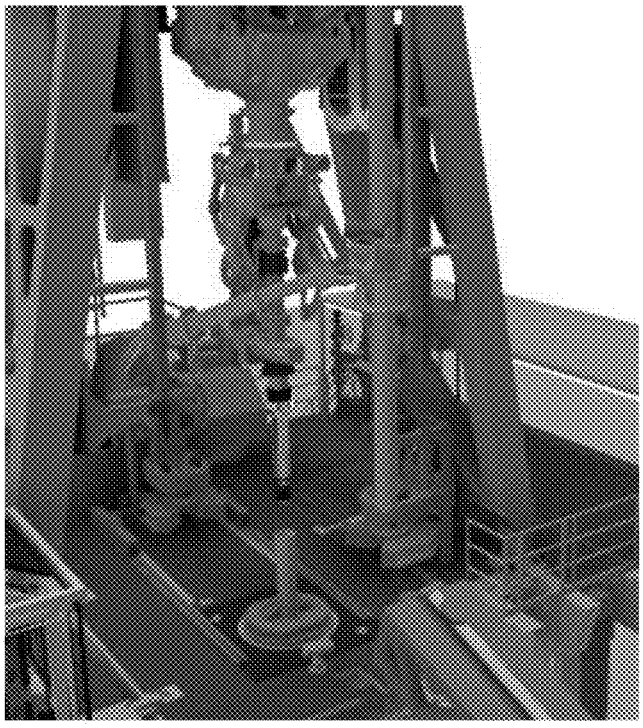
FIG. 88 illustrates releasing the casing running tool from the stickup and hoisting the top drive.

Step 1: Release casing running tool from the stickup and hoist top drive to pick up position. Release the casing running tool from the stickup. Hoist the top drive to clear the stickup. Retract the top drive and tilt link arms to vertical position. Hoist top drive and casing running tool to CRT stabbing position above the casing. See FIG. 88.

Figure 89A:
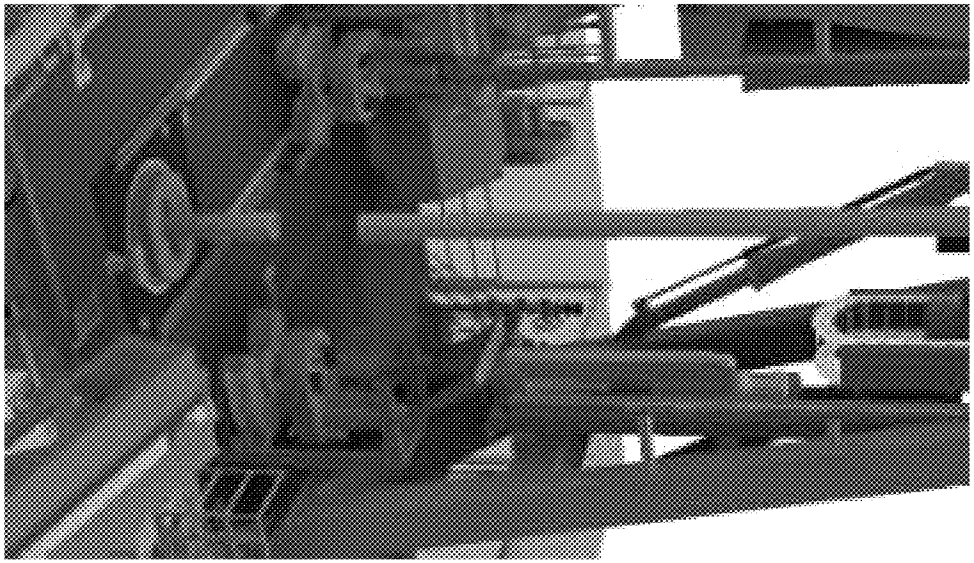
FIGS. 89A and 89B illustrate moving the casing from the catwalk to the well center.
Figure 89B:
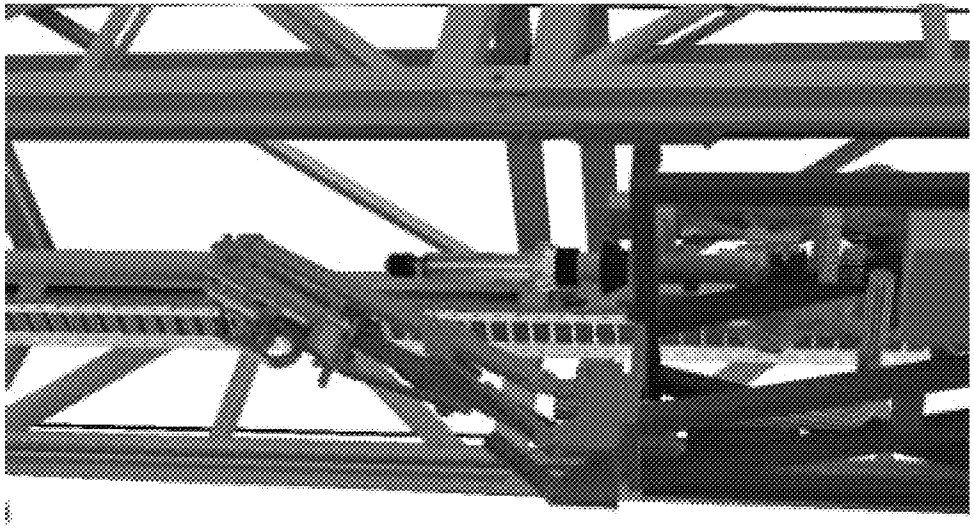

Step 2: Move the casing to well center. The tubular delivery arm 500 and the lower stabilizing arm 800 move the casing section to the well center 30 and elevate to the stick-up height. The tubular delivery arm 500 extends to the well center 30 with pin end above the stick-up, guided by the lower stabilizing arm 800. See FIGS. 89A and 89B.

Step 3: Stab the casing. The casing tong and the stabbing guide close on the stick-up. The make up spinning tong is positioned and closed on the casing (can be closed before or after stabbing the casing). The tubular delivery arm 500 lowers to stab the casing. See FIG. 90. The lower stabilizing arm opens and retracts when the casing is inside the stabbing guide. The tubular delivery arm 500 continues to lower the casing (approximately 1 m/3 ft) to allow room for make-up with the casing running tool.

Step 4: Load the casing on the ramp. The casings are placed on the casing side (driller's side) of the ramp of the catwalk machine 600. The loading fingers load one casing onto the ramp of the catwalk machine 600. See FIG. 91.

Figure 92A:
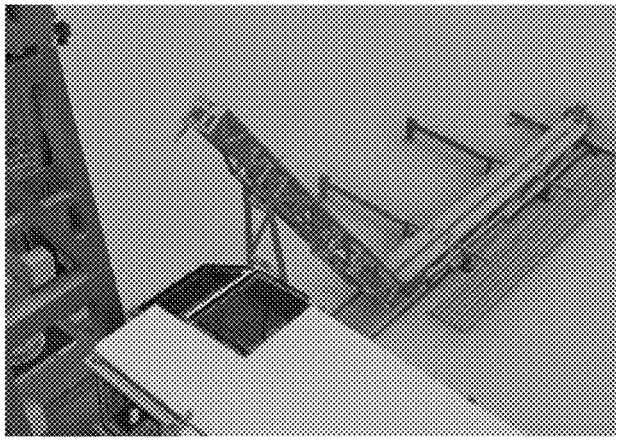
FIGS. 92A and 92B illustrate running the ramp of the catwalk to the drill floor.
Figure 92B:
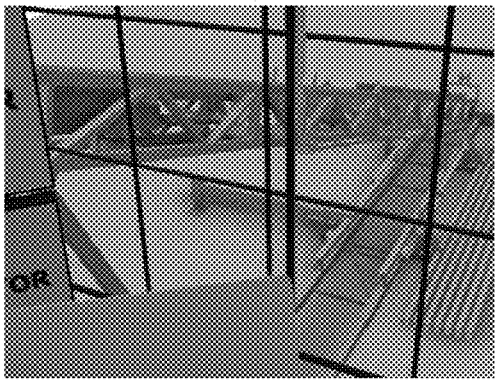

Step 5: Run the casing to the drill floor. The ramp of the catwalk extends to the drill floor position, and the tool pusher slides the casing up the ramp to deliver the casing to the drill floor. See FIGS. 92A and 92B.

Figure 93A:
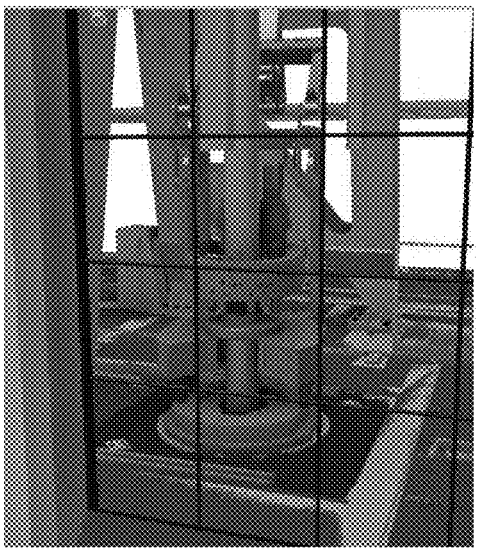
FIGS. 93A and 93B illustrate making the connection of the first single to the string with the casing tong.
Figure 93B:
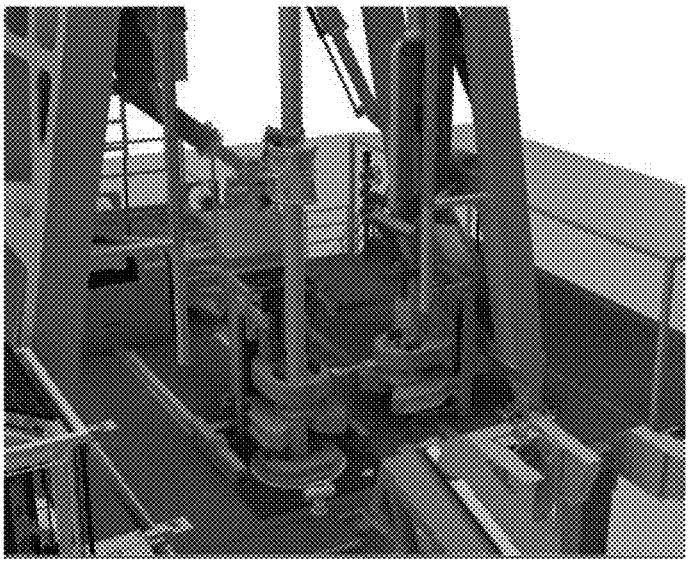

Step 6: Make up the casing connection. The tong handling arm and the casing tong make up the connection by spinning the treads and applying torque. The casing tong opens and the tong handling arm retracts, and may optionally be moved to a standby or parking position. See FIG. 93A. Alternatively, the casing connection may be made up via the tong handling trolley and casing tong. See FIG. 93B. Still another alternative is for the casing connection to be made up with the casing running tool by spinning and torqueing with the top drive.

Figure 94A:
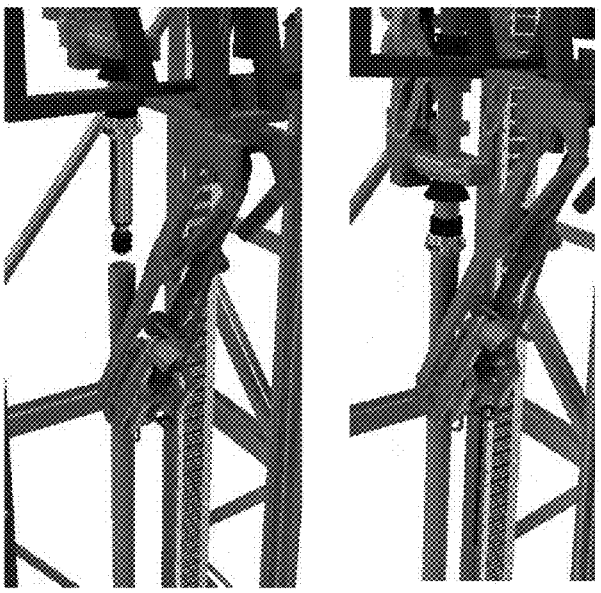
FIGS. 94A and 94B illustrate stabbing the casing running tool and releasing the tubular delivery arm.
Figure 94B:
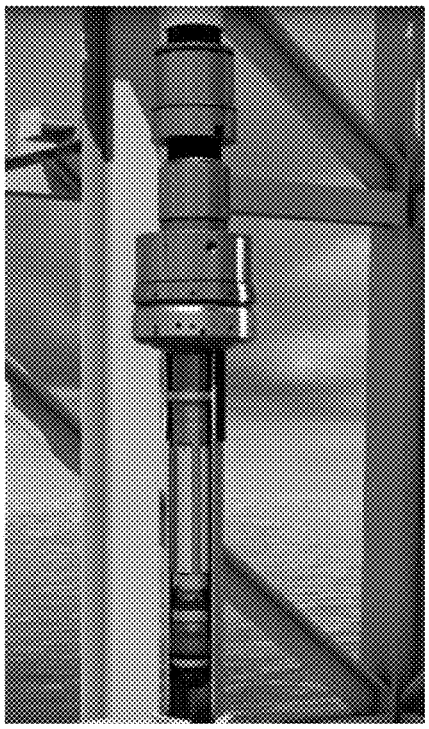

Step 7: Stab in the casing running tool. The casing running tool is stabbed in and locked in the casing. The tubular delivery arm 500 is opened and moved to the catwalk pick-up position. See FIGS. 94A and 94B.

Figure 95A:
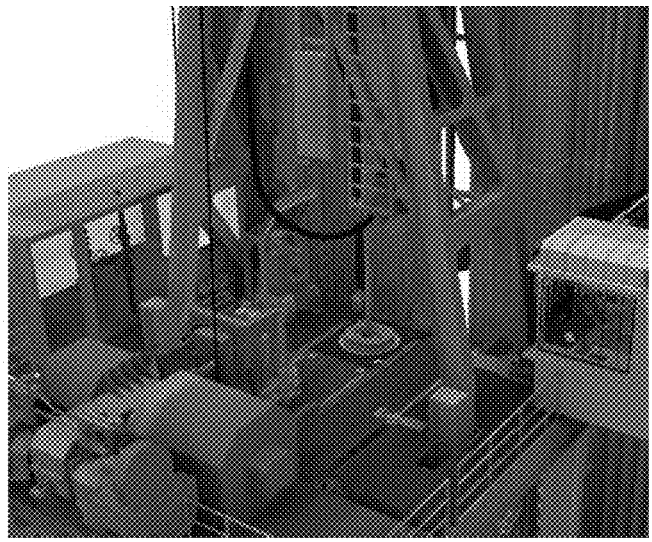
FIGS. 95A and 95B illustrate lowering the casing string.
Figure 95B:
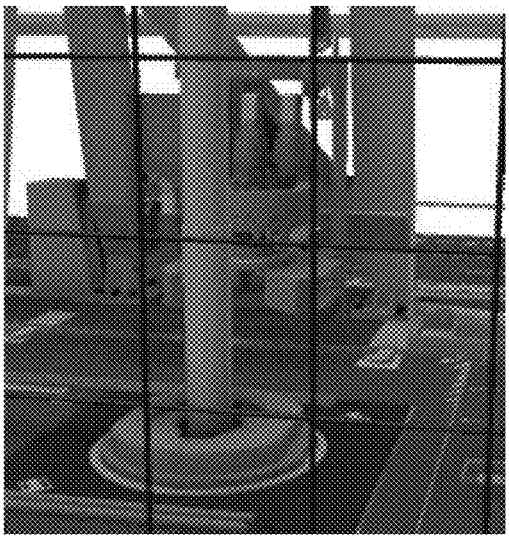

Step 8: Lower the casing string. The top drive/drawworks pick up the weight of the casing string. The slips in the spider are opened. The top drive/drawworks lower the casing string into the well bore to the stick-up height. Optionally, the casing may be filled with drilling fluid. See FIGS. 95A and 95B.

Figure 96:
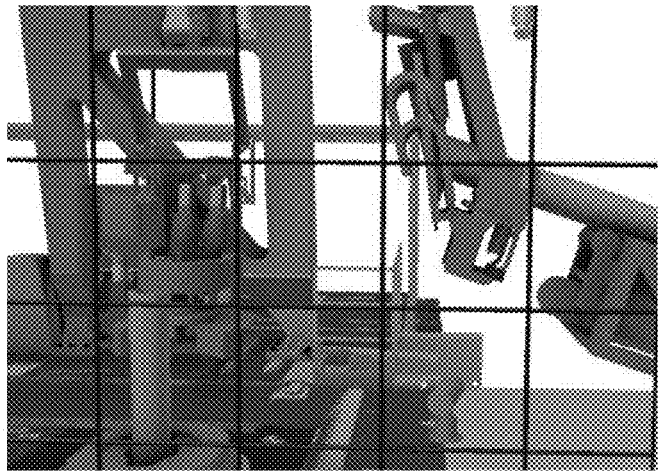
FIG. 96 illustrates pushing the casing up the ramp.

Step 9: Push the casing. The tool delivery arm 500 is moved to the catwalk machine pick up position so that its elevator may receive a casing section. The pipe pusher pushes a casing section up the ramp. The tool delivery arm latches 500 its elevator to the casing section. See FIG. 96.

Figure 97A:
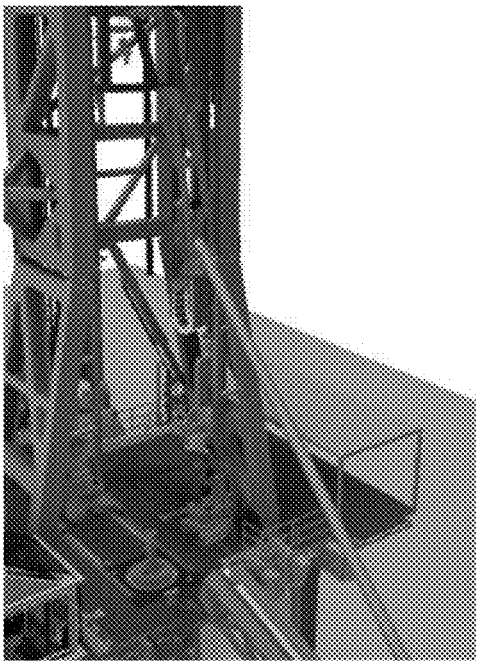
FIGS. 97A and 97B illustrate pulling the casing from the ramp with the tubular delivery arm.
Figure 97B:
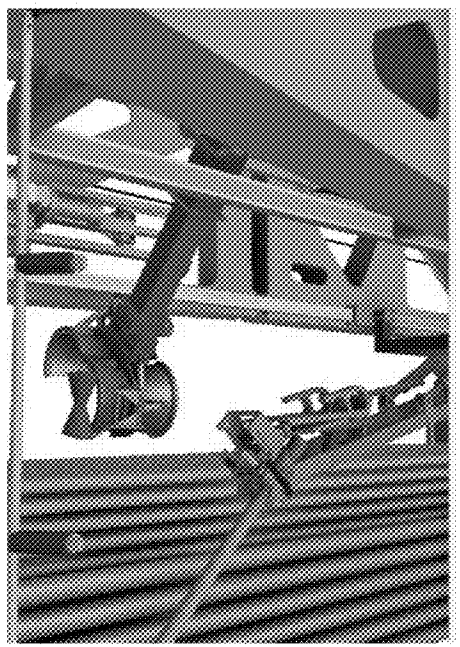

Step 10: Pull up the casing. With its elevator closed around the casing, the tubular delivery arm 500 hoists the casing and the tool pusher pushes the casing up the ramp. Prior to the casing leaving the ramp of the catwalk, the lower stabilizing arm 800 extends to the casing and prepares for guiding, and the funnel is closed on the casing. As the casing approaches vertical, the centralizer of the lower stabilizing arm 800 closes on the casing. The ramp of the catwalk returns to load the next casing. See FIGS. 97A-97B.

Figure 98A:
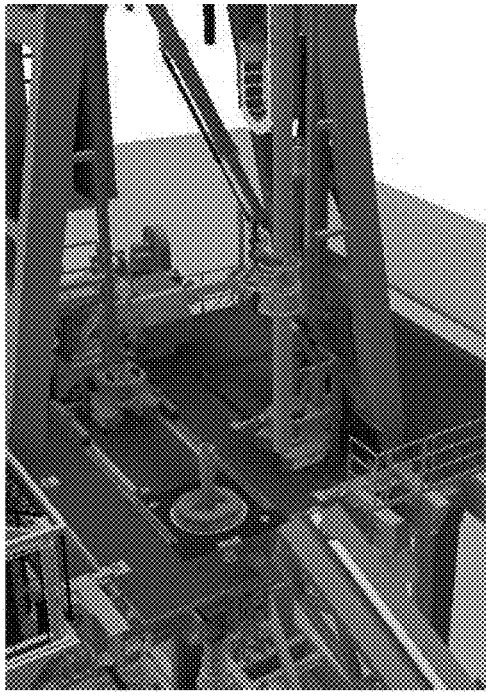
FIGS. 98A and 98B illustrate guiding the casing to a drill floor standby position.
Figure 98B:
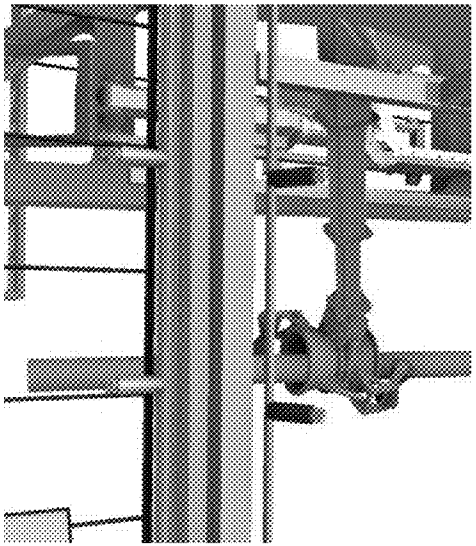

Step 11: Guide the casing. The tubular delivery arm 500 continues to hoist and retract to bring the casing to a vertical position before it rotates toward the top drive. The lower stabilizing arm 800 guides the casing to a vertical position. See FIGS. 98A-98B.

Figure 99A:
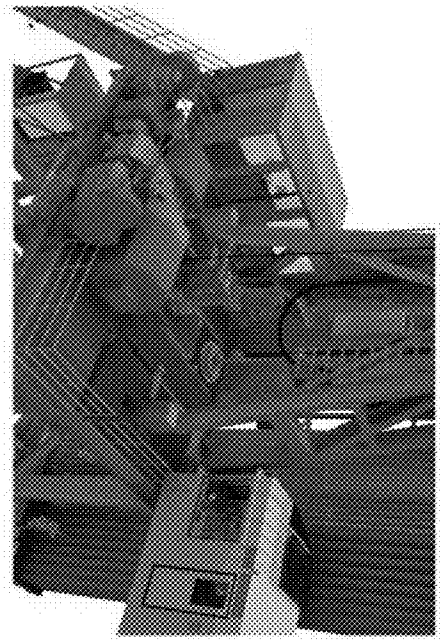
FIGS. 99A and 99B illustrate setting the slips.
Figure 99B:
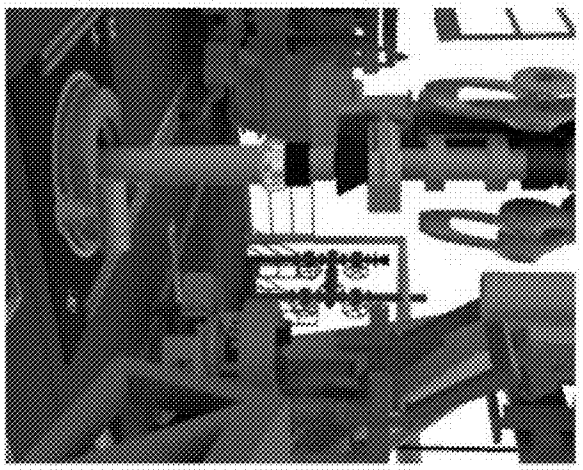

Step 12: Set the slips. The slips are set to suspend the casing string. See FIGS. 99A-99B.

(XIV) Sequence for Offline Drill String Standbuilding

The initial equipment configuration for the sequence for offline standbuilding of drill string is as follows:

- All machines are empty.
- The intermediate stand constraint 430 head is retracted.
- Pipe is loaded on the catwalk feeding table, cleaned and doped without protectors.
- Optionally, the doping may be selected as part of the standbuilding sequence.

The sequence for offline standbuilding comprises the following steps.

Figure 100:
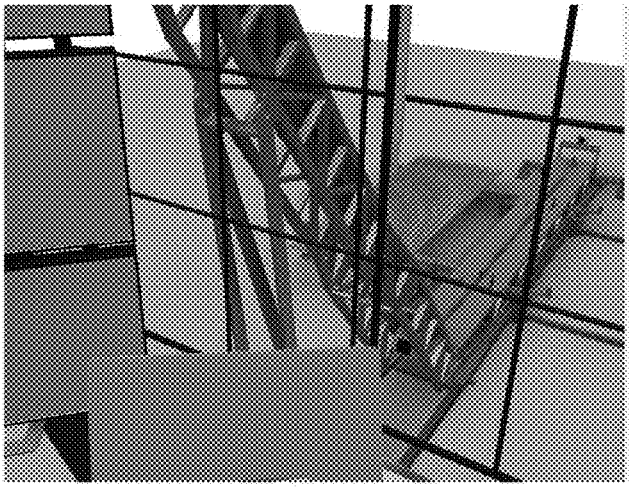
FIG. 100 illustrates an offline standbuilding sequence, by first placing tubulars on the feeding table of the catwalk.

Step 1: Place tubulars on the feeding table. The feeding table then loads one tubular onto the ramp of the catwalk machine 600. See FIG. 100.

Figure 101A:
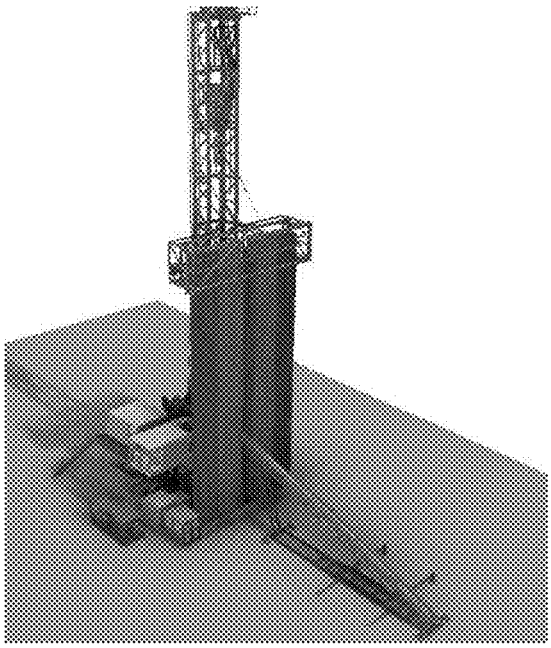
FIGS. 101A and 101B illustrate running the catwalk ramp to the drill floor.
Figure 101B:
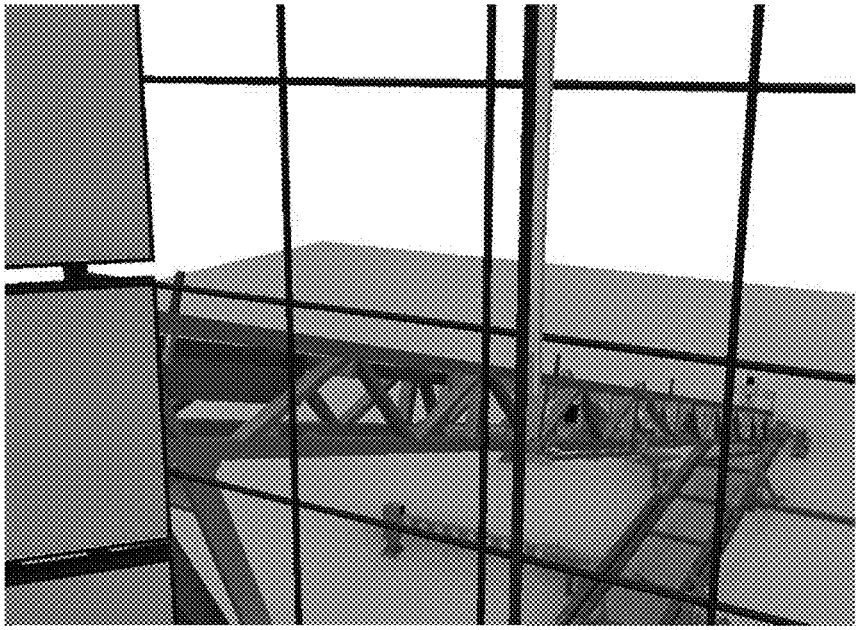

Step 2: Run the ramp to the drill floor. See FIGS. 101A and 101B. The tubular delivery arm 500 is lowered so that its elevator is below the pipe pickup height. The tubular deliver arm 500 tilts its arm toward the catwalk 600.

Figure 102A:
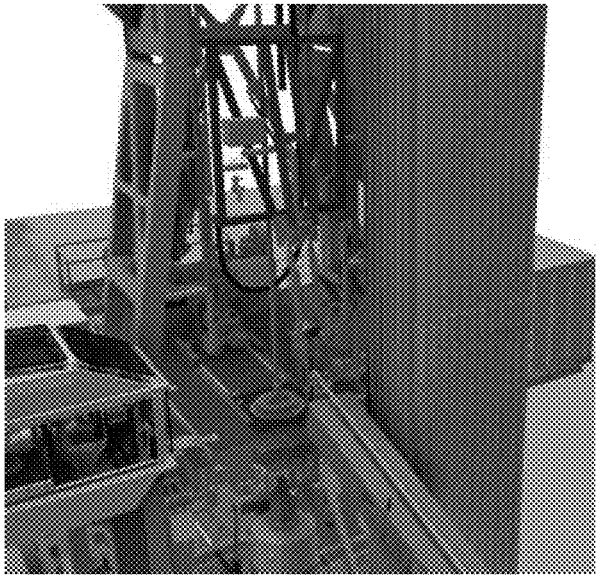
FIGS. 102A and 102B illustrate pushing the tubular up the ramp to the drill floor.
Figure 102B:
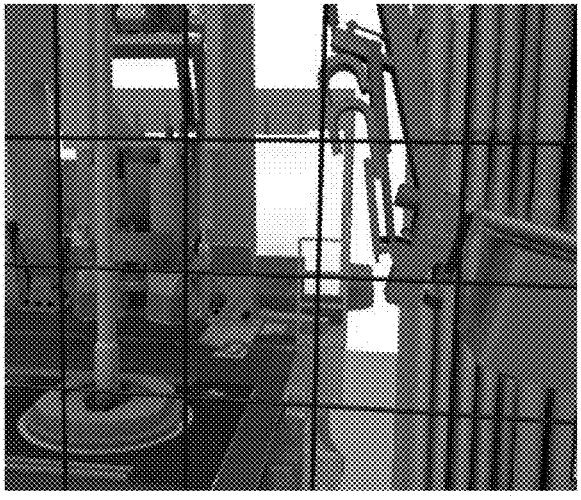

Step 3: Push the tubular. The pipe pusher of the catwalk machine 600 pushes the tubular up the ramp to the latching position. See FIGS. 102A and 102B.

Figure 103A:
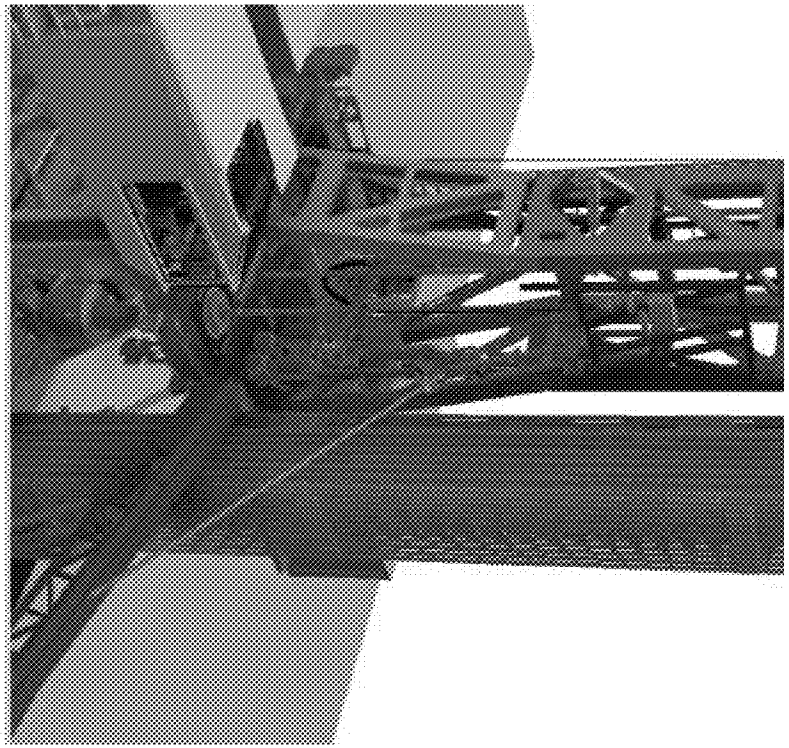
FIGS. 103A and 103B illustrate pulling the tubular up from the ramp by the tubular delivery arm.
Figure 103B:
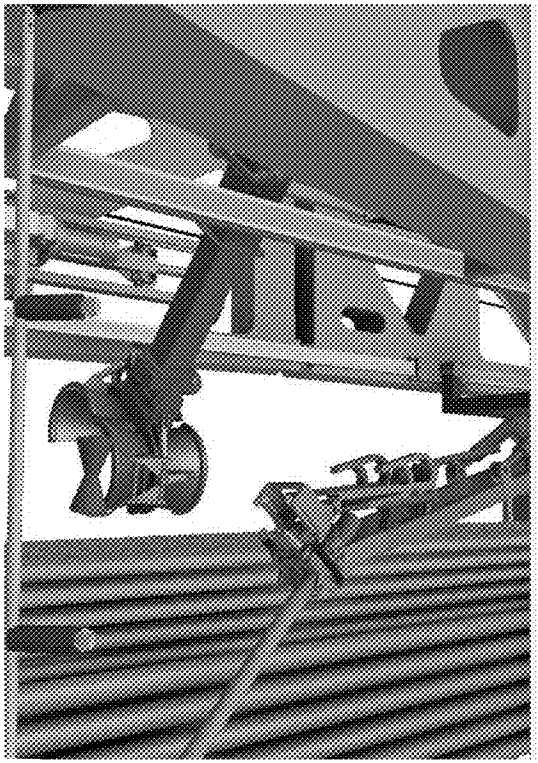

Step 4: Pull up the first tubular from the catwalk machine. The tubular delivery arm 500 is hoisted slightly to latch the elevator to the tubular on the ramp of the catwalk 600. The latch of the elevator is closed. The tubular is pulled up by hoisting the tubular delivery arm 500 up the mast and the pipe pusher follows. Before the tubular leaves the ramp, the lower stabilizing arm 800 extends to prepare for guiding the tubular. The funnel is then closed on the tubular as the tubular raises. As the tubular approaches vertical, the centralizer of the lower stabilizing arm 800 closes on the tubular. The ramp of the catwalk 600 returns to load a second tubular. See FIGS. 103A and 103B.

Figure 104A:
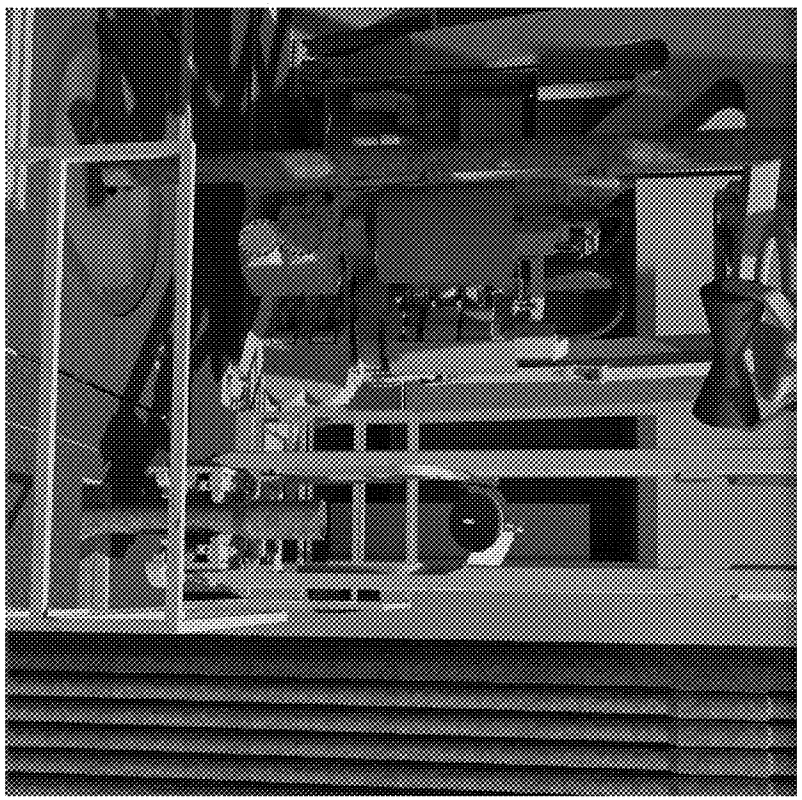
FIGS. 104A and 104B illustrate placing the first tubular in the mousehole and holding with the intermediate stand constraint.
Figure 104B:
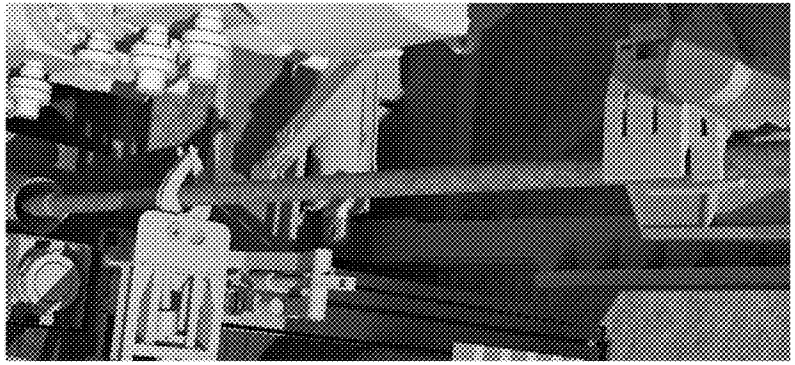

Step 5: Place the first tubular in the mousehole. The first tubular is lowered into the mousehole 40 by the tubular delivery arm 500 to a correct stickup height (1 m/3 ft). The head of the intermediate stand constraint 430 extends and closes on the first tubular. The lower stabilizing arm 800 releases the first tubular and retracts. The lower stand constraint 440 extends and closes on the first tubular. The tubular delivery arm 500 lowers to transfer the weight of the first tubular to the constraints, the elevator opens, and the tubular delivery arm 500 retracts from the stickup. See FIGS. 104A and 104B.

Figure 105A:
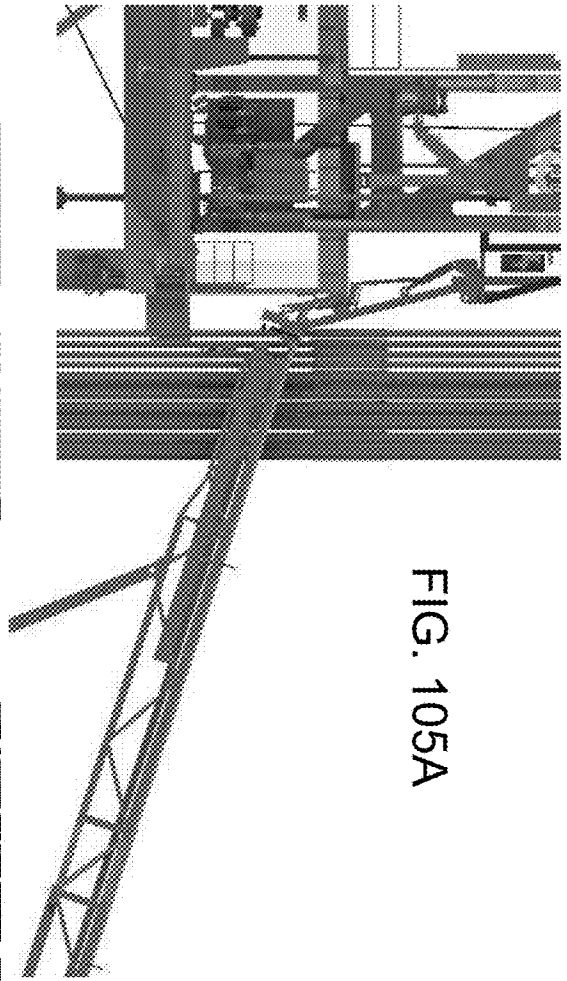
FIGS. 105A-105C illustrate pulling up a second tubular from the catwalk.
Figure 105B:
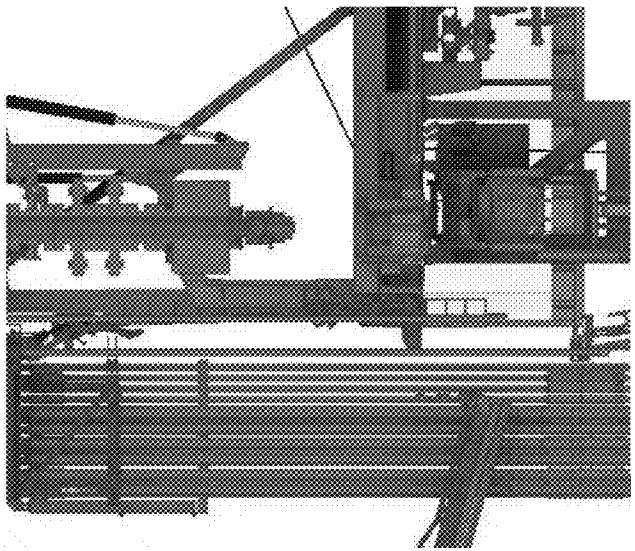
Figure 105C:
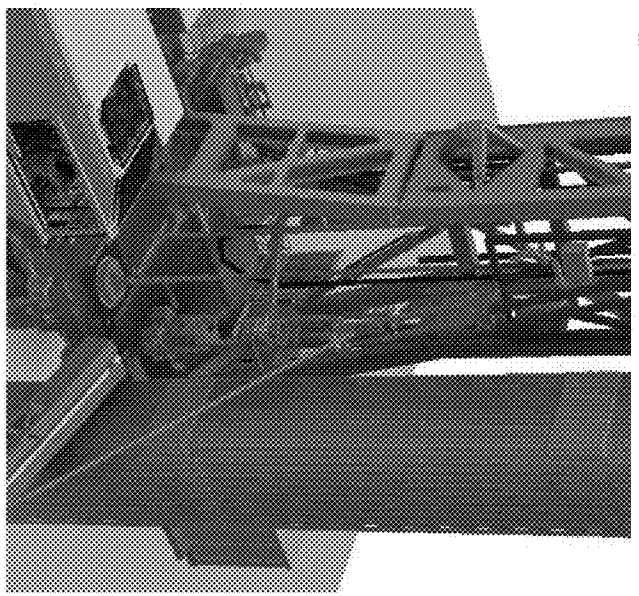
Figure 106A:
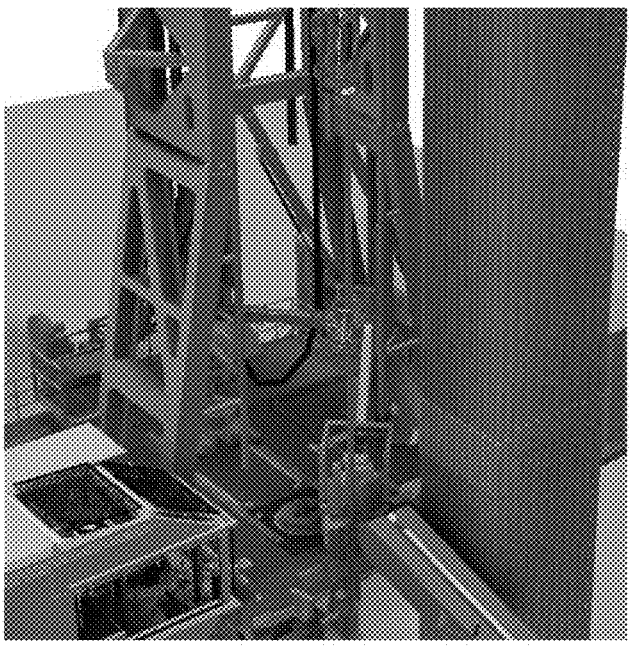
FIGS. 106A and 106B illustrate stabbing the second tubular into the first tubular and making up the joint.
Figure 106B:
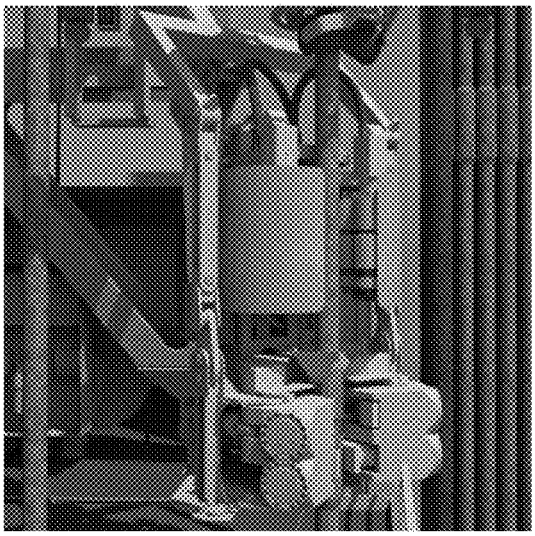

Step 6: Pull up the second tubular. The elevator of the tubular delivery arm 500 is again positioned below the pipe pickup height with the elevator open and tilted toward the catwalk 600. After the second tubular is loaded and the ramp extended, the tool pusher slides the second tubular up the ramp. The tubular delivery arm 500 is hoisted slightly until the elevator engages the second tubular and the elevator latch is closed thereon. The second tubular is pulled up by hoisting the tubular delivery arm and pushed by the tool pusher. Prior to the second tubular leaving the ramp of the catwalk, the lower stabilizing arm 800 extends to the tubular and prepares for guiding, and the funnel is closed on the tubular. As the tubular approaches vertical above the mousehole 40, the centralizer of the lower stabilizing arm 800 closes on the second tubular. If doping is desired, the second tubular is moved to the stand hand-off position 50 prior to moving to the mousehole 40. The ramp of the catwalk returns to load the third tubular. See FIGS. 105A-105C.

Step 7: Stab and make up the second tubular. The second tubular is moved over the stickup of the first tubular in the mousehole 40. The roughneck 760 on the tong handling arm moves to the stickup. The roughneck stabbing guide is closed on the first tubular stickup. The tubular delivery arm is lowered to stab the second tubular into the first tubular stickup. The roughneck spins in and makes up the connection. The lower stabilizing arm opens and retracts. The roughneck retracts to a standby position. See FIGS. 94A and 94B.

Figure 107:
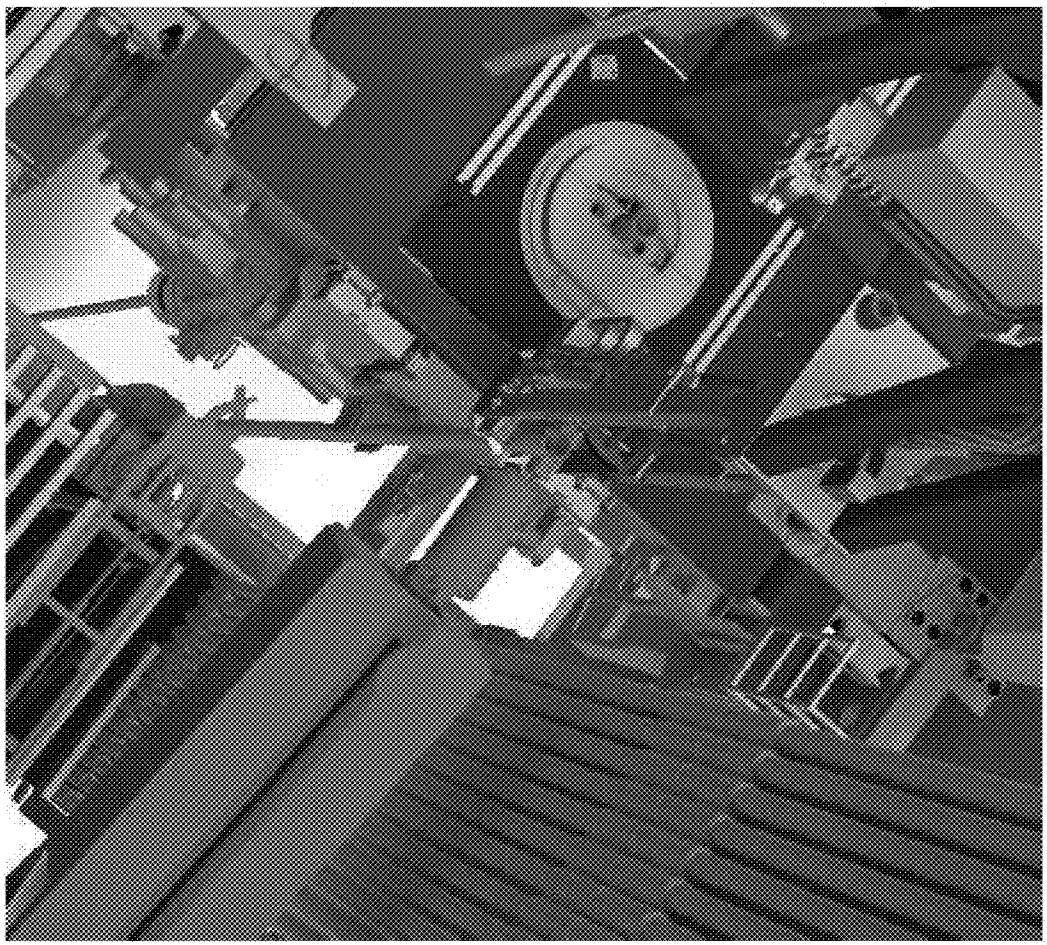
FIG. 107 illustrates lowering the double into the mousehole and holding with the intermediate stand constraint.

Step 8: Lower the double into the mousehole. The tubular delivery arm is hoisted to pick up the weight of the double. The intermediate stand constraint opens to release the double. The lower stand constraint extend to the mousehole position and closes its guide around the double for stabbing mode. The double is lowered by the tubular delivery arm into the mousehole to the correct stickup height, while the lower stand constraint guides the double into the mousehole and opens slightly to allow passage of the tubular joint. The guide of the intermediate stand constraint is then closed and finally the double is clamped to position the double at the stickup height. The tubular delivery arm lowers to transfer the weight of the double to the intermediate stand constraint. The elevator of the tubular delivery arm opens and retracts from the stickup. Repeat steps 6 and 7 to pick up a third single tubular. See FIG. 107.

Figure 108A:
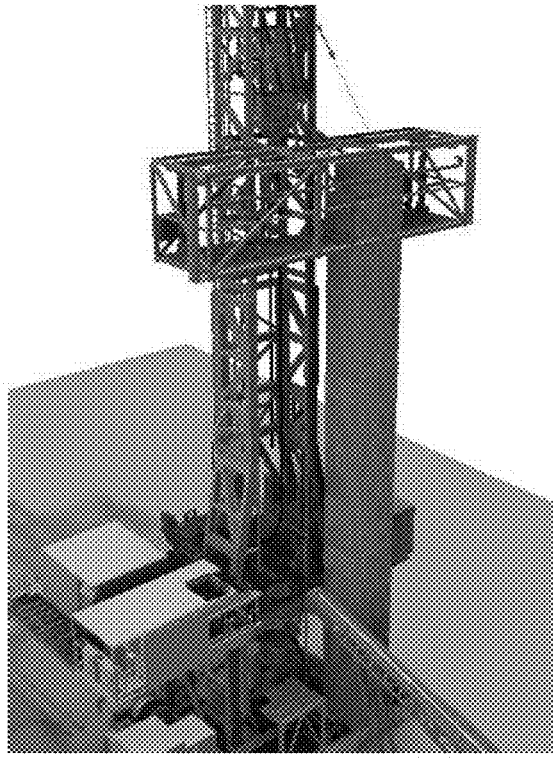
FIGS. 108A and 108B illustrate moving the stand from the mousehole to the stand handoff position.
Figure 108B:
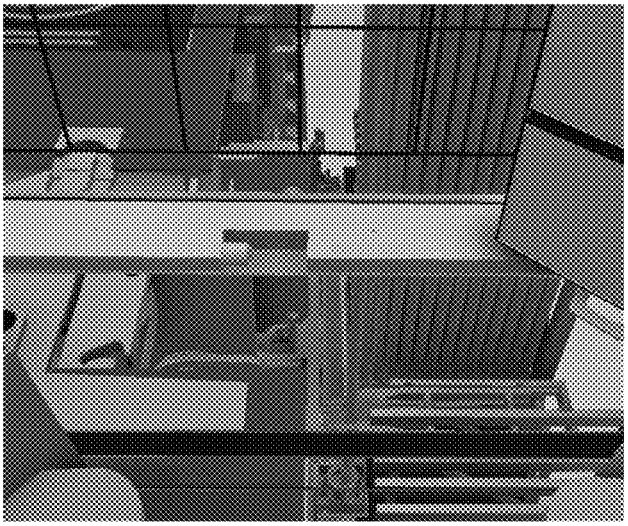
Figure 109A:
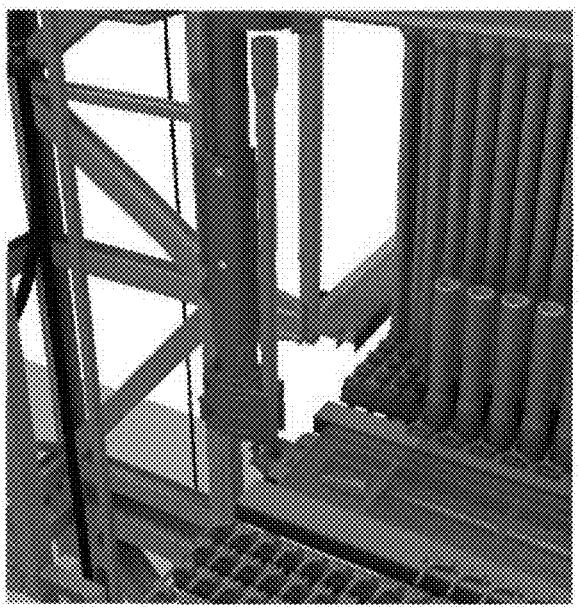
FIGS. 109A-109D illustrate moving the stand from the stand handoff position to a setback position in the fingerboard/setback.
Figure 109B:
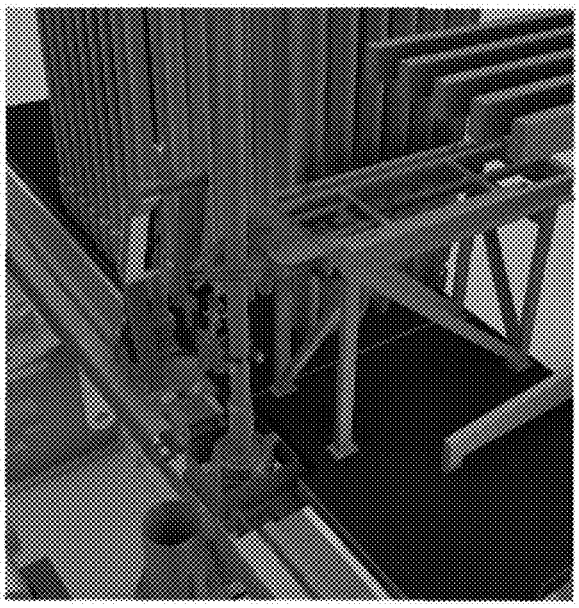
Figure 109C:
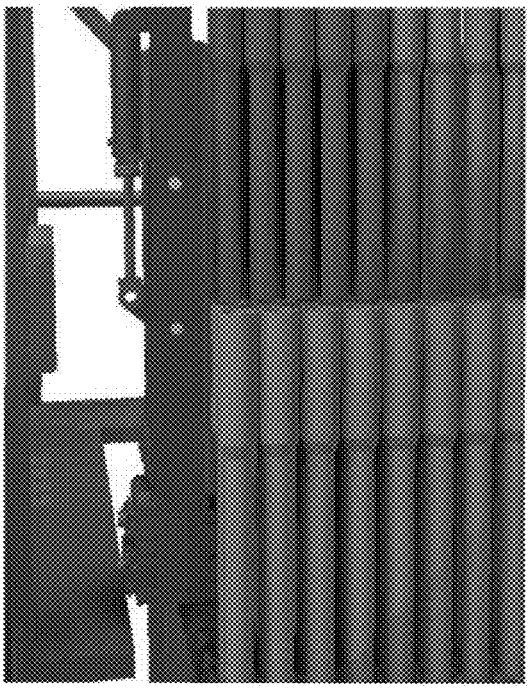
Figure 109D:
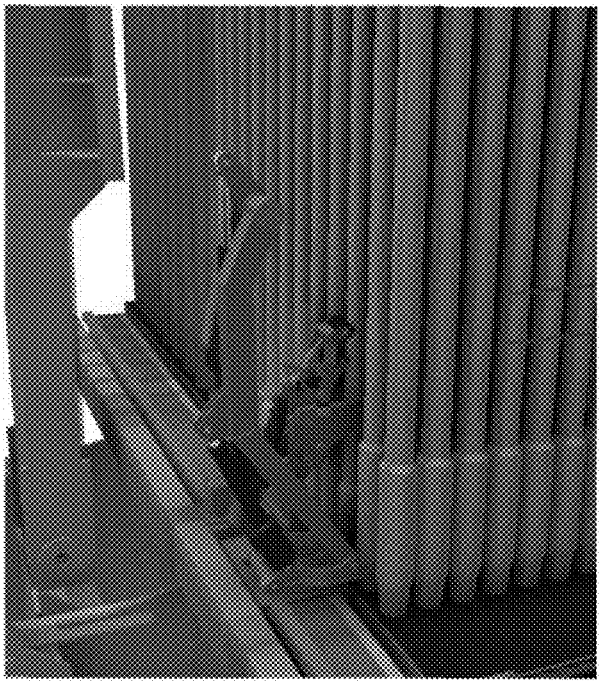

Step 9: Move the stand to the stand handoff position. The lower stand constraint 440 extends to the pipe at the mousehole position and closes its guide. The tubular delivery arm 500 is hoisted to pickup the weight of the stand. Both the guide and the clamp of the intermediate stand constraint 430 are opened. The head of the intermediate stand constraint 430 is retracted. The tubular delivery arm 500 lifts the stand (R2 or R3) from the mousehole 40 and stops when the stand is elevated so that the pin end is above the height of the doper station at the stand handoff position 50. The tubular delivery arm 500 and the lower stabilizing arm 800 move the stand to a position hanging at the stand handoff position 50. The stand is then stabbed into the doper, if selected, where the pin is washed and doped. The upper stand constraint extends to close its guide on the stand. The tubular delivery arm 500 opens and retracts from the stand. See FIGS. 108A and 108B.

Step 10: Set back stand. The transfer bridge racker 350 and the setback guide arm 950 move to the stand handoff position 50 and close their guides and clamps on the stand. The upper and lower stand constraints 420 and 440 open and retract. The transfer bridge racker 350 and the setback guide arm 950 move to setback the stand to a selected position in the fingerboard 310. See FIGS. 109A-109D.

(XV) Sequence for Laying Down Drill String Stands (Offline)

The initial equipment configuration for the sequence for laying down stands of drill string (offline) is as follows:

All machines are empty.

The intermediate stand constraint 430 head is retracted.

The catwalk machine feeding table is empty and ready to receive drill pipe.

The sequence for laying down stands of drill string (offline) comprises the following steps.

Figure 110A:
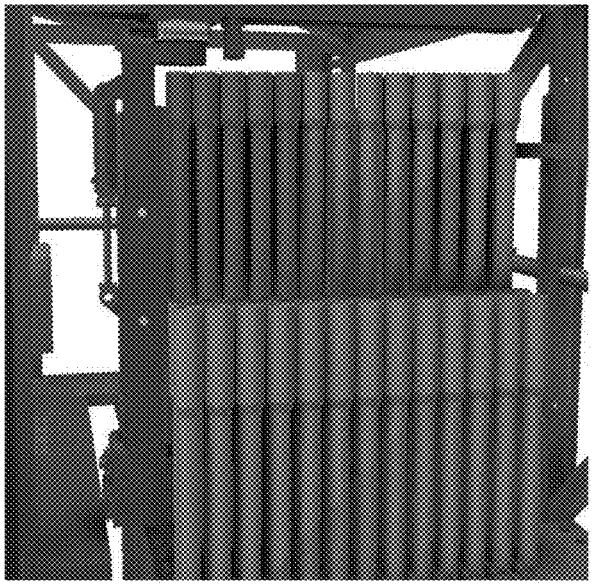
FIGS. 110A and 110B illustrate laying down stands offline, by first picking up a tubular stand from the setback.
Figure 110B:
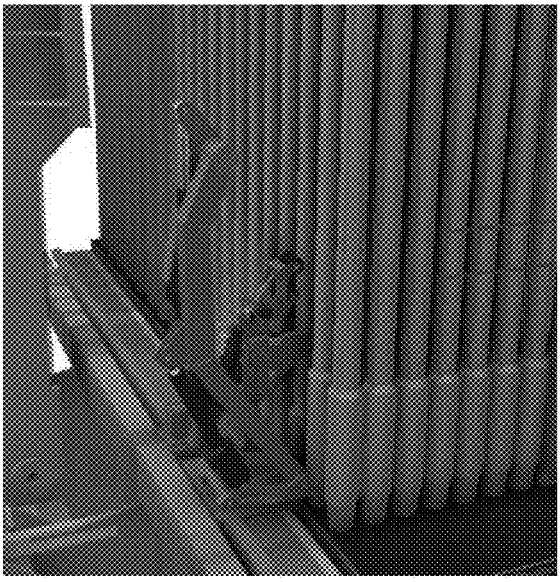

Step 1: Pick up stand from setback. The transfer bridge racker 350 and the setback guide arm 950 move into the setback to pick up a stand from a selected position in the setback/fingerboard 310. See FIGS. 110A and 110B.

Figure 111A:
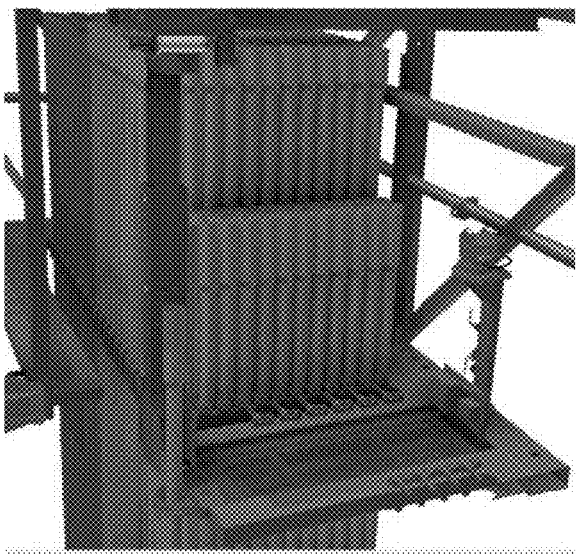
FIGS. 111A and 111B illustrate moving the stand to the stand handoff position.
Figure 111B:
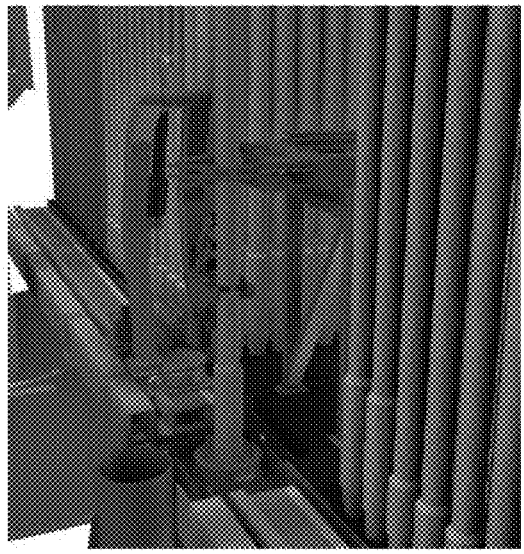

Step 2: Move stand to the stand handoff position. The transfer bridge racker 350 and the setback guide arm 950 move the stand to the stand handoff position 50. The upper and lower stand constraints 420 and 440 close their grasps to hold the stand. The doper washes and dopes the pin (if selected). The transfer bridge racker 350 and the setback guide arm 950 move back into the setback to pick up another stand from another selected position in the setback/fingerboard 310. See FIGS. 111A and 111B.

Figure 112:
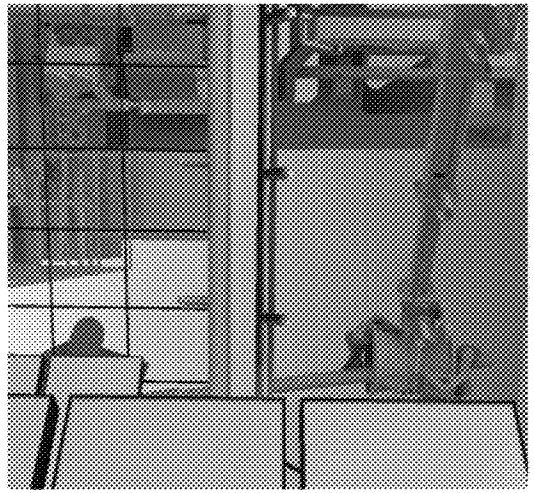
FIG. 112 illustrates moving the stand from the stand handoff position to the mousehole via the tubular delivery arm and the lower stand constraint.

Step 3: Move the stand from the stand handoff position to the mousehole. The tubular delivery arm 500 and the lower stand constraint 440 move to the stand at the stand handoff position 50 and close their clasps on the stand. The upper stand constraint 420 opens and retracts. The tubular delivery arm 500 lists the stand at the stand handoff position 50. The tubular delivery arm 500 and the lower stand constraint 440 move and guide the stand from stand handoff position 50 to the mousehole position 40. See FIG. 112.

Figure 113:
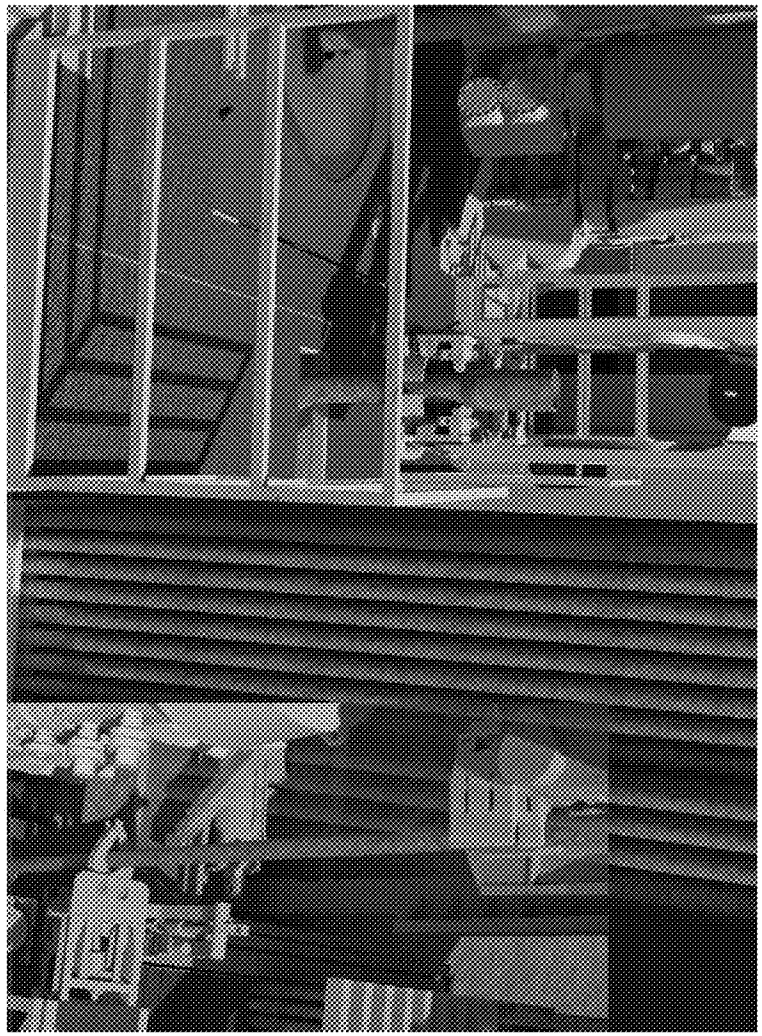
FIG. 113 illustrates lowering the stand into the mousehole.

Step 4: Lower the stand into the mousehole. The tubular delivery arm 500 is lowered to stab the stand into the household 40. The head of the intermediate stand constraint 430 is extended. The stand is lowered until there is about 1 m/3 ft of stickup. The guide and gripper of the intermediate stand constraint 430 are closed on the stand and take the weight. The lower stand constraint 440 opens and retracts. See FIG. 113.

Figure 115A:
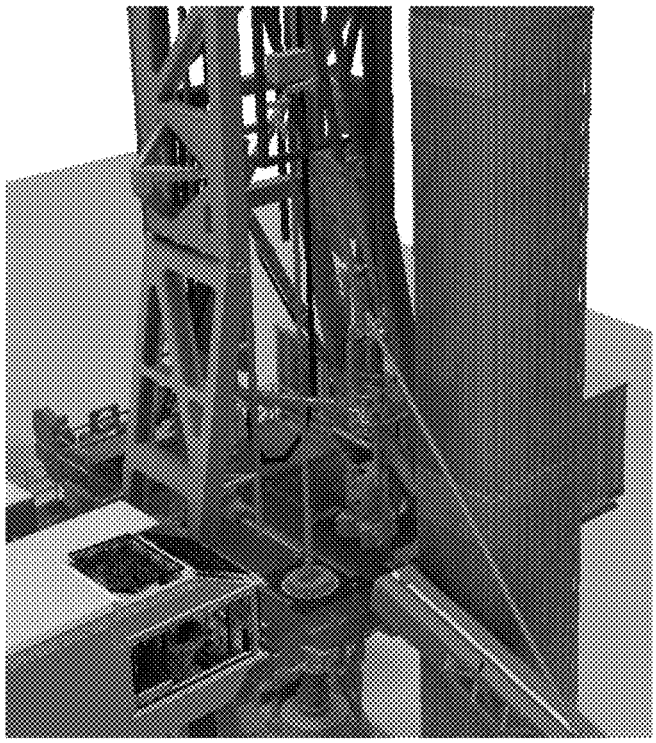
FIGS. 115A and 115B illustrate laying down the top single from the stand on the catwalk.
Figure 115B:
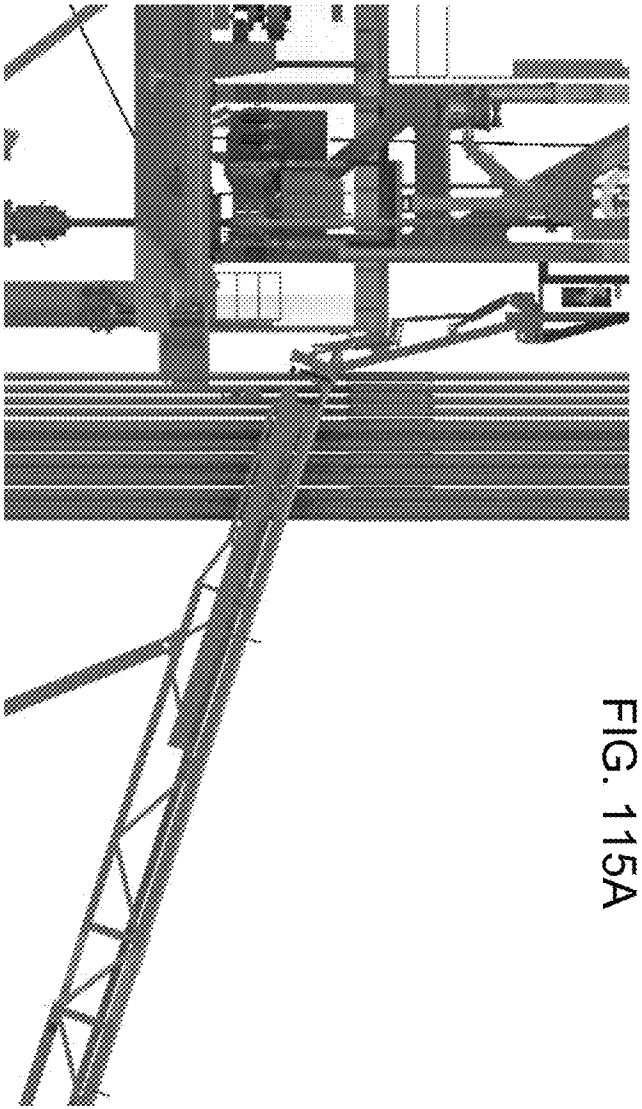

Step 5: Break out the top-single. The roughneck 760 extends to the mousehole 40 to engage the stand. The lower stabilizing arm 800 extends to the mousehole 40 and closes its funnel on the top-single of the stand. The roughneck 760 breaks out the connection, and spins out the threads. See FIGS. 115A and 115B.

Step 6: Lay down the top-single on the catwalk machine. The ramp of the catwalk machine 600 is moved to the drill floor for tubular laydown. The tubular delivery arm 500 lifts the broken out top-single from the stickup and with the help of the lower stabilizing arm 800 it is guided to a position above the ramp of the catwalk 600. The lower stabilizing arm 800 moves the pin end over the ramp and the elevator of the tubular delivery arm 500 tilts toward the ramp. The tubular delivery arm 500 moves down the mast 10 to lower the top-single as the pipe pusher draws the pin end down the ramp of the catwalk 600. When the top-single is loaded on the ramp, the elevator of the tubular delivery arm 500 opens and is tilted back toward the mast 10. See FIGS. 115A and 115B.

Figure 116A:
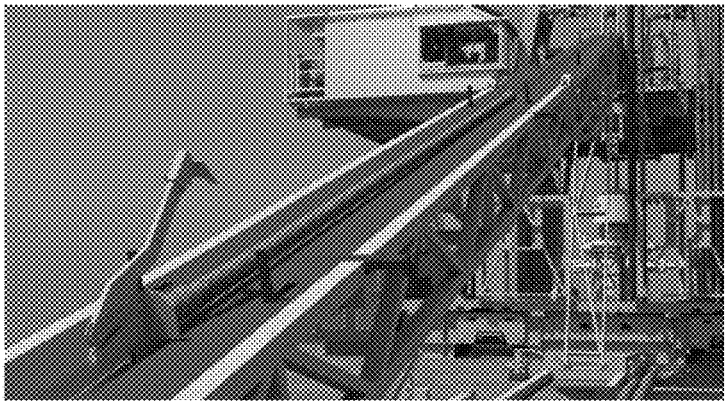
FIGS. 116A and 116B illustrate moving the top single down the ramp to the feeding table of the catwalk.
Figure 116B:
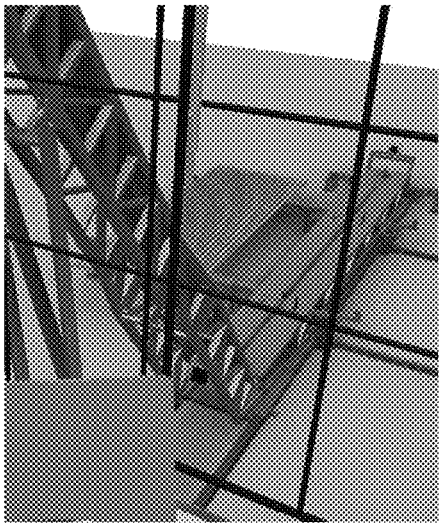

Step 7: Unload the top-single to the catwalk feeding table. The pipe pusher pulls the top-single down the ramp of the catwalk to an unloading position. The ramp of the catwalk 600 tilts away from the drill floor 6 to lower itself to be adjacent the feeding table. The top-single is unloaded from the ramp to the feeding table. The ramp of the catwalk 600 extends again to the drill floor 6 to receive the next single. See FIGS. 116A and 116B.

Figure 117:
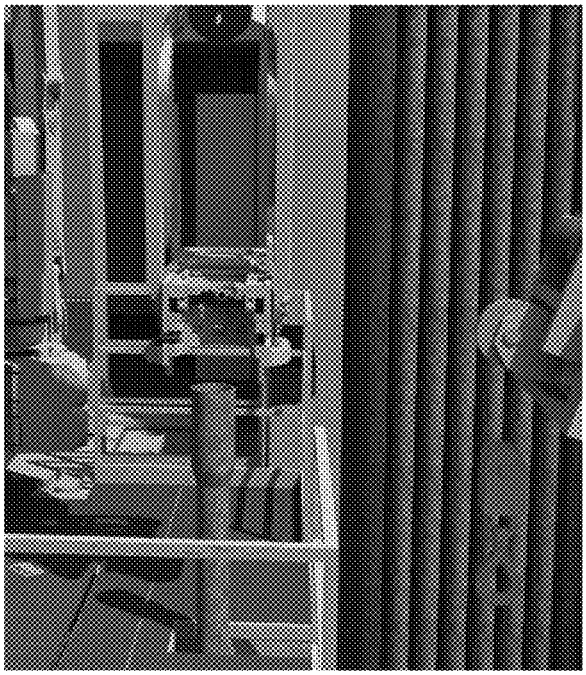
FIG. 117 illustrate moving the tubular delivery arm to pick up the stand double in the mousehole.

Step 8: Pick up the double in the mousehole. The tubular delivery arm 500 rotates and lowers to latch onto the stickup in the mousehole 40. The elevator of the tubular delivery arm 500 closes onto the stickup of the double. The tubular delivery arm 500 is hoisted to take the weight of the double. The intermediate stand constraint 430 opens its grasp when the weight of the double is unloaded from it. The double is hoisted to a stickup height in the mousehole 40. The grasp of the intermediate stand constraint 430 is closed on the double and take the weight as the tubular delivery arm 500 is lowered slightly. See FIG. 117.

Figure 114A:
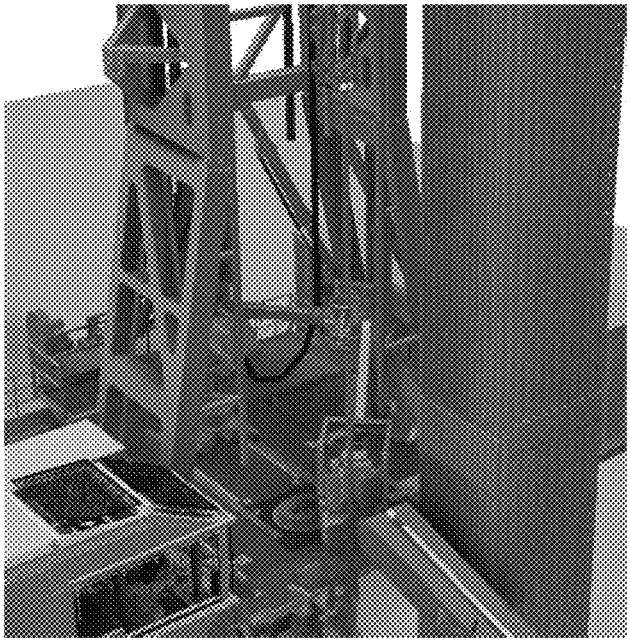
FIGS. 114A and 114B illustrate breaking out the top single from the stand.
Figure 114B:
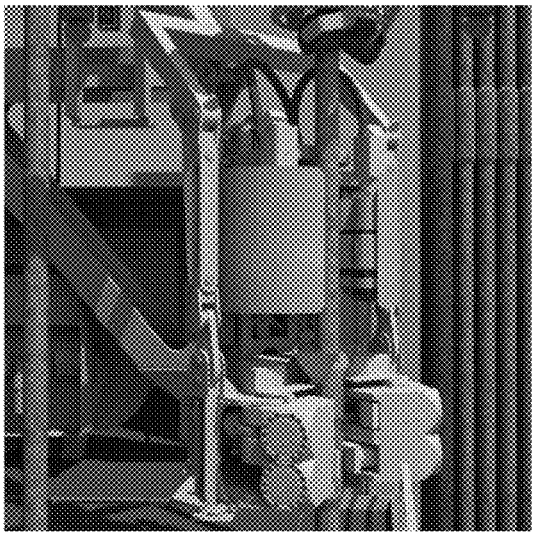

Step 9: Break out the mid-single. The roughneck 760 extends to the mousehole 40. The lower stabilizing arm 800 is extended and its funnel closes on the mid-single. The roughneck 760 breaks out the connection and spins out the threads. The roughneck returns to its standby position. See FIGS. 114A and 114B.

Step 10: Lay down the mid-single. The ramp of the catwalk machine 600 is moved to the drill floor for tubular laydown. The tubular delivery arm 500 lifts the broken out mid-single from the stickup and with the help of the lower stabilizing arm 800 it is guided to a position above the ramp of the catwalk 600. The lower stabilizing arm 800 moves the pin end over the ramp and the elevator of the tubular delivery arm 500 tilts toward the ramp. The tubular delivery arm 500 moves down the mast 10 to lower the mid-single as the pipe pusher draws the pin end down the ramp of the catwalk 600. When the single is loaded on the ramp, the elevator of the tubular delivery arm 500 opens and is tilted back toward the mast 10. See FIGS. 115A and 115B.

Step 11: Unload the mid-single to the catwalk feeding table. The pipe pusher pulls the mid-single down the ramp of the catwalk 600 to an unloading position. The ramp of the catwalk 600 tilts away from the drill floor 6 to lower itself to be adjacent the feeding table. The mid-single is unloaded from the ramp to the feeding table. The ramp of the catwalk 600 extends again to the drill floor 6 to receive the next single. See FIGS. 116A and 116B.

Step 12: Pick up the bottom-single in the mousehole. The tubular delivery arm 500 rotates and lowers to latch onto the stickup of the bottom-single in the mousehole 40. The elevator of the tubular delivery arm 500 closes onto the stickup. The tubular delivery arm 500 is hoisted to take the weight of the bottom-single. The intermediate stand constraint 430 opens its grasp when the weight of the bottom-single is unloaded from it. The lower stabilizing arm 800 extends and closes its funnel around the bottom-single.

Step 13: Lay down the bottom-single. The tubular delivery arm 500 lifts the bottom-single from the mousehole 40 and with the help of the lower stabilizing arm 800 it is guided to a position above the ramp of the catwalk 600. The lower stabilizing arm 800 moves the pin end over the ramp and the elevator of the tubular delivery arm 500 tilts toward the ramp. The tubular delivery arm 500 moves down the mast 10 to lower the bottom-single as the pipe pusher draws the pin end down the ramp of the catwalk 600. When the single is loaded on the ramp, the elevator of the tubular delivery arm 500 opens and is tilted back toward the mast 10. See FIGS. 115A and 115B.

Step 41: Unload the bottom-single to the catwalk feeding table. The pipe pusher pulls the bottom-single down the ramp of the catwalk 600 to an unloading position. The ramp of the catwalk 600 tilts away from the drill floor 6 to lower itself to be adjacent the feeding table. The bottom-single is unloaded from the ramp to the feeding table. See FIGS. 116A and 116B.

(XVI) Sequence for Offline Casing Standbuilding

The initial equipment configuration for the sequence for offline standbuilding of casing string is as follows:

Drilling may be ongoing.

All machines are empty.

The intermediate stand constraint 430 head is retracted.

Casing is loaded on the casing feeding table, cleaned and doped without protectors.

Optionally, the doping may be selected as part of the standbuilding sequence.

The sequence for offline standbuilding of casing string comprises the following steps.

Figure 118B:
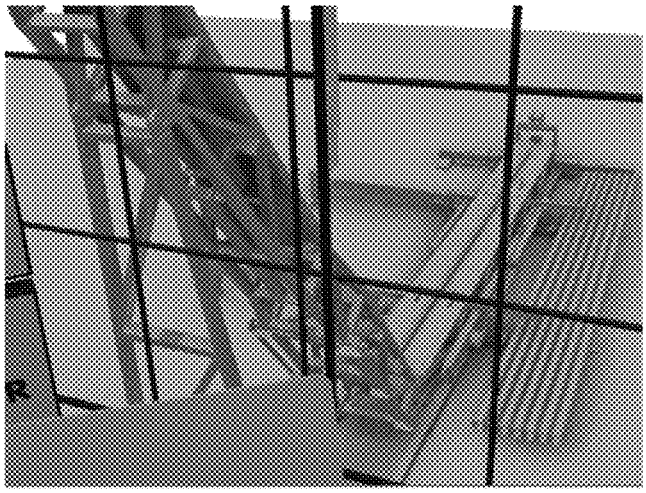
FIGS. 118A and 118B illustrate casing standbuilding by first placing casing tubulars on the feeding table.
Figure 118A:
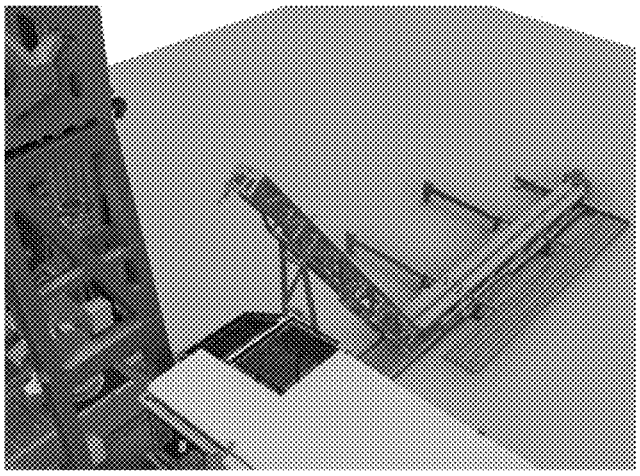

Step 1: Place casing tubulars on the feeding table. The feeding table then loads one casing tubular onto the ramp of the catwalk machine 600. See FIGS. 118A and 118B.

Figure 119A:
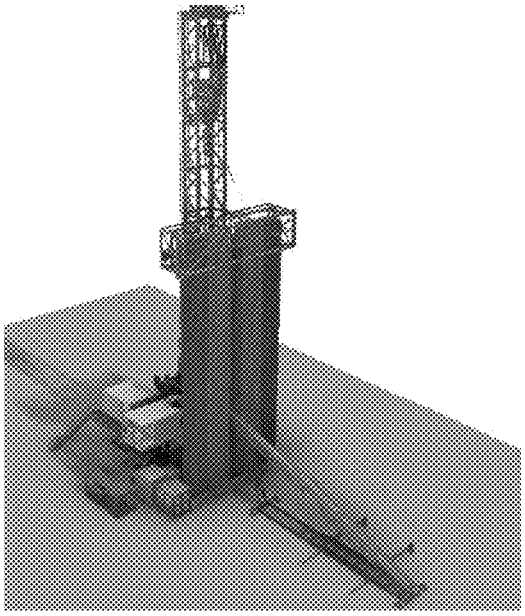
FIGS. 119A and 119B illustrate running the ramp of the catwalk to the drill floor.
Figure 119B:
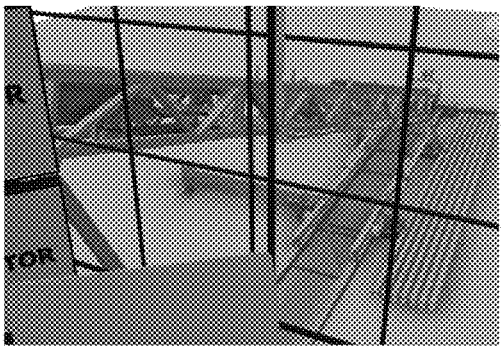

Step 2: Run the ramp to the drill floor. See FIGS. 119A and 119B. The tubular delivery arm 500 is lowered so that its elevator is below the pipe pickup height. The tubular deliver arm 500 tilts its arm toward the catwalk 600.

Figure 120A:
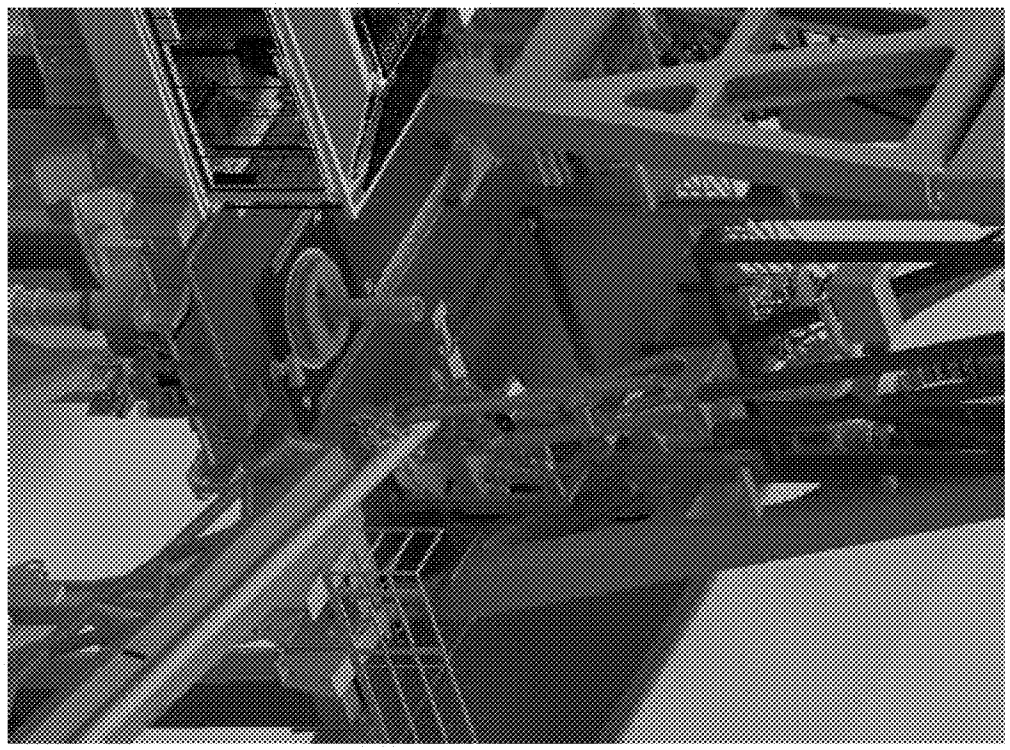
FIGS. 120A and 120B illustrate pushing the casing tubular up the ramp to the pickup position.
Figure 120B:
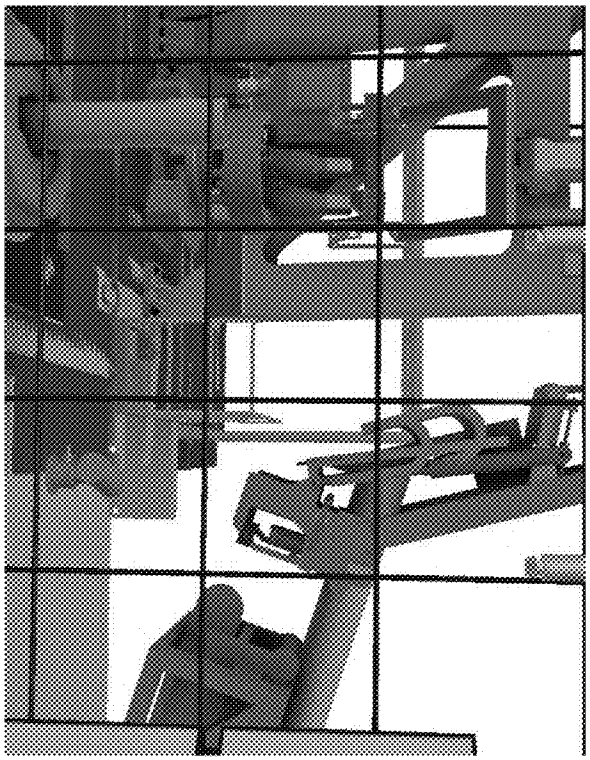

Step 3: Push the casing tubular. The pipe pusher of the catwalk machine 600 pushes the casing tubular up the ramp to the latching position. See FIGS. 120A and 120B.

Figure 121A:
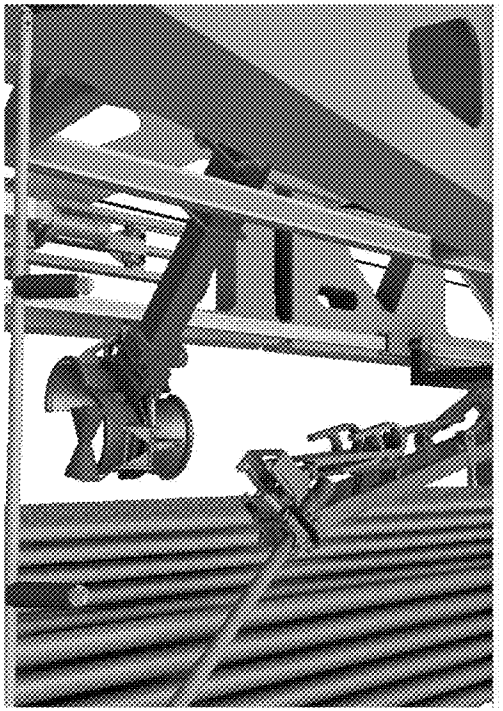
Figure 121B:
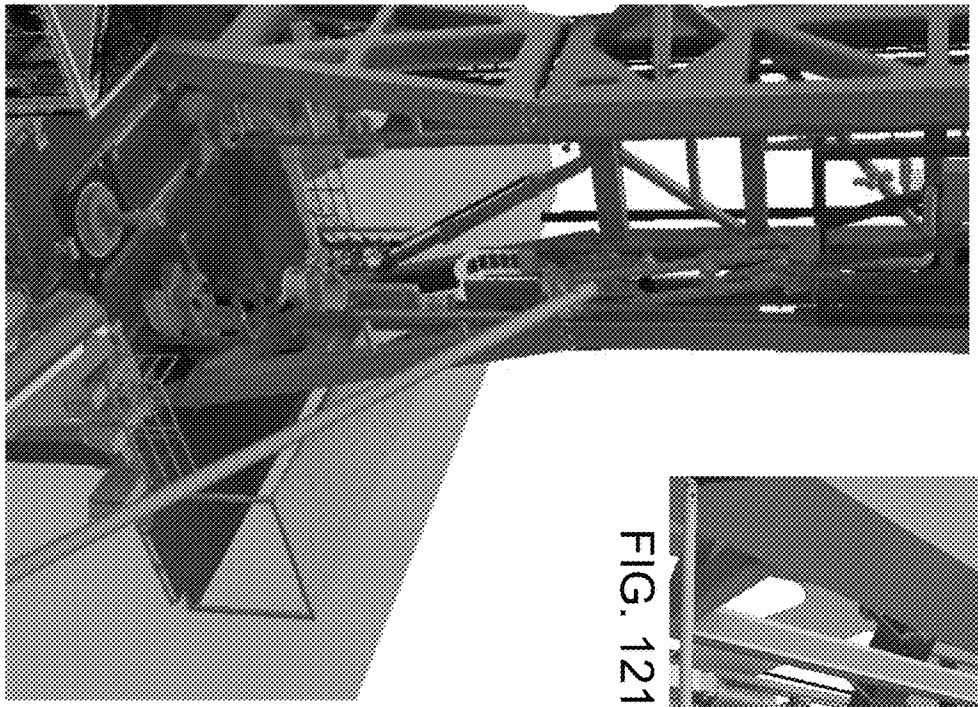
Figure 121C:
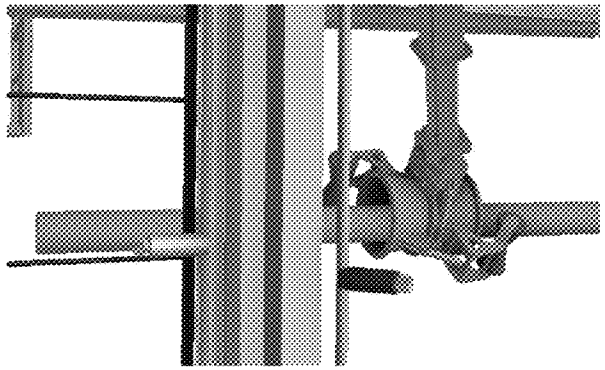

Step 4: Pull up the first casing tubular from the catwalk machine. The tubular delivery arm 500 is hoisted slightly to latch the elevator to the casing tubular on the ramp of the catwalk 600. The latch of the elevator is closed. The casing tubular is pulled up by hoisting the casing tubular delivery arm 500 up the mast 10 and the pipe pusher follows. Before the casing tubular leaves the ramp, the lower stabilizing arm 800 extends to prepare for guiding the tubular. The funnel is then closed on the casing tubular as the tubular raises. As the casing tubular approaches vertical, the centralizer of the lower stabilizing arm 800 closes on the tubular. The ramp of the catwalk 600 returns to load a second casing tubular. See FIGS. 121A-121C.

Figure 122:
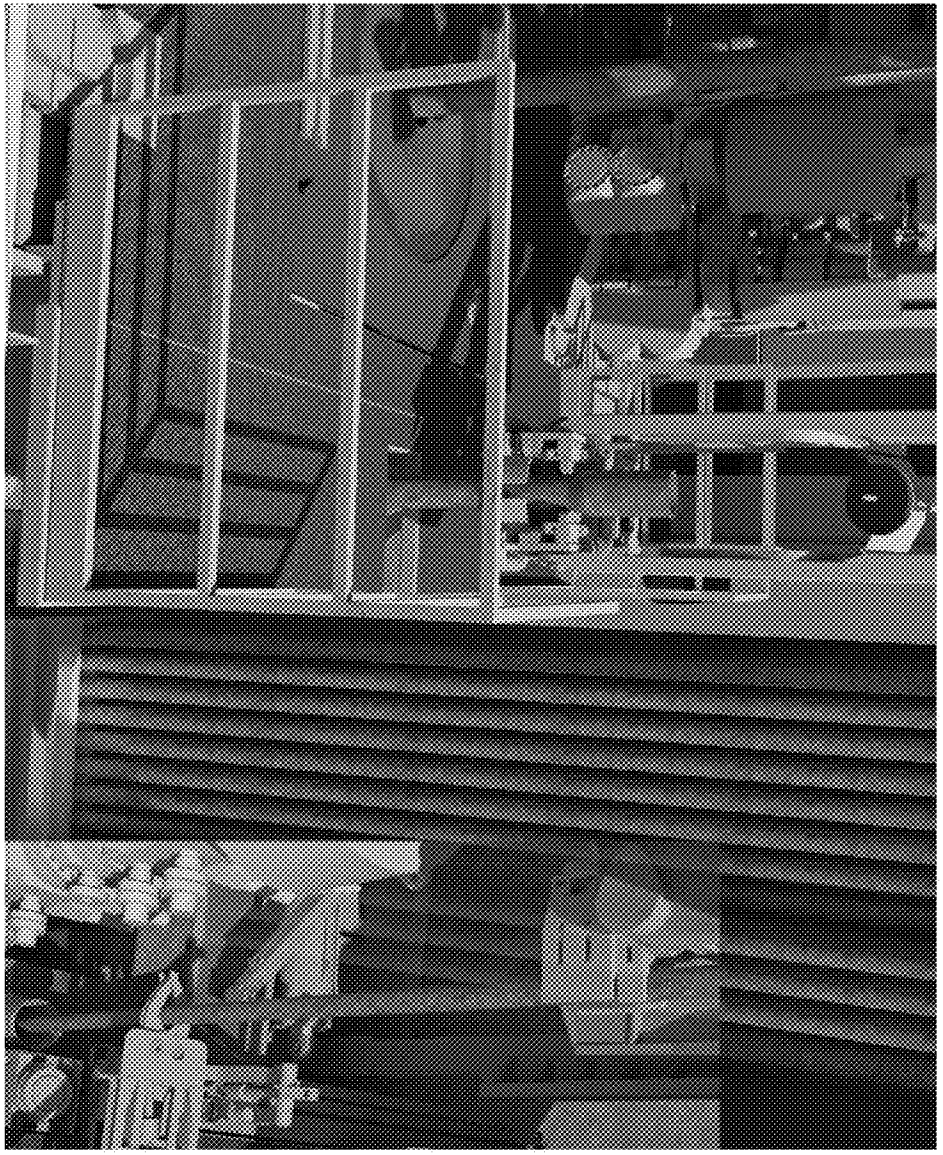

Step 5: Place the bottom-casing tubular in the mousehole. The bottom-casing tubular is lowered into the mousehole 40 by the tubular delivery arm 500 to a correct stickup height (1 m/3 ft). The head of the intermediate stand constraint 430 extends and closes on the first tubular. The lower stabilizing arm 800 releases the first casing tubular and retracts. The lower stand constraint 440 extends and closes to guide the first tubular. The tubular delivery arm 500 lowers to transfer the weight of the first tubular to the constraints, the elevator opens, and the tubular delivery arm 500 retracts from the stickup. See FIG. 122.

Figure 123A:
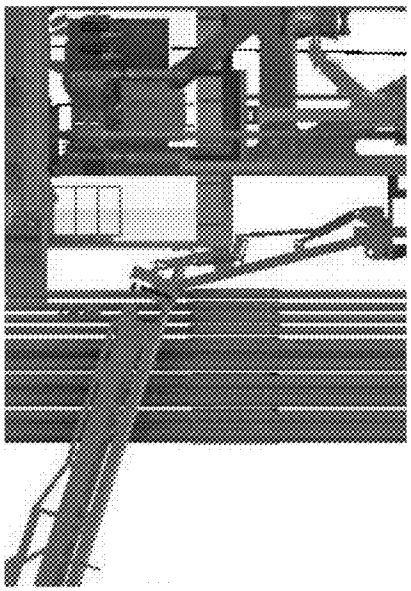
Figure 123B:
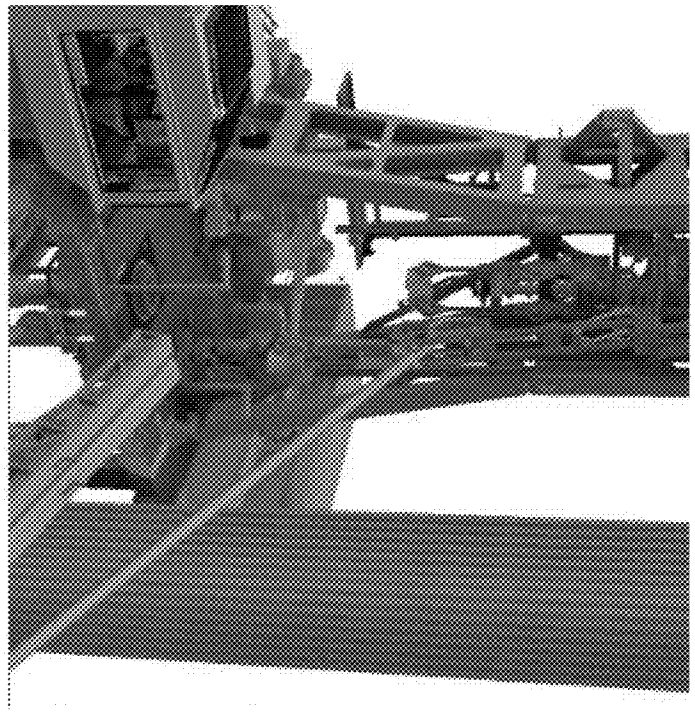

Step 6: Pull up the top-casing tubular. The elevator of the tubular delivery arm 500 is again positioned below the pipe pickup height with the elevator open and tilted toward the catwalk 600. After the top-casing tubular is loaded and the ramp extended, the tool pusher slides the top-casing tubular up the ramp. The tubular delivery arm 500 is hoisted slightly until the elevator engages the tubular and the elevator latch is closed thereon. The top-casing tubular is pulled up by hoisting the tubular delivery arm and pushed by the tool pusher. Prior to the top-casing tubular leaving the ramp of the catwalk, the lower stabilizing arm 800 extends to the tubular and prepares for guiding, and the funnel is closed on the tubular. As top-casing tubular approaches vertical above the mousehole 40, the centralizer of the lower stabilizing arm 800 closes on the second tubular. If doping is desired, the top-casing tubular is moved to the stand hand-off position 50 prior to moving to the mousehole 40. The ramp of the catwalk returns to load the third tubular. See FIGS. 123A and 123B.

Figure 124A:
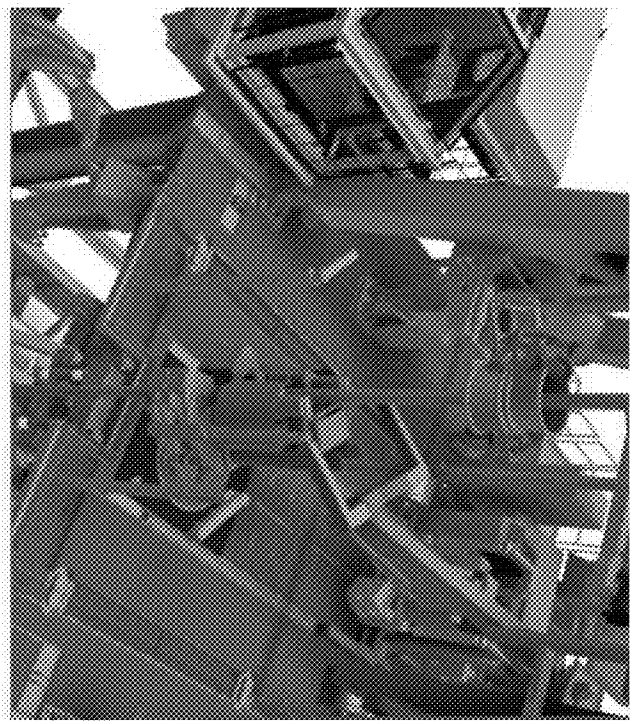
Figure 124B:
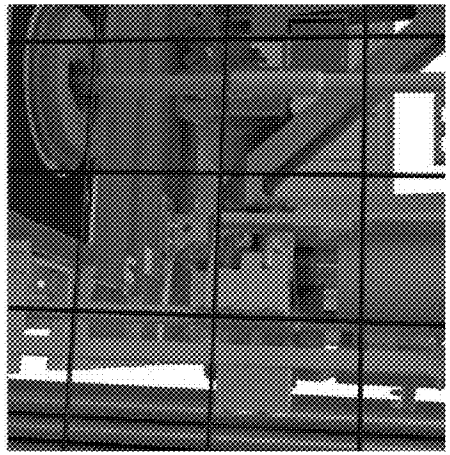

Step 7: Stab and make up the top-casing tubular. The top-casing tubular is moved over the stickup of the bottom-casing tubular in the mousehole 40. The roughneck 760 on the tong handling arm moves to the stickup. The roughneck stabbing guide is closed on the bottom-casing tubular stickup. The tubular delivery arm is lowered to stab the top-casing tubular into the bottom-casing tubular stickup. The roughneck spins in and makes up the connection. The lower stabilizing arm opens and retracts. The roughneck retracts to a standby position. See FIGS. 124A and 124B.

Figure 125A:
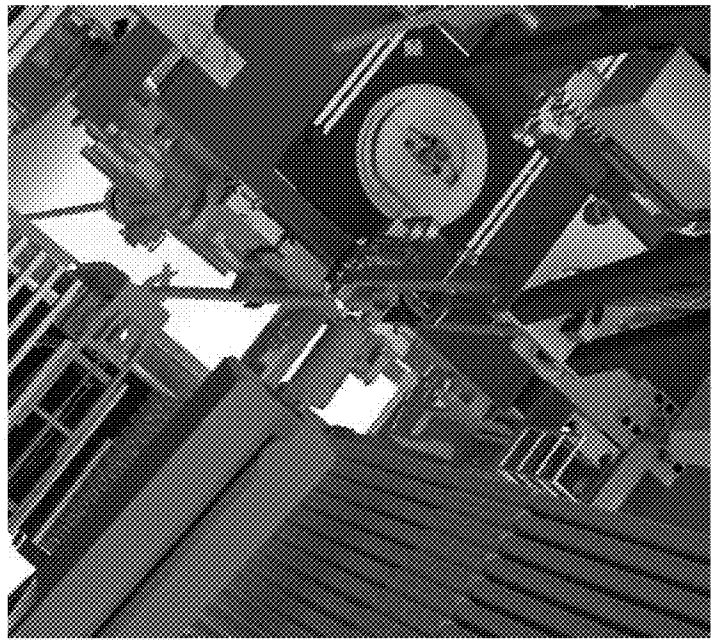
Figure 125B:
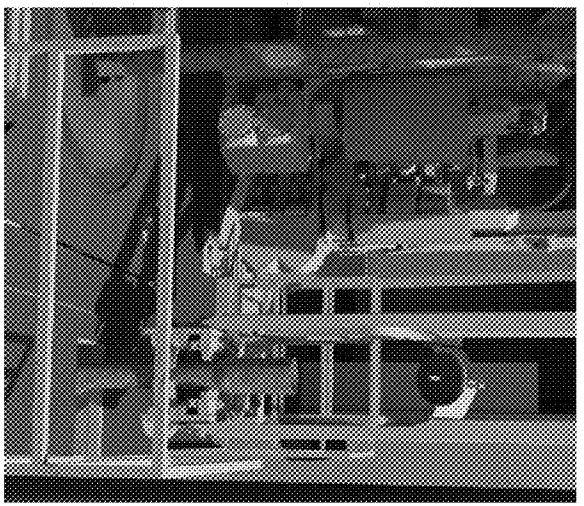

Step 8: Lower the double into the mousehole (not applicable for Range 3). The tubular delivery arm 500 is hoisted to pick up the weight of the double. The intermediate stand constraint 430 opens to release the double. The lower stand constraint 440 extends to the mousehole position 40 and closes its guide around the double for stabbing mode. The double is lowered by the tubular delivery arm 500 into the mousehole 40 to the correct stickup height, while the lower stand constraint 440 guides the double into the mousehole 40 and opens slightly to allow passage of the tubular joint. The guide of the intermediate stand constraint 430 is then closed and finally the double is clamped to position the double at the stickup height. The tubular delivery arm 500 lowers to transfer the weight of the double to the intermediate stand constraint 430. The elevator of the tubular delivery arm 500 opens and retracts from the stickup. Repeat steps 6 and 7 to pick up a third single tubular, if Range 2. See FIGS. 125A and 125B.

Figure 126A:
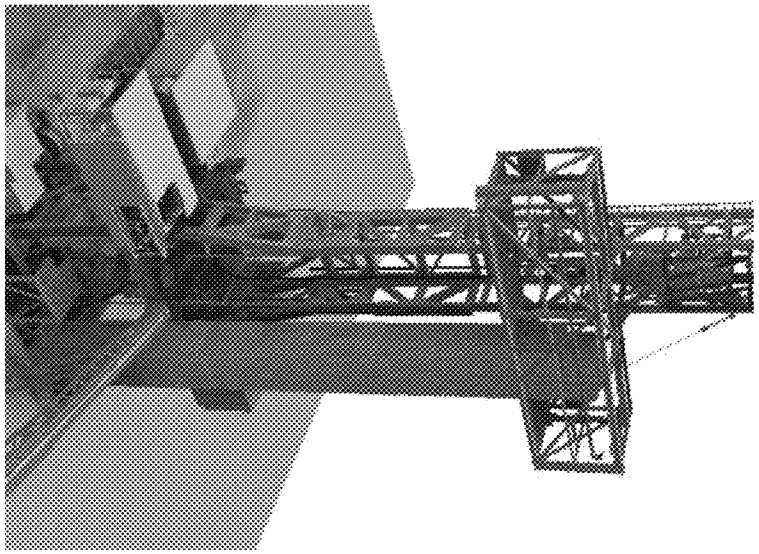
Figure 126B:
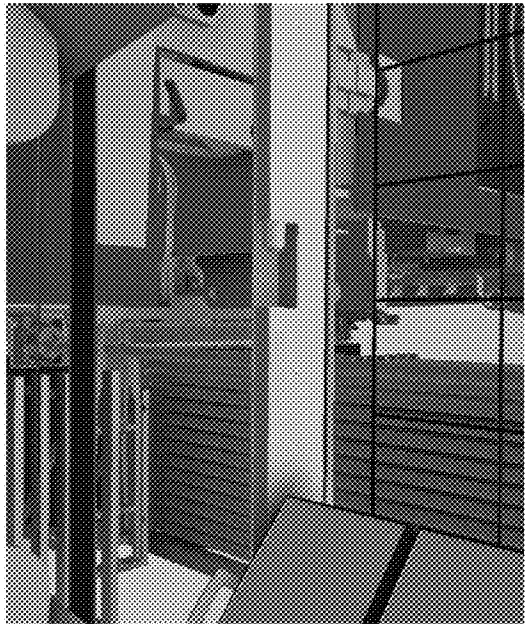
Figure 127A:
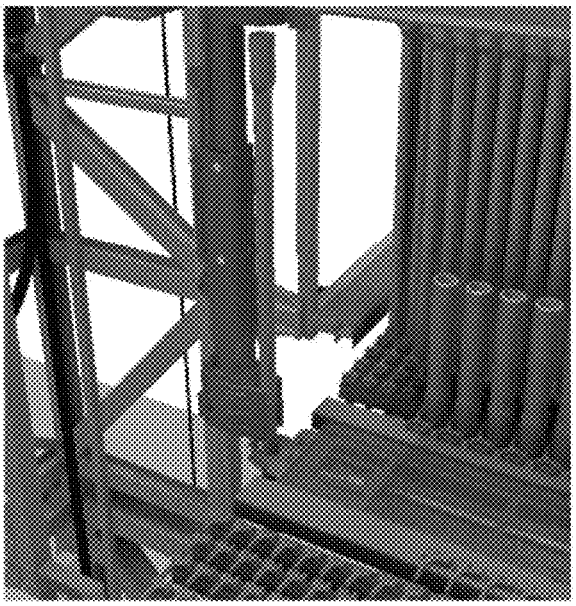
Figure 127B:
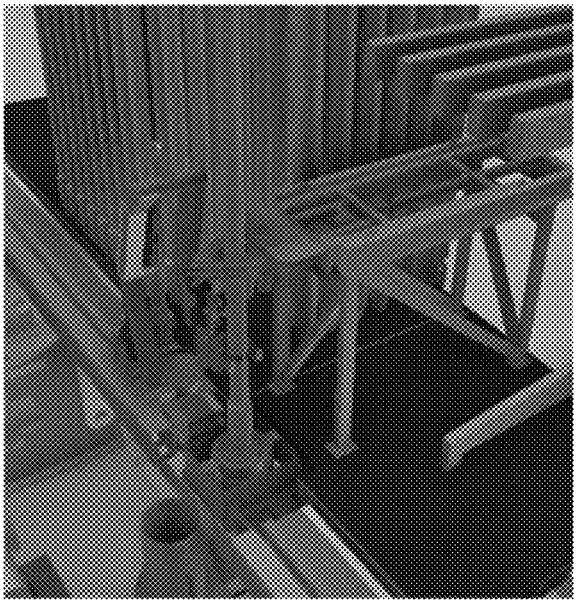
Figure 127C:
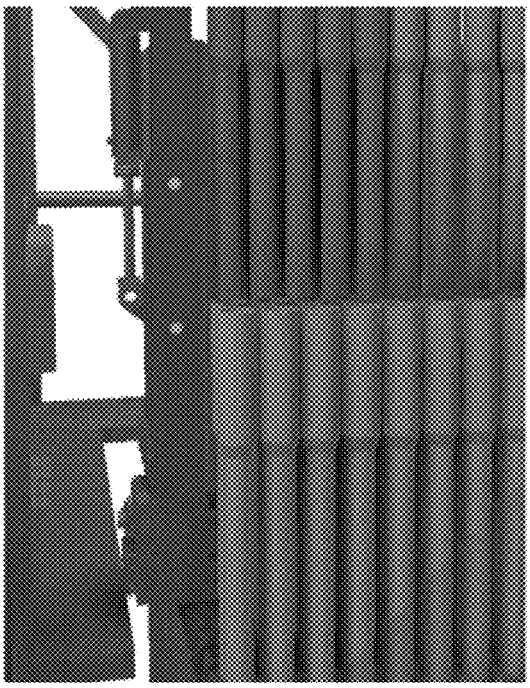
Figure 127D:
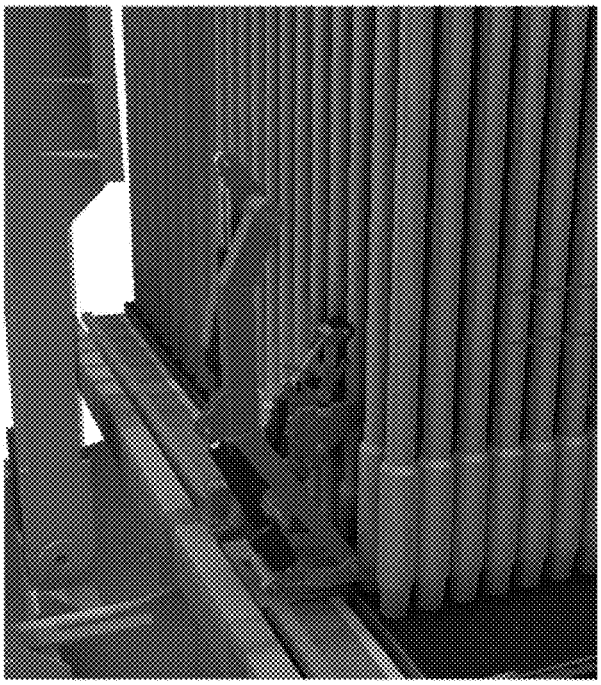

Step 9: Move the casing stand to the stand handoff position. The lower stand constraint 440 extends to the pipe at the mousehole position and closes its guide. The tubular delivery arm 500 is hoisted to pickup the weight of the casing stand. Both the guide and the clamp of the intermediate stand constraint 430 are opened. The head of the intermediate stand constraint 430 is retracted. The tubular delivery arm 500 lifts the casing stand (R2 or R3) from the mousehole 40 and stops when the stand is elevated so that the pin end is above the height of the doper station at the stand handoff position 50. The tubular delivery arm 500 and the lower stabilizing arm 800 move the stand to a position hanging at the stand handoff position 50. The stand is then stabbed into the doper, if selected, where the pin is washed and doped. The upper stand constraint extends to close its guide on the stand. The tubular delivery arm 500 opens and retracts from the stand. See FIGS. 126A and 126B.

Step 10: Set back casing stand. The transfer bridge racker 350 and the setback guide arm 950 move to the stand handoff position 50 and close their guides and clamps on the casing stand. The upper and lower stand constraints 420 and 440 open and retract. The transfer bridge racker 350 and the setback guide arm 950 move to set back the casing stand to a selected position in the fingerboard 310. See FIGS. 127A-127D.

(XVII) Sequence for Offline Laying Down Casing Stands

The sequence for offline laying down casing stands is similar to the sequence for offline casing standbuilding, except the steps are performed in reverse order.

(XVIII) Sequence for Drilling Connection

The initial equipment configuration for the sequence for drilling connection is as follows:

- A stand is drilled all the way down in the wellbore, and reaming, survey, etc. have all been done according to the drilling program.
- One stand of drill pipe is being lifted by the tubular delivery arm/lower stabilizing arm in the stand handoff position to stickup level above the mousehole, and the elevator of the tubular delivery arm is facing the top drive. The drill floor is on standby.
- The transfer bridge racker and setback guide arm are empty and on their way to pick up a new stand in the fingerboard/setback.

The sequence for drilling connection comprises the following steps.

Figure 128:
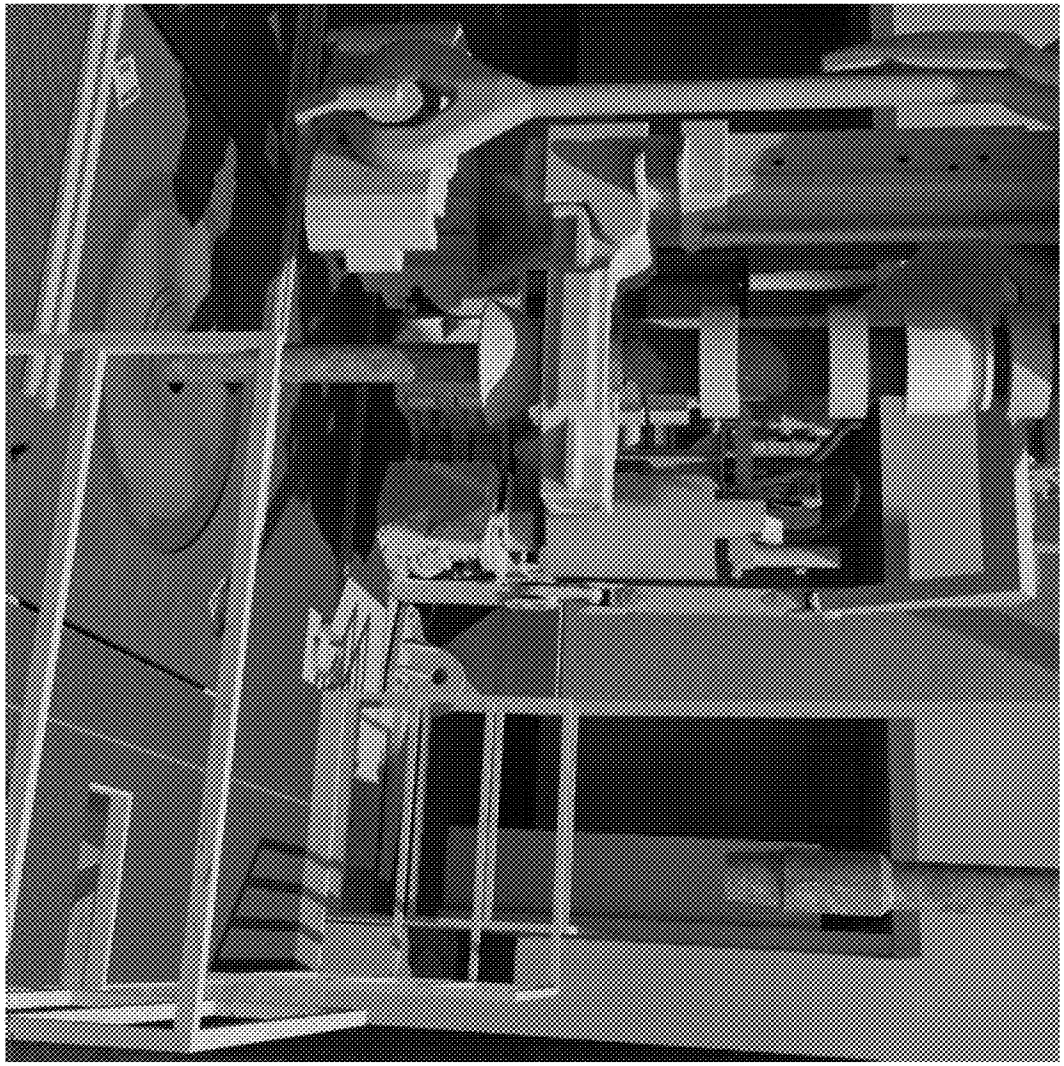

Step 1: Stop drilling and break out top drive connection. The drilling operation is stopped. With the drill string stickup at height (approximately 1.5 m/5 ft), the slips in the spider are set. The weight of the drill string is set on the slips. The top drive connection is broken out and the threads are spun out. See FIG. 128. The top drive 200 is then hoisted upward in the mast 10.

Figure 129A:
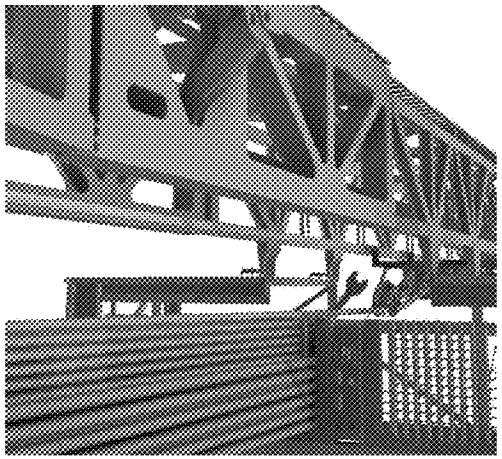
Figure 129B:
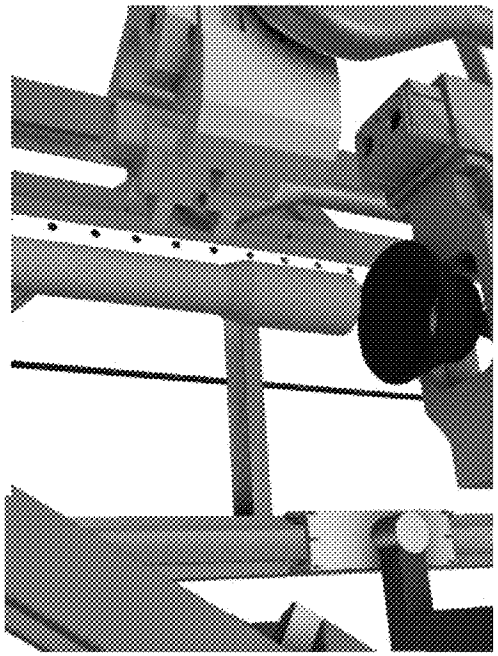

Step 2: The top drive is hoisted to connection height. With the top drive 200 retracted by its trolley, the top drive 200 is hoisted to a height sufficient for connection with the next drill string stand. The elevator link arms tilt to the vertical position below the top drive. See FIGS. 129A and 129B.

Figure 130A:
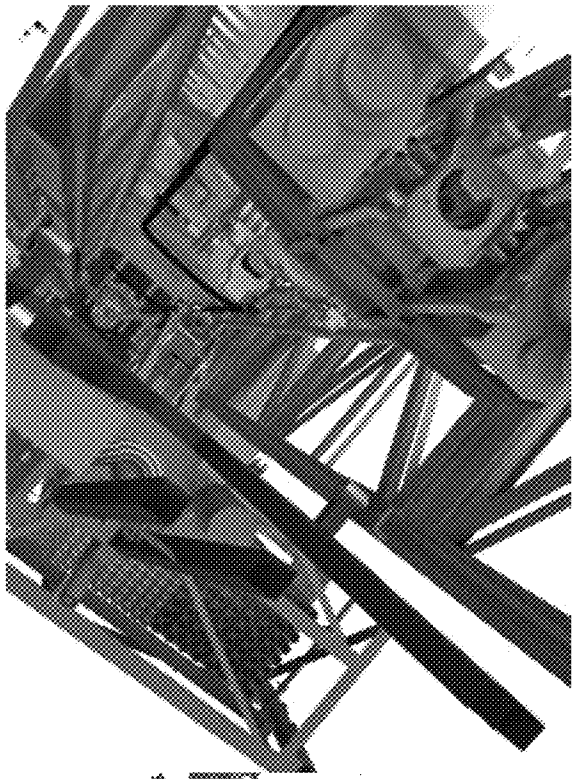
Figure 130B:
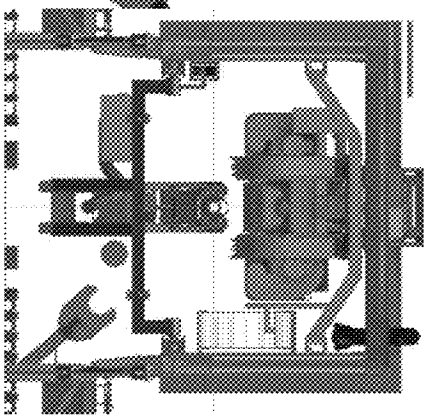

Step 3: Move the stand from the mousehole position to the well center. The tubular deliver arm 500 and the lower stabilizing arm 800 move the stand to the well center 30 from the drill floor standby position above the mousehole 40. The selected roughneck (tong handling trolley) moves to the well center. See FIGS. 130A and 130B.

Figure 131A:
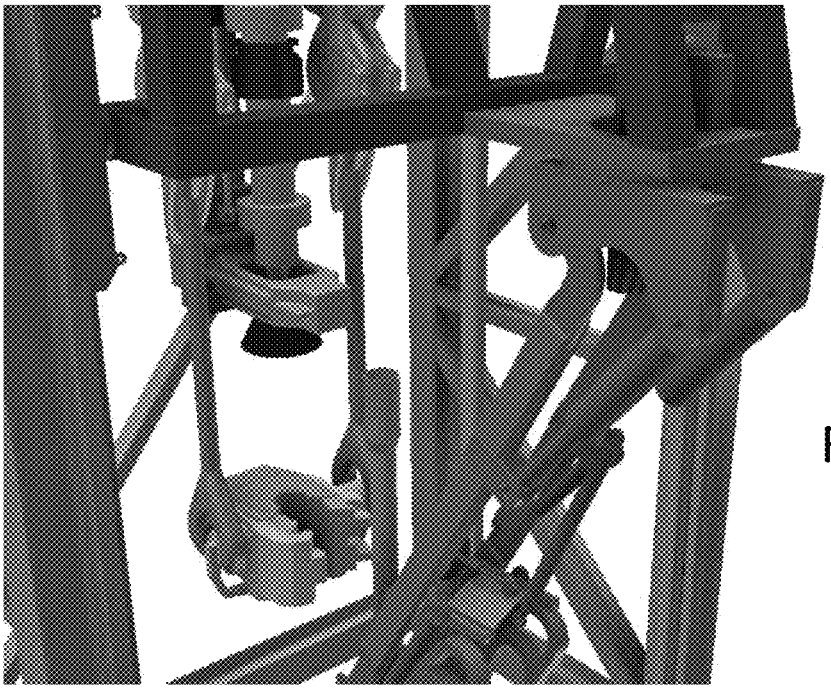
Figure 131B:
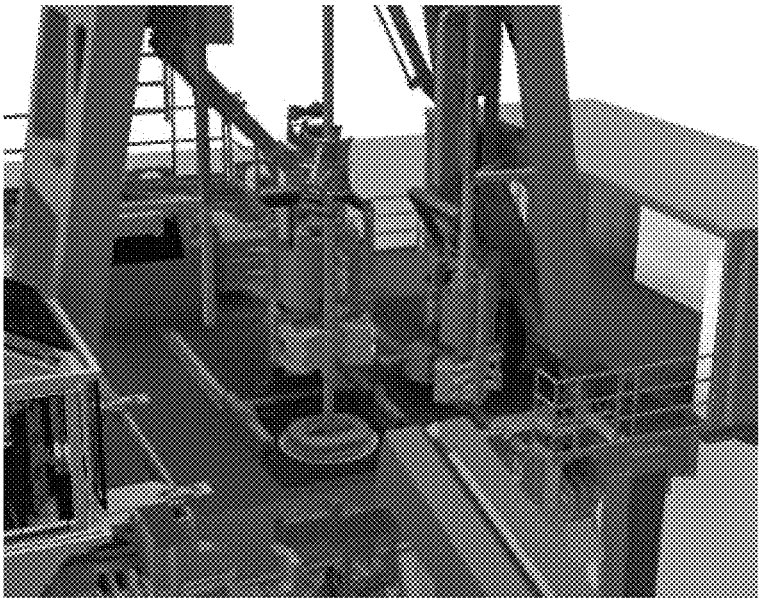

Step 4: Stab the stand in the stickup at well center. The top drive 200 remains at the correct elevation and retracted from well center 30. The roughneck 760 back up tong and stabbing guide close on the stickup to assist with stabbing. The tubular delivery arm 500 lowers the stand to stab the stand in the stick, and continues to lower (approximately 2 m/6 ft) after stabbing to allow room for the top drive make up. The lower stabilizing arm 800 opens and retracts from well center 30. One option is for the roughneck to start the sequence for spin in and make up of the lower connection. See FIGS. 131A and 131B.

Figure 132A:
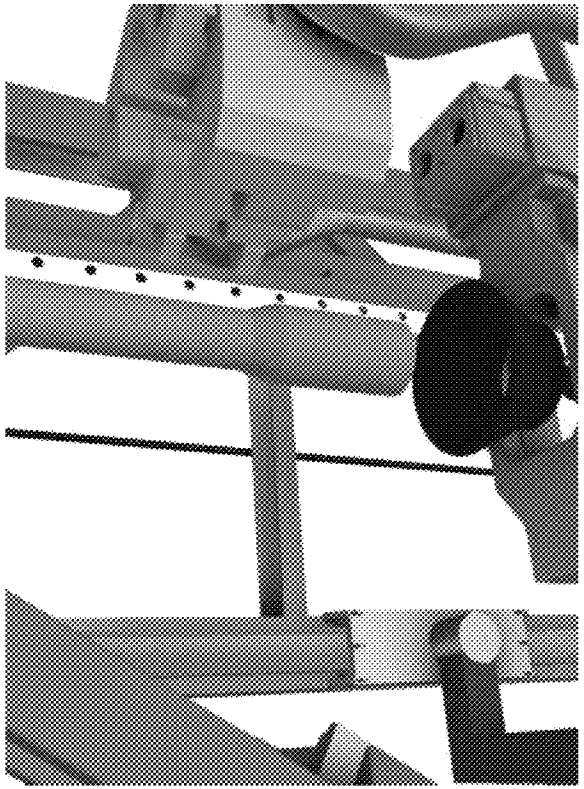
Figure 132B:
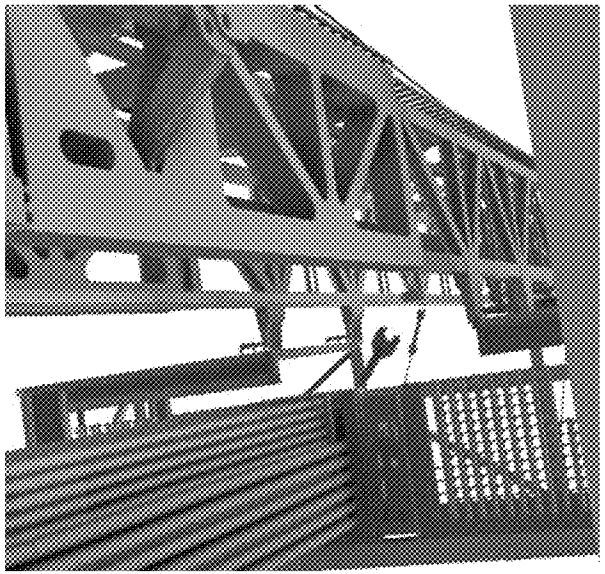

Step 5: Connect the top drive. With the top drive 200 at the correct elevation, the trolley extends to position the top drive 200 at the well center 30. The link arms are tilted toward the mast 10 and parked for a drilling position. The top drive is lowered to stab into the stand, and the top drive then rotates to spin in both the upper and lower connections against the roughneck back up tong. The tubular delivery arm 500 opens its elevator, retracts from the well center 30 and turns to pick up the next stand in the stand handoff position. The roughneck opens and retracts to its standby position. See FIGS. 132A and 132B. Optionally, the roughneck opens and moves to a standby position after make up of the lower connection.

Step 6: Open the slips and resume drilling. The top drive/drawworks hoist the drill string weight. The slips in the spider are opened. Drilling operations are continued. See FIG. 133.

Step 7: Pick up the next stand from the setback. The transfer bridge racker 350 and the setback guide arm 950 pick up another stand from a selected position in the setback/fingerboard 310. See FIGS. 134A and 134B.

Step 8: Move the stand to the stand handoff position. The top drive 200 opens its elevator and retracts from the stickup and hoists to the upper stop. The transfer bridge racker 350 and the setback guide arm 950 move the stand to the stand handoff position 50. The upper and lower stand constraints 420 and 440 close to hold the stand in its position. The doper integrated in the stand handoff position 50 washes and dopes the pin, if selected. The transfer bridge racker 350 and the setback guide arm 950 pick up another stand from a selected position in the setback/fingerboard 310. See FIGS. 135A and 135B.

(XIX) Sequence for Backreaming

The initial equipment configuration for the sequence for backreaming is as follows:

- The top drive is in a lower position, retracted by the trolley, and the link arms are vertical so the elevator is below the top drive. See FIG. 136.
- The slips are closed on the drill string with a standard stickup (approximately 1.5 m/5 ft).
- The tubular delivery arm 500 and lower stabilizing arm 800 are open in the stand handoff position (a stand is delivered from well center to stand handoff position).
- The upper and lower stand constraints are closed on the stand in the stand handoff position. The intermediate stand constraint is open and retracted.
- The transfer bridge racker and setback guide arm are empty and on their way back from the fingerboard/setback to get the next stand in the stand handoff position.

The sequence for backreaming comprises the following steps.

Step 1: Make up the top drive. The top drive trolley extends the top drive 200 to the well center 30. The elevator link arms are tilted backward to the parked position. The top drive is lowered, spun in and made up to the drill string. See FIGS. 137A and 137B.

Step 2: Ream out a stand-length of the borehole. The slips are opened and the top drive/drawworks pick up the weight of the drill string. The inside blowout preventer is opened and the mud pump is activated to circulate drilling fluid. The top drive 200 rotates the drill string and is hoisted in the mast 10 to ream out the borehole until the top drive reaches the connection height. The top drive 200 stops rotating the drill string and releases torque on the drill string. The mud pumps are stopped and the inside blowout preventer is closed. The slips in the spider are closed with the drill string at the correct stickup height. The tubular deliver arm 500 and the lower stabilizing arm 800 move from the stand handoff position to the drill floor to a safe standby position. The elevator of the tubular delivery arm 500 faces the top drive 200. See FIGS. 138A and 138B.

Step 3: Move a stand from the stand handoff position to the setback/fingerboard. The transfer bridge racker 350 and the setback guide arm 950 move to the stand in the stand handoff position 50 and they close their clamps and guides on the stand. The upper and lower stand constraints 420 and 440 open and retract. The transfer bridge racker 350 and the setback guide arm 950 lift the stand and move it to a selected position in the setback/fingerboard, where it is released and held in position by the fingerboard 310. See FIGS. 139A and 139B.

Step 4: Prepare to break out stand from drill string. The tubular delivery arm 500 and the lower stabilizing arm 800 move to the well center 30 and close their elevator and guide on the stand in the drill string. The roughneck 760 moves to the well center and elevates to the stickup height. See FIGS. 140A and 140B.

Step 5: Break out the top drive from the stand. The top drive 200 breaks out and spins out the threads of its connection with the stand. The drawworks hoists the top drive 200 to clear the top of the stand. The trolley retracts the top drive from the well center 30 and the elevator link arms are rotated back to vertical so that the elevator floats to a position under the top drive. The drawworks lowers the top drive 200 down the mast 10 toward the drill floor 6. See FIGS. 141A and 141B.

Step 6: Break out the stand from the drill string. The roughneck 760 breaks out the stand from the stickup and spins out the threads of the joint. See FIGS. 142A and 142B.

Step 7: Drain the stand. The roughneck 760 opens and retracts from the stickup to its standby position. The mud bucket extends to the well center 30 and closes on the broken connection. The tubular delivery arm 500 lifts the stand above the stickup to allow the fluid in the stand to drain into the mud bucket. The mud bucket opens from the stand/stickup and retracts to its standby position. See FIG. 143.

Step 8: Move the stand from the well center. The tubular delivery arm 500 and the lower stabilizing arm 800 move the stand from the well center 30 to the stand handoff position 50. Upon arrival, the tubular deliver arm 500 lowers the stand to offload the weight at the stand handoff position 50. The upper and lower stand constraints 420 and 440 close on the stand to hold it in position. If selected, the doper integrated in the stand handoff position washes and dopes the pin. The top drive 200 continues to lower to the drill floor 6. See FIGS. 144A and 144B.

Step 9: Set back the stand. Move a stand from the stand handoff position to the setback/fingerboard. The transfer bridge racker 350 and the setback guide arm 950 move to the stand in the stand handoff position 50 and they close their clamps and guides on the stand. The upper and lower stand constraints 420 and 440 open and retract. The transfer bridge racker 350 and the setback guide arm 950 lift the stand and move it to a selected position in the setback/fingerboard, where it is released and held in position by the fingerboard 310. The transfer bridge racker 350 and the setback guide arm 950 return to the stand handoff position. See FIGS. 145A and 145B.

It should be noted that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the invention and this detailed description, each numerical value should be read once as modified by the term "about" (unless already expressly so modified), and then read again as not so modified unless otherwise indicated in context. Also, in the summary of the invention and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range. The statements made herein merely provide information related to the present disclosure and may not constitute prior art, and may describe some embodiments illustrating the invention.

This description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

If used herein, the term "substantially" is intended for construction as meaning "more so than not."

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

Although the disclosed embodiments are described in detail in the present disclosure, it should be understood that various changes, substitutions and alterations can be made to the embodiments without departing from their spirit and scope.

INDUSTRIAL APPLICABILITY

Pipe handling systems and processes for drilling rigs of the present invention have many industrial applications including but not limited to drilling well bores for the oil and gas industry.

What is claimed is:

1. A method for performing a wellbore operation via a drill rig, the method comprising:

moving a tubular string relative to the wellbore via a top drive;

moving a tubular stand between a setback position and a stand handoff position via a transfer bridge racker and a setback guide arm;

moving the tubular stand between the stand handoff position and a well center position via the top drive and a lower stabilizing arm; and operating a roughneck on a joint between the tubular stand and the tubular string.

2. The method of claim 1, wherein moving the tubular string relative to the wellbore via the top drive comprises tripping the tubular string into the wellbore, wherein moving the tubular stand between the setback position and the stand handoff position comprises moving the tubular stand from the setback position to the stand handoff position, wherein moving the tubular stand between the stand handoff position and the well center position comprises moving the tubular stand from the stand handoff position to the well center position, and wherein operating the roughneck on the joint between the tubular stand and the tubular string comprises making up the joint.

3. The method of claim 2, further comprising:

moving a first tubular single and a second tubular single from a feeding table position to a drill floor pickup position;

moving the first tubular single from the drill floor pickup position to a mousehole stickup position;

moving the second tubular single from the drill floor pickup position to a mousehole make/brake position;

operating the roughneck on a respective joint between the first tubular single and the second tubular single to form the tubular stand;

moving the tubular stand from a mousehole position to the stand handoff position; and moving the tubular stand from the stand handoff position to the setback position.

4. The method of claim 2, comprising adjusting an extendable constraint engaged with the tubular stand to tilt a top of the tubular stand toward the top drive to enable the top drive to close on the tubular stand to facilitate moving the tubular stand from the stand handoff position to the well center position.

5. The method of claim 1, wherein moving the tubular string relative to the wellbore via the top drive comprises tripping the tubular string out of the wellbore, wherein moving the tubular stand between the setback position and the stand handoff position comprises moving the tubular stand from the stand handoff position to the setback position, wherein moving the tubular stand between the stand handoff position and the well center position comprises moving the tubular stand from the well center position to the stand handoff position, and wherein operating the roughneck on the joint between the tubular stand and the tubular string comprises breaking out the joint.

6. The method of claim 1, wherein the tubular string and the tubular stand comprise drill pipe.

7. The method of claim 1, wherein the tubular string and the tubular stand comprise casing.

8. The method of claim 1, further comprising draining fluid from the tubular stand via a mud bucket.

9. The method of claim 1, wherein the tubular string and the tubular stand comprise drill collar tubulars, and wherein moving the tubular stand between the stand handoff position and the well center position comprises tilting a top of a first drill collar stand to enable the top drive to close on the first drill collar stand, lifting the first drill collar stand with the top drive, and guiding a bottom of the first drill collar stand with the lower stabilizing arm.

10. The method of claim 1, further comprising:

moving a tubular single from a feeding table position to a drill floor pickup position;

moving the tubular single from the drill floor pickup position to the well center position; and operating the roughneck on a respective joint between the tubular single and the tubular string in the wellbore to make up the respective joint.

11. The method of claim 10, further comprising:

moving the tubular single from the drill floor pickup position to the feeding table position;

moving the tubular single from the well center position to the drill floor pickup position; and operating the roughneck on the respective joint between the tubular single and the tubular string in the wellbore to break out the respective joint.

12. The method of claim 10, comprising moving the tubular single from the drill floor pickup position to the well center position via the top drive and the lower stabilizing arm.

13. The method of claim 1, further comprising:

moving a casing single from a feeding table position to a drill floor pickup position;

moving the casing single from the drill floor pickup position to the well center position via the top drive and the lower stabilizing arm;

operating a casing running tool between the casing single and the top drive to make up the casing running tool to the casing single; and operating the top drive via the casing running tool on a respective joint between the casing single and a casing string in the wellbore to make up a respective joint via the top drive.

14. The method of claim 13, further comprising:

moving the casing single from the drill floor position to the feeding table position;

moving the casing single from the well center position to the drill floor pickup position via the top drive and the lower stabilizing arm;

operating the casing running tool between the casing single and the top drive to break out the casing running tool from the casing single; and operating the top drive via the casing running tool on the respective joint between the casing single and a casing string in the wellbore to break out the respective joint via the top drive.

15. A method for performing operations via a drill rig, the method comprising:

drilling a wellbore by rotating a drill string via a top drive;

setting slips at a floor of the drill rig so that the drill string is at a stickup height relative to the floor of the drill rig;

breaking out a respective connection between the top drive and the drill string;

moving a drill string stand from a setback position to a stand handoff position;

moving a drill string stand from the stand handoff position to a well center position via a lower stabilizing arm;

making up a joint between the drill string stand and the drill string to form an extended drill string;

making up a respective connection between the extended drill string stand and the top drive;

opening the slips at the floor of the drill rig;

continuing drilling the wellbore by rotating the extended drill string via the top drive;

breaking out a respective connection between the top drive and the extended drill string;

moving a tubular single from a catwalk machine to the well center position via the lower stabilizing arm; and making up a respective joint between the tubular single and the extended drill string.

16. The method of claim 15, wherein moving the drill string stand from the setback position to the stand handoff position comprises moving the drill string stand via a transfer bridge racker and a setback guide arm.

17. The method of claim 15, wherein making up the joint between the drill string stand and the drill string comprises operating a roughneck to make up the joint.

18. The method of claim 15, wherein making up the joint between the drill string stand and the drill string comprises operating the top drive to make up the joint.

19. The method of claim 1, further comprising moving an additional tubular stand between the stand handoff position and the well center position via a tubular delivery arm and the lower stabilizing arm.

20. The method of claim 15, comprising moving the tubular single from the catwalk machine to the well center position via the top drive and the lower stabilizing arm.

* * * * *